US005990440A

United States Patent [19]

Yamaguchi et al.

[11] Patent Number: 5,990,440

[45] Date of Patent: Nov. 23, 1999

[54] SWITCH AND ARC EXTINGUISHING MATERIAL FOR USE THEREIN

[75] Inventors: Shoji Yamaguchi; Itsuo Nishiyama; Fumiaki Baba; Mitugu Takahasi; Takao Mitsuhashi; Kazuharu Kato; Osamu Hiroi; Tadaki Murakami; Hiroshi Adachi, all of Amagasaki; Kenichi Nishina, Fukuyama; Kazunori Fukuya, Fukuyama; Shinji Yamagata, Fukuyama; Shunichi Katsube, Fukuyama, all of Japan

[73] Assignee: Mitsubishi denki Kabushiki Kaisha, Tokyo, Japan

[21] Appl. No.: 08/941,090

[22] Filed: Sep. 30, 1997

Related U.S. Application Data

[63] Continuation of application No. 08/399,578, Mar. 7, 1995.

[30] Foreign Application Priority Data

| | | | |
|---|---|---|---|
| Mar. 10, 1994 | [JP] | Japan | 6-39884 |
| May 23, 1994 | [JP] | Japan | 6-108316 |
| Jul. 5, 1994 | [JP] | Japan | 6-153717 |
| Jul. 26, 1994 | [JP] | Japan | 6-174465 |
| Aug. 4, 1994 | [JP] | Japan | 6-183489 |

[51] Int. Cl.[6] ..... H01H 33/08

[52] U.S. Cl. ..... 218/158; 218/34

[58] Field of Search ..... 218/1, 15, 22, 218/34–39, 43, 46, 47, 76, 81, 85, 89, 90, 103, 105, 106, 149–151, 155–158

[56] References Cited

U.S. PATENT DOCUMENTS

| | | | |
|---|---|---|---|
| 2,337,949 | 12/1943 | Walle | 200/147 |
| 2,864,919 | 12/1958 | Stringfellow | 200/144 |
| 3,716,685 | 2/1973 | Wilson | 200/174 R |
| 3,742,415 | 6/1973 | Cameron et al. | 337/279 |
| 3,761,660 | 9/1973 | Jones | 200/144 C |
| 3,800,111 | 3/1974 | Holmström | 200/144 C |
| 3,897,384 | 7/1975 | Busch et al. | 260/40 R |

(List continued on next page.)

FOREIGN PATENT DOCUMENTS

| | | |
|---|---|---|
| 0 346 825 | 12/1989 | European Pat. Off. . |
| 0 576 992 | 1/1994 | European Pat. Off. . |

(List continued on next page.)

OTHER PUBLICATIONS

Database WPI, Derwent Publ. Inc., AN 79–53610B, Jun. 9, 1979.

Derwent Publications Ltd., JP63126136 (Matsushita Elec Works), May 30, 1988 *Abstract*.

(List continued on next page.)

*Primary Examiner*—Michael A. Friedhofer

*Attorney, Agent, or Firm*—Burns, Doane, Swecker & Mathis, L.L.P.

[57] ABSTRACT

A switch containing a switch case, contacts adapted to be opened and closed, an arc extinguishing chamber disposed in the vicinity of the contacts, and an arc extinguishing material capable of reducing the amount of metal particles and free carbons to be scattered from components disposed within the switch by an arc generated when the contacts are opened or closed or capable of insulating the metal particles and the free carbons to convert into an insulator, thereby inhibiting a decrease in arc resistance expected to occur upon the generation and extinction of the arc and a decrease in insulation resistance expected to occur within and around the arc extinguishing chamber and at inner wall surfaces of the switch case upon and after the extinction of the arc. The switch is applicable to a switch expected to generate an arc upon interruption of electric current flowing therethrough such as a circuit breaker, current-limiting device or electromagnetic contactor and is capable of immediately extinguishing the arc and inhibiting the decrease in insulation resistance within and around the arc extinguishing chamber and at inner wall surfaces of the switch case.

9 Claims, 22 Drawing Sheets

U.S. PATENT DOCUMENTS

| | | | |
|---|---|---|---|
| 4,082,931 | 4/1978 | Hayes | 200/144 C |
| 4,433,081 | 2/1984 | Britsch | 523/457 |
| 4,436,831 | 3/1984 | Nishizako et al. | 501/119 |
| 4,444,671 | 4/1984 | Wiltgen, Jr. | 252/632 |
| 4,453,053 | 6/1984 | Yamagata et al. | 200/144 R |
| 4,511,773 | 4/1985 | Heft et al. | 200/144 C |
| 4,562,322 | 12/1985 | Yamaguchi et al. | 200/148 G |
| 4,950,852 | 8/1990 | Goldman et al. | 200/144 C |
| 4,975,551 | 12/1990 | Syvertson | 200/144 C |
| 5,227,236 | 7/1993 | Handermann | 428/361 |
| 5,406,245 | 4/1995 | Smith et al. | 337/273 |
| 5,463,199 | 10/1995 | Divincenzo et al. | 218/158 |

FOREIGN PATENT DOCUMENTS

| | | |
|---|---|---|
| 1 061 866 | 7/1959 | Germany . |
| 1 105 028 | 4/1961 | Germany . |
| 1111267 | 7/1961 | Germany . |
| 1 129 206 | 5/1962 | Germany . |
| 1 185 687 | 1/1965 | Germany . |
| 31 06 871 | 12/1981 | Germany . |
| 155 218 | 5/1992 | Germany . |
| 63-310534 | 12/1988 | Japan . |

OTHER PUBLICATIONS

Patent Abstract of Japan, "*Arc Extinguish Device,*" Dec. 19, 1988, vol. 13, No. 150.

Patent Abstract of Japan, "*Arc Extinguishing Device,*" Mar. 23, 1989, vol. 13, No. 298.

Patent Abstract of Japan, "*Arc Extinguishing Material and Circuit Breaker,*" Jun. 4, 1990, vol. 14, No. 391.

Patent Abstract of Japan, "*Arc–Extringuishing Material and Circuit Breaker,*" Oct. 16, 1990, vol. 14, No. 584.

European Search Report, (EP 95 10 3406) Jun. 21, 1995, 6 pages.

SWITCH AND ARC EXTINGUISHING MATERIAL FOR USE THEREIN

This application is a continuation of application Ser. No. 08/399,578, filed on Mar. 7, 1995.

BACKGROUND OF THE INVENTION

The present invention relates to a switch, such as a circuit breaker, current-limiting device or electromagnetic contactor, which is expected to generate an arc when the current passed therethrough is interrupted, and to an arc extinguishing material capable of immediately extinguishing the arc and inhibiting a decrease in insulation resistance within and around an arc extinguishing chamber of the switch and at inner wall surfaces of the switch box.

In a switch kept applied with an overcurrent or rated current, when the contact of a moving contact element is opened from the contact of a fixed contact element, an arc is generated between the two contacts. To extinguish this arc, there is used an arc extinguishing device 8 as shown in FIG. 1-14 having insulator-(1) 1 and insulator-(2) 2 provided around a region where arc 9 is expected to generate between the moving contact 4 (not shown) of moving contact element 3 fixed movably by axis 7 and the fixed contact 5 of fixed contact element 6.

The term "contact portion" on "contact section" as used herein means a portion where the contact point 4 or 5 is located and which includes the contact point and its peripheral portion in the contact element.

The insulator (1) 1 and insulator (2) 2 of the arc extinguishing device 8 generate a thermal decomposition gas owing to the arc 9, and the thermal decomposition gas cools and extinguishes the arc 9.

Examples of such arc extinguishing devices include one employing an insulator comprising polymethylpentene, polybutylene or polymethyl methacrylate and 5 to 35 wt % of glass fiber included therein, one employing an insulator comprising an acrylic acid ester copolymer, aliphatic hydrocarbon resin, polyvinyl alcohol, polybutadiene, polyvinyl acetate, polyvinyl acetal, isoprene resin, ethylene-propylene rubber, ethylene-vinyl acetate copolymer or polyamide resin, and 5 to 30 wt % of glass fiber included therein, and one employing an insulator comprising a melamine resin containing at least two of $\epsilon$-caprolactam, aluminum hydroxide and an epoxy resin.

If the width W of the insulator (2) 2 is reduced as compared to a typical one for the purpose of scaling down the arc extinguishing device, the distance between the insulator (2) 2 and the plane including the locus of an opening or closing movement of the moving contact element is shortened, with the result that the pressure of the thermal decomposition gas generated from the insulator (2) 2 by the arc rises as compared to the case of the typical insulator.

Further, if the decrease in distance between the aforesaid plane and the insulator (2) 2 causes the insulation resistance of the inner wall surfaces of the insulator (2) 2 extending along that plane to decrease, an arc current is more likely to flow in the inner wall surfaces than in the typical switch.

During generation of an arc in a switch, metal particles are scattered from the contact elements, contacts and other metal components existing adjacent the contacts in an arc extinguishing chamber and are deposited onto wall surfaces within and around the arc extinguishing chamber. A conventional switch does not take a measure for the problem of such scattered metal particles.

When the arc extinguishing device is scaled down, however, the density of the scattered metal particles adhering to the wall surfaces within the arc extinguishing chamber is increased, so that the insulation resistance of such wall surfaces is considerably lowered. Further, if the distance between the insulator (2) 2 and the aforesaid plane is shortened, the pressure of thermal decomposition gas to be generated from the insulator (2) 2 by an arc is increased to scatter the metal particles farther than in the conventional switch, so that the insulation resistance of wall surfaces existing outside the arc extinguishing chamber is also considerably lowered. Such scattered metal particles may reach and adhere to the inner wall of the switch box.

To realize a switch having the arc extinguishing device 8 miniaturized and exhibiting an improved current limiting or interrupting property, the provision of the insulator (1) covering a contact portion from which an arc will be generated or the insulator (2) disposed on opposite sides of the aforesaid plane or around the contact portion is effective. In this case, the arc extinguishing property of the insulators (1) and (2) is required to be enhanced.

Where the moving contact element or fixed contact element is reduced in cross-sectional area as compared to the conventional one for the purpose of miniaturizing the arc extinguishing device 8, the electrical resistance thereof is increased and, hence, the temperatures of the contact portion and the periphery thereof at the time when current is being applied to the switch are raised to higher temperatures than in the conventional switch. For this reason, the insulators (1) and (2) are required to have a higher heat resistance than the conventional ones.

As described above, where the width W of the insulator (2) is reduced as compared to that of the conventional one in order to miniaturize the arc extinguishing device 8, the distance between the insulator (2) and the plane including the locus of the opening or closing movement of the contact element is shortened, resulting in an increase of the pressure of thermal decomposition gas to be generated from the insulator (2) by arc. Therefore, the insulators (1) and (2) are required to have a higher pressure withstand strength than the conventional ones.

Further, if the distance between the aforesaid plane and the insulator (2) is shortened, the insulator (2) will be much more consumed by arc. Hence, the insulator (2) is required to have improved consumption-by-arc resistance, specifically to such a degree that a hole is not formed therein.

As described above, with the miniaturization of the arc extinguishing device 8, the metal scattered and deposited on wall surfaces within and around the arc extinguishing chamber causes the insulation resistance of the wall surfaces to be considerably decreased. Accordingly, it is required to insulate the metal particles to be scattered from metal components existing within the arc extinguishing chamber at the time of arc generation to prevent the decrease in the insulation resistance of the wall surfaces attributable to a metal layer formed of such deposited metal particles.

SUMMARY OF THE INVENTION

According to the present invention, there is provided a switch comprising a switch case, contacts adapted to be opened and closed, an arc extinguishing chamber disposed in the vicinity of the contacts, accessary components disposed in respective positions, and an arc extinguishing material capable of reducing the amount of metal particles and free carbons to be scattered from components disposed within the switch by an arc generated when the contacts are operated to be opened or closed or capable of insulating the metal particles and the free carbons to convert into an insulator, thereby suppressing a decrease in arc resistance expected to occur upon the generation and extinction of the arc and a decrease in insulation resistance expected to occur within and around the arc extinguishing chamber and at inner wall surfaces of the switch case upon and after the extinction of the arc.

The following three groups of inventions are provided as means for realizing the above switch of the present invention.

The first group inventions include the inventions stated below.

(1-1) An arc extinguishing material comprising an arc extinguishing insulative material composition comprising at least one filler selected from the group consisting of a glass fiber containing not more than 1% (percent by weight, hereinafter the same) of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total, and a resin matrix containing as a main component at least one resin selected from the group consisting of a polyolefin, an olefin copolymer, a polyamide, a polyamide polymer blend, a polyacetal and a polyacetal polymer blend.

(1-2) An arc extinguishing material comprising an arc extinguishing insulative material composition containing, as a principal component thereof, a polyacetal polymer blend comprising a polyacetal and a thermoplastic resin which is compatible with the polyacetal and has a melting point of not less than that of the polyacetal.

(1-3) An arc extinguishing material comprising an arc extinguishing insulative molded product, the product comprising:

an arc receiving layer made of an arc extinguishing insulative material composition comprising not more than 20% of at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total, and a resin matrix containing as a principal component at least one resin selected from the group consisting of a polyolefin, an olefin copolymer, a polyamide, a polyamide polymer blend, a polyacetal and a polyacetal polymer blend, or an arc receiving layer made a non-reinforced, arc extinguishing insulative material composition comprising as a principal component at least one resin selected from the group consisting of a polyolefin, an olefin copolymer, a polyamide, a polyamide polymer blend, a polyacetal and a polyacetal polymer blend; and a base layer underlying the arc receiving layer and made of an arc extinguishing insulative material composition comprising 20 to 65% of at least one filler selected from the group consisting of a glass fiber, an inorganic mineral and a ceramic fiber, and a resin matrix containing as a principal component at least one resin selected from the group consisting of a polyolefin, an olefin copolymer, a polyamide, a polyamide polymer blend, a polyacetal and a polyacetal polymer blend.

(1-4) An arc extinguishing material comprising an arc extinguishing insulative molded product, the product comprising:

an arc receiving layer made of an arc extinguishing insulative material composition comprising not more than 20% of at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total, and a resin matrix containing as a principal component at least one resin selected from the group consisting of a polyolefin, an olefin copolymer, a polyamide, a polyamide polymer blend, a polyacetal and a polyacetal polymer blend, or made of a non-reinforced, arc extinguishing insulative material composition comprising as a principal component at least one resin selected from the group consisting of a polyolefin, an olefin copolymer, polyamide, a polyamide polymer blend, a polyacetal and a polyacetal polymer blend; and a base layer underlying the arc receiving layer and made of an arc extinguishing insulative material composition comprising 20 to 65% of at least one filler selected from the group consisting of a glass fiber, an inorganic mineral and a ceramic fiber, and a resin matrix containing, as a principal component thereof, a thermoplastic resin or a thermosetting resin.

(1-5) A switch comprising a contact section including contacts from which an arc is generated, and an arc extinguishing device comprising an insulator (1) covering the contact section excepting contact surfaces of the contacts, the insulator (1) being formed of an arc extinguishing material according to the invention (1-1) or (1-2).

(1-6) A switch comprising a contact section including contacts from which an arc is generated, and an arc extinguishing device comprising an insulator (2) disposed on both sides with respect to a plane including the locus of an opening or closing movement of the contacts or around the contact section, the insulator (2) being formed of an arc extinguishing material according to any one of the inventions (1-1) to (1-4).

(1-7) A switch comprising a contact section including contacts from which an arc is generated, and an arc extinguishing device comprising an insulator (1) covering the contact section excepting contact surfaces of the contacts, and an insulator (2) disposed on both sides of a plane including the locus of an opening or closing movement of the contacts or around the contact section, the insulator (1) being formed of an arc extinguishing material according to the invention (1-1) or (1-2), and the insulator (2) being formed of an arc extinguishing material according to any one of the inventions (1-1) to (1-4).

The second group inventions include the inventions stated below.

(2-1) An arc extinguishing material for use in a switch comprising a gas generating source compound capable of scatteredly generating an insulation imparting gas combinable with particles of metals which are scattered from contact elements, contacts and other metal components located in the vicinity thereof in the switch by an arc generated when the contacts of the contact elements are operated to be opened or closed, the insulation imparting gas being reactive with the metals or being per se electrically insulative.

(2-2) An arc extinguishing material for use in a switch comprising a thermoplastic resin, and a gas generating source compound capable of scatteredly generating an insulation imparting gas combinable with particles of metals which are scattered from contact elements, contacts and other metal components located adjacent thereto of the switch by an arc generated when the contacts of the contact elements are operated to be opened or closed, the insulation imparting gas being reactive with the metals or being per se electrically insulative.

(2-3) An arc extinguishing material for use in a switch comprising a thermosetting resin, and a gas generating source compound capable of scatteredly generating an insulation imparting gas combinable with particles of metals which are scattered from contact elements, contacts and other metal components located adjacent thereto of the switch by an arc generated when the contacts of the contact elements are operated to be opened or closed, the insulation imparting gas being reactive with the metals or being per se electrically insulative.

(2-4) An arc extinguishing material comprising a reinforcing filler, a thermoplastic or thermosetting resin, and a gas generating source compound capable of scatteredly generating an insulation imparting gas combinable with particles of metals which are scattered from contact elements, contacts and other metal components located adjacent thereto of the switch by an arc generated when the contacts of the contact elements are operated to be opened or closed, the insulation imparting gas being reactive with the metals or being per se electrically insulative.

(2-5) A switch comprising a fixed contact element having a fixed contact joined to the upper surface thereof, a moving contact element having a moving contact joined to the under surface thereof so as to provide electrical contact with the fixed contact, and a gas generating source material capable of scatteredly generating an insulation imparting gas combinable with particles of metals which are scattered from the contact elements, contacts and other metal components located adjacent thereto by an arc generated when the contacts of the contact elements are operated to be opened or closed, the gas generating source material being disposed in the vicinity of the contact elements, contacts and other metal components located adjacent thereto.

The third group of inventions includes the inventions stated below.

(3-1) An arc extinguishing plate material (I) comprising 35 to 50% of a reinforcing inorganic material sheet, and 50 to 65% of an inorganic binder composition (B), the arc extinguishing plate material being prepared by pressure-molding and aging a sheet comprising the reinforcing inorganic material sheet and an inorganic binder composition (A).

(3-2) An arc extinguishing plate material (II) which is obtained by pressure molding and aging an inorganic binder composition (C) comprising 40 to 55% of an insulation imparting gas generating source compound, 25 to 40% of an arc resistant inorganic powder, 8 to 18% of a primary metal salt of phosphoric acid, 5 to 10% of a curing agent for the primary metal salt of phosphoric acid, 2.6 to 12% of water, and 2 to 10% of a reinforcing inorganic fiber.

(3-3) A switch comprising electrodes, contacts provided to the electrodes, and an arc extinguishing chamber disposed in the vicinity of the electrodes and contacts and having an arc extinguishing side plate formed of an arc extinguishing plate material according to the aforementioned invention (3-1) or (3-2).

BRIEF DESCRIPTION OF THE DRAWINGS

FIG. 1-2 is a schematic side view showing the opened state of the arc extinguishing device (III) according to the present invention;

FIG. 1-3 is a schematic plan view showing the opened state of the arc extinguishing device (III) according to the present invention;

FIG. 1-4 is a schematic plan view showing the closed state of an arc extinguishing device (III) of which insulator (2) is of double-layered structure according to the present invention;

FIG. 1-5 is a perspective view illustrating an insulator (1) molded from an arc extinguishing material composition according to the present invention;

FIG. 1-6 is a perspective view illustrating an embodiment of an insulator (2) of single layer structure molded from an arc extinguishing material composition according to the present invention;

FIG. 1-7 is a perspective view illustrating another embodiment of an insulator (2) of single layer structure molded from an arc extinguishing material composition according to the present invention;

FIG. 1-8 is a perspective view illustrating an embodiment of an insulator (2) of double-layered structure molded from an arc extinguishing material composition according to the present invention;

FIG. 1-9 is a perspective view illustrating another embodiment of an insulator (2) of double-layered structure molded from an arc extinguishing material composition according to the present invention;

FIG. 1-10 is a perspective view illustrating yet another embodiment of an insulator (2) of double-layered structure molded from an arc extinguishing material composition according to the present invention;

FIG. 1-11 is a schematic side view showing the opened state of an arc extinguishing device (I) having an insulator (1) according to the present invention;

FIG. 1-12 is a perspective view showing the opened state of an arc extinguishing device (II) having an insulator (2) according to the present invention;

FIG. 1-13 is a schematic side view showing the opened state of the arc extinguishing device (II) having the insulator (2) according to the present invention;

FIG. 1-14 is a perspective view of a conventional arc extinguishing device for illustrating an arc generation state;

FIG. 1-15 is a schematic plan view of the closed state of the conventional arc extinguishing device;

FIG. 2-1 is a partially cutaway perspective view showing an embodiment of an arc extinguishing chamber in which a gas generating source material is disposed in a switch to which an insulating method according to the present invention is applied and used;

FIG. 2-2 is a side view showing the closed state of the contacts in the arc extinguishing chamber shown in FIG. 2-1;

FIG. 2-3 is a side view showing the opened state of the contacts in the arc extinguishing chamber shown in FIG. 2-1;

FIG. 2-4 is a plan view of the arc extinguishing chamber shown in FIG. 2-1;

FIG. 2-5 is a partially cutaway explanatory view showing an experimental device used in Examples 2-1 to 2-27 and Comparative Examples 2-1 and 2-2;

FIG. 2-6 is a side view showing the closed condition of one embodiment of a switch which includes an arc extinguishing device using one example of a gas generating source material comprising an organic binder and a gas generating source compound according to the present invention;

FIG. 2-7 is a side view showing the opened state of the arc extinguishing device shown in FIG. 2-6;

FIG. 2-8 is a schematic explanatory view showing one example of a switch of three-phase configuration using the arc extinguishing device shown in FIG. 2-6;

FIG. 2-9 is a sectional view of the switch taken along line A—A of FIG. 2-8 showing the closed state of the arc extinguishing device;

FIG. 2-10 is a sectional view of the switch taken along line A—A of FIG. 2-8 showing the closed state of the arc extinguishing device;

FIG. 2-11 is a graphic representation showing an infrared absorption spectrum of the deposit in the arc extinguishing device of Example 2-29;

FIG. 2-12 is a graphic representation showing an infrared absorption spectrum of the deposit in the arc extinguishing device of Example 2-42;

FIG. 2-13 is a graphic representation showing an infrared absorption spectrum of the deposit in the arc extinguishing device of Comparative Example 2-3;

FIG. 3-1 is a schematic perspective view showing one embodiment of an arc extinguishing chamber manufactured by using an arc extinguishing plate material according to the present invention;

FIG. 3-2 is a partially cutaway explanatory side view showing one embodiment of a switch according to the present invention;

FIG. 3-3 is a schematic perspective view showing one example of a conventional arc extinguishing chamber; and FIG. 3-4 is a partially cutaway explanatory side view showing one example of a conventional switch.

DETAILED DESCRIPTION

Figure 1:
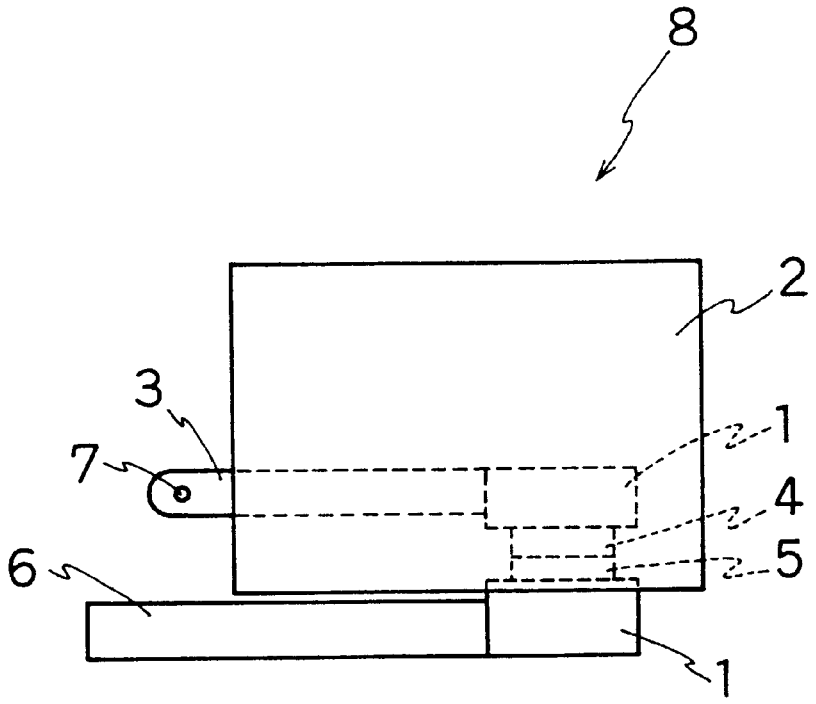
FIG. 1-1 is a schematic side view showing the closed state of an arc extinguishing device (III) according to the present invention.

The present invention will now be described in detail by way of non-limitative examples thereof.

First, reference is made to the first group inventions included in the present invention.

The first group inventions concern arc extinguishing insulative material compositions, molded products of those arc extinguishing insulative material compositions and arc extinguishing devices using the compositions and the molded products. More specifically, the first group inventions relate to arc extinguishing devices for use in circuit breakers, current limiting devices, electromagnetic contactors and the like, each of which generate an arc in the casing thereof when the current passing therethrough is interrupted, and to arc extinguishing insulative material compositions and arc extinguishing insulative molded products for use in such arc extinguishing devices.

In circuit breakers, current limiting devices, electromagnetic contactors and the like, when the contact of a moving contact element is opened from the contact of a fixed contact element with an overcurrent or rated current being passed through those contacts, an arc is generated between the two contacts. To extinguish such an arc, there is used an arc extinguishing device comprising insulator (1) 1 and insulator (2) 2 which are disposed around an arc 9 which will be generated between the moving contact of moving contact element 3 and the fixed contact 5 of fixed contact element 6, as shown in FIG. 1-14. Numeral 7 denotes pivoting center of the moving contact element 3.

The insulator (1) 1 and insulator (2) 2 of the arc extinguishing device 8 generate a thermal decompostion gas due to the arc 9, and the thermal decomposition gas cools down the arc 9, thereby extinguishing it.

Such arc extinguishing devices and arc extinguishing insulator materials for use therein are disclosed in, for example, Japanese Unexamined Patent Publications Nos. 126136/1988, 310534/1988, 77811/1989, 144811/1990 and 256110/1990.

For instance, Japanese Unexamined Patent Publication No. 126136/1988 discloses an arc extinguishing device employing an insulative material comprising polymethylpentene, polybutylene or polymethyl methacrylate and 5 to 35% of glass fiber filled therein. Polymethylpentene, polybutylene or polymethyl methacrylate generates a large amount of hydrogen gas, which has a good heat conductivity and hence exhibits a rapid cooling effect.

Japanese Unexamined Patent Publication No. 310534/1988 discloses an insulative material comprising an acrylic acid ester copolymer, aliphatic hydrocarbon resin, poly (vinyl alcohol), polybutadiene, poly(vinyl acetate), poly (vinyl acetal), isoprene resin, ethylene-propylene rubber, ethylene-vinyl acetate copolymer or polyamide resin and 5 to 35% of glass fiber filled therein.

Japanese Unexamined Patent Publication No. 77811/1989 discloses insulative materials such as polymethylpentene and melamine resin which generate hydrogen in an amount of $2.5\times10^{-2}$ ml/mg or greater when heated at 764° C. for one second in a nitrogen gas atmosphere.

Further, Japanese Unexamined Patent Publication No. 144811/1990 discloses insulative materials such as a melamine resin containing ϵ-caprolactam and aluminum hydroxide and a melamine resin containing an amine-terminated imide compound.

Still further, Japanese Unexamined Patent Publication No. 256110/1990 discloses insulative materials such as a melamine resin containing glass fiber or epoxy resin and a melamine resin containing at least two of ϵ-caprolactam, aluminum hydroxide, glass fiber and epoxy resin, as well as a melamine resin containing ϵ-caprolactam and aluminum hydroxide.

To miniaturize the arc extinguishing device 8 and to improve the current limiting or interrupting property thereof, it is effective to use an insulator (1) 1 covering a contact section in which an arc is generated or an insulator (2) 2 disposed on opposite sides of a plane including the locus of an opening or closing movement of the contacts or around the contact section. In this case the insulator (1) 1 and insulator (2) 2 are required to be improved in arc extinguishing property.

Where the sectional area of the moving contact element or fixed contact element is reduced as compared to conventional one for the purpose of miniaturizing the arc extinguishing device, the electrical resistance of the moving contact element or fixed contact element is increased and, hence, when electric current is passed through the contacts, the temperature of the contact portion and its surroundings is elevated to degrees higher than with the conventional one. Accordingly, the insulator (1) 1 and insulator (2) 2 are required to have a higher heat resistance than the conventional ones.

Alternatively, where the width W of the insulator (2) 2 is reduced than that of the conventional one for the purpose of miniaturizing the arc extinguishing device 8, the distance between the insulator (2) and the plane including the locus of an opening or closing movement of the contacts is shortened and, hence, the pressure of thermal decomposition gas to be generated from the insulator (2) by arc becomes higher than in the conventional ones. Accordingly, the insulator (1) 1 and insulator (2) 2 are required to have a higher strength against pressure than the conventional ones.

In addition, since the distance between the insulator (2) 2 and the plane including the locus of an opening or closing movement of the contacts is shortened, the insulator (2) 2 is much consumed by arc. Accordingly, the insulator (2) 2 is required to have an improved consumption-by-arc resistance, specifically to such a degree that a hole is not formed therein.

Where there is used the aforementioned conventional insulator containing a melamine resin or modified melamine resin as a matrix material thereof or a conventional melamine-phenol type insulator, a problem arises that the insulators (1) and (2) which have an insufficient strength against pressure are likely to be broken to pieces by an increased pressure in the periphery of the contacts due to a thermal decomposition gas generated from the insulators when exposed to an elevated temperature of an arc that is generated upon the opening movement of the moving contact.

Further, when the distance between the insulator (2) and the contacts is shortened for the miniaturization of the arc extinguishing device, the amount of a filler to be used needs to be increased so as to improve the consumption-by-arc resistance of the insulator (2). However, the use of C glass containing about 8% of sodium oxide and about 1% of potassium oxide or A glass containing about 15% of sodium oxide as a filler causes a problem of degraded arc extinguishing property.

Still further, the use of a heat-resistive thermoplastic resin containing a large amount of aromatic ring in the arc receiving portions of the insulators (1) and (2) brings about a problem that an insulation failure arises because the surfaces of the insulators (1) and (2) are carbonized by arc 9 and free carbon will be scattered around, though the heat resistance of the insulators (1) and (2) is improved.

It is, therefore, an object of the present invention is to provide an arc extinguishing insulative material composition, an arc extinguishing insulative molded product and an arc extinguishing device using those composition and molded product, which are free from the problems essential to the prior art and are excellent in arc extinguishing property, heat resistance, strength against pressure, consumption-by-arc resistance and the like.

According to the embodiment 1-1 of the present invention, there is provided an arc extinguishing insulative material composition comprising at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of the compounds of the group 1A metals in total, and a resin matrix containing as a main component at least one resin selected from the group consisting of a polyolefin, an olefin copolymer, a polyamide, a polyamide polymer blend, a polyacetal and a polyacetal polymer blend.

According to the embodiment 1-2 of the present invention, the inorganic mineral of the arc extinguishing insulative material composition according to the embodiment 1-1 is a member selected from the group consisting of calcium carbonate, wollastonite and magnesium silicate hydrate.

According to the embodiment 1-3 of the present invention, the ceramic fiber material of the arc extinguishing insulator composition according to the embodiment 1-1 is a member selected from the group consisting of an aluminum silicate fiber material, an aluminum borate whisker and an alumina whisker.

According to the embodiment 1-4 of the present invention, the polyolefin of the arc extinguishing insulator material according to any one of the embodiments 1-1 to 1-3 is polypropylene or polymethylpentene.

According to the embodiment 1-5 of the present invention, the olefin copolymer of the arc extinguishing insulator composition according to any one of the embodiments 1-1 to 1-3 is an ethylene-vinyl alcohol copolymer.

According to the embodiment 1-6 of the present invention, the polyamide polymer blend of the arc extinguishing insulator composition according to any one of the embodiments 1-1 to 1-3 is a member selected from the group consisting of a combination of a polyamide and a polyolefin, a combination of a polyamide and a thermoplastic elastomer and a combination of a polyamide and a rubber.

According to the embodiment 1-7 of the present invention, the polyamide of the arc extinguishing insulative material composition according to any one of the embodiments 1-1 to 1-3 and 1-6 is a member selected from the group consisting of nylon 6T, nylon 46 and nylon 66.

According to embodiment 1-8 of the present invention, the arc extinguishing insulative material composition according to any one of the embodiments 1-1 to 1-3 and 1-6 contains nylon 6T as the polyamide, and 10 to 55% of the filler.

According to embodiment 1-9 of the present invention, the arc extinguishing insulative material composition according to any one of the embodiments 1-1 to 1-3 and 1-6 contains nylon 6T as the polyamide, and 40 to 55% of the filler.

According to embodiment 1-10 of the present invention, the arc extinguishing insulative material composition according to any one of the embodiments 1-1 to 1-3 and 1-6 contains nylon 46 or nylon 66 as the polyamide, and 10 to 55% of the filler.

According to embodiment 1-11 of the present invention, the arc extinguishing insulative material composition according to any one of the embodiments 1-1 to 1-3 and 1-6 contains nylon 46 or nylon 66 as the polyamide, and 30 to 40% of the filler.

According to embodiment 1-12 of the present invention, the polyacetal polymer blend of the arc extinguishing insulative material composition according to any one of the embodiments 1-1 to 1-3 comprises a polyacetal and a thermoplastic resin which is incompatible with the polyacetal and has a melting point not less than that of the polyacetal.

According to embodiment 1-13 of the present invention, the polyacetal polymer blend of the arc extinguishing insulative material composition according to any one of the embodiments 1-1 to 1-3 comprises a combination of a polyacetal and nylon 6.

According to embodiment 1-14 of the present invention, there is provided an arc extinguishing insulative material composition comprising, as a main component thereof, a polyacetal polymer blend comprised of a thermoplastic resin which is incompatible with the polyacetal and has a melting point not less than that of the polyacetal.

According to embodiment 1-15 of the present invention, the thermoplastic resin of the arc extinguishing insulative material composition according to the embodiment 1-14 is nylon 6.

According to embodiment 1-16 of the present invention, the arc extinguishing insulative material composition according to any one of the embodiments 1-1 to 1-15 contains a substance capable of generating $H_2O$, $O_2$ and O (atomic oxygen) by thermal decomposition.

According to embodiment 1-17 of the present invention, the substance contained in the arc extinguishing insulative material composition according to the embodiment 1-16 is at least one member selected from the group consisting of aluminum hydroxide, magnesium hydroxide, antimony tetroxide and antimony pentoxide.

According to embodiment 1-18 of the present invention, there is provided an arc extinguishing insulative material composition comprising a substance capable of generating $H_2O$, $O_2$ and O (atomic oxygen) by thermal decomposition, and a matrix resin containing as a main component at least one member selected from the group consisting of nylon 6T, nylon 46 and nylon 66.

According to embodiment 1-19 of the present invention, there is provided an arc extinguishing insulative molded product comprising:

an arc receiving layer made of an arc extinguishing insulator composition comprising not more than 20% of at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals in total, and a matrix resin containing as a main component at least one member selected from the group consisting of a polyolefin, an olefin copolymer, a polyamide, a polyamide polymer blend, a polyacetal and a polyacetal polymer blend, or made of a non-reinforced, arc extinguishing insulative material composition comprising as a main component at least one resin selected from the group consisting of a polyolefin, an olefin copolymer, a polyamide, a polyamide polymer blend, a polyacetal and a polyacetal polymer blend; and a base layer underlying the arc receiving layer and made of an arc extinguishing insulator composition comprising 20 to 65% of at least one filler selected from the group consisting of a glass fiber, an inorganic mineral and a ceramic fiber, and a matrix resin containing as a main component at least one member selected from the group consisting of a polyolefin, an olefin copolymer, a polyamide, a polyamide polymer blend, a polyacetal and a polyacetal polymer blend.

According to embodiment 1-20 of the present invention, there is provided an arc extinguishing insulative molded product comprising:

an arc receiving layer made of an arc extinguishing insulative material composition comprising not more than 20% of at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals in total, and a matrix resin containing as a main component at least one member selected from the group consisting of a polyolefin, an olefin copolymer, a polyamide, a polyamide polymer blend, a polyacetal and a polyacetal polymer blend, or made of a non-reinforced, arc extinguishing insulative material composition comprising as a main component at least one member selected from the group consisting of a polyolefin, an olefin copolymer, a polyamide, a polyamide polymer blend, a polyacetal and a polyacetal polymer blend; and a base layer underlying the arc receiving layer and made of an arc extinguishing insulator composition comprising 20 to 65% of at least one filler selected from the group consisting of a glass fiber material, an inorganic mineral and a ceramic fiber material, and a matrix resin containing as a main component thereof a thermoplastic resin or a thermosetting resin.

According to embodiment 1-21 of the present invention, the thermoplastic resin or thermosetting resin contained in the arc extinguishing insulator molded product according to the embodiment 1-20 is at least one member selected from the group consisting of nylon 6T, nylon MXD 6, polyethylene terephthalate and polybutylene terephthalate.

According to embodiment 1-22 of the present invention, the polyamide for use in the arc receiving layer and/or the base layer of the arc extinguishing insulative molded product according to the embodiment 1-19 or 1-20 is nylon 46 or nylon 66.

According to embodiment 1-23 of the present invention, the inorganic mineral for use in the arc receiving layer and/or the base layer of the arc extinguishing insulative molded product according to any one of the embodiments 1-19 to 1-22 is at least one member selected from the group consisting of calcium carbonate, wollastonite and magnesium silicate hydrate.

According to embodiment 1-24 of the present invention, the ceramic fiber for use in the arc receiving layer and/or the base layer of the arc extinguishing insulative molded product according to any one of the embodiments 1-19 to 1-22 is at least one member selected from the group consisting of an aluminum silicate fiber, an aluminum borate whisker and an alumina whisker.

According to embodiment 1-25 of the present invention, the glass fiber material for use in the base layer of the arc extinguishing insulative molded product according to any one of the embodiments 1-19 to 1-22 contains not more than 1% of compounds of group 1A metals of the periodic table in total.

According to embodiment 1-26 of the present invention, the arc receiving layer of the arc extinguishing insulative molded product according to any one of the embodiments 1-19 to 1-25 further contains a substance capable of generating $H_2O$, $O_2$ and O (atomic oxygen) by thermal decomposition.

According to embodiment 1-27 of the present invention, the substance capable of generating $H_2O$, $O_2$ and O (atomic oxygen) by thermal decomposition which is contained in the arc receiving layer of the arc extinguishing insulative molded product according to the embodiment 1-26 is at least one member selected from the group consisting of aluminum hydroxide, magnesium hydroxide, antimony tetroxide and antimony pentoxide.

According to embodiment 1-28 of the present invention, there is provided an arc extinguishing device comprising an arc extinguishing insulative material composition or an arc extinguishing insulative molded product according to any one of the embodiments 1-1 to 1-27.

According to embodiment 1-29 of the present invention, there is provided an arc extinguishing device comprising an insulator (1) covering a contact section of a switch excepting contact surfaces of contacts of the switch, the insulator (1) being formed of an arc extinguishing insulative material composition according to any one of the embodiments 1-1 to 1-18.

According to embodiment 1-30 of the present invention, there is provided an arc extinguishing device comprising an insulator (2) disposed on both sides with respect to a plane including the locus of an opening or closing movement of contacts of a switch or around a contact section of the switch, the insulator (2) being formed of an arc extinguishing insulative material composition or an arc extinguishing insulative molded product according to any one of the embodiments 1-1 to 1-27.

According to embodiment 1-31 of the present invention, there is provided an arc extinguishing device comprising an insulator (1) covering a contact section of a switch excepting contact surfaces of contacts of the switch, and an insulator (2) disposed on both sides with respect to a plane including the locus of an opening or closing movement of the contacts or around the contact section, the insulator (1) being formed of an arc extinguishing insulative material composition according to any one of the embodiments 1-1 to 1-18, the insulator (2) being formed of an arc extinguishing insulative material composition or an arc extinguishing insulative molded product according to any one of the embodiments 1-1 to 1-27.

In each of the embodiments 1-1 to 1-13 of the present invention, the arc extinguishing insulative material composition comprises at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total, and a matrix resin containing, as a main component, at least one resin selected from the group consisting of a polyolefin, an olefin copolymer, a polyamide, a polyamide polymer blend, a polyacetal and a polyacetal polymer blend. The arc extinguishing insulative material composition of such constitution has improved arc extinguishing property, strength against pressure and consumption-by-arc resistance. Further, since the matrix resin of the arc extinguishing insulative material composition contains a thermoplastic resin as a main component thereof, the time period required for the molding of the arc extinguishing insulative material composition is shortened relative to that required for the case of a thermosetting resin which requires a setting time in molding.

In each of the embodiments 1-2 and 1-3 of the present invention, the arc extinguishing insulative material composition contains, as the inorganic mineral, calcium carbonate, wollastonite or magnesium silicate hydrate, or, as the ceramic fiber, an aluminum silicate fiber, an aluminum borate whisker or an alumina whisker. The arc extinguishing insulative material composition of such constitution exhibits an improved arc extinguishing property.

In the embodiment 1-4 of the present invention, the arc extinguishing insulative material composition contains polypropylene or polymethylpentene as the polyolefin. Since polypropylene or polymethylpentene is of a small specific gravity, the insulative material is of a relatively small weight. Polymethylpentene, in particular, is a crystalline resin having a melting point of 240° C. and hence imparts the insulative material composition with a high heat resistance.

In the embodiment 1-5 of the present invention, the arc extinguishing insulative material composition contains an ethylene-vinyl alcohol copolymer having a high strength as the olenfin copolymer. Hence, the insulative material composition enjoys a further improved strength against pressure.

In the embodiment 1-6 of the present invention, the polyamide polymer blend for use in the arc extinguishing insulative material composition comprises a combination of a polyamide and a polyolefin, a combination of a polyamide and a thermoplastic elastomer, or a combination of a polyamide and a rubber. The insulative material composition of such constitution has an improved impact resistance and hence exhibits a further improved strength against pressure.

In the embodiment 1-7 of the present invention, the polyamide for use in the arc extinguishing insulative material composition is at least one member selected from the group consisting of nylon 6T, nylon 46 and nylon 66 which are crystalline polyamides having high melting points. Accordingly, the insulative material composition has a high heat distortion temperature and hence enjoys a further improved heat resistance.

In each of the embodiments 1-8 and 1-9 of the present invention, the polyamide for use in the arc extinguishing insulative material composition is nylon 6T which is a crystalline polyamide having a high melting point. Accordingly, the insulator composition has a high heat distortion temperature and hence enjoys a further improved heat resistance. The insulative material composition further contains 10 to 55%, more preferably 40 to 55%, of at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total. This allows the insulative material composition to exhibit further improved consumption-by-arc resistance and strength against pressure.

In each of the embodiments 1-10 and 1-11 of the present invention, the polyamide for use in the arc extinguishing insulative material composition is either one of nylon 46 and nylon 66 which are crystalline polyamides having high melting points. Accordingly, the insulative material composition has a higher heat distortion temperature and hence enjoys a further improved heat resistance. The insulative material composition further contains 10 to 55%, preferably 30 to 40%, of at least one filler selected from the group consisting of a glass fiber containing not more than 1% of compounds of the group 1A metals of the periodic table in total, an inorganic mineral containing not more than 1% of compounds of group 1A metals of the periodic table in total and a ceramic fiber containing not more than 1% of compounds of group 1A metals of the periodic table in total. This allows the insulative material composition to exhibit further improved consumption-by-arc resistance and strength against pressure. Still further, since nylon 46 and nylon 66 are each free of any aromatic ring in the chemical formula thereof, the insulative material composition is likely to be less carbonized at its surface by arc and hence enjoys a further enhanced arc extinguishing property.

In the embodiment 1-12 of the present invention, the main component of the matrix resin contained in the arc extinguishing insulative material composition comprises, as the polyacetal polymer blend, a combination of a polyacetal and a thermoplastic resin which is incompatible with the polyacetal and has a higher melting point than the polyacetal. Where an insulator has an arc receiving surface formed of, for example, a polyacetal rich layer, the insulative material exhibits an enhanced arc extinguishing property by virtue of the gas to be generated from the polyacetal by an arc. Further, the insulative material composition can have a higher heat resistance than the polyacetal depending on the material combined with the polyacetal in the polymer blend. The insulative material composition further contains at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total. This allows the insulative material composition to exhibit improved consumption-by-arc resistance and strength against pressure.

In the embodiment 1-13 of the present invention, the main component of the matrix resin contained in the arc extinguishing insulative material composition comprises a combination of a polyacetal and nylon 6 as the polyacetal polymer blend. Since nylon 6 is free of any aromatic ring in its chemical formula, the insulative material composition is likely to be less carbonized by arc and hence offers a further improved arc extinguishing property together with the features of the embodiment 1-12.

In the embodiment 1-14 of the present invention, the main component of the arc extinguishing insulative composition is the polyacetal polymer blend comprising a combination of a polyacetal and a thermoplastic resin which is incompatible with the polyacetal and has a higher melting point than the polyacetal. Where an insulator has an arc receiving surface formed of, for example, a polyacetal rich layer, the insulative material exhibits an enhanced arc extinguishing property by virtue of the gas to be generated from the polyacetal by arc. Further, the insulative material composition can have a higher heat resistance than the polyacetal depending on the material combined with the polyacetal in the polymer blend.

In the embodiment 1-15 of the present invention, the polyacetal polymer blend for use in the arc extinguishing insulative material composition comprises a combination of a polyacetal and nylon 6. Since nylon 6 is free of any aromatic ring in its chemical formula, the insulative material composition is likely to be less carbonized by arc and hence offers a further improved arc extinguishing property together with the features of the embodiment 1-12.

In the embodiment 1-16 of the present invention, the arc extinguishing insulative material composition according to any one of the embodiments 1-1 to 1-15 further contains a substance capable of generating $H_2O$, $O_2$ and O (atomic oxygen) by thermal decomposition. Since those gases generated by thermal decomposition act to inhibit the generation of free carbon, the insulative material composition demonstrates a further enhanced arc extinguishing property.

In the embodiment 1-17 of the present invention, such a substance capable of generating $H_2O$, $O_2$ and O (atomic oxygen) is aluminum hydroxide, magnesium hydroxide, antimony tetroxide or antimony pentoxide. Any one of those substances acts to advantageously inhibit the generation of free carbons and, hence, the insulative material composition offers a further enhanced arc extinguishing property.

In the embodiment 1-18 of the present invention, the arc extinguishing insulative material composition contains the substance capable of generating $H_2O$, $O_2$ and O (atomic oxygen) by thermal decomposition. Since those gases generated by thermal decomposition act to inhibit the generation of free carbon, the insulative material composition containing such a substance in combination with the particular polymer demonstrates a further enhanced arc extinguishing property.

In each of the embodiments 1-19 to 1-27, the arc extinguishing insulative molded product is of a double-layered structure and hence is possible to have a layer of an excellent arc extinguishing property and a layer of excellent strength against pressure, consumption-by-arc resistance and heat resistance.

In each of the embodiments 1-19 to 1-21 of the present invention, the arc receiving layer of the arc extinguishing insulative molded product is made of an arc extinguishing insulative material composition comprising not more than 20% of at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total, and a matrix resin containing as a main component at least one resin selected from the group consisting of a polyolefin, an olefin copolymer, a polyamide, a polyamide polymer blend, a polyacetal and a polyacetal polymer blend, or is made of a non-reinforced, arc extinguishing insulative material composition comprising as a main component at least one resin selected from the group consisting of a polyolefin, an olefin copolymer, a polyamide, a polyamide polymer blend, a polyacetal and a polyacetal polymer blend. The arc extinguishing insulative molded product of this constitution offers an improved arc extinguishing property.

In the embodiment 1-19 of the present invention, the arc extinguishing insulative molded product comprises an arc receiving layer, and a base layer underlying the arc receiving layer and made of 20 to 65% of at least one filler selected from the group consisting of a glass fiber, an inorganic mineral and a ceramic fiber, and a matrix resin containing as a principal component thereof at least one member selected from a polyolefin, an olefin copolymer, a polyamide, a polyamide polymer blend, a polyacetal and a polyacetal polymer blend. The arc extinguishing insulative molded product of such constitution offers improved strength against pressure and consumption-by-arc resistance.

In each of the embodiments 1-20 and 1-21 of the present invention, the arc extinguishing insulative molded product comprises an arc receiving layer, and a base layer underlying the arc receiving layer and made of 20 to 65% of at least one filler selected from the group consisting of a glass fiber, an inorganic mineral and a ceramic fiber, and a matrix resin containing as a main component thereof a thermoplastic or thermosetting resin selected from the group consisting of nylon 6T, nylon MXD6, polyethylene terephthalate and polybutylene terephthalate. The arc extinguishing insulative molded product of such constitution offers improved strength against pressure and and consumption-by-arc resistance. Nylon 6T, in particular, has a higher melting point than nylon 46 and nylon 66 and hence will contribute to a further improvement in the heat resistance of the molded product.

In the embodiment 1-22 of the present invention, the polyamide for use in the arc extinguishing insulative molded product is either one of nylon 46 and nylon 66, each of which is free of any aromatic ring in its chemical formula. The molded product is likely to be less carbonized at its surface by arc and thereby offers a further enhanced arc extinguishing property.

In each of the embodiments 1-23 to 1-25 of the present invention, the inorganic mineral is calcium carbonate, wollastonite or magnesium silicate hydrate, the ceramic fiber is an aluminum silicate fiber, an aluminum borate whisker or an alumina whisker, and the glass fiber contained in the base layer is a glass fiber containing not more than 1% of compounds of group 1A metals of the periodic table in total. The molded product of this constitution enjoys an enhanced arc extinguishing property.

In the embodiment 1-26 of the present invention, the arc extinguishing insulative molded product according to any one of the embodiments 1-19 to 1-25 includes the arc receiving layer containing a substance capable of generating $H_2O$, $O_2$ and O (atomic oxygen) by thermal decomposition. These gases which will be generated by thermal decomposition act to inhibit the generation of free carbons and, hence, the molded product enjoys a further enhanced arc extinguishing property.

In the embodiment 1-27 of the present invention, the substance capable of generating $H_2O$, $O_2$ and O by thermal decomposition is at least one member selected from the group consisting of aluminum hydroxide, magnesium hydroxide, antimony tetroxide and antimony pentoxide. Those substances act to inhibit the generation of free carbon more efficiently and thereby impart the molded product with a further enhanced arc extinguishing property.

In the embodiment 1-28 of the present invention, the arc extinguishing device comprises an arc extinguishing insulative material composition or arc extinguishing insulative molded product according to any one of the embodiments 1-1 to 1-27. Such arc extinguishing device is possible to be miniaturized and to exhibit an enhanced current limiting or interrupting performance.

In the embodiment 1-29 of the present invention, the arc extinguishing device comprises insulator (1) covering the contact section excepting the contact surfaces, the insulator (1) being formed of an arc extinguishing insulative material composition according to any one of the embodiments 1-1 to 1-18. Such arc extinguishing device is possible to be miniaturized and to exhibit an enhanced current limiting or interrupting performance.

In the embodiment 1-30 of the present invention, the arc extinguishing device comprises insulator (2) disposed on both sides with respect to a plane including the locus of an opening or closing movement of the contacts or around the contact section, the insulator (2) being formed of an arc extinguishing insulative material composition or arc extinguishing insulative molded product according to any one of the embodiments 1-1 to 1-27. Such arc extinguishing device is possible to be miniaturized and to exhibit an enhanced current limiting or interrupting performance.

In the embodiment 1-31 of the present invention, the arc extinguishing device comprises insulator (1) covering the contact section excepting the contact surfaces, and insulator (2) disposed on both sides with respect to a plane including the locus of an opening or closing movement of the contacts or around the contact section, the insulator (1) being formed of an extinguishing insulative material composition according to any one of the embodiments 1-1 to 1-18, the insulator (2) being formed of arc extinguishing insulative material composition or arc extinguishing insulative molded product according to any one of the embodiments 1-1 to 1-27. Such arc extinguishing device is possible to be miniaturized and to exhibit an enhanced current limiting or interrupting performance.

The arc extinguishing insulative material composition (I) mainly comprises the matrix resin specified above which contains the specified filler.

The filler used therein is at least one member selected from the group consisting of a glass fiber containing not more than 1% of compounds of group 1A metals of the periodic table in total, an inorganic mineral containing not more than 1% of compounds of 1A group metals of the periodic table in total, and a ceramic fiber containing not more than 1% of compounds of group 1A metals of the periodic table.

The above filler is used to improve the consumption-by-arc resistance, strength against pressure and arc extinguishing property of the insulative material composition.

The compounds of group 1A metals (Li, Na, K, Rb, Cs, Fr) of the periodic table herein are in the form of metal oxide $M_2O$ ($Na_2O$, $K_2O$, $Li_2O$, and the like).

The total amount of these compounds allowable in the filler is not more than 1%. If it exceeds 1%, the insulative material composition exhibits a degraded arc extinguishing property. The total amount of such compounds is preferably not more than 0.6%, more preferably not more than 0.15% in view of arc extinguishing property. It is noted that the total amount of the compounds is measured by X-ray diffraction.

The glass fiber material is used to improve the strength against pressure and consumption-by-arc resistance of the insulative material composition by virtue of its reinforcing effect.

The glass fiber herein is a fibrous material of glass, and any particular limitations are not imposed on such fibrous material as far as it contains not more than 1% of compounds of group 1A metals of the periodic table in total. Examples of the specific glass materials usable for the glass fiber include E glass, S glass, D glass, T glass and silica glass. Preferable are S glass, D glass, T glass and silica glass since they are free of any of compounds of group 1A metals. Examples of the specific glass fiber products usable for the glass fiber material include a long fiber product, a short fiber product and glass wool. Preferable is the short fiber product from the viewpoint of use as a filler for a thermoplastic resin.

The glass fiber preferably has a fiber diameter of 6 to 13 $\mu$m and a fiber aspect ratio of 10 or more for imparting the insulative material composition with an improved strength against pressure. Further, the glass fiber may be processed with a treating agent such as a silane coupling agent for imparting the insulative material composition with a further improved strength against pressure.

The inorganic mineral is used to enhance the arc extinguishing property, consumption-by-arc resistance and strength against pressure of the insulative material composition.

Any particular limitations are not imposed on the inorganic mineral as far as it contains not more than 1% of compounds of group 1A metals of the periodic table in total. Preferable examples of such minerals are calcium carbonate, wollastonite, and magnesium silicate hydrate such as talc, Aston, chrysotile or sepiolite. These minerals act to improve the consumption-by-arc resistance of the insulative material composition.

Calcium carbonate is preferably treated with a surface modifier such as stearic acid in order to improve the dispersibility in a resin from the viewpoint of the strength against pressure of the insulative material composition.

Wollastonite is preferably in a fibrous form having a high aspect ratio in view of the strength against pressure of the insulative material composition. Magnesium silicate hydrate is preferably a fibrous one such as Aston in view of the strength against pressure of the insulative material composition.

The ceramic fiber is used to improve the consumption-by-arc resistance and strength against pressure of the insulative material composition, as well as the arc extinguishing property thereof.

The ceramic fiber herein is a fibrous material of a ceramic. Any particular limitations are not imposed on the ceramic fiber as far as the total amount of compounds of group 1A metals contained therein meets the requirement. Preferable examples of such ceramic fiber include an aluminum silicate fiber, an aluminum borate whisker and an alumina whisker. Those ceramic fiber advantageously improves the arc extinguishing property and strength against pressure of the insulative material composition.

The ceramic fiber preferably has a fiber diameter of 1 to 10 $\mu$m and a fiber aspect ratio of 10 or higher in view of the strength against pressure.

One or more kinds of the fillers are used. Where two or more kinds of such materials are used, preferable combinations are: the glass fiber and the inorganic mineral; the glass fiber and the ceramic fiber; the inorganic mineral and the ceramic fiber; two or more of the glass fibers; two or more of the inorganic minerals; two or more of the ceramic fibers; and the glass fiber, the inorganic mineral and the ceramic fiber. These combinations advantageously contribute to improvement in the arc extinguishing property of the insulative material composition.

The weight ratios of such combinations are: preferably 5/50 to 50/5, more preferably 10/30 to 30/10 in the case of glass fiber inorganic/mineral combination, glass fiber/ceramic fiber combination, and inorganic mineral/ceramic fiber combination, and preferably 1:1:1 to 1:1:10 in the case of glass fiber/inorganic mineral/ceramic fiber combination.

The matrix resin is selected from the group consisting of a polyolefin, an olefin copolymer, a polyamide, a polyamide polymer blend, a polyacetal and a polyacetal polymer blend.

The matrix resin is used to enhance the arc extinguishing property, strength against pressure and consumption-by-arc resistance of the insulative material composition and further to shorten the time required for molding the insulative material composition.

The polyolefin is free of any aromatic ring and is excellent in impact resistance, and is therefore used to impart the insulative material composition with satisfactory arc extinguishing property and strength against pressure. Examples of the polyolefins are polypropylene, polyethylene and polymethylpentene. Among these, polypropylene and polymethylpentene which have a small specific gravity are preferred for providing the insulative material composition of a lighter weight. Polymethylpentene is particularly preferable, since it is a crystalline resin having a melting point of 240° C. and hence imparts the insulative material composition with a high heat resistance.

The olefin copolymer is free of any aromatic ring and hence is used to impart the insulative material composition with a satisfactory arc extinguishing property. Examples of the olefin copolymers are ethylene-vinyl alcohol copolymer and ethylene-vinyl acetate copolymer. A resin of a high strength such as the ethylene-vinyl alcohol copolymer is preferred for improving the strength against pressure of the insulative material composition. To realize the insulative material composition of improved strength against pressure, the copolymerization ratio of the ethylene-vinyl alcohol copolymer is preferably within the range of 30/70 to 45/55 by weight, more preferably 30/70 to 35/65 by weight.

The polyamide herein is a high molecular compound having an amido bond and includes a polyamide copolymer in the present invention. The polyamide is a high strength resin and hence is used to impart the insulative material composition with a satisfactory strength against pressure. Examples of the polyamides include nylon 6T, nylon 66, nylon 46, nylon MXD6, nylon 610, nylon 6, nylon 11, nylon 12 and copolymer of nylon 6 and nylon 66. It is noted that nylon in general means a linear synthetic polyamide among polyamides. Nylon mn results from polycondensation of a diamine having m number of carbon atoms ($NH_2(CH_2)_mNH_2$) and a dibasic acid having n number of carbon atoms ($HOOC(CH_2)_{n-2}COOH$). Nylon n is a polymer of an ω-amino acid ($H_2N(CH_2)_{n-1}COOH$) having n number of carbon atoms or of a lactam having n number of carbon atoms.

Among the above polyamides, there are preferred crystalline polyamides having high melting points such as nylon 6T (melting point: 320° C.), nylon 46 (melting point: 290° C.) and nylon 66 (melting point: 260° C.), since they can impart the insulative material composition with a high distortion temperature and a further improved heat resistance.

Chemical formulae of the representative polyamides are as follows.

(I)

Nylon 6T

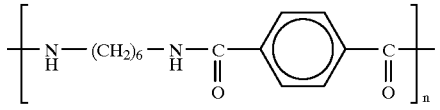

(II)

Nylon 46

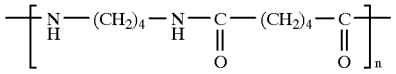

(III)

Nylon 66

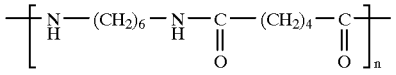

(IV)

Nylon MXD6

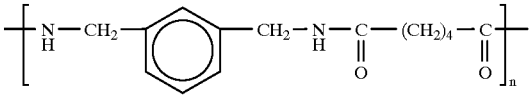

The polyamide polymer blend herein is a blend of a polyamide polymer and another polymer. The polyamide polymer blend is used to impart the insulative material composition with an improved impact resistance. Examples of such polyamide polymer blends include a polyamide-polyolefin blend, a polyamide-thermoplastic elastomer blend, and a polyamide-rubber blend.

Any of the aforementioned polyamides can be used as the polyamide in the polyamide polymer blend. Among such polyamides, there are preferably used nylon 46, nylon 66 and the like which are free of any aromatic ring and have high melting points, since they provide the insulative material composition with improved heat resistance and arc extinguishing property.

Any of the aforementioned polyolefins can be used as the polyolefin usable in the polyamide polymer blend. Among these, polypropylene is preferred, since it provides the insulative material composition with an improved strength against pressure.

Examples of thermoplastic elastomers usable in the polyamide polymer blend include a polyolefin elastomer, a polyamide elastomer and a polyester elastomer. Among those, the polyolefin elastomer is preferably used, since it imparts the insulative material composition with an improved strength against pressure.

Examples of rubbers usable in the polyamide polymer blend include a butadiene rubber, an ethylene-propylene rubber and an acrylic acid rubber. Among these, ethylene-propylene rubber is preferably used, since it imparts the insulating composition with an improved strength against pressure.

In the polyamide polymer blend, the blending ratio of the polyamide to any one of the polyolefin, thermoplastic elastomer or rubber is preferably 100:1 to 100:15 by weight, more preferably 100:5 to 100:10 by weight, taking account of the heat resistance and strength against pressure of the insulating composition.

The polyacetal is used to enhance the arc extinguishing property of the insulative material composition, since a gas to be generated from the polyacetal by arc acts to extinguish the arc. Examples of the polyacetals are homopolymer and copolymer of polyoxymethylene.

The polyacetal polymer blend is used to enhance the arc extinguishing property of the insulative material composition, since a gas to be generated from the polyacetal component thereof acts to extinguish the arc as described above, and to impart the insulative material composition with a higher heat resistance than the polyacetal alone by virtue of the thermoplastic resin other than the polyacetal in the blend.

In the polyacetal polymer blend, the polyacetal component thereof is the same as described above, and the other polymer thereof is a thermoplastic resin which is incompatible with the polyacetal and has a melting point not less than that of the polyacetal, but preferably not more than 230° C. The incompatibility of the thermoplastic resin with the polyacetal herein is a characteristic that the two show a marked change in modulus of elasticity and a peak of loss tangent at the respective glass transition temperatures. It is to be noted that the polyacetal has a melting point of 178° C. in the case of the homopolymer thereof, and a melting of 167° C. in the case of the copolymer thereof.

Examples of the thermoplastic resins for use in the polyacetal polymer blend include nylon 6 and polybutylene terephthalate. Among those, nylon 6 is preferred, since it is free of any aromatic ring in the chemical formula thereof and hence will be less carbonized at its surface by arc thereby further improving the arc extinguishing property of the insulative material composition.

In the polyacetal polymer blend, the blending ratio of the polyacetal component to the other component is preferably 100:100 to 100:400 by weight, more preferably 100:200 to 100:300 by weight, taking account of the heat resistance of the insulative material composition.

The matrix resin contains any one of the foregoing resins and, optionally, accessary constituents, such as a flame retardant, other than the filler. Preferable as such flame retardant are a phosphoric flame retardant free of any aromatic ring and an inorganic flame retardant.

The arc extinguishing insulative material composition (I) of the present invention contains the filler and accessary constituents specified above in the matrix resin as described above. The proportion of the specified filler is preferably 10 to 55%, more preferably 30 to 40%, relative to the total weight of the insulative material composition (I). If the proportion is less than 10%, the insulative material composition is likely to exhibit unsatisfactory consumption-by-arc resistance, strength against pressure and the like. On the other hand, if the proportion of the filler exceeds 55%, the insulative material composition is likely to exhibit an insufficient arc extinguishing property.

The arc extinguishing insulative material composition (I) containing 10 to 55% of the filler is mainly used in a circuit breaker of low electric current (about 100 A).

Even if the insulative material composition contains less than 10% of the filler, lamination of such insulative material composition with another material makes it possible to afford a laminated insulator product with improved consumption-by-arc resistance and strength against pressure as will be described later. Such a laminated insulator product is mainly used in a circuit breaker of high electric current (about 200 A or higher).

Where the matrix resin comprises nylon 6T, the content of the filler specified above is set to preferably 10 to 55%, more preferably 40 to 55%, for imparting the insulative material composition with further improved arc extinguishing property, consumption-by-arc resistance and strength against pressure.

Alternatively, where the matrix resin comprises nylon 46 or nylon 66, the content of the filler is set to preferably 10 to 55%, more preferably 30 to 40%, for imparting the insulative material composition with further improved arc extinguishing property, consumption-by-arc resistance and strength against pressure.

Preferably, the arc extinguishing insulative material composition (I) further contains a substance capable of generating $H_2O$, $O_2$ and O (atomic oxygen) by thermal decomposition for inhibiting the generation of free carbon thereby enhancing the arc extinguishing property of the insulator composition. Such a substance will hereinafter be referred to as "free carbon inhibitor".

To verify whether or not a substance is capable of generating $H_2O$, $O_2$ or O (atomic oxygen), it is possible to employ, for example, a method in which the substance is subjected to thermal decomposition in a nitrogen gas atmosphere, and the gas generated from the substance by thermal decomposition is allowed to pass through a gas detector tube to measure the concentration of $H_2O$, $O_2$ or O therein.

Examples of the free carbon inhibitors include aluminum hydroxide, magnesium hydroxide, antimony tetroxide and antimony pentoxide. These compounds are preferred in view of their free carbon generation inhibiting effect. Aluminum hydroxide or magnesium hydroxide generates $H_2O$ by thermal decomposition, on the other hand antimony tetroxide or antimony pentoxide generates $O_2$ or O by thermal decomposition. $H_2O$, $O_2$ or O thus generated reacts with particles of metals generated from an electrode material or the like, or with free carbon generated from the arc extinguishing material to give metal oxide, carbon monoxide or carbon dioxide, thereby inhibiting the occurrence of insulation failure.

The proportion of the free carbon inhibitor in the arc extinguishing insulative material composition (I) is preferably not more than 20%. The use of free carbon inhibitor in an amount of more than 20% tends to degrade the strength against pressure of the insulative material composition particularly comprising a combination of nylon and magnesium hydroxide.

The constitution of the arc extinguishing insulative material composition (I) to which the free carbon inhibitor is to be added is not particularly varied.

The arc extinguishing insulative material composition (I) can be prepared by any method which is capable of mixing the filler and accessory constituents with the matrix resin, but is usually by an extrusion mixing method, roll mixing method or the like into a pellet form, sheet form or another form.

Representative examples of generally preferred arc extinguishing insulative material compositions (I) are as follows:

An arc extinguishing insulative material composition comprising a matrix resin containing, as a principal component thereof, nylon 46, nylon 66 or nylon 6T, which contains 30 to 50% of a glass fiber formed of E glass containing not more than 1% of compounds of group 1A metals of the periodic table in total.

This insulative material composition is preferred in view of its heat resistance, consumption-by-arc resistance and strength against pressure and from econimical viewpoints.

An arc extinguishing insulative material composition comprising a matrix resin containing, as a principal component thereof, nylon 46 or nylon 66 which contains 30 to 40% of an aluminum borate whisker or aluminum silicate fiber each containing not more than 1% of compounds of group 1A metals of the periodic table in total.

This insulative material composition is preferred in view of its heat resistance and arc extinguishing property.

An arc extinguishing insulative material composition comprising a matrix resin containing, as a principal component thereof, nylon 46 or nylon 66, which contains 30 to 40% of magnesium silicate hydrate or wollastonite each containing not more than 1% of compound of group 1A metals of the periodic table in total.

This insulative material composition is preferred in view of its heat resistance and arc extinguishing property.

An arc extinguishing insulative material composition comprising the constituents of either one of the above generally preferred compositions, and further 5 to 20% of magnesium hydroxide.

This insulative material composition is preferred, since it exhibits a further enhanced effect of inhibiting the generation of free carbons and hence of inhibiting the occurrence of insulation failure.

Reference is made to the arc extinguishing insulative material composition (II) of the present invention.

The arc extinguishing insulative material composition (II) comprises, as a principal component thereof, a polyacetal polymer blend composed of a polyacetal and a thermoplastic resin which is incompatible with the polyacetal and has a higher melting point than the polyacetal. In the insulative material composition (II), the polyacetal component of the polyacetal polymer blend serves to enhance the arc extinguishing property of the insulative material composition by virtue of the gas generated therefrom, and the thermoplastic resin component other than the polyacetal imparts the insulative material composition with a higher heat resistance than that of the polyacetal.

With respect to the polyacetal, the thermoplastic resin which is incompatible with the polyacetal and has a higher melting point than the polyacetal, blending ratio therebetween, kinds of accessary constituents, blending amounts thereof, shape of the insulator composition, preparation method therefor and the like, those are the same as in the arc extinguishing insulative material composition (I) and, therefore, the description thereon is herein omitted.

The insulative material composition (II) of the present invention also may further contain the free carbon inhibitor. In this case the insulative material composition exhibits a further improved arc extinguishing property by virtue of the effect of inhibiting the generation of free carbon.

With respect to examples of the free carbon inhibitor, preferred examples thereof, content thereof in the insulative material composition and other particulars, those are the same as in the arc extinguishing insulative material composition (I) and, therefore, the description thereon is herein omitted.

Generally preferred examples of the arc extinguishing insulative material compositions (II) include one comprising, as a principal component thereof, a polyacetal polymer blend comprising 100 parts (parts by weight, hereinafter the same) of nylon 6 and 100 to 25 parts of a polyacetal, in view of the arc extinguishing property and heat resistance thereof, and one further comprising 5 to 20% of magnesium hydroxide or aluminum hydroxide, in view of effect of inhibiting the generation of free carbon, hence, of inhibiting the occurrence of insulation failure.

Reference is then made to the arc extinguishing insulative material composition (III) of the present invention.

The arc extinguishing insulative material composition (III) comprises a substance capable of generating $H_2O$, $O_2$ and O (atomic oxygen) by thermal decomposition, and a matrix resin containing as a principal component at least one member selected from the group consisting of nylon 6T, nylon 46 and nylon 66. The insulative material composition (III) exhibits an enhanced arc extinguishing property since it is capable of generating $H_2O$, $O_2$ and O (atomic oxygen) which serve to inhibit the generation of free carbon.

With respect to the free carbon inhibitor, nylon 6T, nylon 46, nylon 66 and the like for use in the insulator composition (III), those are the same as in the insulative material composition (I) and, therefore, the description thereon is herein omitted.

Preferable as the free carbon inhibitor are magnesium hydroxide, antimony tetroxide and antimony pentoxide, because they can easily be incorporated into the resin.

The content of the free carbon inhibitor in the arc extinguishing insulative material composition (III) is preferably within the range of 5 to 20%. If the content is less than 5%, the insulative material composition is likely to exhibit an insufficient free carbon generation inhibiting effect, while if it exceeds 20%, the insulative material composition is likely to demonstrate a degraded strength against pressure.

With respect to the preparation method for the arc extinguishing insulative material composition (III), the shape of the composition (II) and the like, those are the same as in the arc extinguishing insulative material composition (I) and, therefore, the description thereon is herein omitted.

The arc extinguishing insulative material compositions (I), (II) and (III) can be molded into specific forms. Such molded products can be used in, for example, an arc extinguishing device comprising insulator (1) covering a contact section to generate an arc excepting the contact surfaces thereof in a switch and/or insulator (2) disposed on both sides with respect to a plane including the locus of the opening or closing movement of contacts or around the contact section. Although the shape, structure and size of the molded product vary depending on the current interrupting mechanism of the switch, exemplary molded products are as shown in FIGS. 1-5 to 1-7.

The molded product can be prepared by, for example, an injection molding method or hot press method. The injection molding method is preferably employed in view of its mass productivity.

Next, reference is made to the arc extinguishing insulative molded product (I) according to the present invention.

The arc extinguishing insulative molded product (I) comprises:

an arc receiving layer made of an arc extinguishing insulative material composition comprising not more than 20% of at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total, and a matrix resin containing as a main component at least one member selected from the group consisting of a polyolefin, an olefin copolymer, a polyamide, a polyamide polymer blend, a polyacetal and a polyacetal polymer blend, or made of a non-reinforced, arc extinguishing insulative material composition comprising as a main component at least one member selected from the group consisting of a polyolefin, an olefin copolymer, a polyamide, a polyamide polymer blend, a polyacetal and a polyacetal polymer blend; and a base layer underlying the arc receiving layer and made of an arc extinguishing insulative material composition comprising 20 to 65% of at least one filler selected from the group consisting of a glass fiber, an inorganic mineral and a ceramic fiber, and a matrix resin containing as a main component at least one member selected from the group consisting of a polyolefin, an olefin copolymer, a polyamide, a polyamide polymer blend, a polyacetal and a polyacetal polymer blend.

The molded product of the present invention is of double-layered structure of arc extinguishing insulative materials, and hence advantageously includes the arc receiving layer exhibiting a further enhanced arc extinguishing property as compared to the case of forming insulator (2) into a single layer of the arc extinguishing insulative material composition (I), (II) or (III), and a layer laminated on the arc receiving layer (hereinafter sometimes referred to as "base layer") exhibiting excellent strength against pressure, consumption-by-arc resistance and heat resistance.

The arc receiving layer provides for an enhanced arc extinguishing property. The same description as with the foregoing arc extinguishing insulative material composition (I) is adapted to the purposes of the fillers for use in the arc receiving layer containing the filler (hereinafter sometimes referred to as "arc receiving layer A"), particulars and content of compounds of group 1A metals of the periodic table, and purposes, particulars and preferable examples of the glass fiber material, inorganic mineral and ceramic fiber material, and is therefore omitted herein.

Further, the same description as with the arc extinguishing insulative material composition (I) is incorporated into the purpose of the matrix resin, the purpose, particulars, examples and preferable examples, together with reasons therefor, of each polymer, and the particulars and contents of the accessary constituents of the matrix resin, and is therefore omitted herein.

It is to be noted that where the matrix resin comprises nylon 46 or nylon 66, the molded product is less carbonized at its surface, since each of these thermoplastic resins is free of any aromatic ring in the chemical formula thereof and hence imparts the molded product with a further enhanced arc extinguishing property.

The arc receiving layer A contains not more than 20% of the foregoing specified filler in the matrix resin. The content of the filler not more than 20% provides an arc extinguishing device with a satisfactory arc extinguishing property for a switch of high current. The content of the filler is preferably within the range of 5 to 20% for assuring the consumption-by-arc resistance and arc extinguishing property of the molded product.

Another embodiment of the arc receiving layer in the arc extinguishing insulative molded product (I) is an arc receiving layer B which is non-reinforced and comprises not any filler but a matrix resin.

The same description as with the arc receiving layer A is incorporated into the purpose of the matrix resin forming the arc receiving layer B, the purpose, particulars, examples and preferable examples with reasons therefor of each thermoplastic resin, the particulars and contents of the accessary constituents of the matrix resin, and the like, and is therefore omitted herein.

As the current to be interrupted by the arc extinguishing device grows higher, the arc receiving layer B becomes more preferable than the arc receiving layer A in view of its arc extinguishing property.

Reference is then made to the base layer. The base layer plays the role of improving the consumption-by-arc resistance and strength against pressure of the molded product.

The glass fiber, inorganic mineral or ceramic fiber contained in the base layer serves to improve the consumption-by-arc resistance and strength against pressure of the molded product. The total amount of compounds of group 1A metals of the periodic table contained in the filler is not particularly limited. This is because the base layer is so positioned as not to be exposed to arc and hence is not particularly required to be enhanced in arc extinguishing property. Nevertheless, the total amount of compounds of group 1A metals of the periodic table contained in such a filler as glass fiber is preferably not more than 1% in view of the safety of the arc extinguishing device.

The same description as with the arc extinguishing insulative material composition (I) is incorporated into other descriptions on the glass fiber, inorganic mineral or ceramic fiber contained in the base layer, i.e., the purpose, particulars and preferable examples of each filler, the purpose of the matrix resin, the purpose, particulars, examples and preferable examples with reasons therefor of each polymer, and the particulars and contents of the accessary constituents of the matrix resin, and is therefore omitted herein. It should be noted that the base layer can also be suitably used, which contains a filler containing more than 1% of compounds of group 1A metals of the periodic table such as clay, kaolin or mica.

The matrix resin of the base layer preferably comprises nylon 46 or nylon 66 in view of the safety of the arc extinguishing device.

Further, the base layer preferably comprises a resin of the same type as used in the arc receiving layer for assuring good adhesion therebetween, since the arc receiving layer overlies the base layer.

The base layer contains 20 to 60% of the foregoing filler. If the content of the filler is less than 20%, insufficient consumption-by-arc resistance and strength against pressure are likely to result, while if it is more than 65%, the moldability of the base layer is likely to degrade. The content of the filler is preferably within the range of 35 to 50% in view of the consumption-by-arc resistance, strength against pressure and moldability of the base layer.

The arc extinguishing insulative molded product (I) of the present invention is a laminate of the arc receiving layer and the base layer. The shape, structure and size of the molded product vary depending on the current interrupting mechanism of a switch including the arc extinguishing device. Nevertheless, exemplary molded products (I) are as shown in FIGS. 1-8 to 1-10. The molded product (I) is preferably prepared by an injection molding method, especially a two color injection molding method.

Description of the arc extinguishing insulative molded product (II) according to the present invention follows.

The arc extinguishing insulative molded product (II) comprises:

an arc receiving layer made of an arc extinguishing insulative material composition comprising not more than 20% of at least one filler selected from the group consisting of a glass fiber containing not greater than 1% of compounds of group 1A metals of the periodic table in total, an inorganic mineral containing not more than 1% of compounds of group 1A metals of the periodic table in total and a ceramic fiber containing not greater than 1% of compounds of group 1A metals of the periodic table in total, and a matrix resin containing as a main component at least one member selected from the group consisting of a polyolefin, an olefin copolymer, a polyamide, a polyamide polymer blend, a polyacetal and a polyacetal polymer blend, or made of a non-reinforced, arc extinguishing insulative material composition comprising as a main component at least one member selected from the group consisting of a polyolefin, an olefin copolymer, a polyamide, a polyamide polymer blend, a polyacetal and a polyacetal polymer blend; and a base layer underlying the arc receiving layer and made of an arc extinguishing insulative material composition comprising 20 to 65% of at least one filler selected from the group consisting of a glass fiber, an inorganic mineral and a ceramic fiber, and a matrix resin containing, as a principal component thereof, a thermoplastic resin or a thermosetting resin.

The arc extinguishing insulative molded product (II) is different from the molded product (I) in that the base layer thereof comprises the arc extinguishing insulative material composition containing the matrix resin of which the principal component is a thermoplastic resin or a thermosetting resin. Therefore, the molded product (II) is further improved in consumption-by-arc resistance and strength against pressure than the molded product (I).

The thermoplastic resin or thermosetting resin is used to improve the consumption-by-arc resistance and strength against pressure of the molded product (II). Examples of the thermoplastic or thermosetting resins include nylon 6T, nylon MXD, polyethylene terephthalate, polybutylene terephthalate, modified polyphenylene oxide, polyphenylene sulfide, polysulfone, polyether sulfone, polyether ketone. These resins may be used either alone or in combination. Preferable among those are nylon 6T, nylon MXD, polyethylene terephthalate and polybutylene terephthalate in view of their moldability and economical feature.

The same description as with the arc extinguishing insulative molded product (I) is incorporated into the particulars of the molded product (II) such as the arc receiving layer A containing filler or the arc receiving layer B free of filler, the materials, shape and structure of the base layer thereof, and the shape of and preparation method for the molded product (II), and is therefore omitted herein.

Preferably the arc extinguishing insulative molded product (I) or (II) further comprises the aforementioned free carbon inhibitor, since the inhibitor inhibits the generation of free carbon and thereby enhances the arc extinguishing property of the molded product.

Examples and preferable examples of the free carbon inhibitor are the same as in the arc extinguishing insulative material composition (I) and, therefore, description thereon is herein omitted.

The free carbon inhibitor is required to be contained in the arc receiving layer, since free carbon is generated when the arc receiving layer is exposed to arc. Examples of such free carbon inhibitors include aluminum hydroxide, magnesium hydroxide, antimony tetroxide and antimony pentoxide. Among those, magnesium hydroxide is preferred, since it can easily be incorporated into the arc receiving layer.

The content of the free carbon inhibitor in each of the arc receiving layers A and B is preferably not more than 20%. If the content exceeds 20%, the arc receiving layer particularly including a combination of a nylon and magnesium hydroxide is likely to show a degraded strength against pressure.

The following are generally preferable examples of the arc extinguishing insulative molded products (I) and (II) of the present invention.

An arc extinguishing insulative molded product comprising:

an arc receiving layer made of a matrix resin containing, as a principal component thereof, nylon 46 or nylon 66, which contains 5 to 10% of an aluminum borate whisker or aluminum silicate fiber containing not more than 1% of compounds of group 1A metals of the periodic table in total, and a base layer made of a matrix resin containing, as a principal component thereof, nylon 46 or nylon 66, which contains 35 to 50% of an aluminum borate whisker or an aluminum silicate fiber.

Such an insulative molded product is preferable in view of its heat resistance, arc extinguishing property and strength against pressure.

An arc extinguishing insulative molded product comprising:

an arc receiving layer made of a matrix resin containing, as a principal component thereof, nylon 46 or nylon 66, which contains 5 to 10% of an aluminum borate whisker or aluminum silicate fiber containing not more than 1% of compounds of group 1A metals of the periodic table in total, and a base layer made of a matrix resin containing, as a principal component thereof, nylon 46 or nylon 66, which contains 35 to 50% of a glass fiber material of E glass containing not greater than 1% of compounds of group 1A metals of the periodic table in total.

Such an insulative molded product is preferable in view of its heat resistance, arc extinguishing property and strength against pressure.

An arc extinguishing insulative molded product comprising:

an arc receiving layer made of a matrix resin containing, as a principal component thereof, nylon 46 or nylon 66, which contains 5 to 10% of an aluminum borate whisker or aluminum silicate fiber containing not more than 1% of compounds of group 1A metals of the periodic table in total, and a base layer made of a matrix resin containing, as a principal component thereof, nylon MDX, nylon 6T, polyethylene terephthalate or polybutylene terephthalate, which contains 35 to 50% of a glass fiber of E glass containing not greater than 1% of compounds of group 1A metals of the periodic table in total.

Such an insulative molded product is preferable in view of its arc extinguishing property, consumption-by-arc resistance and strength against pressure.

An arc extinguishing insulative molded product comprising:

a non-reinforced, arc receiving layer made of a resin containing, as a principal component thereof, nylon 46 or nylon 66, and a base layer made of a matrix resin containing, as a principal component thereof, nylon 46 or nylon 66, which contains 35 to 50% of an aluminum borate whisker or an aluminum silicate fiber.

Such an insulative molded product is preferable in view of its heat resistance, arc extinguishing property, consumption-by-arc resistance and strength against pressure.

These synthetically preferable arc extinguishing insulative molded products (I) and (II) each preferably further contains 5 to 20% of magnesium hydroxide in the arc receiving layer thereof from the viewpoint of an improved effect of inhibiting the generation of free carbon, hence of inhibiting occurrence of insulation failure.

Next, reference is made to the arc extinguishing device according to the present invention.

The arc extinguishing device of the present invention is characterized by using any of the aforementioned arc extinguishing insulative material compositions (I) to (III) and/or arc extinguishing insulative molded product. Examples of the arc extinguishing devices include the arc extinguishing devices (I) to (III). The arc extinguishing device (I) comprises the aforementioned insulator (1) provided to cover a contact section excepting the contact surfaces thereof, the insulator (I) comprising any one of the arc extinguishing insulative material compositions according to the embodiments 1-1 to 1-18. The arc extinguishing device (II) comprises the insulator (2) disposed on both sides with respect to the plane including the locus of an opening or closing movement of contacts or around a contact section, the insulator (2) comprising any one of the arc extinguishing insulative material compositions and the arc extinguishing insulative molded products according to the embodiments 1-1 to 1-27. The arc extinguishing device (III) comprises the insulator (1) provided to cover a contact section excepting the contact surfaces thereof, and the insulator (2) disposed on both sides with respect to the plane including the locus of an opening or closing movement of contacts or around the contact section, the insulator (1) comprising any one of the arc extinguishing insulative material compositions according to the embodiments 1-1 to 1-18, the insulator (2) comprising any one of the arc extinguishing insulative material compositions and the arc extinguishing insulative molded products according to the embodiments 1-1 to 1-27.

In the above arc extinguishing devices, the insulator (2) of the arc extinguishing devices (II) and (III) is preferably disposed in a U-shaped fashion as surrounding the plane including the locus of an opening or closing movement of the contacts on both sides thereof and as closing in the arching direction of arc, as shown in, for example, FIGS. 1-3, 1-4 and 1-6 to 1-10. The arc extinguishing devices (II) and (III) each comprising such insulator (2) are preferable, since they advantageously provide the effects of the present invention Hereinafter, the arc extinguishing device, arc extinguishing insulative material composition and arc extinguishing insulative molded product in use mode according to the present invention will be described in detail with reference to the drawings.

Figures 1, 2:
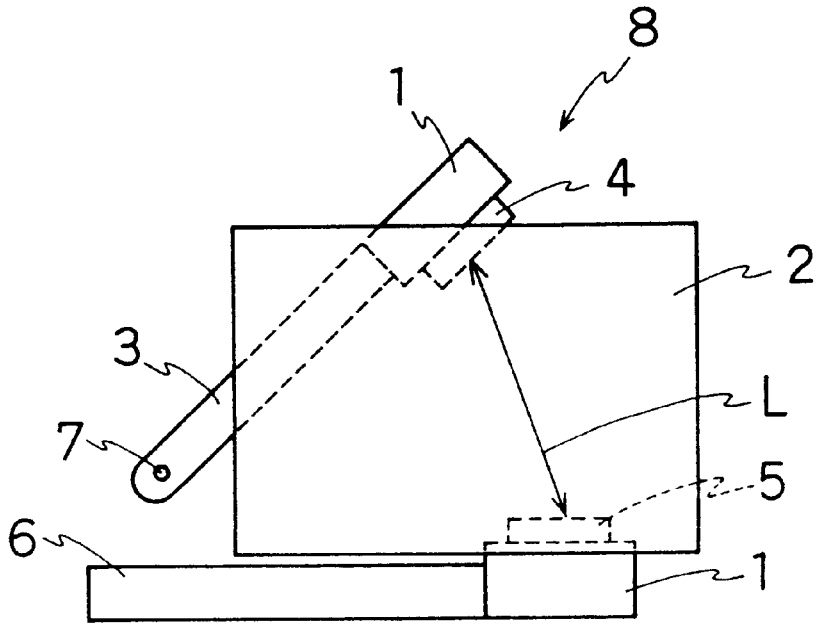
Figures 1, 2, 3:
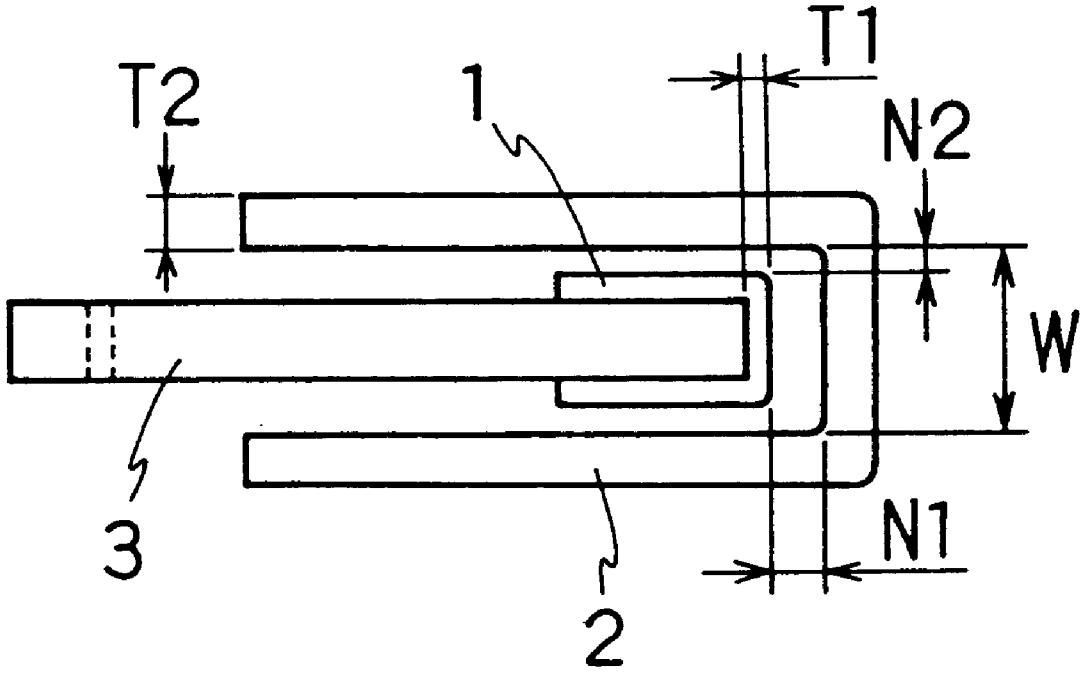

FIG. 1-1 is an explanatory side view of one example of a switch in opened state including the arc extinguishing device (III) comprising the arc extinguishing insulative material composition according to the present invention. FIG. 1-2 is an explanatory side view of the switch in closed state including the arc extinguishing device (III). FIG. 1-3 is an explanatory plan view of the switch in closed state including the arc extinguishing device (III).

In FIGS. 1-1 to 1-3, the switch comprises a moving contact element 3 adapted to pivot about a pivoting center 7, a moving contact 4 disposed on the side opposite to the pivoting center 7, a fixed contact element 6 having a fixed contact 5 in one end portion thereof at a position corresponding to the moving contact 4, an insulator (1) 1 having a thickness T1 and disposed as covering the periphery of each of the moving contact 4 and fixed contact 5, and an insulator (2) 2 having a thickness T2 and a width W and disposed as encompassing the moving contact 4 and fixed contact 5.

The dimensions of the moving contact element 3 are, for example, 3 mm wide×5 mm thick×25 mm long, and those of the moving contact 4 are, for example, 3 mm square×2 mm thick. The insulator (1) has, for example, a thickness T1 of 0.8 to 1.0 mm, a face including the corresponding contact and having an area of 5 mm square (including 3 mm square contact area), and a length perpendicular to the 5 mm square face of 5.8 to 6.0 mm. The dimensions of the fixed contact element 6 are, for example, 3 mm wide×5 mm thick×25 mm long, and those of the fixed contact 5 are, for example, 3 mm square×2 mm thick.

The dimensions of the insulator (2) are 0.8 to 1.2 mm in T2, 8 to 12 mm in W, and 10 to 15 mm in height, preferably 0.8 to 1.0 mm in T2 and 8 to 10 mm in W. Where the insulator (2) is of double-layered structure, T2 is 1.5 to 2.0 mm, the thickness of the arc receiving layer is 0.5 to 1.0 mm, and the height is 10 to 15 mm.

The distance N1 between the end edge of the fixed contact and the insulator (2) is 2 to 8 mm, preferably 3 to 5 mm, and the distance N2 between the lateral side of the fixed contact and the insulator (2) is 2 to 5 mm, preferably 3 to 4 mm.

FIG. 1-4 is an explanatory plan view of a switch in closed state provided with the arc extinguishing device (III) including insulator (2) of double-layered structure.

FIG. 1-15 is an explanatory plan view of a switch in closed state including a conventional arc extinguishing device.

As is apparent from FIGS. 1-3, 1-4 and 1-15, the distance N1 between the end edge of the fixed contact and the insulator (2) and the distance N2 between the lateral side of the fixed contact and the insulator (2) in the arc extinguishing device of the present invention are both smaller that those in the conventional arc extinguishing device.

The arc extinguishing device of the invention is thus miniaturized because the arc extinguishing insulative material composition or arc extinguishing insulative molded product used in the insulators (1) and (2) is significantly improved in the above-mentioned performances.

In the arc extinguishing device (III), the insulator (1) comprises the arc extinguishing insulative material composition according to any one of the embodiments 1-1 to 1-18, which are described earlier, and hence the description on which is herein omitted. Of such insulative material compositions for the insulator (1) of the arc extinguishing device (III), those according to the embodiments 1-8 and 1-9 are preferable in view of the heat resistance, consumption-by-arc resistance, strength against strength against pressure and arc extinguishing property thereof. Such preferable compositions each comprise the constitution according to any one of the embodiments 1-1, 1-2, 1-3 and 1-6 which is featured in that the polyamide, for example, is nylon 6T and the content of the at least one filler selected from the group consisting of a glass fiber containing not more than 1% by weight of compounds of group 1A metals of the periodic table in total, an inorganic mineral containing not more than 1% by weight of compounds of group 1A metals of the periodic table in total and a ceramic fiber containing not more than 1% by weight of compounds of group 1A metals of the periodic table in total is 10 to 55%, preferably 40 to 55%.

In the arc extinguishing device (III), the insulator (2) comprises the arc extinguishing insulative material composition or arc extinguishing insulative molded product according to any one of the embodiments 1-1 to 1-27, which are described earlier, and hence the description on which is herein omitted. Of such insulative material compositions for the insulator (2) of the arc extinguishing device (III), those according to the embodiments 1-8 and 1-9 are preferable in view of the heat resistance, consumption-by-arc resistance, strength against pressure and arc extinguishing property. Such preferable compositions each comprise the constitution according to any one of the embodiments 1-1, 1-2, 1-3 and 1-6 which is featured in that the polyamide, for example, is nylon 46 or nylon 66 and the content of the at least one filler selected from the group consisting of a glass fiber containing not more than 1% by weight of compounds of group 1A metals of the periodic table in total, an inorganic mineral containing not more than 1% by weight of compounds of group 1A metals of the periodic table in total and a ceramic fiber containing not more than 1% by weight of compounds of group 1A metals of the periodic table in total, is 10 to 55%, preferably 30 to 40%.

Of the arc extinguishing insulative molded products for the insulator (2) of the arc extinguishing device (III), those according to the embodiments 1-22 to 1-24 are preferable in view of the arc extinguishing property, strength against pressure and consumption-by-arc resistance thereof. Such preferable molded products each comprise an arc receiving layer made of an arc extinguishing insulative material composition comprising not more than 20% of at least one filler selected from the group consisting of a glass fiber containing not greater than 1% of compounds of group 1A metals of the periodic table in total, calcium carbonate, wollastonite or magnesium silicate hydrate containing not more than 1% of compounds of group 1A metals of the periodic table in total, and an aluminum silicate fiber, aluminum borate whisker or alumina whisker containing not more than 1% of compounds of group 1A metals of the periodic table in total, and a matrix resin containing, as a principal component thereof, a polyamide such as nylon 46 or nylon 66, or made of a non-reinforced, arc extinguishing insulative material composition comprising, as a principal component thereof, a polyamide such as nylon 46 or nylon 66; and a base layer underlying the arc receiving layer and made of an arc extinguishing insulative material composition comprising 20 to 65% of at least one filler selected from the group consisting of a glass fiber containing not more than 1% of compounds of group 1A metals of the periodic table in total, calcium carbonate, wollastonite or magnesium silicate hydrate containing not more than 1% of compounds of group 1A metals of the periodic table in total and an aluminum silicate fiber, aluminum borate whisker or alumina whisker containing not more than 1% of compounds of group 1A metals of the periodic table in total, and a matrix resin containing as a main component at least one member selected from the group consisting of a polyolefin, an olefin copolymer, a polyamide such as nylon 46 or nylon 66, a polyamide polymer blend, a polyacetal, a polyacetal polymer blend, and a thermoplastic or thermosetting resin such as nylon 6T, nylon MXD6, polyethylene terephthalate or polybutylene terephthalate.

Other embodiments of the arc extinguishing device according to the present invention include the arc extinguishing device (I) comprising only insulator (1) as shown in FIG. 1-11, and the arc extinguishing device (II) comprising only insulator (2) as shown in FIGS. 1-12 and 1-13.

The arc extinguishing insulative material composition according to each of the inventions relating to the embodiments 1-1 to 1-13 comprises at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total, and a matrix resin containing as a principal component at least one member selected from the group consisting of a polyolefin, an olefin copolymer, a polyamide, a polyamide polymer blend, a polyacetal and a polyacetal polymer blend. The insulative material composition of such constitution enjoys improved arc extinguishing property, strength against pressure and consumption-by-arc resistance. Further, since the principal component of the matrix resin is a thermoplastic resin, the insulative material composition requires a relatively short molding time as compared to an insulative material composition containing a thermosetting resin requiring a setting time in molding.

The arc extinguishing insulative material composition according to each of the inventions directing to the embodiments 1-2 and 1-3 contains calcium carbonate, wollastonite or magnesium silicate hydrate as the inorganic mineral, or an aluminum silicate fiber, aluminum borate whisker or alumina whisker as the ceramic fiber material. Such insulative material composition has an enhanced arc extinguishing property.

The arc extinguishing insulative material composition according to the invention directing to the embodiment 1-4 contains polypropylene or polymethylpentene as the polyolefin. Since polypropylene or polymethylpentene is of a small specific gravity, the arc extinguishing insulative material composition is of a relatively small weight. Polymethylpentene, in particular, is a crystalline resin having a melting point of 240° C. and hence imparts the insulator composition with a high heat resistance.

The arc extinguishing insulative material composition according to the invention directing to the embodiment 1-5 contains an ethylene-vinyl alcohol copolymer having a high strength as the olefin copolymer. Hence, the insulative material composition enjoys a further improved strength against pressure.

The arc extinguishing insulative material composition according to the invention directing to the embodiment 1-6 contains, as the polyamide polymer blend, a combination of a polyamide and a polyolefin, a combination of a polyamide and a thermoplastic elastomer or a combination of a polyamide and a rubber. The insulative material composition of such constitution has an improved impact resistance and hence exhibits a further improved strength against pressure.

The arc extinguishing insulative material composition according to the invention directing to the embodiment 1-7 contains, as the polyamide, nylon 6T, nylon 46 or nylon 66 each of which is a crystalline polyamide having a high melting point. Accordingly, the insulative material composition has a high heat distortion temperature and hence enjoys a further improved heat resistance.

The arc extinguishing insulative material composition according to each of the inventions directing to the embodiments 1-8 and 1-9 contains, as the polyamide, nylon 6T which is a crystalline polyamide having a high melting point. Accordingly, the insulative material composition has a high heat distortion temperature and hence enjoys a further improved resistance. The insulative material composition further contains 10 to 55%, more preferably 40 to 55%, of at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber material containing not more than 1% of compounds of group 1A metals of the periodic table in total. This allows the insulative material composition to exhibit further improved consumption-by-arc resistance and strength against pressure.

The arc extinguishing insulative material composition according to each of the inventions directing to the embodiments 1-10 and 1-11 contains, as the polyamide, nylon 46 or nylon 66 each of which is a crystalline polyamide having a high melting point. Accordingly, the insulative material composition has a higher heat distortion temperature and hence enjoys a further improved heat resistance. Also, this insulative material composition contains 10 to 55%, preferably 30 to 40%, of at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total. This allows the insulative material composition to exhibit further improved consumption-by-arc resistance and strength against pressure. Still further, since nylon 46 and nylon 66 are each free of any aromatic ring in the chemical formula thereof, the insulative material composition of these embodiments is less subject to surface carbonization by arc and hence enjoys a further enhanced arc extinguishing property.

The arc extinguishing insulative material composition according to the invention directing to the embodiment 1-12 contains a matrix resin of which the principal component is a polyacetal polymer blend comprising a combination of a polyacetal and a plastic which is incompatible with the polyacetal and has a higher melting point than the polyacetal. Where an insulative material of the insulative material composition has an arc receiving surface formed of, for example, a polyacetal rich layer, the insulative material exhibits an enhanced arc extinguishing property by virtue of the gas to be generated from the polyacetal by arc. Further, the insulative material composition can have a higher heat resistance than the polyacetal depending on the material combined with the polyacetal in the polymer blend. The insulative material composition further contains at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total. This allows the insulative material composition to exhibit improved consumption-by-arc resistance and strength against pressure.

The arc extinguishing insulative material composition according to the invention directing to the embodiment 1-13 contains a matrix resin of which the principal component is a polyacetal polymer blend comprising a combination of a polyacetal and nylon 6. Since nylon 6 is free of any aromatic ring in its chemical formula, the insulative material composition is likely to be less carbonized by arc and hence offers a further improved arc extinguishing property together with the features and effects of the embodiment 1-12.

The arc extinguishing insulative material composition according to the invention directing to the embodiment 1-14 contains, as a principal component thereof, a polyacetal polymer blend comprising a combination of a polyacetal and a thermoplastic resin which is incompatible with the polyacetal and has a higher melting point than the polyacetal. Accordingly, in case that the insulative material composition is used, for example, at an arc receiving surface to form a polyacetal rich layer, the resulting insulative material exhibits an enhanced arc extinguishing property by virtue of the gas to be generated from the polyacetal by arc. Further, the insulative material composition can have a higher heat resistance than the polyacetal depending on the material combined with the polyacetal in the polymer blend. Thus, the insulative material composition, though free of the aforementioned filler, can be used as an excellent arc extinguishing insulative material composition.

The arc extinguishing insulative material composition according to the invention directing to the embodiment 1-15 contains, as the polyacetal polymer blend, a combination of a polyacetal and nylon 6. Since nylon 6 is free of any aromatic ring in its chemical formula, the insulative material composition is likely to be less carbonized by arc and hence offers a further improved arc extinguishing property together with the features and effects of the embodiment 1-12. Thus, the insulative material composition, though free of the aforementioned filler, can be used as an excellent arc extinguishing insulative material composition.

The arc extinguishing insulative material composition according to the invention directing to the embodiment 1-16 contains, in addition to the insulative material composition according to any one the embodiments 1-1 to 1-15, a substance capable of generating $H_2O$, $O_2$ and O (atomic oxygen) by thermal decomposition. Since those gases generated by thermal decomposition act to inhibit the generation of free carbon, the insulative material composition demonstrates a further enhanced arc extinguishing property.

The arc extinguishing insulative material composition according to the invention directing to the embodiment 1-17 contains, as the substance capable of generating the foregoing gases, aluminum hydroxide, antimony tetroxide or antimony pentoxide. Any one of those compounds acts to advantageously inhibit the generation of free carbon and, hence, the insulative material composition offers a further enhanced arc extinguishing property.

The arc extinguishing insulative material composition according to the invention directing to the embodiment 1-18 contains a substance capable of generating $H_2O$, $O_2$ and O (atomic oxygen) by thermal decomposition. Since those gases generated by thermal decomposition act to inhibit the generation of free carbon, the insulative material composition containing such a substance in combination with a particular thermoplastic polymer demonstrates a further enhanced arc extinguishing property.

The arc extinguishing insulative molded product according to each of the inventions directing to the embodiments 1-19 to 1-27 is formed into a double-layered structure and hence is possible to have a layer of an excellent arc extinguishing property and a layer of excellent strength against pressure, consumption-by-arc resistance and heat resistance.

The arc extinguishing insulative molded product according to each of the inventions directing to the embodiments 1-19 to 1-21 has an arc receiving layer made of an arc extinguishing insulative material composition comprising not more than 20% of at least one filler selected from the group consisting of a glass fiber containing not more than 1% of compounds of group 1A metals of the periodic table in total, an inorganic mineral containing not more than 1% of compounds of group 1A metals of the periodic table in total and a ceramic fiber containing not more than 1% of compounds of group 1A metals of the periodic table in total, and a matrix resin containing as a principal component at least one member selected from the group consisting of a polyolefin, an olefin copolymer, a polyamide, a polyamide polymer blend, a polyacetal and a polyacetal polymer blend, or made of a non-reinforced, arc extinguishing insulative material composition comprising as a principal component at least one member selected from the group consisting of a polyolefin, an olefin copolymer, a polyamide, a polyamide polymer blend, a polyacetal and a polyacetal polymer blend. The arc extinguishing insulative molded product of this constitution offers an improved arc extinguishing property.

The arc extinguishing insulative molded product according to the invention directing to the embodiment 1-19 has a base layer underlying an arc receiving layer, the base layer comprising 20 to 65% of at least one filler selected from the group consisting of a glass fiber, an inorganic mineral and a ceramic fiber, and a matrix resin containing, as the principal component thereof, a polyolefin, an olefin copolymer, a polyamide, a polyamide polymer blend, a polyacetal and a polyacetal polymer blend. The arc extinguishing insulative molded product of such constitution offers improved strength against pressure and consumption-by-arc resistance.

The arc extinguishing insulative molded product according to each of the inventions directing to the embodiments 1-20 and 1-21 has a base layer underlying an arc receiving layer, the base layer comprising 20 to 65% of at least one filler selected from the group consisting of a glass fiber, an inorganic mineral and a ceramic fiber, and a matrix resin containing, as the principal component thereof, a thermoplastic or thermosetting resin such as nylon 6T, nylon MXD6, polyethylene terephthalate or polybutylene terephthalate. The arc extinguishing insulative molded product of such constitution offers improved strength against pressure and consumption-by-arc resistance. Nylon 6T, in particular, has a higher melting point than nylon 46 and nylon 66 and hence will contribute to a further improvement in the heat resistance of the insulative molded product.

The arc extinguishing insulative molded product according to the invention directing to the embodiment 1-22 contains, as the polyamide, nylon 46 or nylon 66, each of which is free of any aromatic ring in its chemical formula The molded product is likely to be less carbonized at its surface by arc and hence offers a further enhanced arc extinguishing property.

The arc extinguishing insulative molded product according to each of the inventions directing to embodiments 1-23 to 1-25 contains calcium carbonate, wollastonite or magnesium silicate hydrate as the inorganic mineral, or an aluminum silicate fiber, aluminum borate whisker or alumina whisker as the ceramic fiber, or a glass fiber containing not more than 1% of compounds of group 1A metals of the periodic table in total as the glass fiber contained in the base layer thereof. The molded product of this constitution enjoys an enhanced arc extinguishing property.

The arc extinguishing insulative molded product according to the invention directing to the embodiment 1-26 is of substantially the same constitution as any one of the embodiments 1-19 to 1-25, but the arc receiving layer thereof further contains a substance capable of generating $H_2O$, $O_2$ and O (atomic oxygen) by thermal decomposition. Those gases generated by thermal decomposition act to inhibit the generation of free carbon and hence impart the molded product with a further enhanced arc extinguishing property.

The arc extinguishing insulative molded product according to the invention directing to the embodiment 1-27 contains, as the substance capable of generating $H_2O$, $O_2$ and O (atomic oxygen) by thermal decomposition, aluminum hydroxide, magnesium hydroxide, antimony tetroxide or antimony pentoxide. Those substances act to more advantageously inhibit the generation of free carbon and thereby impart the molded product with a further enhanced arc extinguishing property.

The arc extinguishing device according to the invention directing to the embodiment 1-28 uses the arc extinguishing insulative material composition or arc extinguishing insulative molded product according to any one of the embodiments 1-1 to 1-27. Such arc extinguishing device is possible to be miniaturized and to contribute to the enhancement in the current limiting or interrupting performance of a switch.

The arc extinguishing device according to the invention directing to the embodiment 1-29 includes insulator (1) covering the contact section generated an arc excepting the contact surfaces thereof, the insulator (1) comprising the arc extinguishing insulative composition according to any one of the embodiments 1-1 to 1-18. Such arc extinguishing device is possible to be miniaturized and to contribute to the enhancement in the current limiting or interrupting performance of a switch.

The arc extinguishing device according to the invention directing to the embodiment 1-30 includes insulator (2) disposed on both sides with respect to the plane including the locus of an opening or closing movement of the contacts or around the contact section, the insulator (2) comprising the arc extinguishing insulative material composition or arc extinguishing insulative molded product according to any one of the embodiments 1-1 to 1-27. Such arc extinguishing device is possible to be miniaturized and to contribute to the enhancement in the current limiting or interrupting performance of a switch.

The arc extinguishing device according to the invention directing to the embodiment 1-30 includes insulator (1) covering the contact section excepting the contact surfaces thereof, and insulator (2) disposed on both sides with respect to the plane including the locus of an opening or closing movement of the contacts or around the contact section, the insulator (1) comprising the arc extinguishing insulative material composition according to any one of the embodiments 1-1 to 1-18, and the insulator (2) comprising the arc extinguishing insulative material composition or arc extinguishing insulative molded product according to any one of the embodiments 1-1 to 1-27. Such arc extinguishing device is possible to be miniaturized and to contribute to the enhancement in the current limiting or interrupting performance of a switch.

Description will hereinafter be made on the second group of inventions included in the present invention.

The second group inventions relate to a method for insulating scattered metallic substances (which hereinafter may also be referred to as "metal particles" or "metals") generated upon the generation of an arc, a gas generating source material for use therein, and a switch employing such method. More particularly, the inventions relate to a method for insulating such scattered metal particles or the like, which is capable of preventing a decrease in the electric resistance of a switch, such as electromagnetic contactor, circuit breaker or current limiting device, which generates an arc in its arc extinguishing chamber when the contacts thereof are operated to be opened or closed; a gas generating source material for use therein; and a switch employing such method.

It has been conventionally considered that the insulation failure of a switch occurring upon the generation of an arc is caused by a decrease in the electric resistance due to carbons resulting from the decomposition of an organic substance and adhering to wall surfaces of an arc extinguishing device of the switch or to the contact section of the switch. There have been proposed methods for preventing such a decrease in the electric resistance, including a method employing an organic substance that is rich in hydrogen atom as disclosed in, for example, Japanese Unexamined Patent Publication No. 310534/1988, and a method using crystal water dissociated from alumina hydrate as disclosed in Japanese Unexamined Patent Publication No. 144811/1990. Such methods, however, pose a problem of an insufficient effect in preventing the decrease in electric resistance and a problem of cracking of an organic material occurring due to rapid expansion of the crystal water.

The inventors of the present invention made detailed analysis on the deposit adhering to wall surfaces and contact section within the arc extinguishing chamber of a switch. As a result, there was found the fact that a metal layer was formed from metals that were scattered from electrodes, contacts and other metal components in the vicinity thereof upon an open-close operation of the electrodes of the switch, and such a metal layer greatly influenced the decrease in electric resistance. Accordingly, the conventional method of inhibiting only the deposition of carbon was found to be incapable of satisfactory preventing the decrease in electric resistance.

In view of the foregoing prior art, it is an object of the present invention to provide a method for insulating metallic substances scattered upon the generation of an arc, which method is capable of sufficiently inhibiting a decrease in electric resistance attributable to a deposited metal layer formed of metallic substances scattered from the electrodes, contacts and other metal components in the vicinity thereof in a switch upon an open-close operation of the contacts of the switch.

Another object of the present invention is to provide a gas generating source material for use in the above method.

A further object of the present invention is to provide a switch employing the above method.

Thus, the second group inventions included in the present invention pertain to a method for insulating metals scattered from the electrodes, contacts and other metal components in the vicinity thereof in a switch by an arc generated between the contacts upon an open-close operation of the contacts of the electrodes of the switch, by causing a gas generating source compound to generate an insulation imparting gas capable of combining with the metals; to a gas generating source material containing the gas generating source compound for use in the method; and to a switch employing the method.

The second group inventions include the following embodiments 2-1 to 2-65.

Embodiment 2-1

A method for insulating particles of metals which generate from electrodes, respective contacts thereof and other metal components of a switch in the vicinity thereof by an arc generated upon an opening or closing operation of the contacts of the electrodes, the method comprising causing a gas generating source compound provided in the vicinity of the electrodes, the contacts and neighboring other metal components to scatteredly generate an insulation imparting gas capable of combining with the scattered particles of metals thereby insulating the scattered particles of metals.

Embodiment 2-2

The method of embodiment 2-1, wherein the gas generating source compound is capable of scatteredly generating an insulation imparting gas which is reactive with the metals.

Embodiment 2-3

The method of embodiment 2-2, wherein the gas generating source compound is a member selected from the group consisting of a metal peroxide, a metal hydroxide, a metal hydrate, a metal alkoxide hydrolysate, a metal carbonate, a metal sulfate, a metal sulfide, a metal fluoride and a fluorine-containing silicate.

Embodiment 2-4

The method of embodiment 2-3, wherein the metal hydroxide is magnesium hydroxide, and the metal carbonate is calcium carbonate or magnesium carbonate.

Embodiment 2-5

The method of embodiment 2-1, wherein the gas generating source compound is capable of scatteredly generating an insulation imparting gas which is, per se, electrically insulative.

Embodiment 2-6

The method of embodiment 2-5, wherein the gas generating source compound is a member selected from the group consisting of a metal oxide, a compound oxide and a silicate hydrate.

Embodiment 2-7

The method of embodiment 2-1, wherein the gas generating source compound is used in combination with a binder.

Embodiment 2-8

The method of embodiment 2-7, wherein the binder is an organic binder.

Embodiment 2-9

The method of embodiment 2-8, wherein the organic binder contains a thermoplastic resin as a principal component thereof.

Embodiment 2-10

The method of embodiment 2-9, wherein the thermoplastic resin is a polyolefin or an olefin copolymer.

Embodiment 2-11

The method of embodiment 2-10, wherein the polyolefin is selected from the group consisting of a polyethylene, a polypropylene and a polymethyl pentene.

Embodiment 2-12

The method of embodiment 2-10, wherein the olefin copolymer is an ethylene-vinyl alcohol copolymer.

Embodiment 2-13

The method of embodiment 2-9, wherein the thermoplastic resin is a polyamide or a polyamide polymer blend.

Embodiment 2-14

The method of embodiment 2-13, wherein the polyamide is nylon 12.

Embodiment 2-15

The method of embodiment 2-13, wherein the polyamide polymer blend is selected from the group consisting of a polymer blend of a polyamide and a polyolefin, a polymer blend of a polyamide and a thermoplastic elastomer, a polymer blend of a polyamide and a rubber, and a polymer blend of a polyamide and a thermosetting resin.

Embodiment 2-16

The method of embodiment 2-8, wherein the organic binder is an organic wax.

Embodiment 2-17

The method of embodiment 2-16, the organic wax is a paraffin wax.

Embodiment 2-18

The method of embodiment 2-8, wherein the organic binder contains a thermosetting resin as a principal component thereof.

Embodiment 2-19

The method of embodiment 2-18, wherein the thermosetting resin is a bisphenol F-type epoxy resin.

Embodiment 2-20

The method of embodiment 2-18, wherein the thermosetting resin is a biphenyl-type epoxy resin.

Embodiment 2-21

The method of any one of embodiment 2-8 to 2-20, wherein the gas generating source compound is capable of scatteredly generating $H_2O$, $O_2$, atomic oxygen, oxygen ion and oxygen plasma.

Embodiment 2-22

The method of any one of embodiment 2-8 to 2-21, wherein the gas generating source compound is selected from the group consisting of a hydroxide, a hydrate and an oxide.

Embodiment 2-23

The method of embodiment 2-22, wherein the hydroxide is magnesium hydroxide.

Embodiment 2-24

The method of any one of embodiments 2-1 to 2-6 and 2-8 to 2-23, wherein the gas generating source compound is in the form of a powder or a molded product, or is supported by a carrier in a supported material.

Embodiment 2-25

The method of embodiment 2-24, wherein the supported material is such that the gas generating source compound is supported by the carrier through a medium.

Embodiment 2-26

The method of embodiment 2-25, wherein the medium is a fat or oil.

Embodiment 2-27

The method of embodiment 2-25, wherein the medium is an organic solvent.

Embodiment 2-28

The method of embodiment 2-24 or 2-25, wherein the carrier is a metal material having a high melting point or a porous material having a high melting point.

Embodiment 2-29

The method of embodiment 2-24 or 2-25, wherein the carrier is a laminated material.

Embodiment 2-30

The method of any one of embodiments 2-8 to 2-23, wherein the organic binder is combined with a reinforcing filler.

Embodiment 2-31

The method of embodiment 2-30, wherein the reinforcing filler is a glass fiber material.

Embodiment 2-32

A gas generating source material for use in a switch comprising a gas generating source compound capable of scatteredly generating an insulation imparting gas combinable with particles of metals generated from electrodes, respective contacts thereof and other metal components of the switch in the vicinity thereof by an arc generated when the contacts are operated to be opened or closed.

Embodiment 2-33

The gas generating source material of embodiment 2-32, wherein the insulation imparting gas generated from the gas generating source compound is reactive with the metals.

Embodiment 2-34

The gas generating source material of embodiment 2-33, wherein the gas generating source compound is selected from the group consisting of a metal peroxide, a metal hydroxide, a metal hydrate, a metal alkoxide hydrolysate, a metal carbonate, a metal sulfate, a metal sulfide, a metal fluoride and a fluorine-containing silicate.

Embodiment 2-35

The gas generating source material of embodiment 2-34, the metal hydroxide is magnesium hydroxide, and the metal carbonate is calcium carbonate or magnesium carbonate.

Embodiment 2-36

The gas generating source material of embodiment 2-32, wherein the insulation imparting gas generated from the gas generating source compound is, per se, electrically insulative.

Embodiment 2-37

The gas generating source material of embodiment 2-36, wherein the gas generating source compound is selected from the group consisting of a metal oxide, a compound oxide and a silicate hydrate.

Embodiment 2-38

The gas generating source material of embodiment 2-32, further comprising a binder in combination with the gas generating source compound.

Embodiment 2-39

The gas generating source material of embodiment 2-38, wherein the binder is an organic binder.

Embodiment 2-40

The gas generating source material of embodiment 2-39, wherein the organic binder contains a thermoplastic resin as a principal component thereof.

Embodiment 2-41

The gas generating source material of embodiment 2-40, wherein the thermoplastic resin is a polyolefin or an olefin copolymer.

Embodiment 2-42

The gas generating source material of embodiment 2-41, wherein the polyolefin is selected from the group consisting of a polyethylene, a polypropylene and a polymethyl pentene.

Embodiment 2-43

The gas generating source material of embodiment 2-41, wherein the olefin copolymer is an ethylene-vinyl alcohol copolymer.

Embodiment 2-44

The gas generating source material of embodiment 2-40, wherein the thermoplastic resin is a polyamide or a polyamide polymer blend.

Embodiment 2-45

The gas generating source material of embodiment 2-44, wherein the polyamide is nylon 12.

Embodiment 2-46

The gas generating source material of embodiment 2-44, wherein the polyamide polymer blend is selected from the group consisting of a polymer blend of a polyamide and a polyolefin, a polymer blend of a polyamide and a thermoplastic elastomer, a polymer blend of a polyamide and a rubber, and a polymer blend of a polyamide and a thermosetting resin.

Embodiment 2-47

The gas generating source material of embodiment 2-39, wherein the organic binder is an organic wax.

Embodiment 2-48

The gas generating source material of embodiment 2-47, wherein the organic wax is a paraffin wax.

Embodiment 2-49

The gas generating source material of embodiment 2-39, wherein the organic binder contains a thermosetting resin as a principal component thereof.

Embodiment 2-50

The gas generating source material of embodiment 2-49, wherein the thermosetting resin is a bisphenol F-type epoxy resin.

Embodiment 2-51

The gas generating source material of embodiment 2-49, wherein the thermosetting resin is a biphenyl-type epoxy resin.

Embodiment 2-52

The gas generating source material of any one of embodiments 2-39 to 2-51, the gas generating source compound is capable of generating $H_2O$, $O_2$, atomic oxygen, oxygen ion and oxygen plasma as the insulation imparting gas.

Embodiment 2-53

The gas generating source material of any one of embodiments 2-39 to 2-52, wherein the gas generating source compound is selected from the group consisting of a hydroxide, a hydrate and an oxide.

Embodiment 2-54

The gas generating source material of embodiment 2-53, wherein the hydroxide is magnesium hydroxide.

Embodiment 2-55

The gas generating source material of any one of embodiments 2-32 to 2-37 and 2-39 to 2-54, which is in the form of a powder, a molded product or a supported material in which the gas generating source compound is supported by a carrier.

Embodiment 2-56

The gas generating source material of embodiment 2-55, wherein the supported material is such that the gas generating source compound is supported by the carrier through a medium.

Embodiment 2-57

The gas generating source material of embodiment 2-56, wherein the medium is a fat or oil.

Embodiment 2-58

The gas generating source material of embodiment 2-56, wherein the medium is an organic solvent.

Embodiment 2-59

The gas generating source material of embodiment 2-55 or 2-56, wherein the carrier is a metal material having a high melting point or a porous material having a high melting point.

Embodiment 2-60

The gas generating source material of embodiment 2-55 or 2-56, wherein the carrier is a laminated material.

Embodiment 2-61

The gas generating source material of any one of embodiments 2-39 to 2-54, further comprising a reinforcing filler in combination with the organic binder.

Embodiment 2-62

The gas generating source material of embodiment 2-61, wherein the reinforcing filler is a glass fiber material.

Embodiment 2-63

A switch comprising a fixed contact element having a fixed contact joined to the upper face thereof, a moving contact element having a moving contact joined to a under face thereof so as to provide electrical contact with the fixed contact, and an arc extinguishing device including a gas generating source material capable of generating an insulation imparting gas combinable with particles of metals scattered from the contact elements, contacts and other metal components in vicinity thereof by an arc which generate when the contact of the contact elements are operated to be opened or closed, the gas generating source material being provided in the vicinity of the contact elements, contacts and neighboring other metal components.

Embodiment 2-64

The switch of embodiment 2-63, wherein the gas generating source material is any one of those recited in embodiments 2-32 to 2-39 and 2-55 to 2-60.

Embodiment 2-65

The switch of embodiment 2-63, wherein the gas generating source material is any one of those recited in embodiments 2-32 to 2-62.

According to the insulating method of the present invention, when an arc is generated upon an opening or closing operation of the respective contacts of electrodes of a switch, the gas generating source compound is caused to generate an insulation imparting gas which is combinable with metal particles that are scattered from the electrodes, contacts and other metal components in the vicinity thereof by the arc, thereby insulating the scattered metal particles.

The gas generating source material for use in the method of the present invention contains the gas generating source compound which is capable of scatteredly generating an insulation imparting gas combinable with metal particles scattered from the electrodes, contacts and other metal components of a switch by an arc generated when the contacts are operated to be opened or closed, thereby insulating the scattered metal particles.

The switch of the present invention, which employs the foregoing method and material, includes such gas generating source material provided in the vicinity of the electrodes, contacts and neighboring other metal components, and therefore makes it possible to insulate scattered metal particles or the like.

The gas generating source material of the present invention comprises the aforementioned gas generating source compound or a combination of the gas generating source compound and a binder.

The gas generating source compound generates gases such as $H_2O$, $O_2$, atomic oxygen, oxygen ion and oxygen plasma when subjected to heat caused by arc.

These gases convert the metallic substances into a metal oxide or metal hydroxide so as to reduce the amount of an electroconductive substance.

The present invention uses a compound such as a hydroxide, hydrate or oxide which is easy to generate $H_2O$, $O_2$, atomic oxygen, oxygen ion and oxygen plasma when subjected to arc and, hence, a reaction for insulating the aforementioned scattered metal particles is easy to occur. Thus, it is possible to advantageously reduce the amount of an electroconductive substance.

In the present invention, the term "metallic substances", "metals" or "metal particles" as used herein is meant to include, for example, a sublimated metal vapor, molten metal droplet, metal particulate, metal ion (metal plasma), which are possible to be scattered from the electrodes, contacts and other metal components of a switch located in the vicinity thereof by an arc which generate upon an opening or closing operation of the contacts.

In the present invention, the process of insulating the aforementioned metal particles scattered from the metal components of a switch with use of the insulation imparting gas scattered from the gas generating source compound is assumed to proceed in the following manner.

First, an arc is generated between the contacts of the electrodes in an arc extinguishing chamber of a switch when the contacts are operated to be opened or closed. The arc usually generates heat of about 4000° to about 6000° C., which in turn heats up the electrodes, contacts and other metal components located in the vicinity thereof to cause them to scatter metal particles therefrom.

Subsequently, the gas generating source compound provided in the vicinity of the electrodes, contacts and other metal components is heated by the arc as well as by the scattered metal particles to scatteredly generate the insulation imparting gas.

In the present invention, the insulation imparting gas is meant by a gas which is generated from the aforementioned gas generating source compound and possesses a characteristic of combining with the metal particles so as to insulate the same.

In the present invention, the expression "the insulation imparting gas combinable with the scattered metal particles" or a like expression is meant to include the case where the insulation imparting gas reacts with the scattered metals, the case where the insulation imparting gas adheres to the surface of each metal particle, and the case where the insulation imparting gas intervenes between metal particles.

The insulation imparting gas for insulating the metal particles is roughly divided into the type which is reactive with the metals and the type which is, per se, electrically insulative.

Where there is generated the gas which is reactive with the metals, the gas reacts with the metals, and the reaction product together with the unreacted gas generating source compound is scattered and deposited around the electrodes and contacts as an insulator.

On the other hand, where there is generated the gas which is, per se, electrically insulative, such gas adheres onto the scattered metal particles to form an insulative layer on the surface of each particle, or particulates of the gas intervene between metal particles to insulate these metal particles, and the metal particles thus imparted with insulation property are deposited around the electrodes and contacts to form an insulative layer.

Thus, in either case the scattered metal particles, which have conventionally being greatly influencing a decrease in electric resistance, are insulated thereby inhibiting the decrease in electric resistance, hence the occurrence of insulation failure due to arc.

It should be noted that when the metal particles being forcibly scattered from the electrodes, contacts and other metal components by arc are insulated, the insulation imparting gas generated by arc is prevented from approaching the contacts by an expanding high pressure metal vapor, whereby an insulative layer containing metal particles is not formed on the contacts and, hence, the electroconductivity of the contacts is not affected.

As described above, gas generating source compounds for use in the compounds which include those compounds which are each adapted to generate a gas that is reactive mainly with metals and those compounds which are each adapted to generate a gas that is, per se, electrically insulative.

Preferable compounds of the former type include, for instance, a metal peroxide, a metal hydroxide, a metal hydrate, a metal alkoxide hydrolysate, a metal carbonate, a metal sulfate, a metal sulfide, a metal fluoride and a fluorine-containing silicate. These compounds offer a great insulation imparting effect.

Representative examples of the metal peroxides are calcium peroxide ($CaO_2$), barium peroxide ($BaO_2$) and magnesium peroxide ($MgO_2$).

Representative examples of the metal hydroxides are zinc hydroxide ($Zn(OH)_2$), aluminum hydroxide ($Al(OH)_3$), calcium hydroxide ($Ca(OH)_2$), barium hydroxide ($Ba(OH)_2$) and magnesium hydroxide ($Mg(OH)_2$). Aluminum hydroxide and magnesium hydroxide are preferred in view of the quantity of the gas generated by thermal decomposition. Of these, magnesium hydroxide is more preferable in view of its effect in insulating metal particles.

Representative examples of the metal hydrates are barium octohydrate ($Ba(OH)_2.8H_2O$), magnesium phosphate.octohydrate ($Mg(PO_4)_2.8H_2O$), alumina hydrate ($Al_2O_3.3H_2O$), zinc borate ($2ZnO.3B_2O_3.3.5H_2O$) and ammonium borate ($(NH_4)_2O.5B_2O_3.8H_2O$). Among these, alumina hydrate is preferred in view of its metal insulating effect.

Representative examples of the metal alkoxide hydrolysates are silicon ethoxide hydrolysate ($Si(OC_2H_5)_{4-x}(OH)_x$, where x is an integer of 1 to 3), silicon methoxide hydrolysate ($Si(OCH_3)_{4-x}(OH)_x$, where x is the same as above), barium ethoxide hydrolysate ($Ba(OC_2H_5)(OH)$), aluminum ethoxide hydrolysate ($Al(OC_2H_5)_{3-y}(OH)_y$, where y is 1 or 2), aluminum butoxide hydrolysate ($Al(OC_4H_9)_{3-y}(OH)_y$, where y is the same as above), zirconium methoxide hydrolysate ($Zr(OCH_3)_{4-x}(OH)_x$, where x is the same as above) and titanium methoxide hydrolysate ($Ti(OCH_3)_{4-x}(OH)_x$, where x is the same as above). Among these, silicon ethoxide is preferred in view of its metal insulating effect.

Representative examples of the metal carbonates are calcium carbonate ($CaCO_3$), barium carbonate ($BaCO_3$), magnesium carbonate ($MgCO_3$) and dolomite ($CaMg(CO_3)_2$). Among these, calcium carbonate and magnesium carbonate are preferred in view of their metal insulating effect.

Representative examples of the metal sulfates are aluminum sulfate ($Al_2(SO_4)_3$), calcium sulfate.dihydrate ($CaSO_4.2H_2O$) and magnesium sulfate ($MgSO_4.7H_2O$).

Representative examples of the metal sulfides are barium sulfide (BaS) and magnesium sulfide (MgS). Of these, barium sulfide is preferred in view of its metal insulating effect.

Representative examples of the metal fluorides are zinc fluoride ($ZnF_2$), iron fluoride ($FeF_2$), barium fluoride ($BaF_2$) and magnesium fluoride ($MgF_2$). Among these, zinc fluoride and magnesium fluoride are preferred in view of their metal insulating effect.

Representative examples of the fluorine-containing silicates are fluorophlogopite ($KMg_3(Si_3Al)O_{10}F_2$), fluorine-containing tetrasilicate mica ($KMg_{2.5}Si_4O_{10}F_2$) and litium taeniolite ($KLiMg_2Si_4O_{10}F_2$). Among these, fluorine-containing phlogopite is preferred in view of its metal insulating effect.

The foregoing gas generating compounds which are each adapted to generate a gas that is reactive mainly with metals can be used either alone or as mixtures thereof. Among these, particularly preferable are magnesium hydroxide, calcium carbonate and magnesium carbonate because these compounds each generate a gas exhibiting a great insulating effect and are less expensive.

Preferable gas generating compounds of the type which mainly generate an electrically insulative gas include, for instance, a metal oxide, a compound oxide and a silicate hydrate. These compounds exhibits a great insulation imparting effect.

Representative examples of the metal oxides are aluminum oxide ($Al_2O_3$), zirconium oxide ($ZrO_2$), magnesium oxide (MgO), silicon dioxide ($SiO_2$), antimony pentoxide ($Sb_2O_5$), ammonium octamolybdate ($(NH_4)_4Mo_8O_{26}$).

Representative examples of the compound oxides are zircon ($ZrO_2.SiO_2$), cordierite ($2MgO.2Al_2O_3.5SiO_2$), mullite ($3Al_2O_3.2SiO_2$) and wollastonite ($CaO.SiO_2$).

Representative examples of the silicate hydrates are muscovite ($KAl_2(Si_3Al)O_{10}(OH)_2$), kaoline ($Al_2(Si_2O_5)(OH)_4$), talc ($Mg_3(Si_4O_{10})(OH)_2$) and ASTON ($5MgO.3SiO_2.3H_2O$). Among these, ASTON is preferred in view of its metal insulating effect and mechanical strength.

These compounds of the type which generates a gas that is, per se, electrically insulative can be used either alone or as mixtures thereof.

Hydroxides, hydrates, oxides and the like have a good effect of converting the metallic substances into insulative substances. In particular, magnesium hydroxide is very easy to generate $H_2O$, $O_2$, atomic oxygen, oxygen ion and oxygen plasma by dehydration reaction owing to arc and is easy to cause a reaction to insulate metals and, hence, magnesium hydroxide is advantageous in reducing the amount of electroconductive substances.

In the present invention, the binder contributes to improvements in moldability and mechanical strength of the gas generating source material. Such binders include inorganic binders and organic binders.

The inorganic binders include, for instance, an alkali metal silicate-based binder, a phosphate-based binder, and the like.

The organic binders include, for instance, a thermoplastic resin, a thermoplastic elastomer, a thermosetting resin, a rubber, an organic wax, a polymer blend, and the like.

Examples of the thermoplastic resin are, for instance, polyolefins such as high density polyethylene, low density polyethylene, polypropylene and polymethyl pentene, of which are preferable the high density polyethylene, polypropylene and polymethyl pentene in view of their mechanical strength; olefin copolymers such as ethylene-vinyl alcohol copolymer and ethylene-vinyl acetate copolymer, of which is preferable the ethylene-vinyl alcohol copolymer in view of its mechanical strength; general purpose plastics such as polystyrene and polyvinyl chloride; and polyamides such as nylon 6, nylon 12 and nylon 66, of which are preferable nylon 6 and nylon 12 because they provide for easy filling.

Examples of the thermoplastic elastomer are, for instance, a polyolefin thermoplastic elastomer, polyurethane thermoplastic elastomer and polyamide thermoplastic elastomer, of which are preferable the polyolefin thermoplastic elastomer and polyamide thermoplastic elastomer because they provide for easy filling and a high mechanical strength.

Examples of the thermosetting resin are, for instance, a bisphenol A-type epoxy resin, bisphenol F-type epoxy resin, biphenyl epoxy resin, unsaturated polyester, melamine resin and urea resin, of which are preferable the bisphenol F-type epoxy resin, biphenyl epoxy resin and melamine resin because they provide for easy filling and great metal insulating effect.

Examples of the rubber are, for instance, an ethylene-propylene rubber, isoprene rubber and Neoprene rubber, of which are preferable the ethylene-propylene rubber because it provides for easy filling.

Examples of the organic wax are, for instance, a paraffin wax and microcrystalline wax, of which is preferable the paraffin wax because it is inexpensive and provides for easy filling.

Examples of the polymer blend are, for instance, blends of two or more polymers selected from the foregoing resins, elastomers and rubbers, specifically a blend of a polyamide and a polyolefin, that of a polyamide and a thermoplastic elastomer, that of a polyamide and a rubber, and that of a polyamide and a thermosetting resin, of which are preferable the blend of a polyamide and a polyolefin because they provide for easy filling and a high mechanical strength.

Examples of the aforementioned reinforcing filler are, for instance, a glass fiber material, glass beads and ceramic fiber material. The glass fiber is preferred from the viewpoint of its reinforcing effect and low price.

The gas generating source material of the present invention can be in any form without particular limitations, for example, in the form of powder, molded product or a supported material in which the gas generating source compound is supported by a carrier.

Where the gas generating source compound is in the form of powder, the average particle diameter thereof is not particularly limited. However, if there are taken into consideration the moldability, adhesion to the carrier, mixability in a medium to be described later, and cost, preferable particle diameter of the powder is usually about 0.3 to about 30 μm in the case of the metal peroxide, metal oxide or compound oxide, usually about 0.6 to about 40 μm in the case of the metal hydroxide, metal hydrate, metal alkoxide hydrolysate or silicate hydrate, usually about 3 to about 20 μm in the case of the metal carbonate, usually about 6 to about 40 μm in the case of the metal sulfate, usually about 0.6 to about 40 μm in the case of the metal sulfide, or usually about 0.3 to about 20 μm in the case of the metal fluoride or fluorine-containing silicate.

If the gas generating source compound in the form of powder is provided in the vicinity of the electrodes, contacts and neighboring other metal components, the amount of the powder is preferably to such an extent as to generate a sufficient amount of the insulation imparting gas to insulate the scattered metal particles, though such amount cannot be unconditionally determined because it depends on the kind of the gas generating compound, the dimensions of an arc extinguishing chamber in a switch, or a like factor. Where the arc extinguishing chamber is of the dimensions: about 20 mm long×about 50 mm wide×about 20 mm high×about 2 mm thick, the amount of the powder to be used is preferably about 0.4 g or greater.

Where the gas generating source compound is in the form of a molded product for use as the gas generating source material, the gas generating source compound in the form of, for example, powder may be molded by, for example, press molding. Although the size of such a molded product differs depending on, for example, the kind of the gas generating compound and the size of the arc extinguishing chamber in a switch and hence cannot be unconditionally determined, the size of the molded product is preferably to such an extent as to generate a sufficient amount of the insulation imparting gas to insulate the scattered metal particles.

To obtain such a molded product of the gas generating source material from the gas generating source compound using the organic binder, it is possible that 25 to 300 parts, preferably 40 to 100 parts of the binder and 100 parts of the gas generating source compound are homogeneously mixed using a roll kneader or extrusion kneader, and then the resulting mixture is molded using an injection molding machine or press molding machine. If the proportion of the binder is less than 25 parts, the kneadability and moldability of the mixture tend to degrade, whereas if it exceeds 300 parts, the metal insulating effect of the molded product tends to become poor.

The molded product should have such a strength as to withstand a rise in pressure due to generation of an arc.

Where the molded product is provided in the vicinity of the electrodes, contacts and neighboring other metal components, the surface area of the molded product is preferably about 50 $mm^2$ or larger, more preferably about 100 $mm^2$ or larger. Where the arc extinguishing chamber itself is formed of the molded product, the inner surface area of such a chamber is preferably about 50 $mm^2$ or larger, more preferably about 100 $mm^2$ or larger.

Further, where the gas generating source material is in the form of a supported material in which the gas generating source compound is supported by a carrier, there can be preferably used as the carrier a metal material having a high melting point, porous material having a high melting point and a laminated material.

Examples of such a metal material having a high melting point include tungsten, titanium alloy and stainless steel. Examples of such a porous material having a high melting point include a sintered metal, porous ceramic material, stainless steel mesh, ceramic paper, ceramic mat, ceramic blanket and electrocast metal product.

The laminated material may be either inorganic or organic, and examples of such a laminated material are FRPs such as a laminated material of glass fiber in combination with a polyester resin, melamine resin or epoxy resin, and a glass-mica laminated material.

The gas generating source compound can be supported by the carrier through such a coating method as roll coating, spray coating, flow coating or brush coating with use of, for example, a medium. Where the porous material having a high melting point is used as the carrier, the pores of the porous material may be filled with the gas generating source compound.

If the pores of the porous material are filled with the gas generating source compound, an advantage will result such that the gas generating source compound can hardly be released from the porous material by anchoring effect. If the porous material is coated with the gas generating source compound, it is preferable to coat the entire surface of the porous material with the gas generating source compound.

The aforementioned medium may be any one which allows the gas generating source compound to be dispersed therein. Examples of preferable media are fat and oil, including oils such as silicone oil and greases such as silicone grease.

Although it is impossible to unconditionally determine the size of the supported material in which the gas generating source compound is supported by the carrier because the size thereof differs depending on, for example, the kind of the gas generating source compound to be used and the size of the arc extinguishing chamber in a switch as in the aforementioned molded product, the size of such gas generating source material is usually such as to generate a sufficient amount of the insulation imparting gas to insulate the scattered metal particles.

If such a supported material is provided, for example, in the vicinity of the electrodes, contacts and other metal components, the surface area of the supported material is preferably about 50 $mm^2$ or larger, more preferably about 100 $mm^2$ or larger. Alternatively, if the arc extinguishing chamber itself is formed of the supported material, the gas generating source compound is supported by the carrier in the arc extinguishing chamber partially or entirely. The surface area in which the gas generating source compound is supported by the carrier is preferably about 50 $mm^2$ or larger, more preferably about 100 $mm^2$ or larger. Further, alternatively, it is possible to form a side plate of the arc extinguishing chamber from the gas generating source material.

It is noted that the gas generating source material may, as required, be incorporated with a binder such as methyl cellulose or polyvinyl alcohol for an improvement in moldability and mechanical strength, or a coloring agent such as glass frit seal or ceramic color, within such a proportion range as not to affect the purpose of the present invention in addition to the aforementioned binder.

The insulating method and switch employing the same according to the present invention are greatly characterized in that the gas generating source material is provided in the vicinity of the electrodes, contacts and neighboring other metal components in a switch.

The location represented by "in the vicinity of the electrodes, contacts and neighboring other metal components" is herein meant by that location which enables the insulation imparting gas generated from the gas generating material to effectively insulate the scattered metal particles generated from such metal components.

Although the location where the gas generating source material is to be provided differs depending on the kind of the gas generating source compound to be used in the gas generating source material, the contact gap distance in the arc extinguishing chamber of the switch in which an arc will generate and a like factor and hence cannot be unconditionally determined, the location is at least such as to permit the gas generating source compound to generate the insulation imparting gas by an arc. Preferably, such location is usually within the radius range from the contacts of about 5 to about 50 mm, more preferably about 5 to about 30 mm.

Specifically, the gas generating source material is preferably provided as shown in, for example, FIG. 2-1.

Figures 1, 2, 3, 4:
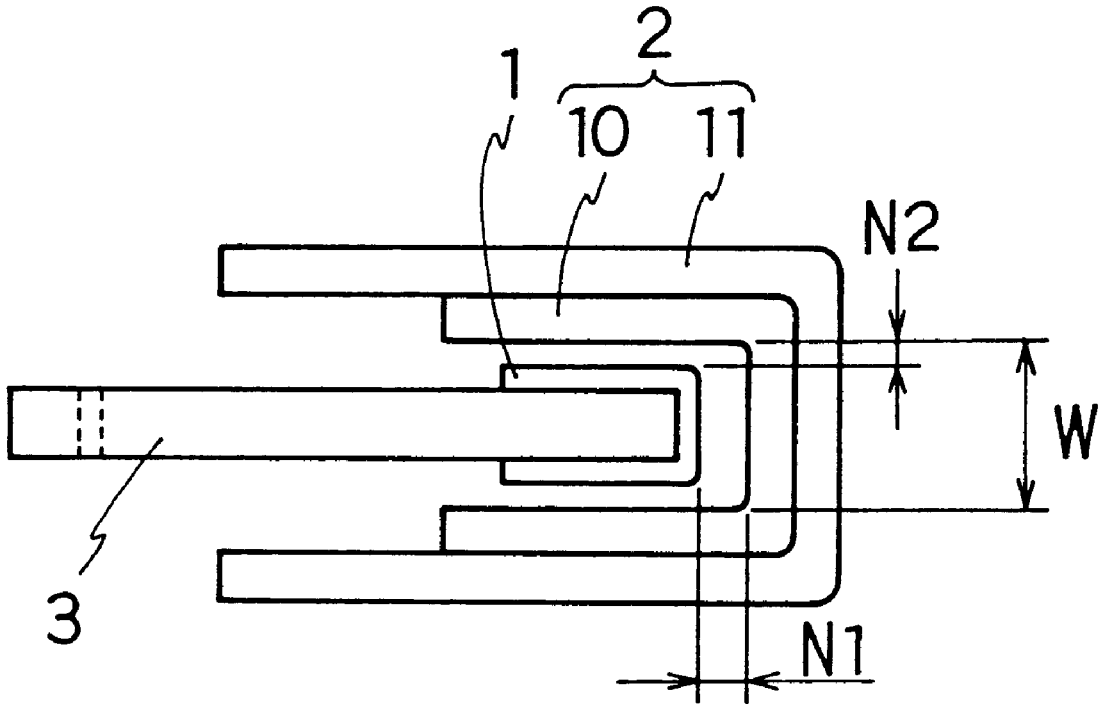
Figures 1, 2, 3, 4, 5:
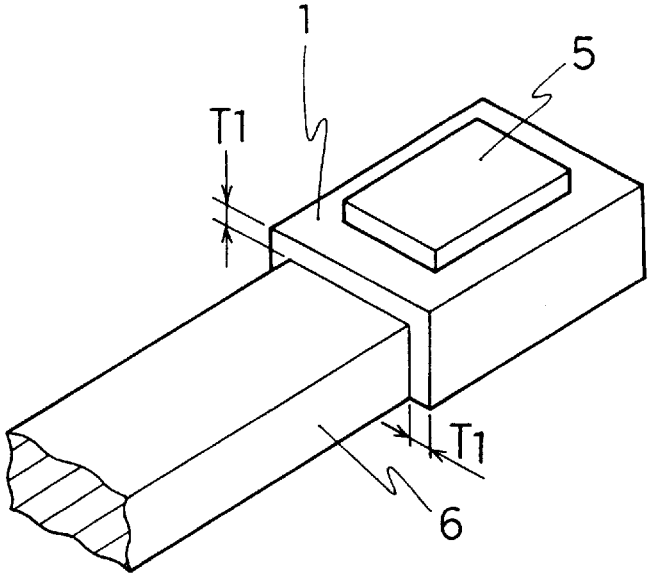
Figures 1, 2, 3, 4, 5, 6:
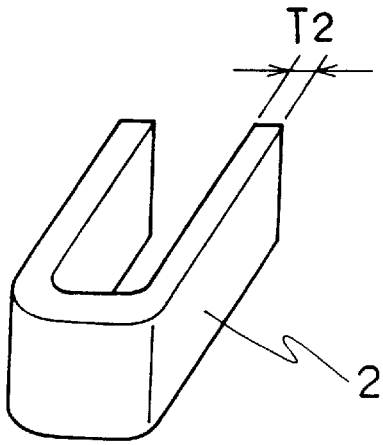
Figures 1, 2, 3, 4, 5, 6, 7:
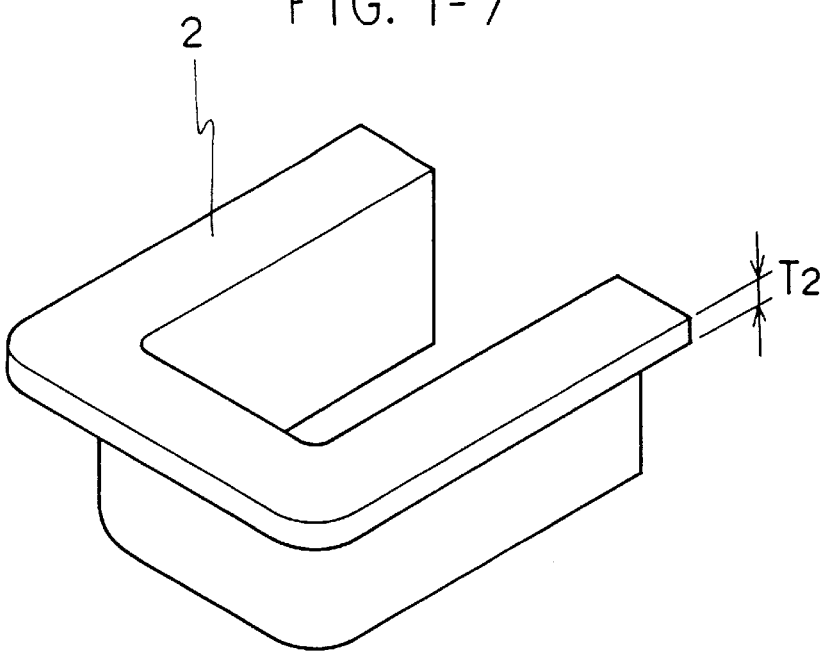
Figures 1, 2, 3, 4, 5, 6, 7, 8:
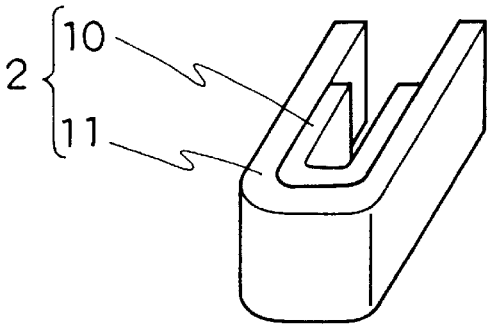
Figures 1, 2, 3, 4, 5, 6, 7, 8, 9:
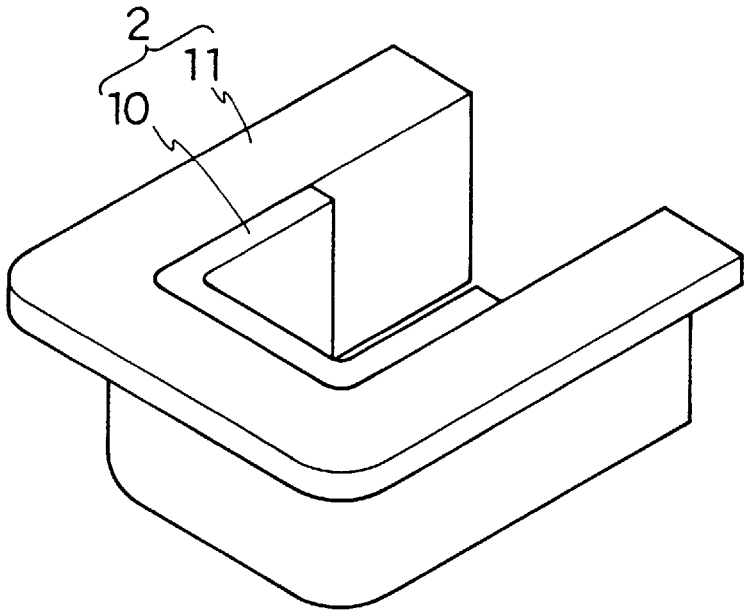
Figures 1, 2, 3, 4, 5, 6, 7, 8, 9, 10:
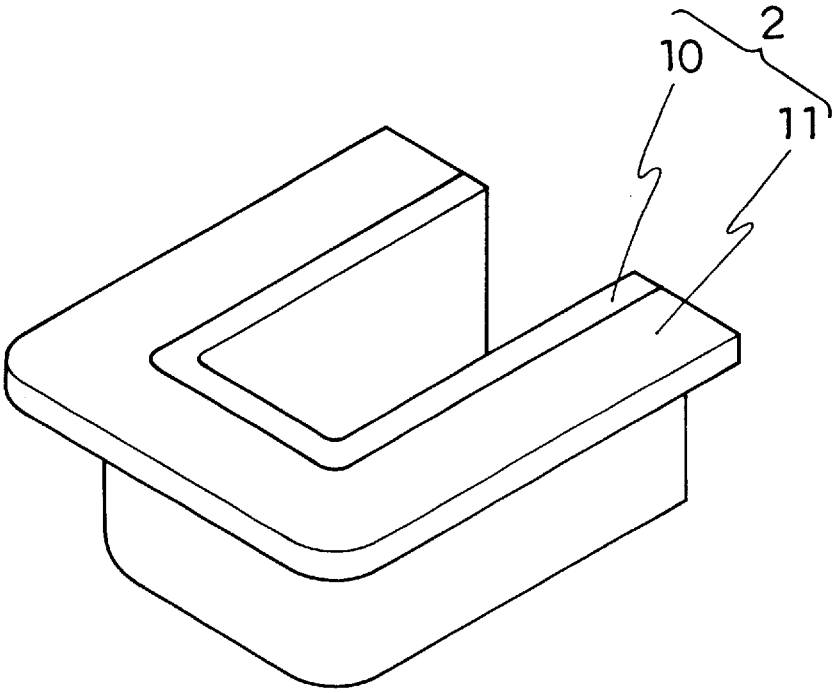
Figures 1, 2, 3, 4, 5, 6, 7, 8, 9, 10, 11:
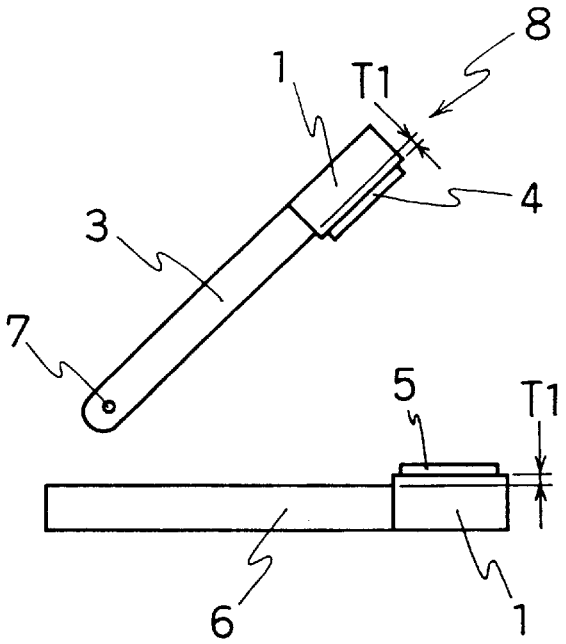
Figures 1, 2, 3, 4, 5, 6, 7, 8, 9, 10, 11, 12:
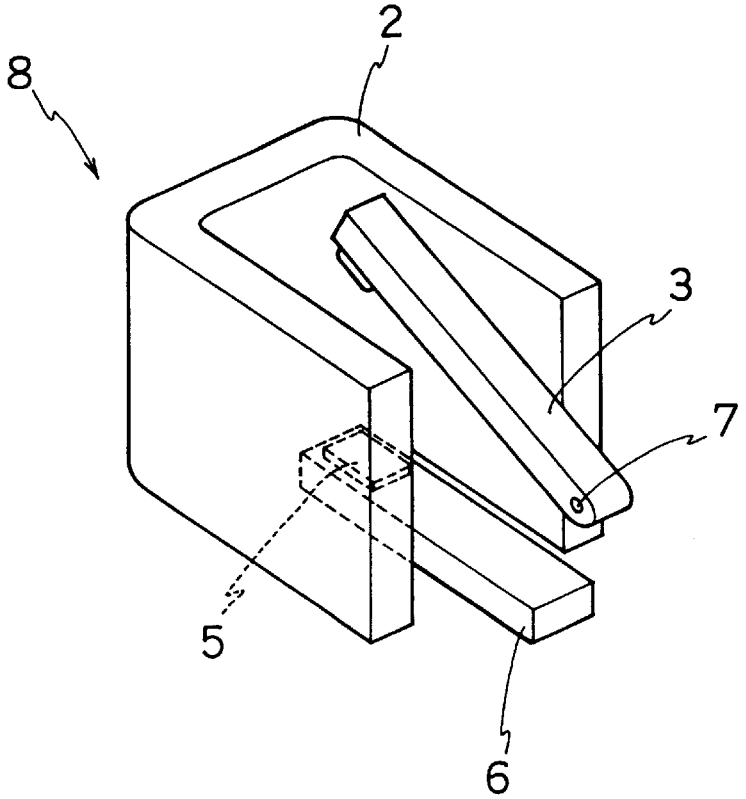
Figures 1, 2, 3, 4, 5, 6, 7, 8, 9, 10, 11, 12, 13:
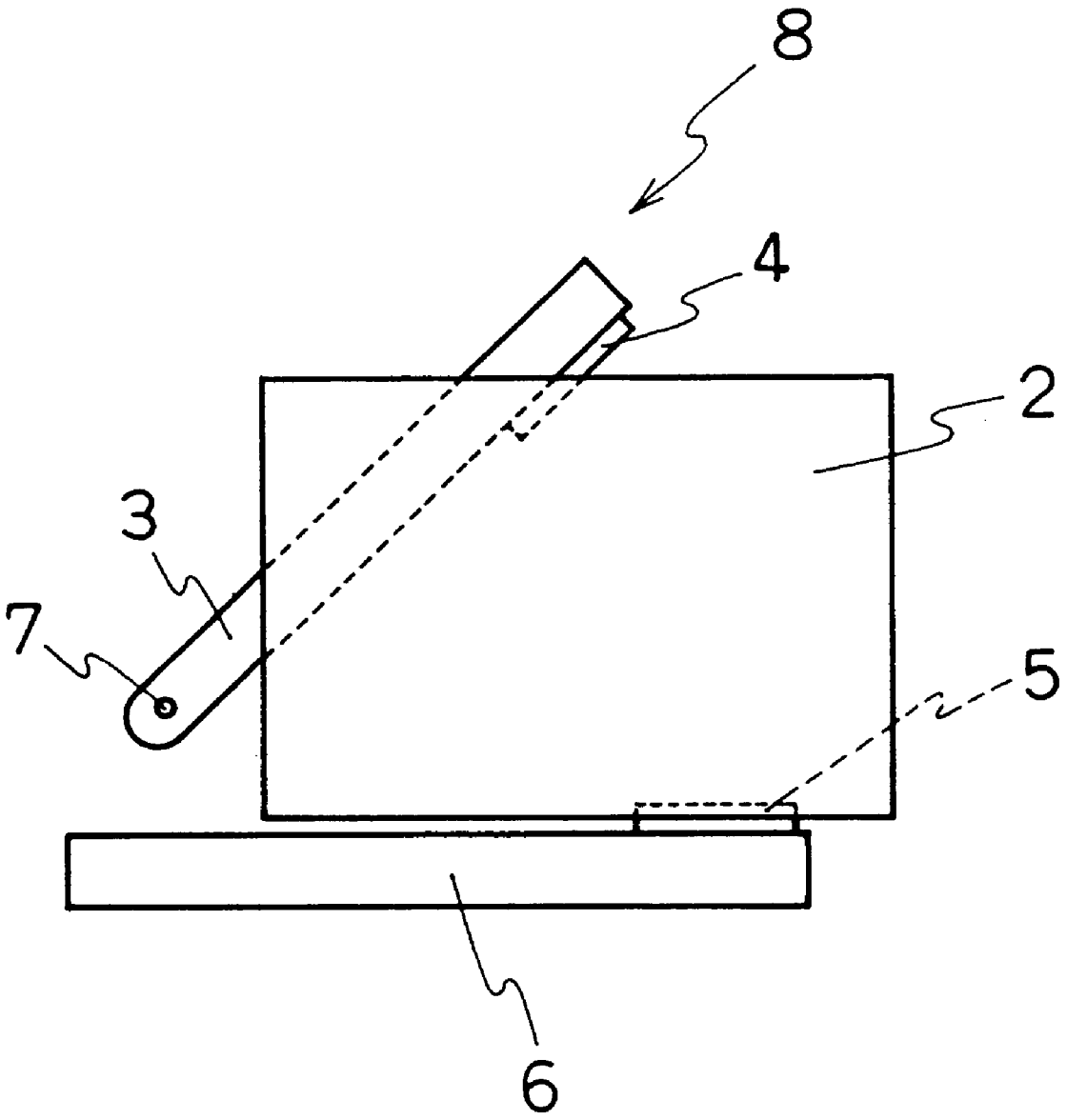
Figures 1, 2, 3, 4, 5, 6, 7, 8, 9, 10, 11, 12, 13, 14:
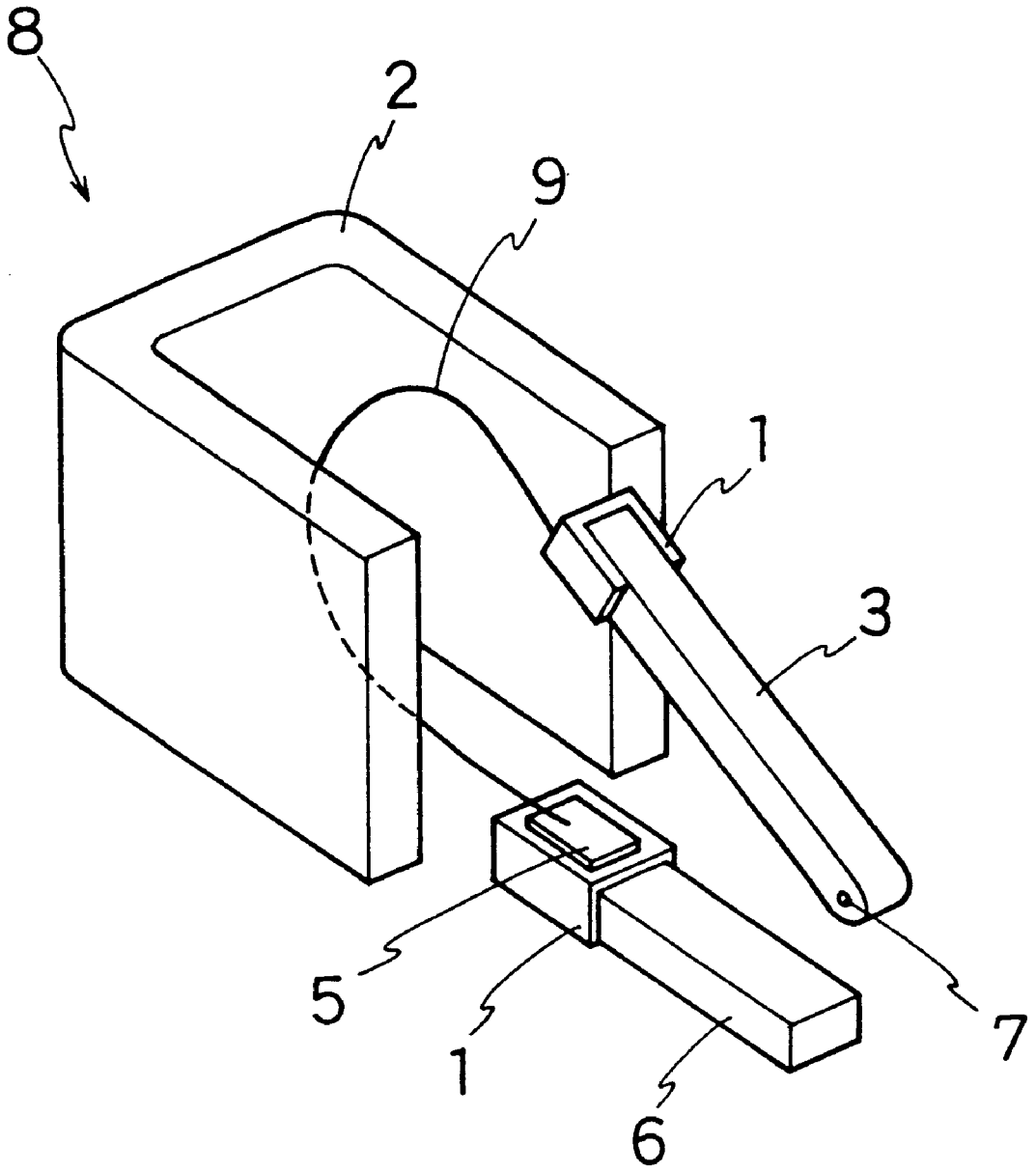
Figures 1, 2, 3, 4, 5, 6, 7, 8, 9, 10, 11, 12, 13, 14, 15:
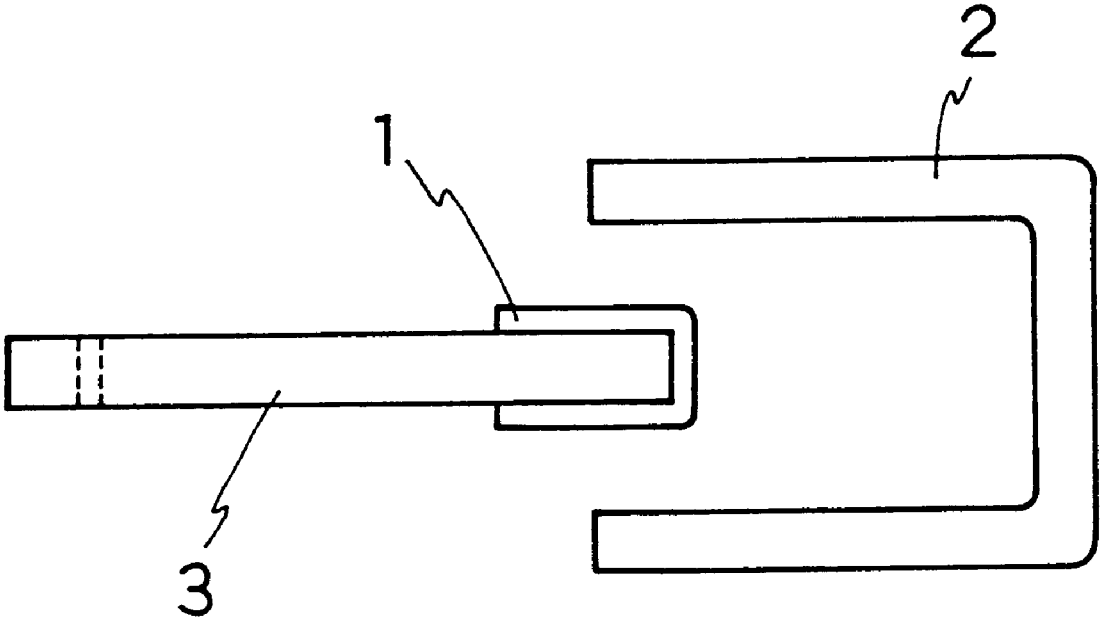
Figures 1, 2:
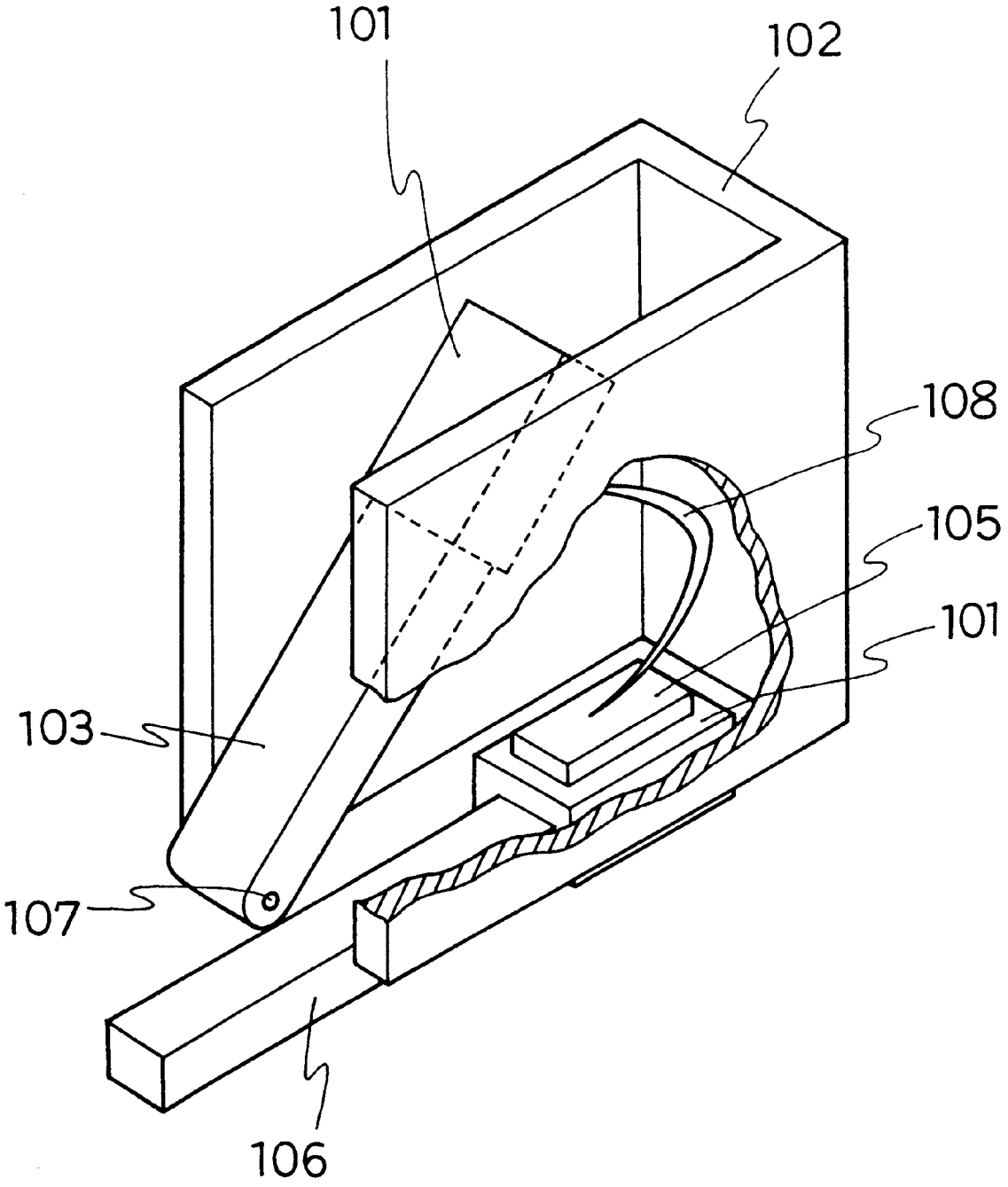
Figure 2:
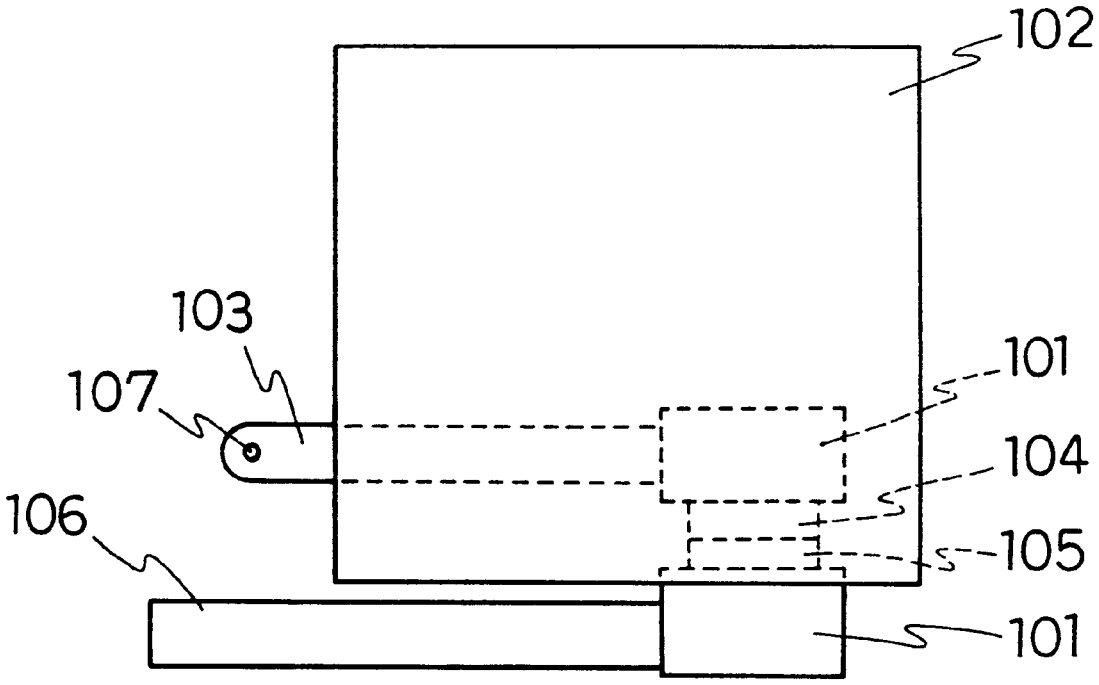
Figures 2, 3:
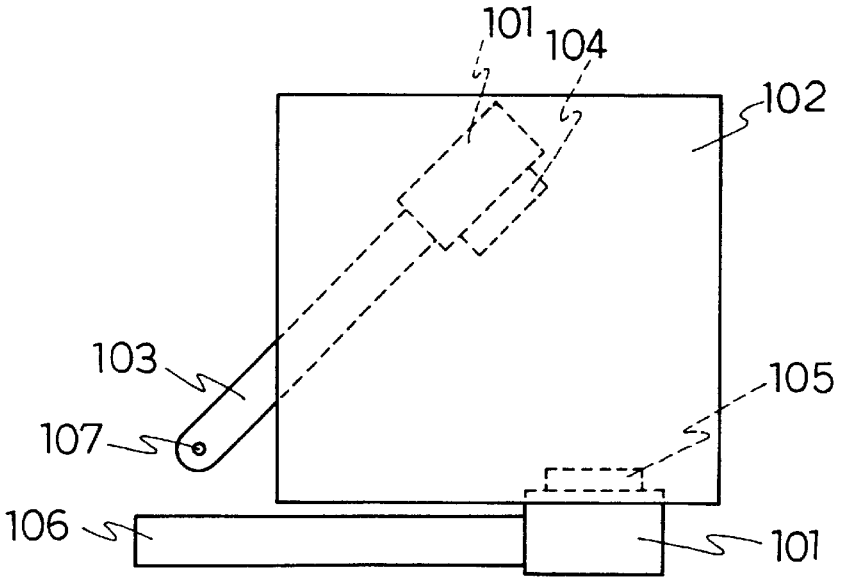
Figures 2, 3, 4:
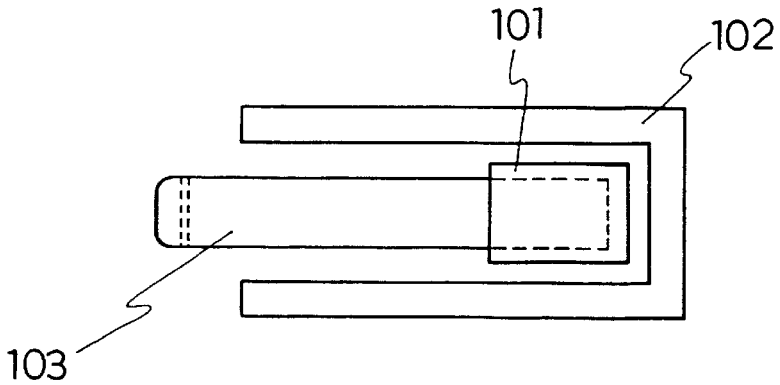
Figures 2, 3, 4, 5:
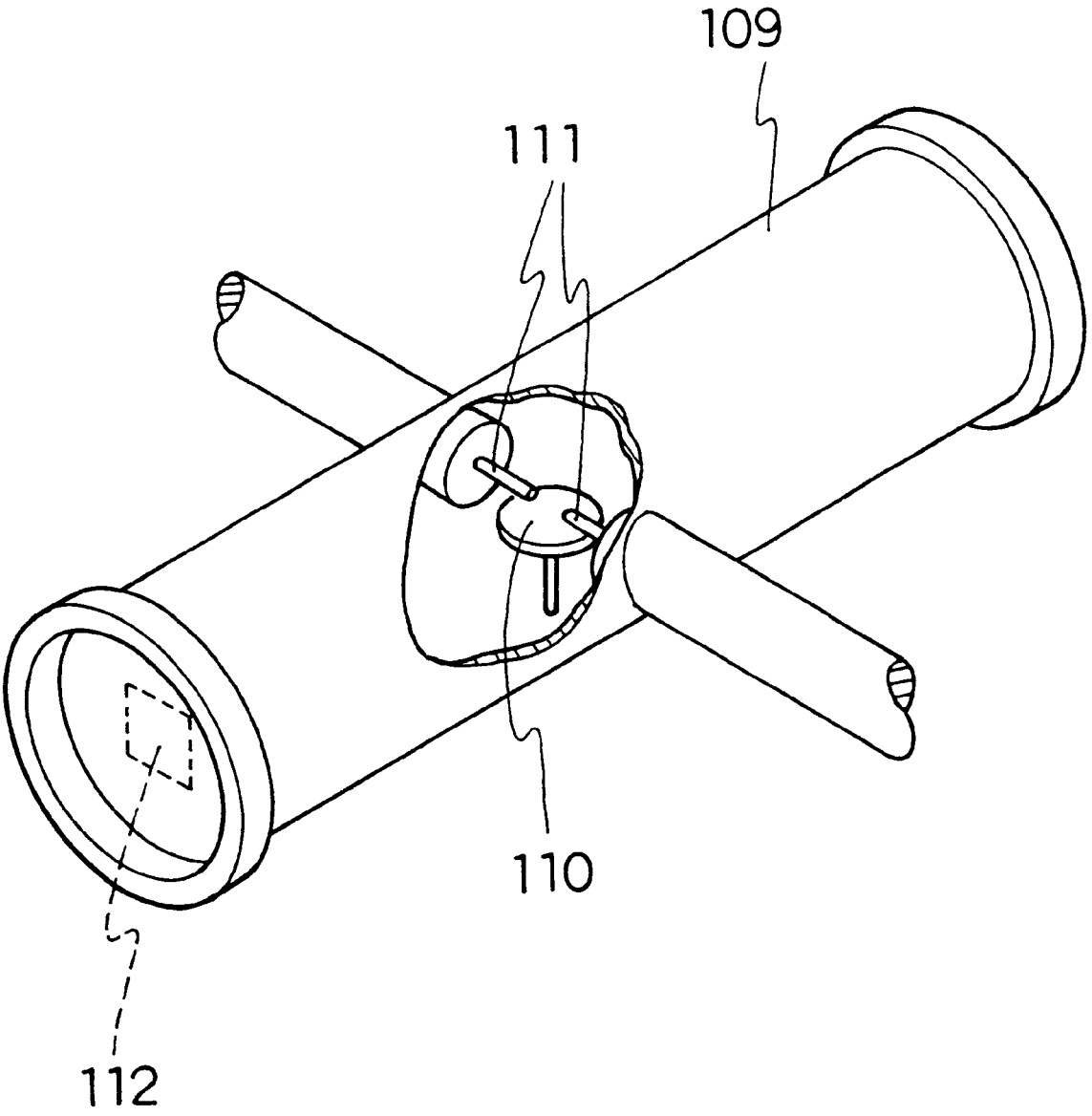
Figures 2, 3, 4, 5, 6:
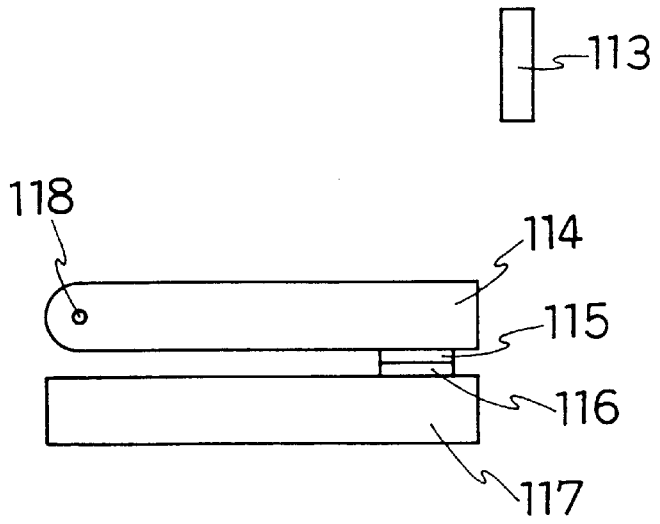
Figures 2, 3, 4, 5, 6, 7:
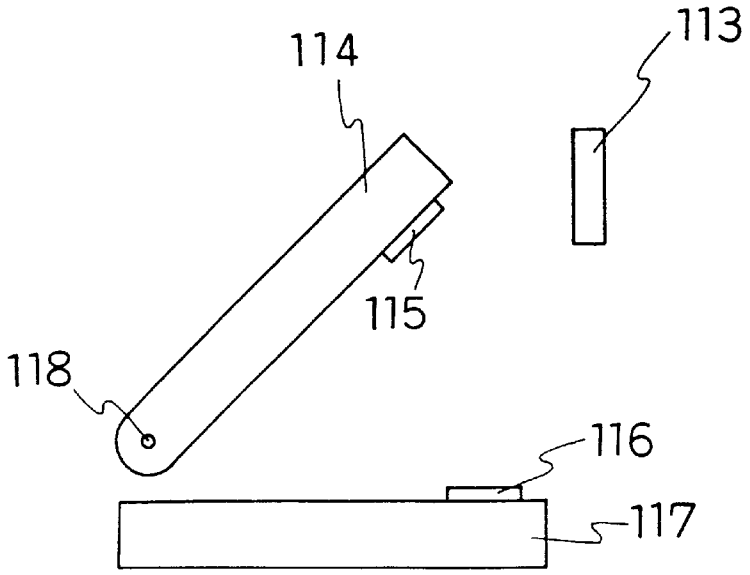
Figures 2, 3, 4, 5, 6, 7, 8:
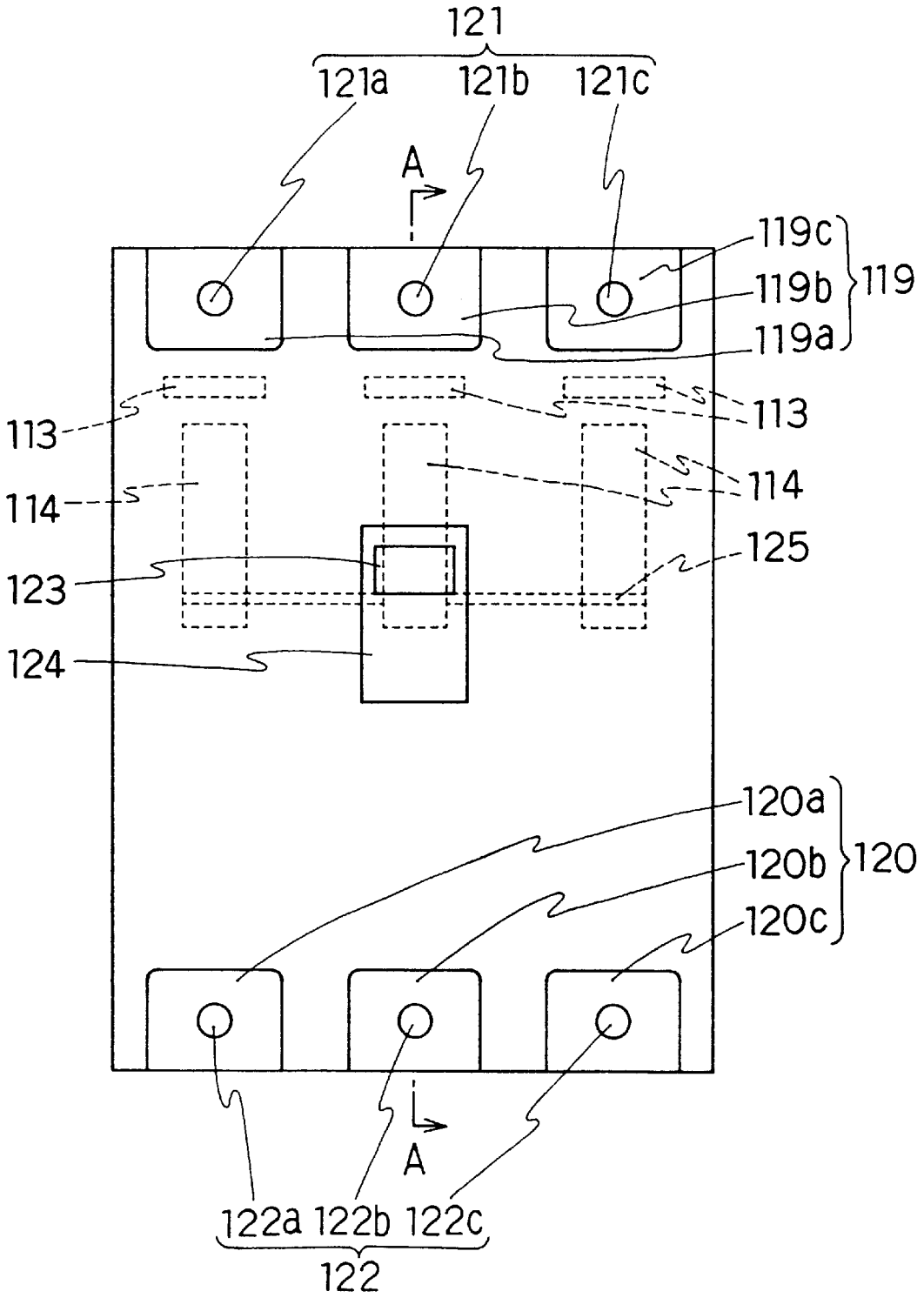
Figures 2, 3, 4, 5, 6, 7, 8, 9:
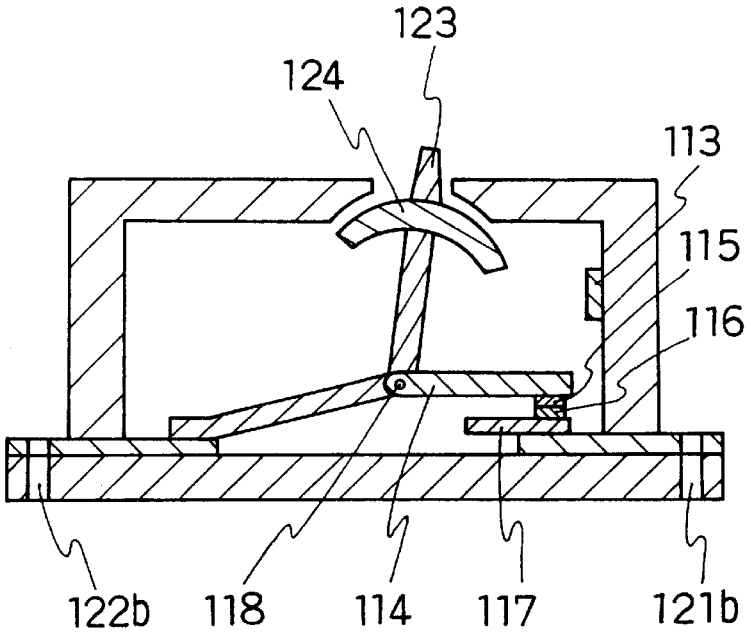
Figures 2, 3, 4, 5, 6, 7, 8, 9, 10:
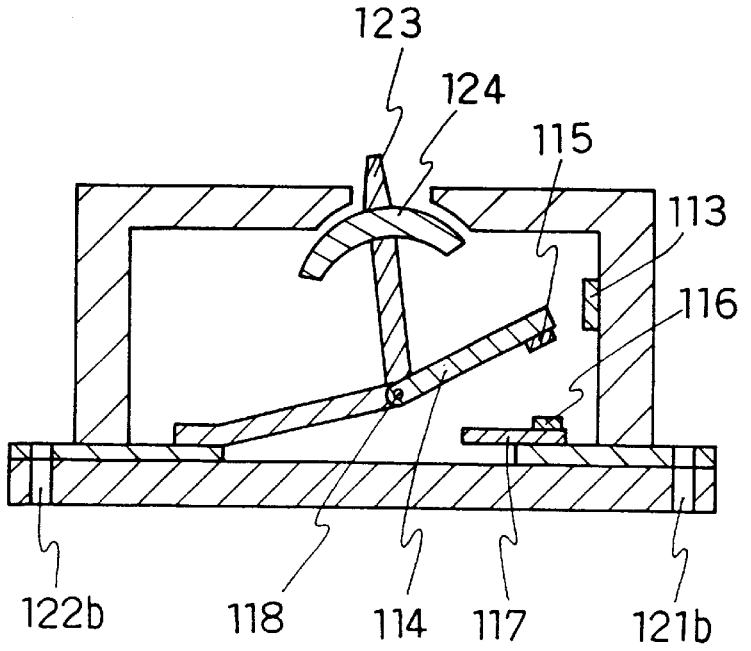
Figures 2, 3, 4, 5, 6, 7, 8, 9, 10, 11:
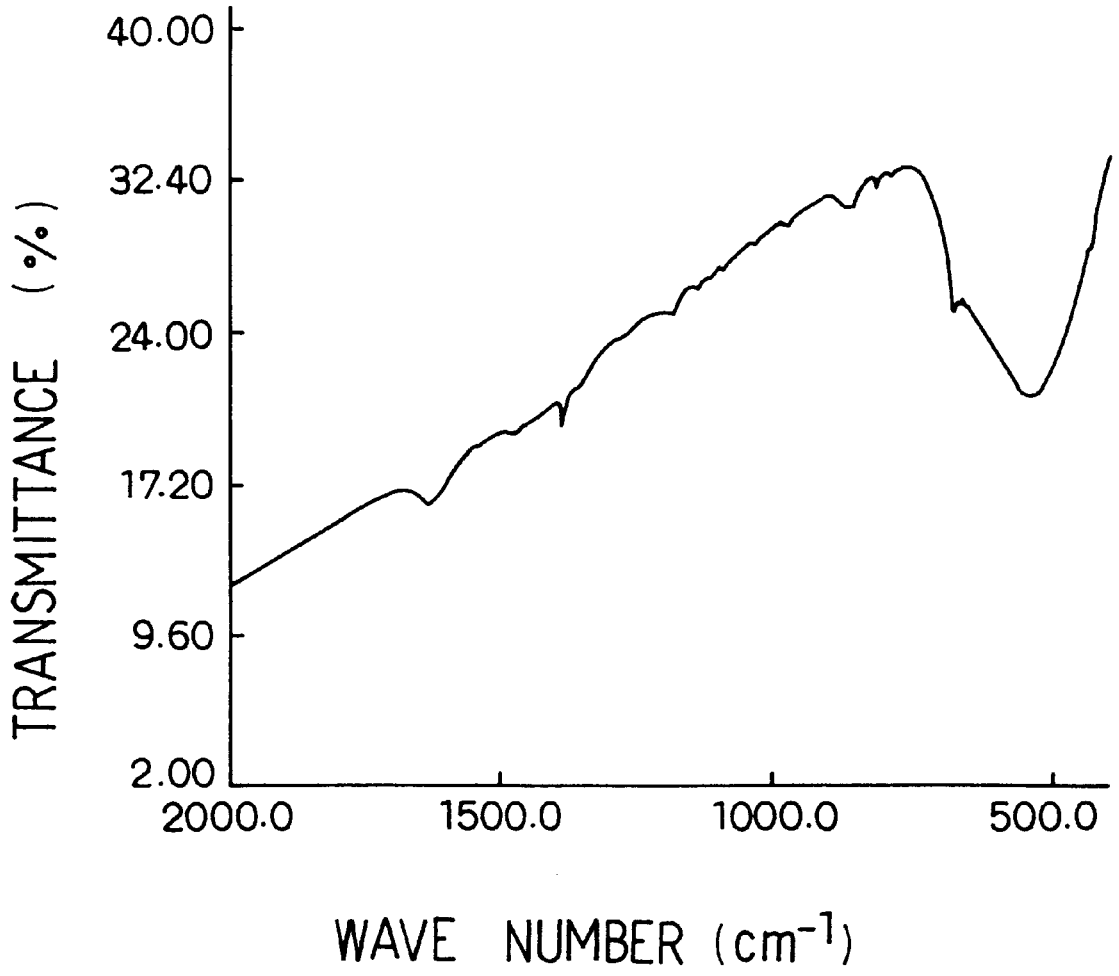
Figures 2, 3, 4, 5, 6, 7, 8, 9, 10, 11, 12:
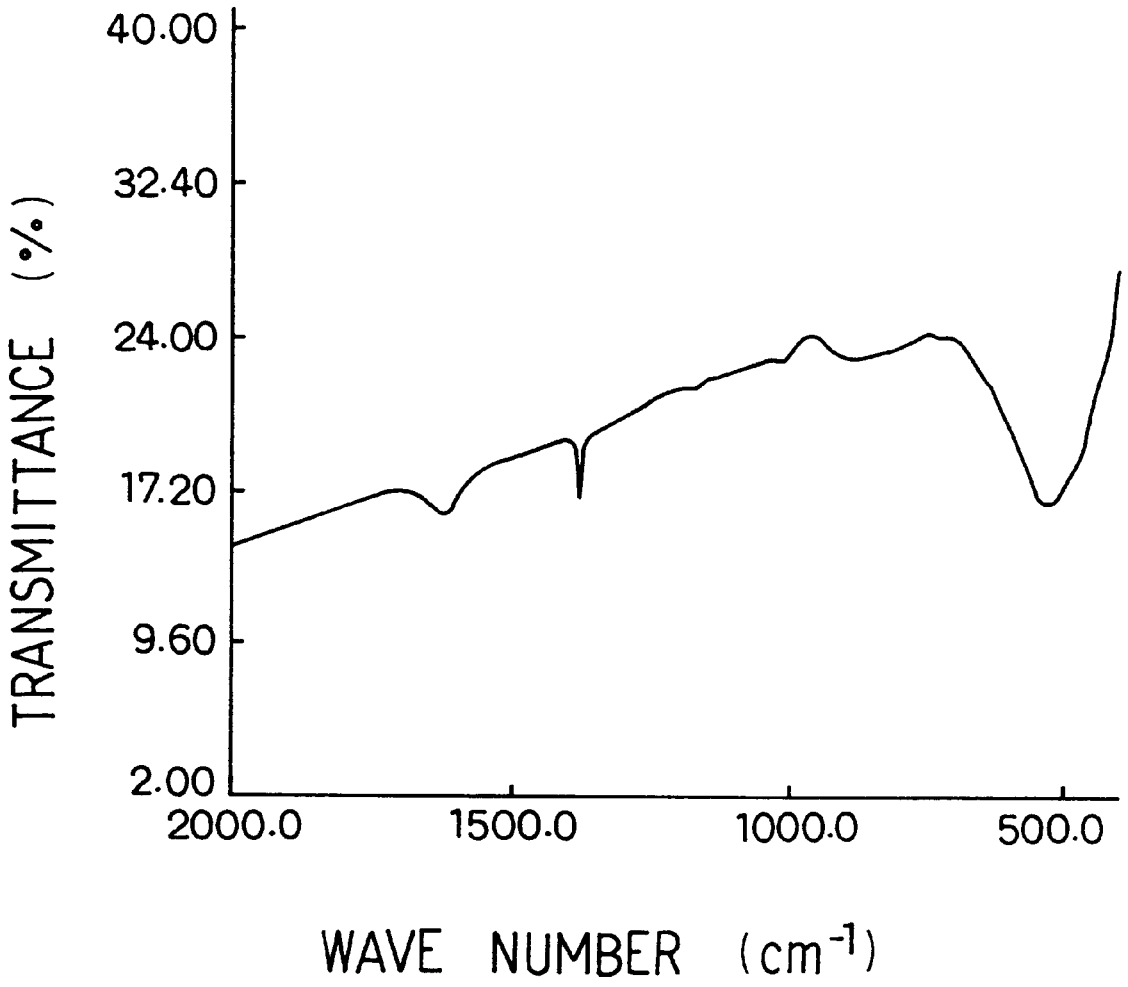
Figures 2, 3, 4, 5, 6, 7, 8, 9, 10, 11, 12, 13:
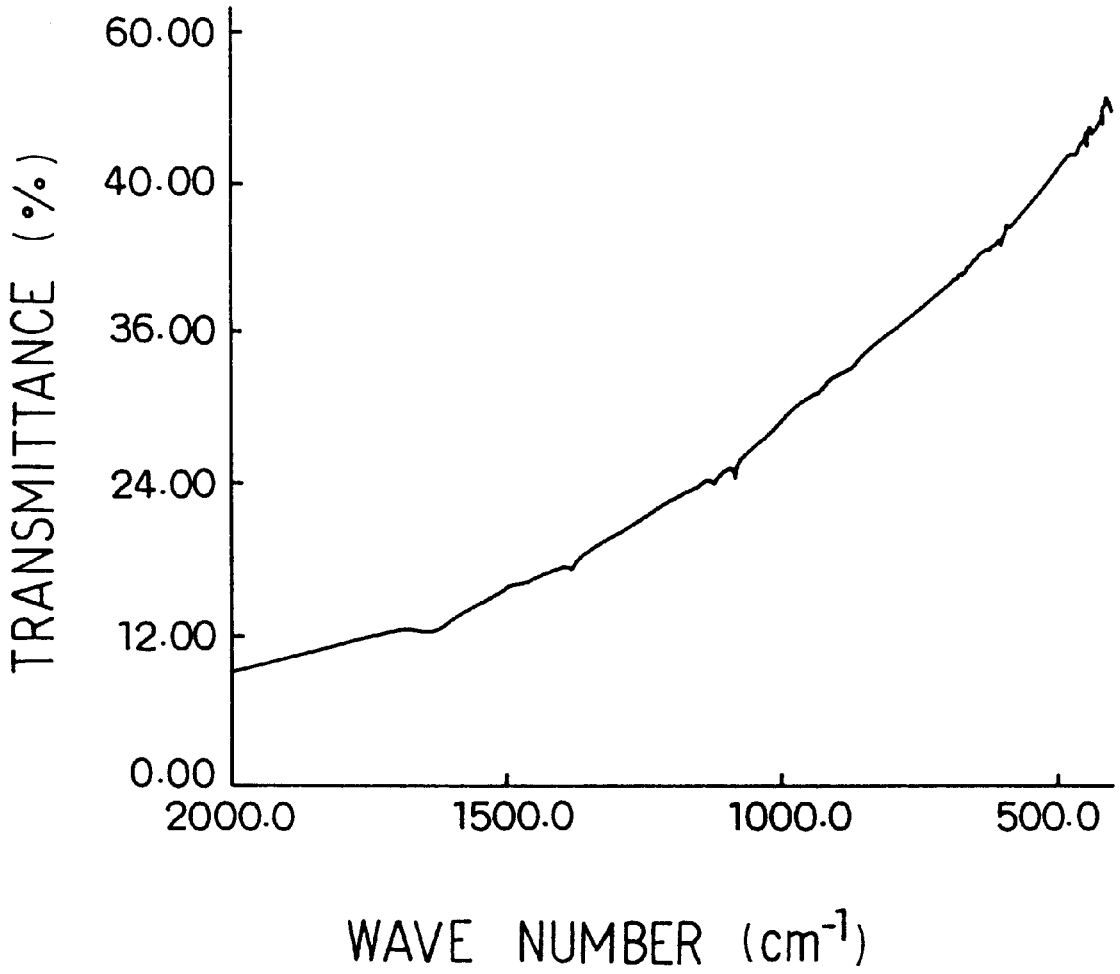
Figures 1, 3:
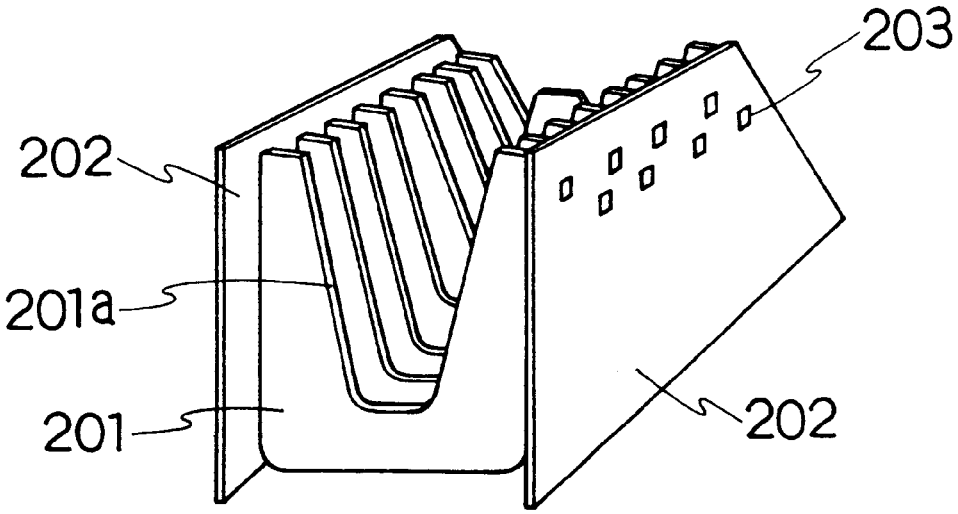
Figures 2, 3:
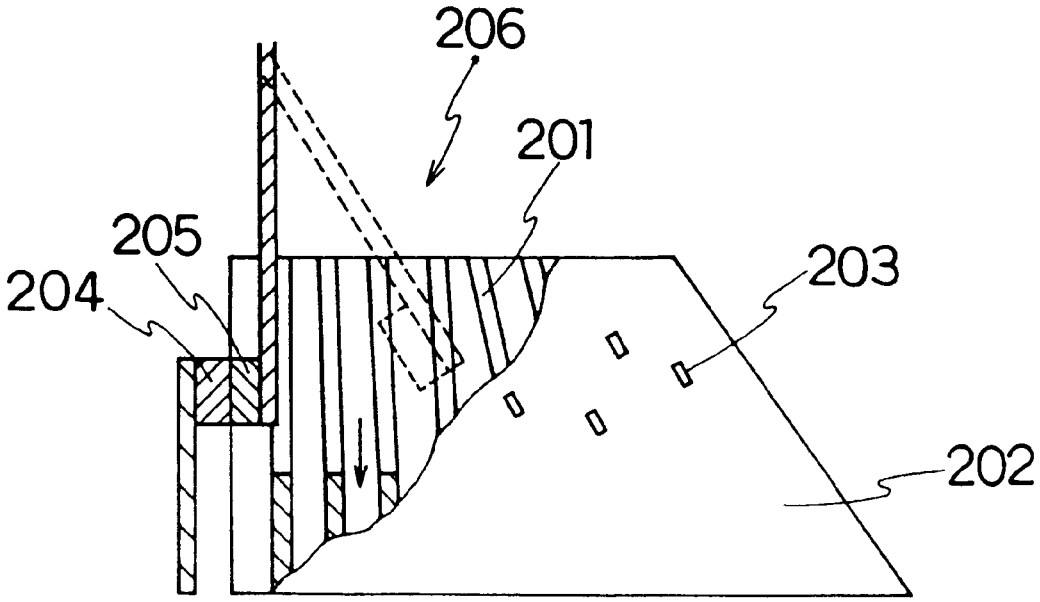
Figure 3:
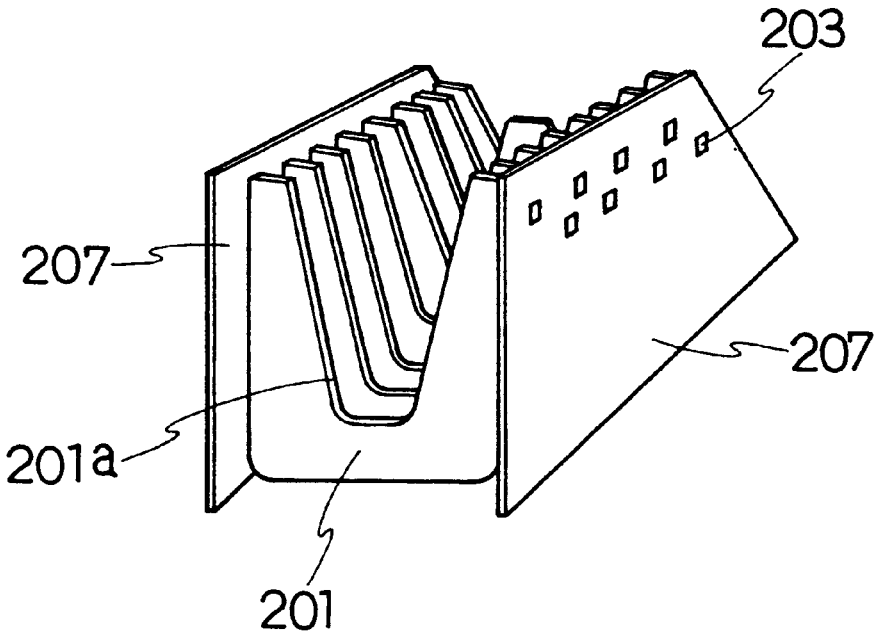
Figures 3, 4:
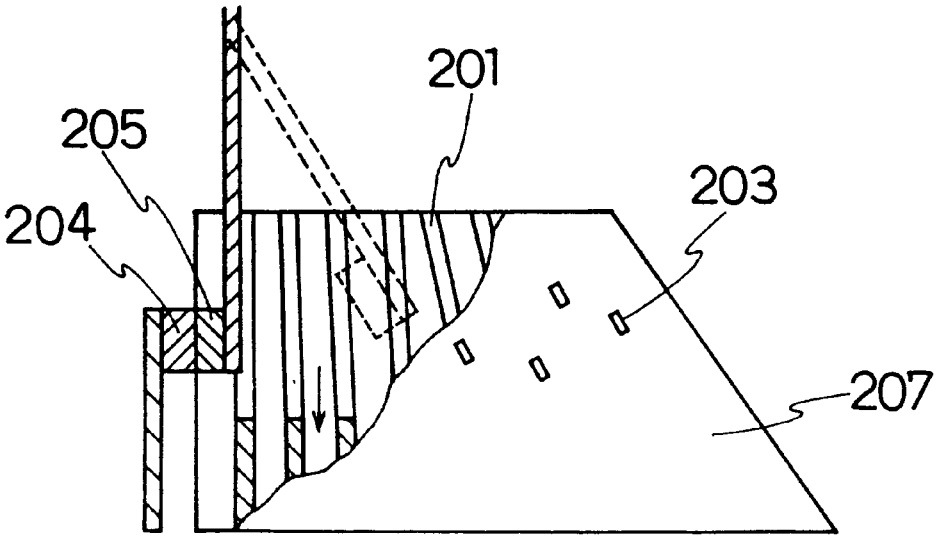

FIG. 2-1 is a partially cutaway schematic perspective view showing one embodiment of an arc extinguishing chamber including the gas generating source material provided therein, which chamber is used in a switch employing the insulating method of the present invention. FIG. 2-2 is a side view of the arc extinguishing chamber shown in FIG. 2-1, in which the contacts are in closed state. FIG. 2-3 is a side view of the arc extinguishing chamber shown in FIG. 2-1, in which the contacts are in opened state. FIG. 2-4 is a plan view of the arc extinguishing chamber shown in FIG. 2-1. It is to be noted that FIG. 2-1 also illustrates an arc generated between the contacts. In these figures, there are illustrated a molded product 101 of the gas generating source material, an arc extinguishing side plate 102, a moving contact element 103, a moving contact 104, a fixed contact 105, a fixed contact element 106, a pivoting center 107, and an arc 108 generated between the contacts.

The molded product 101 is secured to the tip of the moving contact element 103 by, for example, a screw within the space defined by the arc extinguishing side plate 102 of the arc extinguishing chamber provided in the switch. Likewise, to the tip of the fixed contact element 106 is secured the molded product 101 on top of which is provided the fixed contact 105.

When the moving contact element 103 in opened state is downwardly moved to provide a contact between the moving contact 104 and the fixed contact 105 as shown in FIG. 2-2 and is then upwardly moved to separate the moving contact 104 from the the fixed contact 105 as shown in FIG. 2-3, the arc 108 is generated between the moving contact 104 and the fixed contact 105 as shown in FIG. 2-1. This arc 108 heats up the moving contact 104, fixed contact 105 and other metal components in the vicinity thereof to cause metal particles to be scattered therefrom. At the same time therewith, the molded product 101 is also heated up by the arc 108 thereby generating an insulation imparting gas.

The insulation imparting gas generated from the molded product 101 serves to insulate the scattered metal particles.

In the present invention, the gas generating source material may be provided as overlying the moving contact 104 and as underlying the fixed contact 105, as described above. Further, the inner surface of the arc extinguishing plate 102 shown in, for example, FIG. 2-1 may be coated with, for example, a dispersion of the gas generating source material in a medium to usually about 2 to about 150 $\mu$m thickness by roll coating, flow coating, spray coating or a like coating process, thereby using the arc extinguishing side plate comprising the supported material. Alternatively, the arc extinguishing side plate 102 itself may comprise a molded product formed from the gas generating source material.

By thus insulating the scattered metal particles, it is possible to satisfactorily prevent a decrease in electric resistance upon an opening or closing operation of the contacts of the electrodes, thereby eliminating the cause of insulation failure.

Although the thickness of the deposited layer resulting from the insulation of the scattered metal particle is not particularly limited, preferably such thickness is usually limited to the range of about 3 to about 20 μm so as to prevent the deposited layer from being peeled off or removed away. Further, particularly where the metal hydroxide is used as the gas generating source compound, the insulation imparting gas generated from the metal hydroxide reacts with the scattered metal particles to insulate them and, hence, the resulting deposited layer preferably has a thickness of about 5 to about 15 μm when the arc resistant property of the deposited layer is taken into account.

The switch according to the present invention includes the arc extinguishing chamber and the gas generating source material provided in the vicinity of the electrodes, contacts and neighboring other metal components in the arc extinguishing chamber. In such a switch the scattered metal particles produced by an arc generated between the contacts upon an opening or closing operation of the contacts are insulated by the insulation imparting gas thereby preventing the decrease in the electric resistance of the switch, hence the occurrence of insulation failure within the switch.

The present invention is applicable to any kind of switch which generates an arc in the arc extinguishing chamber thereof when the contacts of the electrodes thereof are operated to be opened or closed, for example, an electromagnetic contactor, circuit breaker and current limiting device. The electrodes of such a switch are usually formed of, for example, Ag—WC alloy or Ag—CdO alloy.

The insulation method of the present invention is adapted to insulate metal particles to be scattered from the electrodes, contacts and other metal components of a switch in the vicinity thereof by the generation of arc by means of an insulation imparting gas generated from the gas generating compound, thereby preventing a decrease in the electric resistance of the switch, hence the occurrence of insulation failure thereof.

The gas generating source material according to the present invention contains a gas generating source compound for generating an insulation imparting gas which is capable of combining with the metal particles scattered from the electrodes, contacts and neighboring other metal components of a switch. Hence, the gas generating source material can be advantageously used in any switch which generates an arc.

The switch according to the present invention is remarkably improved to prevent a decrease in the electrical resistance thereof and hence can be advantageously applied to any kind of switch which generates an arc such as an electromagnetic contactor, circuit breaker or current limiting device.

Next, description will hereinafter be made on the third group inventions.

The third group inventions generally concern an arc extinguishing plate material, a preparation method therefor and a switch having an arc extinguishing chamber of which side plate comprises the arc extinguishing plate material. More specifically, the third group inventions concern an arc extinguishing plate material exhibiting excellent heat resistance, arc resistance, heat impact resistance and a like characteristic, which can readily be prepared and is capable of extinguishing an arc generated in an arc extinguishing chamber upon an opening or closing operation of the contacts of electrodes in a switch such as an electromagnetic contactor, circuit breaker or current-limiting device by absorbing the energy of the arc and cooling down, thereby protecting the devices or components installed in such a switch from the heat of the arc, while at the same time exhibiting the effect of preventing the electrical resistance of the switch from decreasing by insulating a metal vapor and molten metal droplets that are generated from the electrodes, contacts and other metal components located adjacent thereto upon an opening or closing operation of the electrodes. The inventions also concern a preparation method for such arc extinguishing plate material and a switch having an arc extinguishing chamber of which arc extinguishing side plate comprises the arc extinguishing plate material.

A typical arc extinguishing chamber will be illustrated by way of FIG. 3-3 showing, in schematic perspective, one example of a conventional arc extinguishing chamber.

The arc extinguishing chamber shown in FIG. 3-3 includes a plurality of arc extinguishing magnetic plates 201 each defining a U-shaped notch 201*a* in the central portion thereof and formed of, for example, an iron plate, and a pair of arc extinguishing side plates 207 to which the both sides of each magnetic plate 201 are secured at caulking portions 203.

FIG. 3-4 is a partially cutaway side view of one example of a conventional switch for illustrating the arc extinguishing operation of an arc extinguishing chamber, wherein like numerals are used to denote like or corresponding parts of FIG. 3-3, and numerals 204 and 205 denote a fixed contact and a moving contact, respectively.

Reference will be made to the operation of the switch.

In the arc extinguishing chamber comprising the magnetic plates 201 and the arc extinguishing side plates 207, the fixed contact 204 and moving contact 205 assuming contact condition (closed condition) allows electric current to flow therethrough. When the electric current is to be interrupted, the moving contact 205 is moved toward the position indicated by dotted line (opened condition). At this time an arc is generated over the gap between the fixed contact 204 and moving contact 205. Such arc is drawn in the direction indicated by arrow so as to be extinguished.

Conventionally, the arc extinguishing side plate forming part of the arc extinguishing chamber is usually formed of an organic-inorganic combined material such as a rigid fiber material, a combination of this rigid fiber material and asbestos paper attached onto the inner face of the rigid fiber material, a laminated plate comprising a glass base and a melamine resin and a laminated plate comprising glass mat and polyester resin (refer to Japanese Examined Patent Publication No. 54609/1990). There are also used as the material of the side plate a material formed only of inorganic substance such as a glass fiber sheet laminated plate using a boric acid-zinc oxide based binder (refer to Japanese Examined Patent Publication No. 9335/1988), and various sintered ceramic materials.

The rigid fiber material, however, is prone to be decomposed by heat of an arc at arc extinguishing or to be carbonized by repeated exposure to arc and, hence, the insulation resistance thereof will be severely lowered. In addition, the rigid fiber material involves a problem of deformation by thermal shrinkage.

With the combination of such a rigid fiber material and asbestos paper attached thereto, the asbestos is likely to scatter when subjected to the pressure of arc and to enter the gap between the contacts 204 and 205, thus resulting in the likehood of a conduction failure.

The glass base-melamine resin laminated plate also presents the problem of susceptibility to decomposition or carbonization due to heat of arc at arc extinguishing.

Further, the glass mat-polyester resin laminated plate in general is incorporated with an inorganic substance containing crystal water for an improvement in arc resistance (by utilizing the cooling action of latent heat of vaporization of moisture physico-chemically adhering thereto upon interruption of current, or the arc extinguishing action of free water, or by improving the heat release or heat conduction). Usually used as the inorganic filler is, for instance, alumina hydrate or aluminum hydroxide. This type of laminated plate, however, suffers non-uniform surface characteristics due to, for example, the formation of glass fiber and resin-excessive layer which is poor in arc resistance in the surface layer and hence cannot serve the purpose, resulting in a problem similar to that of the glass base-melamine resin laminated plate.

It has heretofore been assumed that the insulation failure due to the generation of arc in a switch is caused by a decrease in electrical resistance attributed to carbon resulting from the decomposition of an organic substance and adhering to the surfaces of components accommodated within the switch as well as the inner walls of the arc extinguishing chamber. To prevent the decrease in electrical resistance, there have been proposed methods such as employing an organic substance which is free of any aromatic ring having many carbon atoms and is rich in hydrogen atom (as disclosed in Japanese Unexamined Patent Publication No. 310534/1988), and utilizing the generation of carbon monoxide or volatile hydrocarbon resulting from the reaction represented by:

$$Al_2O_3.3H_2O \rightarrow Al_2O_3+3H_2O \text{ organic group (HC)}+3H_2O \rightarrow CO(HC)$$

wherein aluminum hydroxide ($Al_2O_3.3H_2O$) is contained in an arc extinguishing material and is used as a starting material, and the crystal water dissociated therefrom is allowed to react with the organic group (HC) (as disclosed in Japanese Unexamined Patent Publication No. 144844/1990).

However, with increasing demand for a switch of smaller size and higher capacity in the recent trend toward electric devices of smaller sizes and lighter weights, the number of components made of an organic substance and used in a switch is increased and, hence, there is a high possibility that the amount of free carbon to be generated from such organic substance by arc is increased. For this reason the method proposed in, for example Japanese Unexamined Patent Publication No. 310534/1988 employs an organic substance which is free of any aromatic ring having many carbon atoms and is rich in hydrogen atom, and which is prepared by filling 5 to 30% of a glass fiber material into an acrylic acid ester copolymer or an aliphatic hydrocarbon resin. Such a method, however, sometimes fails to satisfactorily prevent the electrical resistance from decreasing. Alternatively, in the method employing an arc extinguishing material formed from a resin filled with aluminum hydroxide as disclosed in Japanese Unexamined Patent Publication No. 144844/1990, although there is a certain effect in inhibiting the generation of free carbons by virtue of the reaction of the crystal water dissociated from aluminum hydroxide with the organic group of the organic material, it is possible that the organic material be cracked and broken by expansion of the crystal water due to rapid vaporization thereof when exposed to arc and hence be rendered unusable.

The glass fiber sheet laminated plate of Japanese Examined Patent Publication No. 9335/1988 which uses a boric acid-zinc oxide binder and is formed only of inorganic substances is insusceptible to carbonization and decomposition and hence exhibits an excellent wear resistance, but is incapable of satisfactorily preventing the decrease in insulation resistance due to free carbon and is poor in applicability to mass production.

Further, the ceramic material, though it does not generate carbon, is likely to be damaged by thermal shock when rapidly heated by arc and hence involves a danger of a severe accident. In addition, a molded product of the ceramic material needs to be baked at a high temperature, e.g. 1300° C. or above. This causes energy loss and shrinkage in dimensions and hence leads to a lower yield for a product of more complicated shape.

According to the detailed analysis on the deposit adhering to the inner surface of a switch by the inventors of the present invention, there was found that a metal layer is formed from metal vapor or molten metal droplets that are generated from the electrodes, contacts and other metal components located adjacent thereto by an arc generated upon an opening or closing operation of the contacts, and such a metal layer as well as free carbon greatly contributes to the decrease in electrical resistance.

Consequently, the prior art, or only inhibiting the generation of free carbons cannot sufficiently prevent the decrease in electrical resistance.

In view of the foregoing, the third group inventions included in the present invention are made to provide an arc extinguishing plate material having excellent heat resistance, arc resistance, thermal shock resistance and the like which can be readily prepared and which is adapted to extinguish an arc to be generated within an arc extinguishing chamber of a switch upon an opening or closing operation of the contacts of the electrodes by absorbing the energy of the arc and cooling down thereby protecting the components of the switch from the heat of the arc, while satisfactorily preventing the electrical resistance of the switch from decreasing by insulating metal vapor and molten metal droplets produced from the electrodes, contacts and other metal components located adjacent thereto upon an opening or closing operation of the contacts. The third group inventions also provide a preparation method for such arc extinguishing plate material and a switch provided with an arc extinguishing chamber of which arc extinguishing side plate comprises the arc extinguishing plate material.

Embodiments of the third group inventions included in the present invention are as follows.

According to embodiment 3-1 of the present invention, there is provided an arc extinguishing plate material (I) comprising 35 to 50% of a reinforcing inorganic material sheet and 50 to 65% of an inorganic binder composition (B), wherein the arc extinguishing plate material is prepared by pressure molding and aging a sheet comprising the reinforcing inorganic material sheet and an inorganic binder composition (A).

According to embodiment 3-2 of the present invention, the reinforcing inorganic material sheet in the arc extinguishing plate material (I) of embodiment 3-1 comprises a glass mat or glass fabric formed of a glass fiber having an insulating property or a ceramic paper prepared by papering of a ceramic fiber.

According to embodiment 3-3 of the present invention, the inorganic binder composition (A) in the arc extinguishing plate material (I) of embodiment 3-1 is an inorganic binder composition (I) comprising 30 to 45% of an insulation imparting gas generating source compound, 0 to 28% of an arc resistant inorganic powder, 40 to 65% of an aqueous solution of a primary metal salt of phosphoric acid, and 2 to 10% of a curing agent for the primary metal salt of phosphoric acid.

According to embodiment 3-4 of the present invention, the insulation imparting gas generating source compound in the arc extinguishing plate material (I) of embodiment 3-3 is aluminum hydroxide.

According to embodiment 3-5 of the present invention, the primary metal salt of phosphoric acid in the arc extinguishing plate material (I) of embodiment 3-3 is aluminum primary phosphate or magnesium primary phosphate.

According to embodiment 3-6 of the present invention, the concentration of the primary metal salt of phosphoric acid in the aqueous solution used in the arc extinguishing plate material (I) of embodiment 3-3 is from 25 to 55%.

According to embodiment 3-7 of the present invention, the curing agent for the primary metal salt of phosphoric acid in the arc extinguishing plate material (I) of embodiment 3-3 is wollastonite crystal or aluminum hydroxide.

According to embodiment 3-8 of the present invention, the inorganic binder composition (A) in the arc extinguishing plate material (I) of embodiment 3-1 is an inorganic binder composition (II) comprising 30 to 50% of an insulation imparting gas generating source compound, 0 to 20% of an arc resistant inorganic powder, and 50 to 70% of an aqueous solution of condensed alkali metal phosphate.

According to embodiment 3-9 of the present invention, the insulation imparting gas generating source compound in the arc extinguishing plate material (I) of embodiment 3-8 is selected from the group consisting of magnesium hydroxide, magnesium carbonate and calcium carbonate.

According to embodiment 3-10 of the present invention, the condensed alkali metal phosphate in the arc extinguishing plate material (I) of embodiment 3-8 is sodium metaphosphate or potassium metaphosphate.

According to embodiment 3-11 of the present invention, the concentration of the condensed alkali metal phosphate in the aqueous solution used in the arc extinguishing plate material (I) of embodiment 3-8 is from 10 to 40%.

According to embodiment 3-12 of the present invention, the insulation imparting gas generating source compound in the arc extinguishing plate material (I) of embodiment 3-8 or 3-9 acts also as a curing agent for the aqueous solution of condensed alkali metal phosphate.

According to embodiment 3-13 of the present invention, the arc resistance inorganic powder in the arc extinguishing plate material (I) of embodiment 3-3 or 3-8 is selected from the group consisting of aluminum oxide powder, zircon powder and cordierite powder.

According to embodiment 3-14 of the present invention, there is provided a method for preparing an arc extinguishing plate material (I) comprising 35 to 50% of a reinforcing inorganic material sheet and 50 to 65% of an inorganic binder composition (B), and the method comprises the steps of: drying a sheet comprising the reinforcing inorganic material sheet and an inorganic binder composition (A) at 80° to 120° C. and then subjecting the same to pressure molding; and aging the sheet at 120° to 200° C. to remove moisture therefrom and cure the sheet, followed by cooling the sheet down to 80° C. or below.

According to embodiment 3-15 of the present invention, the sheet prior to undergoing the pressure molding in the method of embodiment 3-14 is prepared by the steps of: mixing 30 to 45% of an insulation imparting gas generating source compound, 0 to 28% of an arc resistant inorganic powder and 2 to 10% of a curing agent for a primary metal salt of phosphoric acid; adding, to the resulting mixture, 40 to 65% of the aqueous solution of primary metal salt of phosphoric acid, followed by kneading to prepare an inorganic binder composition (I); immersing the reinforcing inorganic material sheet into the inorganic binder composition (I) to form a sheet with the inorganic binder composition (I) adhering thereto; and drying the sheet at 80° to 120° C. to adjust the concentration of the primary metal salt of phosphoric acid in the aqueous solution to 65 to 85%.

According to embodiment 3-16 of the present invention, in the method of embodiment 3-15, the insulation imparting gas generating source compound is aluminum hydroxide; the arc resistant inorganic powder is selected from the group consisting of aluminum oxide powder, zircon powder and cordierite powder; the curing agent for the primary metal salt of phosphoric acid is wollastonite crystal or aluminum hydroxide; and the aqueous solution of the primary metal salt of phosphoric acid is a 25 to 55% aqueous solution of aluminum primary phosphate or magnesium primary phosphate.

According to embodiment 3-17 of the present invention, the sheet prior to undergoing the pressure molding in the method of embodiment 3-14 is prepared by the steps of: mixing 30 to 50% of an insulation imparting gas generating source compound and 0 to 20% of an arc resistant inorganic powder; adding, to the resulting mixture, 50 to 70% of an aqueous solution of condensed alkali metal phosphate, followed by kneading to prepare an inorganic binder composition (II); immersing the reinforcing inorganic material sheet into the inorganic binder composition (II) to prepare a sheet with the inorganic binder composition (II) adhering thereto; and drying the sheet at 80° to 120° C. to adjust the concentration of the condensed alkali metal phosphate in the aqueous solution to 65 to 85%.

According to embodiment 3-18 of the present invention, in the method of embodiment 3-17, the insulation imparting gas generating source compound is selected from the group consisting of magnesium hydroxide, magnesium carbonate and calcium carbonate; the arc resistant inorganic powder is selected from the group consisting of aluminum oxide powder, zircon powder and cordierite powder; and the aqueous solution of condensed alkali metal phosphate is a 10 to 40% aqueous solution of sodium metaphosphate or potassium metaphosphate.

According to embodiment 3-19 of the present invention, in the method of any one of embodiments 3-14, 3-15 and 3-17, the proportion of the inorganic binder composition (I) or (II) adhering to the sheet is 200 to 350 parts relative to 100 parts of the reinforcing inorganic material sheet.

According to embodiment 3-20 of the present invention, in the method of embodiment 3-14, the sheet prior to undergoing the pressure molding comprises a plurality of stacked sheets dried at 80° to 120° C.

According to embodiment 3-21 of the present invention, the method of embodiment 3-14 or 3-20 comprises the step of applying, prior to pressure molding, an insulation imparting gas generating source compound onto either or both faces of a reinforcing inorganic material sheet containing the inorganic binder composition (A).

According to embodiment 3-22 of the present invention, in the method of embodiment 3-21, the insulation imparting gas generating source compound is selected from the group consisting of magnesium hydroxide, magnesium carbonate and calcium carbonate.

According to embodiment 3-23 of the present invention, the method of embodiment 3-20 comprises the steps of: preparing one of the sheets to be stacked on each other with use of an inorganic binder composition (I) as recited in embodiment 3-3 and the other with use of an inorganic binder composition (II) as recited in embodiment 3-8; drying at 80° to 120° C. the one sheet to adjust the concentration of the primary metal salt of phosphoric acid in the aqueous solution contained therein to 65 to 85% and the other sheet to adjust the concentration of the condensed alkali metal phosphate in the aqueous solution contained therein to 65 to 85%; stacking the other sheet on either or both faces of the one sheet; further stacking the resulting stacked sheet on a stacked sheet of the same type to obtain a laminated sheet of a required thickness; subjecting the laminated sheet to pressure molding; aging the thus molded laminated sheet to facilitate removal of moisture therefrom and curing of the molded laminated sheet; and cooling the molded laminated sheet down to 80° C. or below.

According to embodiment 3-24 of the present invention, the method of any one of embodiments 3-14, 3-20, 3-21 and 3-23 further comprises the step of coating or impregnating the arc extinguishing plate material (I) with a coating material for preventing the arc extinguishing plate material (I) from dusting when subjected to a punching process.

According to embodiment 3-25 of the present invention, the coating material used in the method of embodiment 3-24 is an organic metal compound (a metal alkoxide) or an organic resin.

According to embodiment 3-26 of the present invention, there is provided an arc extinguishing plate material (I) which is obtained by pressure molding and aging an inorganic binder composition (C) comprising 40 to 55% of an insulation imparting gas generating source compound, 25 to 40% of an arc resistant inorganic powder, 8 to 18% of a primary metal salt of phosphoric acid, 5 to 10% of a curing agent for the primary metal salt of phosphoric acid, 2.6 to 12% of water, and 2 to 10% of a reinforcing inorganic fiber.

According to embodiment 3-27 of the present invention, the insulation imparting gas generating source compound in the arc extinguishing plate material (II) of embodiment 3-26 is selected from the group consisting of magnesium hydroxide, aluminum hydroxide, magnesium carbonate and calcium carbonate.

According to embodiment 3-28 of the present invention, the arc resistant inorganic powder in the arc extinguishing plate material (II) of embodiment 3-26 is selected from the group consisting of zircon powder, cordierite powder and mullite powder.

According to embodiment 3-29 of the present invention, the primary metal salt of phosphoric acid in the arc extinguishing plate material (II) of embodiment 3-26 is selected from the group consisting of aluminum primary phosphate, magnesium primary phosphate and sodium primary phosphate.

According to embodiment 3-30 of the present invention, in the arc extinguishing plate material (II) of any one of embodiments 3-26 to 3-28, the water is contained in such an amount as to afford a 60 to 75% aqueous solution of the primary metal salt of phosphoric acid.

According to embodiment 3-31 of the present invention, the curing agent for the primary metal salt of phosphoric acid in the arc extinguishing plate material (II) of embodiment 3-26 is selected from the group consisting of wollastonite crystal, magnesium hydroxide, aluminum hydroxide, magnesium carbonate and calcium carbonate.

According to embodiment 3-32 of the present invention, the reinforcing inorganic fiber in the arc extinguishing plate material (II) of embodiment 3-26 is an inorganic short fiber.

According to embodiment 3-33 of the present invention, the inorganic short fiber in the arc extinguishing plate material (II) of embodiment 3-32 is selected from the group consisting of a natural mineral fiber, a ceramic fiber and a ceramic whisker.

According to embodiment 3-34 of the present invention, the natural mineral fiber in the arc extinguishing plate material (II) of embodiment 3-33 is wollastonite crystal which acts also as a curing agent for the primary metal salt of phosphoric acid.

According to embodiment 3-35 of the present invention, there is provided a method for preparing an arc extinguishing plate material (II) comprising the steps of pressure molding in a mold an inorganic binder composition (C) comprising 40 to 55% of an insulation imparting gas generating source compound, 25 to 40% of an arc resistant inorganic powder, 8 to 18% of a primary metal salt of phosphoric acid, 5 to 10% of a curing agent for the primary metal salt of phosphoric acid, 2.6 to 12% of water and 2 to 10% of a reinforcing inorganic fiber; and aging the thus molded product at 120° to 200° C.

According to embodiment 3-36 of the present invention, the insulation imparting gas generating source material in the method of embodiment 3-35 is selected from the group consisting of magnesium hydroxide, aluminum hydroxide, magnesium carbonate and calcium carbonate.

According to embodiment 3-37 of the present invention, the arc resistant inorganic powder in the method of embodiment 3-35 is selected from the group consisting of zircon powder, cordierite powder and mullite powder.

According to embodiment 3-38 of the present invention, the primary metal salt of phosphoric acid in the method of embodiment 3-35 is selected from the group consisting of aluminum primary phosphate, magnesium primary phosphate and sodium primary phosphate.

According to embodiment 3-39 of the present invention, the curing agent for the primary metal salt of phosphoric acid in the method of embodiment 3-35 is selected from the group consisting of wollastonite crystal, magnesium hydroxide, aluminum hydroxide, magnesium carbonate and calcium carbonate.

According to embodiment 3-40 of the present invention, there is provided a switch comprising electrodes, contacts provided to the electrodes, and an arc extinguishing chamber provided in the vicinity of the electrodes and contacts and having an arc extinguishing side plate formed of an arc extinguishing plate material as recited in any one of embodiments 3-1 to 3-13 and 3-26 to 3-34.

The arc extinguishing plate material (I) of the present invention comprises, after curing, 35 to 50% of the reinforcing inorganic material sheet and 50 to 65% of the inorganic binder composition (B). Such a high content of the inorganic binder composition (B) imparts the arc extinguishing plate material (I) with excellent heat resistance, arc resistance, thermal shock resistance and the like. Further, the reinforcing inorganic material sheet contained in the proportion of 35 to 50% allows the plate material (I) to exhibit excellent mechanical strength, punching quality and the like and to be readily produced. Such plate material (I) offers such merit as to absorb the energy of an arc generated in the arc extinguishing chamber of a switch upon an opening or closing operation of the electrodes thereof to extinguish the arc by absorbing the energy of the arc and cooling down, thereby protecting components of the switch from the heat of the arc.

Where the reinforcing inorganic material sheet used in the arc extinguishing plate material (I) is formed of a glass mat or glass fabric, e.g. those made of a glass fiber having an excellent insulating property, or a ceramic paper made from a ceramic fiber, the plate material (I) exhibits higher mechanical strength and heat resistance.

Where the inorganic binder composition (A) used in the arc extinguishing plate material (I) is the inorganic binder composition (I) comprising 30 to 45% of an insulation imparting gas generating source compound, 0 to 28% of an arc resistant inorganic powder, 40 to 65% of an aqueous solution of primary metal salt of phosphoric acid and 2 to 10% of a curing agent for the primary metal salt of phosphoric acid, combining the binder composition (I) integrally with the reinforcing inorganic material sheet affords the arc extinguishing plate material (I) with excellent mechanical strength, arc resistance, heat resistance and the like. When this plate material (I) is applied to a switch, it will demonstrate the effect of satisfactorily preventing a decrease in electrical resistance by insulating metal vapor and molten metal droplets which are generated from the electrodes, contacts and other metal components located adjacent thereto by an arc generated upon an opening or closing operation of the contacts.

Where the insulation imparting gas generating source compound in the arc extinguishing plate material (I) is aluminum hydroxide, the compound will generate atomic oxygen and molecular oxygen (O and $O_2$) as the insulation imparting gas, resulting in a more potent effect in preventing the decrease in electrical resistance.

Where the primary metal salt of phosphoric acid contained in the inorganic binder composition (A) in the arc extinguishing plate material (I) is aluminum primary phosphate or magnesium primary phosphate, the binder composition exhibits favorable properties required for a binder since aluminum primary phosphate or magnesium primary phosphate exhibits an excellent solubility in water and affords an aqueous solution of satisfactory viscosity and binding property, thus giving the inorganic binder composition (A) advantageously.

Where the aqueous solution of primary metal salt of phosphoric acid contained in the inorganic binder composition (A) in the arc extinguishing plate material (I) has a concentration of the primary metal salt of phosphoric acid ranging from 25 to 55%, the concentration of the primary metal salt of phosphoric acid in such solution can be easily adjusted to 65 to 85%. In addition, it is possible to adjust the contents of the insulation imparting gas generating source compound and arc resistant inorganic powder to predetermined values and, hence, the inorganic binder composition (A) is possible to be favorably made to adhere to the reinforcing inorganic material sheet. This results in an easy preparation of the sheet.

Where the curing agent for the primary metal salt of phosphoric acid in the arc extinguishing plate material (I) is wollastonite crystal or aluminum hydroxide, it is possible to impart the primary metal salt of phosphoric acid with water resistance by heating to about 150° C., thereby giving the plate material (I) with an excellent water resistance.

Where the inorganic binder composition (A) in the arc extinguishing plate material (I) is the inorganic binder composition (II) comprising 30 to 50% of an insulation imparting gas generating source compound, 0 to 20% of an arc resistant inorganic powder and 50 to 70% of an aqueous solution of condensed alkali metal phosphate, the plate material (I) containing the inorganic binder composition (II) is capable of more effectively preventing the decrease in electrical resistance than that containing the aforementioned inorganic binder composition (I).

Where the insulation imparting gas generating source compound in the arc extinguishing plate material (I) is magnesium hydroxide, magnesium carbonate or calcium carbonate, the plate material (I) is capable of more effectively preventing the decrease in electrical resistance than that containing aluminum hydroxide.

Where the condensed alkali metal phosphate contained in the inorganic binder composition (A) in the arc extinguishing plate material (I) is sodium metaphosphate or potassium metaphosphate, the binder composition exhibits favorable properties required for a binder such as an excellent solubility in water and affords an aqueous solution of satisfactory viscosity and binding property, thus giving the inorganic binder composition (A) advantageously.

Where the aqueous solution of condensed alkali metal phosphate contained in the inorganic binder composition (A) in the arc extinguishing plate material (I) has a condensed alkali metal phosphate concentration of 10 to 40%, it is possible to easily adjust the concentration of the condensed alkali metal phosphate in the aqueous solution to 65 to 85%. In addition, the contents of the insulation imparting gas generating source compound and arc resistant inorganic powder can readily be adjusted to predetermined values and, hence, it is possible to make the inorganic binder composition (A) favorably adhere to the reinforcing inorganic material sheet, thereby facilitating the preparation of the sheet.

Where the insulation imparting gas generating source compound in the arc extinguishing plate material (I) acts also as a curing agent for the condensed alkali metal phosphate, the compound reacts with the condensed alkali metal phosphate, thereby advantageously rendering the condensed alkali metal phosphate water resistant.

Where the arc resistant inorganic powder in the arc extinguishing plate material (I) is aluminum oxide powder, it exhibits excellent arc resistance and electrical insulating property and serves also as a curing agent, while on the other hand when the arc resistant inorganic powder is zircon powder or cordierite powder, it exhibits excellent arc resistance and low expansibility. Accordingly, the plate material (I) obtained with use of such arc resistant inorganic powder exhibits improved thermal shock resistance and can be prepared with less raw material cost.

The arc extinguishing plate material (I) of the present invention is prepared by the steps of: drying a sheet comprising a reinforcing inorganic material sheet and an inorganic binder composition (A) at 80° to 120° C. and then subjecting the same to pressure molding; and aging the sheet, thus pressure molded at 120° to 200° C. to remove moisture therefrom and cure the sheet, followed by cooling the sheet thus molded and cured down to 80° C. or below. Such preparation method affords the aforementioned excellent arc extinguishing plate material (I) with ease.

In the above preparation method, the sheet prior to undergoing the pressure molding is prepared by the steps of: mixing 30 to 45% of an insulation imparting gas generating source compound, 0 to 28% of an arc resistant inorganic powder and 2 to 10% of a curing agent for a primary metal salt of phosphoric acid; adding, to the resulting mixture, 40 to 65% of the aqueous solution of primary metal salt of phosphoric acid, followed by kneading to prepare the inorganic binder composition (I); immersing the reinforcing inorganic material sheet into the inorganic binder composition (I) to form a sheet with the inorganic binder composition (I) adhering thereto; and drying the sheet at 80° to 120° C. to adjust the concentration of the primary metal salt of phosphoric acid in the aqueous solution to 65 to 85%. The inorganic binder composition (I) can be well integrated with the reinforcing inorganic material sheet without being forced out thereof when the sheet is pressure molded, thereby giving the arc extinguishing plate material (I) of dense quality which offers an excellent mechanical strength and the like.

In the method of the present invention, in case that the insulation imparting gas generating source compound is aluminum hydroxide; the arc resistant inorganic powder is selected from the group consisting of aluminum oxide powder, zircon powder and cordierite powder; the curing agent for the primary metal salt of phosphoric acid is wollastonite crystal or aluminum hydroxide; and the aqueous solution of primary metal salt of phosphoric acid is a 25 to 55% aqueous solution of aluminum primary phosphate or magnesium primary phosphate, the arc extinguishing plate material (I) obtained by the method exhibits excellent arc resistance, heat resistance and thermal shock resistance and offers a favorable effect in preventing the decrease in electrical resistance.

In the method of the present invention, in case that the sheet prior to undergoing the pressure molding is prepared by the steps of: mixing 30 to 50% of an insulation imparting gas generating source compound and 0 to 20% of an arc resistant inorganic powder; adding, to the resulting mixture, 50 to 70% of an aqueous solution of a condensed alkali metal phosphate, followed by kneading to prepare the inorganic binder composition (II); immersing the reinforcing inorganic material sheet into the inorganic binder composition (II) to prepare a sheet with the inorganic binder composition (II) adhering thereto; and drying the sheet at 80° to 120° C. to adjust the concentration of the condensed alkali metal phosphate in the aqueous solution to 65 to 85%, the arc extinguishing plate material obtained by this method offers a more potent effect in preventing the decrease in electrical resistance than that employing the inorganic binder composition (I).

In the method of the present invention, in case that the insulation imparting gas generating source compound is selected from the group consisting of magnesium hydroxide, magnesium carbonate and calcium carbonate; the arc resistant inorganic powder is selected from the group consisting of aluminum oxide powder, zircon powder and cordierite powder; and the aqueous solution of the condensed alkali metal phosphate is a 10 to 40% aqueous solution of sodium metaphosphate or potassium metaphosphate, the resulting arc extinguishing plate material offers a more potent effect in preventing the decrease in electrical resistance than that employing the aqueous solution of primary metal salt of phosphoric acid.

In the method of the present invention, in case that the proportion of the inorganic binder composition (I) or (II) adhering to the sheet is 200 to 350 parts relative to 100 parts of the reinforcing inorganic material sheet, the resulting arc extinguishing plate material exhibits excellent heat resistance, arc resistance and thermal shock resistance.

In the method of the present invention, in case that the sheet prior to undergoing the pressure molding comprises a plurality of stacked sheets dried at 80° to 120° C., the resulting arc extinguishing plate material offers the effect of easily controlling the size (thickness) thereof and enjoys improved mechanical strength as compared to that comprising a single sheet.

Where the method of the present invention comprises the step of applying an insulation imparting gas generating source compound onto either or both faces of a reinforcing inorganic material sheet containing the inorganic binder composition (A), the resulting arc extinguishing plate material offers a potent effect in preventing the decrease in electrical resistance as compared to that resulting from the method excluding the application step.

In the method of the present invention, in case that the insulation imparting gas generating source compound is selected from the group consisting of magnesium hydroxide, magnesium carbonate and calcium carbonate, the resulting arc extinguishing plate material offers a greater effect in preventing the decrease in electrical resistance than that employing aluminum hydroxide.

Where the method of the present invention comprises the steps of: preparing one of the sheets to be stacked on each other with use of an inorganic binder composition (I) as recited in embodiment 3-3 and the other with use of an inorganic binder composition (II) as recited in embodiment 3-8; drying at 80° to 120° C. the one sheet to adjust the concentration of the primary metal salt of phosphoric acid in the aqueous solution contained therein to 65 to 85% and the other sheet to adjust the concentration of the condensed alkali metal phosphate in the aqueous solution contained therein to 65 to 85%; stacking the other sheet on either or both faces of the one sheet; further stacking the resulting stacked sheet on a stacked sheet of the same type to obtain a laminated sheet of a required thickness; subjecting the laminated sheet to pressure molding; aging the thus molded laminated sheet to facilitate removal of moisture therefrom and curing of the molded laminated sheet; and cooling the molded laminated sheet down to 80° C. or below, the resulting arc extinguishing plate material enjoys a more potent effect in preventing the decrease in electrical resistance than that using the inorganic binder composition (I) singly.

Where the method of the present invention further comprises the step of coating or impregnating the arc extinguishing plate material (I) with a coating material for preventing the plate material (I) from dusting when subjected to a punching process, the resulting plate material enjoys the effect of reducing the amount of fiber particles to be generated when the plate material is punched or cut in the punching process.

In the method of the present invention, in case that the coating material is an organic metal compound (a metal alkoxide) or an organic resin, the binding property of the coating material with the underlying plate material (I) is satisfactory, thus resulting in a potent effect in preventing dusting.

The arc extinguishing plate material (II) of the present invention is obtained by pressure molding and aging the inorganic binder composition (C) comprising 40 to 55% of an insulation imparting gas generating source compound, 25 to 40% of an arc resistant inorganic powder, 8 to 18% of a primary metal salt of phosphoric acid, 5 to 10% of a curing agent for the primary metal salt of phosphoric acid, 2.6 to 12% of water, and 2 to 10% of a reinforcing inorganic fiber. The plate material (II) of such constitution enjoys excellent heat resistance and arc resistance.

Where the insulation imparting gas generating source compound used in the arc extinguishing plate material (II) is selected from the group consisting of magnesium hydroxide, aluminum hydroxide, magnesium carbonate and calcium carbonate, the plate material (II) offers an potent effect in preventing the decrease in electrical resistance, like the foregoing plate material (I) employing the inorganic binder composition (II).

Where the arc resistant inorganic powder used in the arc extinguishing plate material (II) is selected from the group consisting of zircon powder, cordierite powder and mullite powder, the plate material (II) exhibits excellent thermal shock resistance as well as excellent arc resistance.

Where the primary metal salt of phosphoric acid used in the arc extinguishing plate material (II) is selected from the group consisting of aluminum primary phosphate, magnesium primary phosphate and sodium primary phosphate, the insulation imparting gas generating source compound acts also as a curing agent, thus leading to a favorable inorganic binder composition.

Where the water is contained in the arc extinguishing plate material (II) in such an amount as to afford a 60 to 75% aqueous solution of primary metal salt of phosphoric acid, the plate material (II) becomes plastic when subjected to the pressure molding and hence is turned into a dense molded product.

Where the curing agent for the primary metal salt of phosphoric acid in the arc extinguishing plate material (II) is selected from the group consisting of wollastonite crystal, magnesium hydroxide, aluminum hydroxide, magnesium carbonate and calcium carbonate, there appears an effect such that heating up to 200° C. affords a molded product with water resistance.

Where the reinforcing inorganic fiber in the arc extinguishing plate material (II) is an inorganic short fiber, the reinforcing inorganic fiber is homogeneously dispersed in the plate material (II) and imparts the plate material (II) with an excellent heat resistance.

Where the inorganic short fiber in the arc extinguishing plate material (II) is selected from the group consisting of a natural mineral fiber, a ceramic fiber and a ceramic whisker, the plate material (II) enjoys further enhanced mechanical strength and arc resistance.

Where the natural mineral fiber in the arc extinguishing plate material (II) is wollastonite crystal which acts also as a curing agent for the primary metal salt of phosphoric acid, the unreacted fiber component thereof acts to improve the mechanical strength of the plate material while the reacted fiber component thereof acts to impart the plate material with water resistance.

The arc extinguishing plate material (II) of the present invention is prepared by the steps of: pressure molding in a mold the inorganic binder composition (C) comprising 40 to 55% of an insulation imparting gas generating source compound, 25 to 40% of an arc resistant inorganic powder, 8 to 18% of a primary metal salt of phosphoric acid, 5 to 10% of a curing agent for the primary metal salt of phosphoric acid, 2.6 to 12% of water and 2 to 10% of a reinforcing inorganic fiber; and aging the thus molded product at 120° to 200° C. The arc extinguishing plate material thus prepared does, in most cases, not require finishing and hence can be a final product such as an arc extinguishing plate.

In the above method of the present invention, in case that the insulation imparting gas generating source compound is selected from the group consisting of magnesium hydroxide, aluminum hydroxide, magnesium carbonate and calcium carbonate, the compound will generate an insulation imparting gas comprising atomic oxygen, molecular oxygen, carbon dixoide and carbon monoxide, which effectively prevents the decrease in electrical resistance.

In the method of the present invention, in case that the arc resistant inorganic powder is selected from the group consisting of zircon powder, cordierite powder and mullite powder, the resulting arc extinguishing plate material (II) enjoys excellent arc resistance as well as excellent thermal shock resistance.

In the method of the present invention, in case that the primary metal salt of phosphoric acid is selected from the group consisting of aluminum primary phosphate, magnesium primary phosphate and sodium primary phosphate, the inorganic binder composition (C) exhibits a strong binding power.

In the method of the present invention, in case that the curing agent for the primary metal salt of phosphoric acid is selected from the group consisting of wollastonite crystal, magnesium hydroxide, aluminum hydroxide, magnesium carbonate and calcium carbonate, the water resistance of the plate material (II) is developed by heating up to 200° C. and, in addition, the mechanical strength thereof is improved.

The switch of the present invention comprises electrodes, contacts provided to the electrodes, and an arc extinguishing chamber provided in the vicinity of the electrodes and contacts, and the chamber has an arc extinguishing side plate formed of an arc extinguishing plate material (I) or (II) as recited in any one of embodiments 3-1 to 3-13 and 3-26 to 3-34. The switch of such arrangement enjoys superior interrupting property, durability and insulation resistance enhancing performance.

The arc extinguishing plate material (I) of the present invention comprises 35 to 50% of a reinforcing inorganic material sheet and 50 to 65% of an inorganic binder composition (B), the arc extinguishing plate material resulting from pressure molding and aging of a sheet comprising the reinforcing inorganic material sheet and an inorganic binder composition (A).

The reinforcing inorganic material sheet serves to impart the obtained arc extinguishing plate material with an excellent mechanical strength, and any reinforcing inorganic material sheets which have been conventionallly used in the production of arc extinguishing plate material can be used in the present invention without particular limitations.

Examples of specific reinforcing inorganic material sheets are, for instance, glass mat and glass fabric, e.g. those made of a glass fiber having an excellent insulating property such as E glass, S glass, D glass or silica glass, and a ceramic paper of about 0.5 to 2.0 mm thickness which is obtained by papering a ceramic fiber such as alumina fiber or aluminosilicate fiber, which are all commercially available.

The inorganic binder composition (A), which is used as integrated with the reinforcing inorganic material sheet, serves to afford a plate material with excellent mechanical strength, heat resistance, arc resistance, thermal shock resistance and the like. The inorganic binder composition (A) also serves, when an arc is generated in the arc extinguishing chamber of a switch upon an opening or closing operation of the electrodes of the switch, to absorb the energy of the arc for cooling down and extinguish it, thereby protecting the components of the switch from the heat of the arc, while at the same time insulating metal vapor and molten metal droplets that are generated from the electrodes, contacts and other metal components adjacent thereto by the arc, thereby preventing a decrease in the insulation resistance of the switch.

The inorganic binder composition (A) used in the preparation of the aforementioned sheet may comprise any such composition which serves the aforementioned purposes without particular limitations. Examples of the binder composition (A) include inorganic binder composition (I) comprising 30 to 45% of an insulation imparting gas generating source compound, 0 to 28% of an arc resistant inorganic powder, 40 to 65% of an aqueous solution of primary metal salt of phosphoric acid and 2 to 10% of a curing agent for the the primary metal salt of phosphoric acid, and inorganic binder composition (II) comprising 30 to 50% of an insulation imparting gas generating source compound, 0 to 20% of an arc resistant inorganic powder and 50 to 70% of an aqueous solution of condensed alkali metal phosphate.

Detailed description will be made on the inorganic binder composition (I) for use as the inorganic binder composition (A).

The insulation imparting gas generating source compound contained in the binder composition (I) is adapted to generate a gas by an arc generated upon an opening or closing operation of the electrodes of a switch, and the gas acts to insulate metal vapor and molten metal droplets which are generated from the electrodes, contacts and other metal components adjacent thereto of the switch by the arc.

It is assumed that the insulation imparting gas generated from the insulation imparting gas generating source compound insulates the metal vapor and molten metal droplets produced from the metal components of the switch according to the following process.

When the electrodes disposed within the arc extinguishing chamber of the switch is operated to be opened or closed, an arc is generated between the contacts of the electrodes and generates heat of about 4000° to about 6000° C. As a result, the electrodes, contacts and other metal components located adjacent thereto are heated and thereby scatter metal vapor and molten metal droplets therefrom. At this time, the insulation imparting gas generating source compound contained in the arc extinguishing side plate of the arc extinguishing chamber is heated by the arc as well as by the metal vapor and molten metal droplets to generate an insulation imparting gas.

The insulation imparting gas herein is meant by a gas of the properties to insulate the metal vapor and molten metal droplets. The gas reacts with the metal vapor and molten metal droplets and thereby insulates the same.

When the gas reactive with such metal vapor and molten metal droplets is generated, the gas reacts with the metal vapor and molten metal droplets and, hence, the reaction product is scattered together with unreacted insultion imparting gas generating source compound. Accordingly, the substance thus insulated and the substance inherently insulative are deposited onto walls of the arc extinguishing chamber as well as onto the surfaces of components accommodated within the switch.

Thus, the metal vapor and molten metal droplets, which conventionally have greatly contributed to the decrease in electrical resistance, are insulated and, hence, the decrease in electrical resistance is prevented, thereby inhibiting the occurrence of insulation failure due to the generation of arc.

It should be noted that when the metal vapor and molten metal droplets being forcibly scattered from the electrodes, contacts and other metal components located adjacent thereto by arc are insulated, the insulation imparting gas cannot approach the contacts because of the high pressure metal vapor expanding, so that a layer resulting from insulated metal vapor and molten metal droplets is not formed on the contacts and, hence, the electric conduction between the contacts will not be affected.

Examples of the insulation imparting gas generating source compound for generating the aforementioned gas which is reactive with the metal vapor and molten metal droplets are, for instance, metal hydroxides and metal carbonates, which are advantageously used in view of their great insulation imparting effect.

Representative examples of the metal hydroxides are zinc hydroxide ($Zn(OH)_2$), aluminum hydroxide ($Al(OH)_3$), calcium hydroxide ($Ca(OH)_2$) and magnesium hydroxide ($Mg(OH)_2$).

Representative examples of the metal carbonates are calcium carbonate ($CaCO_3$), magnesium carbonate ($MgCO_3$) and dolomite ($CaMg(CO_3)_2$).

Of these compounds, aluminum hydroxide is preferred, since it reacts with the aqueous solution of primary metal salt of phosphoric acid not rapidly, imparts the inorganic binder composition (I) with appropriate viscosity, and offers a potent insulation imparting effect.

The above-mentioned insulation imparting gas generating source compounds which are reactive with the metal vapor and molten metal droplets may be used either alone or in combination.

Where the insulation imparting gas generating source compound is in powder form, the average particle diameter thereof is not particularly limited, but is usually from about 0.6 to about 40 $\mu$m for metal hydroxides and from about 0.3 to about 20 $\mu$m for metal carbonates from the viewpoints of the mixing property thereof in the inorganic binder composition (A), the moldability of the resulting arc extinguishing plate material and cost.

The arc resistant inorganic powder used in the inorganic binder composition (I) is a component for imparting the obtained arc extinguishing plate material (I) with an excellent arc resistance.

Examples of the arc resistant inorganic powders are, for instance, aluminum oxide powder (alumina powder, $Al_2O_3$), zircon powder (zirconium silicate, $ZrO_2.SiO_2$), cordierite powder ($2MgO.2A_2O_3.5SiO_2$), mullite powder ($3Al_2O_3.2SiO_2$), magnesium oxide (MgO) and zirconium oxide ($ZrO_2$). These may be used either alone or in combination.

Of these powders, aluminum oxide powder, zircon powder, cordierite powder and mullite powder are preferred in terms of the following features.

Aluminum oxide powder is excellent in arc resistance and electrical insulating property and acts also as a curing agent for the primary metal salt of phosphoric acid and of condensed alkali metal phosphate to be described later and hence is advantageously used in the present invention.

Zircon powder is excellent in arc resistance, has a low expansibility, and offers the effect of improving the thermal shock resistance of the resulting arc extinguishing plate material together with less raw material cost.

Cordierite powder is excellent in arc resistance, has a low expansibility, and offers the effect of improving the thermal shock resistance of the resulting arc extinguishing plate material together with less raw material cost.

Mullite powder is excellent in arc resistance, has a low expansibility, and offers the effect of improving the thermal shock resistance of the resulting arc extinguishing plate material together with less raw material cost.

The average particle size of the arc resistant inorganic powder is not particularly limited herein but is usually about 0.3 to about 40 $\mu$m in terms of its mixing property, dispersibility and cost.

The aqueous solution of primary metal salt of phosphoric acid used in the inorganic binder composition (I) is a component for serving as a binder of the reinforcing inorganic material sheet, insulation imparting gas generating source compound, arc resistant inorganic powder and curing agent for the primary metal salt of phosphoric acid.

Examples of the primary metal salts of phosphoric acid are, for instance, aluminum primary phosphate, magnesium primary phosphate, zinc primary phosphate and calcium primary phosphate. Among these, aluminum primary phosphate and magnesium primary phosphate are advantageously used, since they offers favorable properties in the preparation of the inorganic binder composition (I) such as high solubility in water and suitable viscosity for a binder when in the aqueous solution thereof. The suitable viscosity herein is such a low viscosity as to facilitate the mixing of the aqueous solution with the other components of the inorganic binder composition (I) and as to provide the binder composition (I) with a suitable binding characteristic for making the binder composition (I) adhere to the reinforcing inorganic material sheet.

The concentration of the primary metal salt of phosphoric acid in the aqueous solution is preferably not lower than 25%, more preferably not lower than 30%, since when it is too low, a prolonged time period is likely to be required to remove excessive moisture from the aqueous solution in adjusting the concentration of the primary metal salt of phosphoric acid to 65 to 85% for the pressure molding of the sheet. When the concentration of the aqueous solution of primary metal salt of phosphoric acid is too high, such difficulties in preparing the plate material are likely to occur that: the aqueous solution comes to have an undesirably high viscosity; it is impossible for the binder composition (I) to contain the predetermined amounts of the insulation imparting gas generating source compound and arc resistant inorganic powder; and further the reaction of the aqueous solution with the curing agent proceeds too rapidly. Therefore, the concentration of the primary metal salt of phosphoric acid is preferably not higher than 55%, more preferably not higher than 50%.

The aluminum primary phosphate represented by $Al(H_2PO_4)_3$ remains water soluble when heated to a temperature lower than 500° C. and hence is poor in water resistance and electrical insulating property. For this reason, the aluminum primary phosphate is required to be heated to 500° C. or above so as to develop the water resistance thereof. The same is true for the magnesium primary phosphate ($Mg(H_2PO_4)_2$). Accordingly, any of the following curing agents is needed to cause the primary metal salts to develop their water resistance.

Examples of the curing agents for the primary metal salt of phosphoric acid for use in the inorganic binder composition (I) include, as well as conventionally known aluminum hydroxide, wollastonite crystal ($CaO.SiO_2$), magnesium oxide (MgO), calcium oxide (CaO) and zinc oxide (ZnO). Among these, wollastonite crystal and aluminum hydroxide are preferable.

Aluminum hydroxide serves also as the insulation imparting gas generating source compound. Hence, where aluminum hydroxide is used for both the curing agent for the primary metal salt of phosphoric acid and the insulation imparting gas generating source compound, the amount thereof to be used is the total of the amounts required for the two.

As a result of intensive study by the inventors on curing agents other than aluminum hydroxide which are applicable to the primary metal salt of phosphoric acid, wollastonite crystal is found to act as a curing agent which is capable of imparting the primary metal salt of phosphoric acid with water resistance by heating to about 150° C.

The average particle diameter of the curing agent is not particularly limited but is usually less than about 60 $\mu$m, especially about 2 to about 40 $\mu$m in terms of its mixing property, dispersibility and cost.

The content of the insulation imparting gas generating source compound in the inorganic binder composition (I) is usually within the range of 30 to 45%, preferably 35 to 40%. When it is too small, the insulation imparting gas generating source compound is consumed as the curing agent for the primary metal salt of phosphoric acid and hence is impossible to serve the inherent purpose, i.e., to generate the insulation imparting gas. On the other hand, when the content thereof is too large, it exceeds the range for assuring the effect of binding the primary metal salt of phosphoric acid and, hence, it is difficult to obtain a dense plate material but a bulky plate material with less strength hence susceptible to damage.

When the content of the arc resistant inorganic powder in the inorganic binder composition (I) is too large, the resulting arc extinguishing plate material exhibits a degraded strength and hence is susceptible to damage though enjoying an enhanced arc resistance. For this reason, the content of the arc resistant inorganic powder is usually not greater than 28%, preferably not greater than 25%. In case that there is used no arc resistant inorganic powder, the insulation imparting gas generating source compound can replace the arc resistant inorganic powder, thereby suppressing the decrease in the arc resistance of the plate material. Therefore, there is no particular lower limit of the content of the arc resistant inorganic powder. Nevertheless, as far as it is used, the arc resistant inorganic powder is preferably contained in an amount of about 10% or greater to serve its purpose.

When the content of the aqueous solution of primary metal salt of phosphoric acid in the inorganic binder composition (I) is too small, it is difficult to obtain a dense arc extinguishing plate material. For this reason, the content of the aqueous solution is usually not smaller than 40%, preferably not smaller than 45%. On the other hand, when the content of the aqueous solution is too large, not only it is difficult for the curing agent to impart the plate material with water resistance but also the aqueous solution adheres to the reinforcing inorganic material sheet in a decreased amount, resulting in the plate material with degraded strength. For this reason the content of the aqueous solution is usually not greater than 65%, preferably not greater than 60%.

When the content of the curing agent for the primary metal salt of phosphoric acid in the inorganic binder composition (I) is too small, there is little difference in the temperature at which the primary metal salt of phosphoric acid develops its water resistance between the case where the curing agent is used and the case where no curing agent is used and, hence, the heating to about 500° C. is required for the development of the water resistance. For this reason, the content of the curing agent is usually not less than 2%, preferably not less than 3%. When the content of the curing agent is too large, the primary metal salt of phosphoric acid is cured too rapidly and, hence, the time period for required operation is shortened; for example, such a problem may arise that the inorganic binder composition (I) is solidified upon the preparation thereof, thereby rendering the subsequent operation impossible to be carried out. For this reason, the content of the curing agent in the inorganic binder composition (I) is usually not greater than 10%, preferably not greater than 5%.

Where the curing agent is used within the above range, such benefits will result that: a sufficient time is assured for subsequent operations; the water resistance of the aqueous solution of primary metal salt of phosphoric acid is developed at about 150° to about 200° C.; the preparation of the plate material is facilitated; and the resulting plate material is excellent in arc resistance, mechanical strength and thermal shock resistance.

Where wollastonite crystal is used as the curing agent, there is no need to change the aforementioned content thereof, whereas when aluminum hydroxide is used which acts also as the insulation imparting gas generating compound, the amount thereof to be used has to be the total of the amount acting as the insulation imparting gas generating source compound and the amount acting as the curing agent. Where the arc extinguishing plate material is prepared by gradually increasing the amount of aluminum hydroxide in the inorganic binder composition (A), the amount of aluminum hydroxide for use as the curing agent is the minimum amount for sufficient curing, and the amount thereof for use as the insulation imparting gas generating source compound is the amount used as exceeding the amount for use as the curing agent. When wollastonite crystal and aluminum hydroxide are used in combination as the curing agent, the amount of aluminum hydroxide for use as the curing agent and that for use as the insulation imparting gas generating source compound can also be determined.

In the present invention, it is preferable to use wollastonite crystal as the curing agent and aluminum hydroxide as the insulation imparting gas generating source compound for preventing the decrease in insulation resistance due to arc, for the purpose of imparting the plate material with insulating property and water resistance.

Next, reference will be made to the aforementioned inorganic binder composition (II).

The purposes and specific examples of the insulation imparting gas generating source compound in the inorganic binder composition (II) are the same as those of the inorganic binder composition (I) and, hence, the description thereon is herein omitted. Nevertheless, the use of the insulation imparting gas generating source compound comprising magnesium hydroxide, magnesium carbonate or calcium carbonate is advantageous in that the compound partially reacts with the condensed alkali metal phosphate in the drying step of the preparation process for the arc extinguishing plate material and further reacts therewith by 10 to 25% in the aging step at 120° to 200° C. after the pressure molding, thereby acting also as the curing agent which imparts the plate material with water resistance as in the inorganic binder composition (I).

Magnesium hydroxide, magnesium carbonate and calcium carbonate are each insoluble in the aqueous solution of condensed alkali metal phosphate at room temperature but each assumes suspended condition therein.

The purposes and specific examples of the arc resistant inorganic powder in the inorganic binder composition (II) are the same as those of the inorganic binder composition (I) and, hence, the description thereon is herein omitted.

The aqueous solution of condensed alkali metal phosphate in the inorganic binder composition (II) serves as a binding agent as does the aqueous solution of primary metal salt of phosphoric acid in the inorganic binder composition (I).

Examples of the condensed alkali metal phosphates are, for instance, sodium metaphosphate, potassium metaphosphate and lithium metaphosphate. Among these, sodium metaphosphate and potassium metaphosphate are advantageously used because they are less reactive with the aforementioned insulation imparting gas generating source compound at room temperature and have favorable characteristics for the preparation of the inorganic binder composition (II) such as to enjoy good solubility in water and to assure an aqueous solution thereof with suitable viscosity for a binding agent. The suitable viscosity of the aqueous solution of condensed alkali metal phosphate is meant by such a low viscosity as to facilitate the mixing thereof with other components of the inorganic binder composition (II) and as to impart the aqueous solution with a binding property suitable for making the solution adhere to the reinforcing inorganic material sheet.

The concentration of the condensed alkali metal phosphate in the aqueous solution is preferably not lower than 10%, more preferably not lower than 12%, since when it is too low, a prolonged time period is likely to be required to remove excessive moisture from the aqueous solution in adjusting the concentration of the condensed alkali metal phosphate in the aqueous solution to 65 to 85% for the pressure molding of the sheet. On the other hand, when the concentration of the condensed alkali metal phosphate is too high, such difficulties in preparing the plate material are likely to occur that: the aqueous solution comes to have an undesirably high viscosity; it is impossible for the binder composition (II) to contain the predetermined amounts of the insulation imparting gas generating source compound and arc resistant inorganic powder; and further the reaction of the aqueous solution with the curing agent proceeds too rapidly. Therefore, the concentration of the condensed alkali metal phosphate in the aqueous solution is preferably not higher than 40%, more preferably not higher than 30%.

The content of the insulation imparting gas generating source compound in the inorganic binder composition (II) is usually within the range of 30 to 50%, preferably 35 to 45%. When it is too small, the effect of the insulation imparting gas generating source compound is degraded. On the other hand, when the content thereof is too large, it exceeds the range for assuring the effect of binding the condensed alkali metal phosphate and, hence, the resulting plate material becomes bulky with less strength and hence susceptible to damage; in some cases the inorganic binder composition (II) assumes a condition like undissolved lump of flour, resulting in a difficulty in the preparation of the binder composition (II), which makes the subsequent operations unabled.

Where the insulation imparting gas generating source compound is used within the above range, such benefits will result that: a sufficient time is assured for required operations; the water resistance of the aqueous solution of condensed alkali metal phosphate is developed at about 150° to about 200° C.; the preparation of the plate material is facilitated; and the resulting plate material is excellent in arc resistance, strength and thermal shock resistance.

When the content of the arc resistant inorganic powder in the inorganic binder composition (II) is too large, the resulting arc extinguishing plate material exhibits degraded strength and hence is susceptible to damage though enjoying enhanced arc resistance. For this reason, the content of the arc resistant inorganic powder is usually not greater than 20%, preferably not greater than 15%. Where there is used no arc resistant inorganic powder, the insulation imparting gas generating source compound can replace the arc resistant inorganic powder, thereby suppressing the decrease in the arc resistance of the plate material. Therefore, there is no particular lower limit of the content of the arc resistant inorganic powder. Nevertheless, as far as it is used, the arc resistant inorganic powder is preferably contained in an amount of about 10% or greater to serve its purpose.

When the content of the aqueous solution of condensed alkali metal phosphate in the inorganic binder composition (II) is too small, it is difficult to obtain a dense arc extinguishing plate material. For this reason, the content of the aqueous solution is usually not smaller than 50%, preferably not smaller than 55%. On the other hand, when the content of the aqueous solution is too large, the aqueous solution adheres to the reinforcing inorganic material sheet in a decreased amount, resulting in the plate material with degraded strength. For this reason, the content of the aqueous solution is usually not greater than 70%, preferably not greater than 65%.

The arc extinguishing plate material (I) of the present invention is obtained by preparing the sheet from the foregoing reinforcing inorganic material sheet and the inorganic binder composition (A) and pressure molding and aging the sheet. The details of the pressure molding and aging overlaps the preparation method for the arc extinguishing plate material (I) to be described later and hence will be described in the description on such method.

In preparing the sheet, there may, as required, be incorporated, in addition to the aforementioned raw materials, a binder such as methyl cellulose or polyvinyl alcohol, a coloring agent such as glass frit or ceramic color, or the like within such a range as not to obstruct the purpose of the invention.

The inorganic binder composition (B) contained in the arc extinguishing plate material (I), which is used as integrated with the reinforcing inorganic material sheet, serves to afford the plate material with excellent mechanical strength, heat resistance, arc resistance, thermal shock resistance and the like. The inorganic binder composition (B) also serves, when an arc is generated in the arc extinguishing chamber of a switch upon an opening or closing operation of the electrodes of the switch, to absorb the energy of the arc for cooling down and extinguish it, thereby protecting the components of the switch from the heat of the arc, while at the same time insulating metal vapor and molten metal droplets that are generated from the electrodes, contacts and other metal components adjacent thereto by the arc, thereby preventing the decrease in the insulation resistance of the switch.

The inorganic binder composition (B) is prepared by drying, pressure molding and aging the inorganic binder composition (A) adhering to the reinforcing inorganic material sheet. Accordingly, the moisture originating from the aqueous solution of primary metal salt of phosphoric acid or condensed alkali metal phosphate in the inorganic binder composition (A) is removed, while all the solid contents of the composition (A) are retained as adhering to the reinforcing inorganic material sheet. When the arc extinguishing plate material (I) was heated to 200° C. to examine whether or not the weight thereof was decreased, the plate material was found not to lose its weight. Therefore, the inorganic binder composition (B) has, for example, such a composition as approximately containing 40 to 55% of the insulation imparting gas generating source compound, 0 to 34% of the arc resistant inorganic powder and 26 to 45% of the cured reaction product of the primary metal salt of phosphoric acid, when the inorganic binder composition (I) is used as the inorganic binder composition (A); a composition as approximately containing 42 to 65% of the insulation imparting gas generating source compound, 0 to 28% of the arc resistant inorganic powder and 34 to 40% of the cured condensed alkali metal phosphate, when the inorganic binder composition (II) is used as the inorganic binder composition (A), or a like composition. It should be noted that although the curing agent for the primary metal salt of phosphoric acid does not necessarily 100% react with the aqueous solution, the content of the curing agent is assumed to have entirely reacted therewith and hence is entirely included in the content of the cured reaction product of the primary metal salt of phosphoric acid.

When the content of the reinforcing inorganic material sheet in the arc extinguishing plate material (I) is too small, the amount of the inorganic binder composition (B) adhering to the sheet is greater than required. This results in the arc extinguishing plate material having degraded moldability for an arc extinguishing side plate though exhibiting excellent arc resistance and insulation imparting gas generating effect. Further, when such plate material is incorporated in the arc extinguishing chamber and is subjected to interrupting operations, the plate material may be peeled off or released from the chamber by heat of arc, vibration and generation of the insulation imparting gas and hence cannot retain its arc extinguishing property. For this reason the content of the reinforcing inorganic material sheet is set to not less than 35%, preferably not less than 37%. On the other hand, when the content of the reinforcing inorganic material sheet is too large, the amount of the inorganic binder composition (B) adhering to the sheet is less than required. This results in the arc extinguishing plate material which exhibits poor arc resistance and insulation imparting gas generating effect and hence does not show the characteristics required for an arc extinguishing plate material. For this reason the content of the reinforcing inorganic material sheet is set to not greater than 50%, preferably not greater than 45%.

The content of the inorganic binder composition (B), or 50 to 65% in the arc extinguishing plate material (I) of the present invention is so high that it was conventionally difficult to make such content of a binder composition adhere to the reinforcing inorganic material sheet and that even if such content of the binder composition had been successfully made adhere to the reinforcing inorganic material sheet and then aged, the binder composition would have been likely to be released from the sheet upon exposure to arc. Since the present invention enables a large amount of the inorganic binder composition (B) to be contained in the arc extinguishing plate material, the plate material enjoys superior arc resistance and insulation imparting gas generating effect.

The arc extinguishing plate material (I) may be a plate material having a thickness of 0.2 to 1.5 mm, preferably 0.4 to 1.2 mm which is obtained by pressure molding and aging a single sheet of the aforementioned type, or a plate material having a thickness of 0.5 to 3 mm, preferably 0.8 to 2.0 mm which is obtained by pressure molding and aging two or more, preferably two to five stacked sheets of the aforementioned type.

Where the arc extinguishing plate material is to be prepared from a single sheet, an insulation imparting gas generating source compound may further be applied onto either or both faces of the sheet. Further, the sheet may be coated or impregnated with a coating material for preventing the resulting plate material (I) from dusting when the plate material (I) is subjected to punching.

The above insulation imparting gas generating source compound to be applied is the same as the foregoing compound and preferably has an average diameter of about 0.3 to about 40 $\mu$m.

Such insulation imparting gas generating source compound to be applied is preferably magnesium hydroxide, magnesium carbonate or calcium carbonate in terms of their potent insulation imparting effect.

In the application of the source compound, any binder is usually unnecessary, but it is possible to use the aforesaid coating material as a binder.

The amount of the insulation imparting gas generating source compound to be applied is usually about 200 to about 450 g/m$^2$ for one face of the sheet.

The amount of the coating material for coating or impregnation is usually about 40 to about 100 g/m$^2$ for one face of the sheet. Examples of specific coating materials include organic metal compounds (metal alkoxides and the like) such as ethyl silcate, methyl silicate and tributoxy aluminum, and organic resins such as an acrylic resin, epoxy resin and polyester resin.

Where a plurality of stacked sheets are used, preferably the sheet prepared using the inorganic binder composition (II) is stacked on either or both faces of the sheet prepared using the inorganic binder composition (I). Such stacked sheets usually having a thickness of 1.1 to 3.0 mm in total, and the total thickness thereof is preferably adjusted to the required thickness of 0.8 to 2.5 mm in view of the mechanical strength and punching quality of the resulting plate material.

The plate material comprising a plurality of stacked sheets may also be applied with the insulation imparting gas generating source compound on either or both faces thereof, and further coated or impregnated with the coating material.

Next, the preparation method for the arc extinguishing plate material (I) will be described.

The arc extinguishing plate material (I) of the present invention is prepared by the steps of: preparing the sheet from the aforementioned reinforcing inorganic material sheet and the aforementioned inorganic binder composition (A); drying the sheet at 80° to 120° C. and then pressure molding the sheet; aging the sheet at 120° to 200° C. during or after the pressure molding to remove moisture therefrom so as to allow it to cure; and cooling the cured sheet to 80° C. or below.

The preparation of the inorganic binder composition (A) can be made by any of various methods without any particular limitations so far as the components of the composition are uniformly dispersed. For example, the solid components of the inorganic binder composition (A) are mixed using a mixer such as an agitation mortar, and then the liquid component (the aqueous solution of primary metal salt of phosphoric acid or of condensed alkali metal phosphate) is added to the mixture, followed by kneading to prepare the binder composition (A). Such method is preferred because it permits the solid components of the inorganic binder composition (A) to be uniformly mixed and dispersed and the liquid component to be uniformly mixed with the solid components, with the solid components being prevented from partially reacting with the liquid components.

If the inorganic binder composition (I) is prepared by, for example, mixing the solid components: 30 to 45% of the insulation imparting gas generating source compound, 0 to 28% of the arc resistant inorganic powder and 2 to 10% of the curing agent for the primary metal salt of phosphoric acid, and adding the liquid component, 40 to 65% of the aqueous solution of primary metal salt of phosphoric acid, to the resulting mixture, followed by kneading, the resulting binder composition (I) assumes a condition like a slurry as having the solid components thereof uniformly dispersed in the liquid component, i.e. the aqueous solution of primary metal salt of phosphoric acid and exhibiting a viscosity suitable for a binder.

A representative example of the inorganic binder composition (I) comprises aluminum hydroxide as the insulation imparting gas generating source compound, aluminum oxide powder, zircon powder or cordierite powder as the arc resistant inorganic powder, wollastonite crystal or aluminum hydroxide as the curing agent for the aqueous solution of primary metal salt of phosphoric acid, 25 to 55% aqueous solution of aluminum primary phosphate or magnesium primary phosphate as the aqueous solution of primary metal salt of phosphoric acid.

If the inorganic binder composition (II) is prepared by, for example, mixing the solid components: 30 to 50% of the insulation imparting gas generating source compound and 0 to 20% of the arc resistant inorganic powder, and adding the liquid component, 50 to 70% of the aqueous solution of condensed alkali metal phosphate, to the resulting mixture, followed by kneading, the resulting binder composition (II) assumes a condition like a slurry as having the solid components thereof uniformly dispersed in the liquid component, i.e. the aqueous solution of condensed alkali metal phosphate and exhibiting a viscosity suitable for a binder.

A representative example of the inorganic binder composition (II) comprises aluminum hydroxide, magnesium carbonate or calcium carbonate as the insulation imparting gas generating source compound, aluminum oxide powder, zircon powder or cordierite powder as the arc resistant inorganic powder, and 10 to 40% aqueous solution of sodium metaphosphate or potassium metaphosphate as the aqueous solution of condensed alkali metal phosphate.

It should be noted that the concentration of the primary metal salt of phosphoric acid or condensed alkali metal phosphate in the aqueous solution contained in the inorganic binder composition (I) or (II) is the same as that before the kneading.

The inorganic binder composition exhibiting the foregoing characteristics facilitates the subsequent preparation of the sheet and easily adheres to the voids or gaps and surface of the reinforcing inorganic material sheet.

The sheet can be prepared from the inorganic binder composition and reinforcing inorganic material sheet by any method without any limitations. Examples of specific methods include one in which the reinforcing inorganic material sheet is immersed in the predetermined inorganic binder composition and removed therefrom to have the predetermined impregnation rate, a roll coating method in which the predetermined inorganic binder composition (A) is supplied to the reinforcing inorganic material sheet from between rolls, and a doctor blade method in which the predetermined inorganic binder composition is applied to the reinforcing inorganic material sheet through a blade having a thickness set to a predetermined value.

The amount of the inorganic binder composition (I) or (II) adhering to the reinforcing inorganic material sheet is preferably 200 to 350 parts, more preferably 250 to 300 part relative to 100 parts of the reinforcing inorganic material sheet. The amount of the binder composition (I) or (II) within such range facilitates the transportation of the sheet in the preparation thereof, allows the arc extinguishing plate material (I) after undergoing the aging to have a suitable thickness, and results in the weight ratio between the reinforcing inorganic material sheet and the inorganic binder composition (B) after undergoing the aging falling within a proper range.

The sheet thus formed, which retains moisture in the inorganic binder composition (A) and is in a soft and deformable condition, is then dried at 80° to 120° C. (in an over, for example) to adjust the concentration of the primary metal salt of phosphoric acid or condensed alkali metal phosphate in the aqueous solution to 65 to 85%, preferably 75 to 80%. This is because if the sheet not subjected to the drying is directly pressure molded, the inorganic binder composition (A) with which the reinforcing inorganic material sheet is impregnated will ooze out of the sheet, so that the resulting plate material (I) of the undesired composition results.

If the concentration of the primary metal salt of phosphoric acid or condensed alkali metal phosphate in the aqueous solution exceeds 85%, the following disadvantages may result: the sheet can hardly be deformed even when pressure molded; the inorganic binder composition (A) is not densely filled into voids or gaps of the reinforcing inorganic material sheet; and where a plurality of sheets are stacked, the adhesion between the sheets becomes insufficient. As will be described later, in the case of the sheets stacked, the concentration of the primary metal salt of phosphoric acid or condensed alkali metal phosphate in the aqueous solution contained therein is preferably adjusted to 70 to 80% for providing suitable interlayer adhesion.

In the preparation method of the present invention, the adjustment of the concentration of the primary metal salt of phosphric acid or condensed alkali metal phosphate is very important.

The sheet dried at 80° to 120° C. is then subjected to pressure molding.

When the pressure in the pressure molding is too low, the arc extinguishing plate material is insufficiently pressurized and, hence, the plate material prior to undergoing the aging may suffer non-uniform denseness, or an unbonded portion may result at the interface of the stacked sheets. For this reason, the pressure in the pressure molding is preferably not lower than 100 kg/cm$^2$. On the other hand, when such pressure is too high, the inorganic binder composition (I) or (II) is likely to flow out of the reinforcing inorganic material sheet and thereby to make the sheet exposed and, hence, the characteristics required for the plate material may be impaired. In view of this, the pressure in the pressure molding is preferably not higher than 200 kg/cm$^2$.

In the present invention, the pressure molding may be carried out at room temperature or with the surface table of a press machine appropriately heated. Further, the duration of the pressure molding can be appropriately adjusted. Devices for use in the pressure molding include press machines having surface table, such as a hand press, mechanical press and oil press.

The arc extinguishing plate material prior to undergoing the aging is allowed to stand over a whole day and night, aged by heating at 120° to 200° C. in, for example, an oven to cure with the moisture contained therein being removed, and then cooled down to 80° C. or below. Thus, the arc extinguishing plate material is prepared.

When the temperature at which the heat aging is carried out is too low, the curing of the plate material proceeds taking a very long time, or otherwise even when the curing is successfully carried out, the compound for imparting the primary metal salt of phosphoric acid or condensed alkali metal phosphate with water resistance is insufficiently produced. For this reason, such temperature has to be not lower than 120° C., preferably not lower than 150° C. When the temperature is too high, only the surface layer of the molded product is cured rapidly and, hence, the required reaction becomes non-uniform between the surface portion and the deep portion of the molded product, thereby causing warpage of the plate material. For this reason, the temperature for the heat aging has to be not higher than 200° C., preferably not higher than 180° C. Since rapid cooling of the molded product after the heat aging causes the product to be warped, the molded product is cooled to 80° C. or below, preferably 50° C. or below to prevent such warpage. The cooling may be natural gradual cooling or a program-controlled cooling for cooling the product stepwise.

In pressure molding the sheet dried at 80° to 120° C., a suitable number of sheets may be stacked depending on the required thickness for the purpose of improving the mechanical strength and adjusting the size of the product. In this case, the insulation imparting gas generating source compound may further be applied onto either or both faces of the sheet to increase the amount of insulation imparting gas to be generated. The application is carried out by, for example, sieving the insulation imparting gas generating source compound with a 35-mesh sieve onto the sheet which has been dried at 80° to 120° C. to such an extent that the sheet becomes tacky when touched with a finger, in such a manner that the layer of the sieved compound has a uniform thickness.

Alternatively, to cause an increased amount of a more effective insulation imparting gas to be generated, the sheet containing the inorganic binder composition (II) may be stacked on either or both sides of the sheet containing the inorganic binder composition (I), and an appropriate number of sets of such stacks may further be stacked on top of another depending on the thickness of an intended product and then pressure molded.

In these cases also, the molded product is aged at 120° to 200° C. to remove the moisture contained therein and to cure, and then cooled to 80° C. or below. Thus, the arc extinguishing plate material (I) of the present invention is prepared.

The plate material thus formed may further be coated or impregnated with the coating material so as to prevent the plate material (I) from dusting when subjected to punching. The coating of the coating material can be carried out by roll coating, spray coating or brush coating. The impregnation can be carried out by filling a container sufficiently sized to accommodate the plate material (I) with the coating material and immersing the plate material (I) into the coating material with optional vacuum drawing process.

The arc extinguishing plate material (I) thus prepared is then subjected to a machine work such as finishing or punching to form an arc extinguishing plate, which is in turn combined with a magnetic plate to construct an arc extinguishing chamber.

The arc extinguishing plate material (II) of the present invention is obtained by pressure molding and aging the inorganic binder composition (C) comprising 40 to 55% of an insulation imparting gas generating source compound, 25 to 40% of an arc resistant inorganic powder, 8 to 18% of a primary metal salt of phosphoric acid, 5 to 10% of a curing agent for the primary metal salt of phosphoric acid, 2.6 to 12% of water, and 2 to 10% of a reinforcing inorganic fiber.

Unlike the inorganic binder composition (A), the inorganic binder composition (C) does not require the adjustment of the concentration of the primary metal salt of phosphoric acid in the aqueous solution. Further, the composition (C) advantageously has good moldability (the plate material can be molded directly into an arc extinguishing plate) and can afford the arc extinguishing plate material (II) with an excellent mechanical strength.

The purpose of the insulation imparting gas generating source compound contained in the inorganic binder composition (C), the process of insulating metal vapor and the like with an insulation imparting gas generated from the insulation imparting gas generating source compound, examples of specific insulation imparting gas generating source compounds, and the average particle diameter of the source compound when in powder form are the same as described with respect to the arc extinguishing plate material (I) and, hence, the description thereof is herein omitted.

It should be noted that among insulation imparting gas generating source compounds, there are preferred magnesium hydroxide, aluminum hydroxide, magnesium carbonate and calcium carbonate, since they are each capable of generating a sufficient amount of a highly effective insulation imparting gas.

The purpose, examples, preferable examples with reasons therefor, and average particle diameter of the arc resistant inorganic powder contained in the inorganic binder composition (C) are the same as described with respect to the arc extinguishing plate material (I) and, hence, the description thereon is herein omitted. Nevertheless, although aluminum oxide powder is preferably used in the plate material (I), aluminum oxide powder which is poor in thermal shock resistance cannot be preferably used in the arc extinguishing plate material (II) not containing the reinforcing inorganic material sheet for fear of break of the plate material (II) due to thermal shock.

The primary metal salt of phosphoric acid contained in the inorganic binder composition (C) acts to bind the insulation imparting gas generating source compound, arc resistant inorganic powder, curing agent for the primary metal salt of phosphoric acid and reinforcing inorganic fiber.

Examples, preferred examples together with reasons therefor of the primary metal salt of phosphoric acid are the same as described with respect to the arc extinguishing plate material (I) and, hence, the description thereon is herein omitted.

When the concentration of the primary metal salt of phosphoric acid in the aqueous solution is too low, the inorganic binder composition (C) has a decreased binding capacity and develops no plasticity, thereby providing a less densified molded product with degraded dimensional accuracy. For this reason the concentration is preferably not lower than 60%, more preferably not lower than 65%. When the concentration is too high, the aqueous solution exhibits an increased viscosity and rapidly reacts with the curing agent, thereby rendering the preparation of the composition (C) difficult, and even if the composition (C) is prepared, the resulting composition (C) readily adheres to a mold and hence can hardly be released therefrom, resulting in a molded product with lessened dimensional accuracy. For this reason, the concentration is preferably not higher than 75%, more preferably not higher than 72%.

Examples of the curing agents for the aqueous solution of primary metal salt of phosphoric acid for use in the inorganic binder composition (C) are, for instance, wollastonite crystal ($CaO.SiO_2$), magnesium hydroxide, aluminum hydroxide, magnesium carbonate and calcium carbonate. Among these, wollastonite crystal is found to serve as a curing agent which is capable of imparting the primary metal salt of phosphoric acid with water resistance by heating to about 150° C. from the intensive study on curing agents applicable to the primary metal salt of phosphoric acid made by the inventors, as described earlier. Wollastonite crystal effectively acts also as the reinforcing inorganic fiber of the arc extinguishing plate material (II), as will be described later.

Among the above curing agents, there are preferably used magnesium hydroxide, aluminum hydroxide, magnesium carbonate and calcium carbonate, since they act also as the insulation imparting gas generating source compound.

The average particle diameter of the curing agent is not particularly limited but is usually smaller than about 60 μm, preferably about 2 to about 40 μm in terms of mixing property, dispersibility and cost.

The water is used in the inorganic binder composition (C) for purposes of affording the aqueous solution of the primary metal salt of phosphoric acid having an appropriate concentration, imparting the binder composition (C) with excellent moldability and causing the arc extinguishing plate material (II) to develop a mechanical strength.

The reinforcing inorganic fiber contained in the inorganic binder composition (C) is a component which imparts the resulting plate material (II) with an excellent mechanical strength.

The reinforcing inorganic fiber is preferably an inorganic short fiber which is excellent in arc resistance and electrical insulating property and can be readily mixed uniformly with other materials. Examples of the short fibers are natural mineral fibers such as wollastonite crystal, ceramic fibers such as silica-alumina glass fiber (amorphous aluminum silicate fiber, $Al_2O_3$:$SiO_2$=47:53, 56:44, or the like), and ceramic whiskers such as aluminum borate whisker ($9Al_2O_3.2B_2O_3$), silicon carbide whisker (SiC), silicon nitride whisker ($Si_3N_4$) and calcium carbonate whisker. These may be used either alone or in combination. The natural mineral fibers, ceramic fibers and ceramic whiskers are preferred, since they exhibit excellent arc resistance and electrical insulating property and are readily uniformly mixed with the other components of the inorganic binder composition (C).

The average fiber diameter and average fiber length of the reinforcing inorganic fiber are not particularly limited, and commercially-available ones are usable in the present invention. Nevertheless, the average fiber diameter and average fiber length of the reinforcing inorganic fiber are preferably about 1 to about 10 μm and about 20 to about 50 μm, respectively, for wollastonite crystal; about 1 to about 15 μm and about 2 to about 100 μm, respectively, for silica-alumina glass fiber; about 1 to about 10 μm and about 30 to about 100 μm, respectively, for alumina fiber; about 0.5 to 1 μm and about 10 to 30 μm, respectively, for aluminum borate whisker; about 0.05 to about 10 μm and about 5 to about 40 μm, respectively, for silicon carbide whisker; about 0.2 to about 1 μm and about 5 to about 200 μm, respectively, for silicon nitride whisker; and about 0.5 to about 1 μm and about 20 to about 30 μm, respectively, for calcium carbonate whisker.

When the content of the insulation imparting gas generating source compound in the inorganic binder composition (C) is too small, the compound is consumed as the curing agent for the primary metal salt of phosphoric acid and hence cannot serve its inherent purpose or generate the insulation imparting gas, as described earlier. For this reason, the content of the insulation imparting gas generating source compound is set to usually not less than 40%, preferably not less than 45%, more preferably not less than 50%. On the other hand, when the content thereof is too large, it exceeds the range for assuring the effect of binding the primary metal salt of phosphoric acid and, hence, it is difficult to obtain a dense plate material but a bulky plate material with less strength hence susceptible to damage. The content of the compound is set to usually not greater than 55%, preferably not greater than 52%.

When the content of the arc resistant inorganic powder in the inorganic binder composition (C) is too small, the resulting arc extinguishing plate material (II) exhibits degraded arc resistance and loses the characteristics required for the arc extinguishing plate material. For this reason, the content thereof is set to usually not less than 25%, preferably not less than 30%. When the content of the powder is too large, the resulting arc extinguishing plate material (II) exhibits degraded strength and hence is susceptible to damage though enjoying enhanced arc resistance. For this reason, the content of the arc resistant inorganic powder is set to usually not greater than 40%, preferably not greater than 35%.

When the content of the primary metal salt of phosphoric acid in the inorganic binder composition (C) is too small, it is difficult to obtain a dense arc extinguishing plate material (II). For this reason, the content thereof is set to usually not less than 8%, preferably not less than 10%. When the content thereof is too large, it is difficult for the curing agent to impart the plate material with water resistance. For this reason, the content of the primary metal salt of phosphoric acid is set to usually not greater than 18%, preferably not greater than 15%.

When the content of the curing agent for the primary metal salt of phosphoric acid in the inorganic binder composition (C) is too small, there is little difference in the temperature, at which the primary metal salt of phosphoric acid develops its water resistance, whether or not the curing agent be used and, hence, the heating to about 500° C. is required for the development of the water resistance. For this reason, the content of the curing agent is set to usually not less than 5%, preferably not less than 7 %. When the content of the curing agent is too large, the primary metal salt of phosphoric acid is cured too rapidly and, hence, the time period available for necessary operations is shortened; for example, such a problem may arise that the inorganic binder composition (C) is solidified upon the preparation thereof, thereby rendering the subsequent operation impossible to be carried out. For this reason the content of the curing agent is set to usually not greater than 10%, preferably not greater than 9%.

Where the curing agent is used within the above range, such benefits will result that: a sufficient time is assured for operations; the water resistance of the aqueous solution of primary metal salt of phosphoric acid is developed at about 150° C. to about 200° C.; the preparation of the plate material (II) is facilitated; and the resulting plate material (II) is excellent in arc resistance, strength and thermal shock resistance.

Where wollastonite crystal is used as the curing agent, there is no need to change the aforementioned content thereof, whereas when there is used aluminum hydroxide, magnesium hydroxide, magnesium carbonate or calcium carbonate, each of which acts also as the insulation imparting gas generating source compound, the amount thereof to be used should be the total of the amount acting as the insulation imparting gas generating source compound and the amount acting as the curing agent. Where the arc extinguishing plate material (II) is prepared by gradually increasing the amount of, for example, aluminum hydroxide in the inorganic binder composition (C), the amount of aluminum hydroxide for use as the curing agent is the minimum amount for sufficient curing, and the amount thereof for use as the insulation imparting gas generating source compound is the amount used as exceeding the amount for use as the curing agent. Where wollastonite crystal and aluminum hydroxide are used in combination, the amount of aluminum hydroxide for use as the curing agent and that for use as the insulation imparting gas generating source compound can also be determined.

In the present invention, it is preferable to use wollastonite crystal as the curing agent, and aluminum hydroxide, magnesium hydroxide, magnesium carbonate or calcium carbonate as the insulation imparting gas generating source compound for preventing the decrease in insulation resistance due to arc, for the purpose of maximizing the inherent effect of the plate material (II).

As described earlier, when the concentration of the aqueous solution of primary metal salt of phosphoric acid is adjusted to within the preferable range, particularly to 60 to 75%, it is easy to obtain a dense molded product. From this point of view, the amount of water used in the inorganic binder composition (C) is at least 2.6%, preferably not less than 5%, more preferably not less than 6%. When the amount of water is too large, the inorganic binder composition (C) comes to assume a slurry condition in the preparation thereof, thus rendering required operations difficult. For this reason, the amount of water to be used in the inorganic binder composition (C) is usually not greater than 12%, preferably not greater than 10%, more preferably not greater than 8%.

When the content of the reinforcing inorganic fiber in the inorganic binder composition (C) is too small, the resulting arc extinguishing plate material (II) exhibits degraded mechanical strength (flexural strength) and hence loses the characteristics required for the arc extinguishing plate material (II). For this reason the content thereof is set to usually not less than 2%, preferably not less than 3%. When the content thereof is too large, it exceeds the range for assuring the effect of binding the primary metal salt of phosphoric acid and, hence, it is difficult to obtain a dense plate material but a bulky plate material with less strength hence susceptible to damage. For this reason, the content of the reinforcing inorganic fiber is set to usually not greater than 10%, preferably not greater than 8%.

If required, the inorganic binder composition (C) in the present invention may be incorporated with, in addition to the foregoing components, a binder such as methyl cellulose or polyvinyl alcohol, a coloring agent such as glass frit or ceramic color, or the like within such a range as not to obstruct the purpose of the invention.

The arc extinguishing plate material (II) of the present invention is obtained by pressure molding and aging the inorganic binder composition (C) thus described. Details of the pressure molding and aging will be described in the preparation method for the arc extinguishing plate material (II).

Since the inorganic binder composition (C) becomes free of water, the obtained plate material (II) approximately comprises 46 to 55% of the insulation imparting gas generating source compound, 33 to 45% of the arc resistant inorganic powder, 18 to 35% of the cured reaction product of the primary metal salt of phosphoric acid and 3 to 12% of the reinforcing inorganic fiber. It should be noted that although the curing agent for the primary metal salt of phosphoric acid does not necessarily 100% react with the primary metal salt of phosphoric acid, the content of the curing agent is assumed to have entirely reacted therewith and hence is entirely included in the content of the cured reaction product of the primary metal salt of phosphoric acid. When the arc extinguishing plate material (II) was heated to 200° C. to examine whether or not the weight thereof was decreased, the plate material was found not to lose its weight.

The arc extinguishing plate material (II) has a thickness of, for example, 0.5 to 2.5 mm, preferably 0.8 to 2.0 mm.

Next, the preparation method for the arc extinguishing plate material (II) is to be described.

The arc extinguishing plate material (II) of the present invention is prepared by the steps of: preparing the inorganic binder composition (C); pressure molding the composition (C) with a mold; and aging the molded product at 120° to 200° C.

The preparation of the inorganic binder composition (C) can be made by any of various methods without particular limitations so far as the components thereof are uniformly dispersed. For example, the solid components (insulation imparting gas generating source compound, arc resistant inorganic powder, primary metal salt of phosphoric acid, curing agent and reinforcing inorganic fiber) of the composition (C) are mixed using a mixer such as an agitation mortar, and the resulting mixture is kneaded while adding thereto the predetermined amount of water dropwise, to prepare the inorganic binder composition (C). Such method is preferred since it permits the primary metal salt of phosphoric acid to be uniformly mixed with and dispersed in the solid components and the water to be evenly added to the mixture and hence is capable of affording the inorganic binder composition (C) which assures homogenized plate material (II).

The inorganic binder composition (C) is in the form like granulates comprising primary particles which can be readily filled into a mold.

The inorganic binder composition (C) in such form can be readily filled into the mold and plastically deformed within the mold in the pressure molding, thereby achieving a close packing. This assures a dense molded product.

A representative example of the inorganic binder composition (C) comprises magnesium hydroxide, aluminum hydroxide, magnesium carbonate or calcium carbonate as the insulation imparting gas generating source compound, zircon powder, cordierite powder or mullite powder as the arc resistant inorganic powder, aluminum primary phosphate, magnesium primary phosphate or sodium primary phosphate as the primary metal salt of phosphoric acid, wollastonite crystal or magnesium hydroxide as the curing agent for the primary metal salt of phosphoric acid, water and the reinforcing inorganic fiber.

Such representative composition (C) is preferred because it is excellent in filling property into a mold and moldability and assures the arc extinguishing material (II) in the form of a molded product or the like by heat aging, which exhibits excellent arc resistance and mechanical strength and serves as a favorable insulation imparting gas source.

In turn, the inorganic binder composition (C) thus formed is filled into a mold defining a desired shape of arc extinguishing plate material and pressure molded. When the pressure in the pressure molding is too low, the composition (C) is insufficiently pressurized and, hence, the resulting molded product may suffer non-uniform denseness. For this reason, the pressure is preferably not lower than 400 kg/cm$^2$, more preferably not lower than 500 kg/cm$^2$. On the other hand, when the pressure is too high, the composition (C) is likely to penetrate into the clearance of the mold and thereby to cause the mold to be hardly opened. In view of this, the pressure in the pressure molding is preferably not higher than 800 kg/cm$^2$, more preferably not higher than 750 kg/cm$^2$. In the present invention, the pressure molding may be carried out at room temperature or with the surface table of a press machine appropriately heated. Further, the duration of the pressure molding can be appropriately adjusted. Devices for use in the pressure molding include press machines having surface table for molding to a uniform thickness, such as a hand press, mechanical press and oil press.

The arc extinguishing plate material prior to undergoing the aging is allowed to stand over a whole day and night, aged by heating at 120° to 200° C. in, for example, an oven to cure for removing the moisture contained therein. Thus, the arc extinguishing plate material (II) is prepared.

When the temperature, at which the heat aging is carried out, is too low, the curing of the plate material requires a very long time, or otherwise even when the curing is successfully carried out, the compound for imparting the primary metal salt of phosphoric acid with water resistance is insufficiently produced. For this reason, such temperature has to be not lower than 120° C., preferably not lower than 150° C. When the temperature is too high, only the surface layer of the molded product is cured rapidly and, hence, a non-uniform reaction occurs between the surface portion and the deep portion thereof, thereby causing warpage of the plate material. For this reason, the temperature for the heat aging has to be not higher than 200° C., preferably not higher than 180° C. The cooling following the heat aging may be a natural gradual cooling.

Since the finishing, punching, or the like of the arc extinguishing plate material (II) can be achieved at the time of molding, no machine working is required. Accordingly, in most cases the arc extinguishing plate material (II) finished with the heat aging can be directly used as an arc extinguishing plate or arc extinguishing side plate. An arc extinguishing chamber can be constructed of, for example, two such arc extinguishing side plates and a magnetic plate.

The description will be made on the switch of the present invention.

The switch of the present invention comprises an arc extinguishing chamber disposed in the vicinity of electrodes and contacts, and the arc extinguishing chamber uses an arc extinguishing side plate formed of the arc extinguishing plate material (I) or (II). The switch of the present invention is similar to the conventional one in structure and shape, but is characterized by the arc extinguishing plate such as the arc extinguishing side plate being formed of the arc extinguishing plate material (I) or (II). The switch of the present invention is applicable to any kinds of switches without particular limitations so far as they generate an arc in the arc extinguishing chamber thereof when the contacts of the electrodes thereof is opened or closed. Examples of such switches are, for instance, an electromagnetic contactor, circuit breaker and current-limiting device.

Reference is first made to the arc extinguishing chamber according to the present invention.

FIG. 3-1 is a schematic perspective view of one embodiment of an arc extinguishing chamber according to the present invention. The chamber shown includes a plurality of arc extinguishing magnetic plates 201, each defining a U-shaped notch 201*a* in a central portion thereof and formed of an iron plate or a chrome-plated iron plate, and a pair of arc extinguishing side plates 202, each formed of the arc extinguishing plate material (I) or (II). The arc extinguishing plates 202 and the magnetic plates 201 are secured to each other at caulking portions 203.

The electrodes and contacts are meant by those in, for example, an electromagnetic contactor, circuit breaker or current-limiting device, and are formed of, for example, an Ag—WC alloy or Ag—CdO alloy.

The term "in the vicinity of the electrodes and contacts" as used herein is equivalent to the arc exposure position in a conventional switch and means a region spaced apart from the electrodes and contacts by about 5 to about 15 cm in the electromagnetic contactor, by about 5 to about 15 cm in the circuit breaker or by about 5 to about 30 cm in the current-limiting device.

FIG. 3-2 is a schematic side view, partly in section, of one embodiment of a switch according to the present invention, and wherein the reference numerals 201 to 203 denote the same parts of FIG. 3-1, and numerals 204 and 205 denotes a fixed contact and a moving contact, respectively.

The fixed and moving contacts 204 and 205 located within the arc extinguishing chamber constructed of the magnetic plates 201 and arc extinguishing side plates 202 permit electric current to flow therethrough when they contact each other (closed condition). To interrupt the current, the moving contact 205 is moved toward the position (opened condition) indicated by broken line. At this time an arc is generated over the gap between the fixed and moving contacts 204 and 205 and is drawn in the direction indicated by arrow so as to be extinguished.

The arc extinguishing side plate formed of the arc extinguishing plate material (I) or (II) of the present invention is excellent in heat resistance, arc resistance, thermal shock resistance and the like, acts to absorb the energy of an arc, generated in the arc extinguishing chamber for cooling down and extinguish it, thereby protecting the components of the switch from the heat of the arc, and serves to insulate metal vapor and molten metal droplets that are generated from the electrodes, contacts and other metal components adjacent thereto by the arc, thereby overcoming the problems such as the decrease in electrical resistance. Therefore, the switch of the present invention using the plate material (I) or (II) also offers highly excellent effects.

Where the arc extinguishing plate material (I) is the arc extinguishing plate material (I) of embodiment 3-2, it further enjoys enhanced electrical insulating property and mechanical strength.

Where the arc extinguishing plate material (I) is the arc extinguishing plate material (I) of embodiment 3-3, it further enjoys such benefits as easy preparation, excellent heat resistance and arc resistance, and an enhanced effect in preventing the decrease in electrical resistance.

Where the arc extinguishing plate material (I) is the arc extinguishing plate material (I) of embodiment 3-4, it further enjoys such benefits as excellent water resistance and a potent effect in preventing the decrease in electrical resistance, since aluminum hydroxide contained therein acts also as the curing agent for the primary metal salt of phosphoric acid.

Where the arc extinguishing plate material (I) is the arc extinguishing plate material (I) of embodiment 3-5, it further enjoys such a benefit as a highly dense quality, since the material (I) has a water solubility and viscosity suitable as a binder and hence uniformly adheres to the reinforcing inorganic material sheet.

Where the arc extinguishing plate material (I) is the arc extinguishing plate material (I) of embodiment 3-6, it further enjoys such a benefit that the inorganic binder composition (I) and the sheet can be prepared with ease.

Where the arc extinguishing plate material (I) is the arc extinguishing plate material (I) of embodiment 3-7, it further enjoys such a benefit as enhanced water resistance.

Where the arc extinguishing plate material (I) is the arc extinguishing plate material (I) of embodiment 3-8, it further enjoys such benefits as easy preparation, excellent heat resistance and arc resistance, and enhanced effect in preventing the decrease in electrical resistance.

Where the arc extinguishing plate material (I) is the arc extinguishing plate material (I) of embodiment 3-9, it further enjoys such a benefit as an enhanced effect in preventing the decrease in electrical resistance.

Where the arc extinguishing plate material (I) is the arc extinguishing plate material (I) of embodiment 3-10, it further enjoys such a benefit that the insulation imparting gas generating source compound can be easily incorporated therein.

Where the arc extinguishing plate material (I) is the arc extinguishing plate material (I) of embodiment 3-11, it further enjoys such benefits that the inorganic binder composition (II) and the sheet can readily be prepared.

Where the arc extinguishing plate material (I) is the arc extinguishing plate material (I) of embodiment 3-12, it further enjoys such a benefit that there is no need to blend the curing agent for imparting the plate material (I) with water resistance.

Where the arc extinguishing plate material (I) is the arc extinguishing plate material (I) of embodiment 3-13, it further enjoys such benefits as excellent heat resistance and arc resistance.

Where the arc extinguishing plate material (II) is the arc extinguishing plate material (II) of embodiment 3-26, it further enjoys such benefits as easy preparation, excellent heat resistance and arc resistance, and enhanced effect in preventing the decrease in electrical resistance.

Where the arc extinguishing plate material (II) is the arc extinguishing plate material (II) of embodiment 3-27, it further enjoys such a benefit as a more enhanced effect in preventing the decrease in electrical resistance as compared with the case using the material (II) of embodiment 3-26.

Where the arc extinguishing plate material (II) is the arc extinguishing plate material (II) of embodiment 3-28, it further enjoys such benefits as excellent arc resistance and thermal shock resistance.

Where the arc extinguishing plate material (II) is the arc extinguishing plate material (II) of embodiment 3-29, it further enjoys such a benefit as a highly dense quality, since the material (II) has a water solubility and viscosity suitable as a binder.

Where the arc extinguishing plate material (II) is the arc extinguishing plate material (II) of embodiment 3-30, it further enjoys such a benefit that it is possible to obtain a highly dense molded product, since the material of the product becomes plastic during the pressure molding.

Where the arc extinguishing plate material (II) is the arc extinguishing plate material (II) of embodiment 3-31, it further enjoys such a benefit as excellent water resistance.

Where the arc extinguishing plate material (II) is the arc extinguishing plate material (II) of embodiment 3-32, it further enjoys such a benefit as excellent heat resistance.

Where the arc extinguishing plate material (II) is the arc extinguishing plate material (II) of embodiment 3-33, it further enjoys such benefits as excellent arc resistance and mechanical strength.

Where the arc extinguishing plate material (II) is the arc extinguishing plate material (II) of embodiment 3-34, it further enjoys such benefits as developed water resistance and enhanced mechanical strength.

The arc extinguishing plate material (I) of the present invention comprises, after aging, 35 to 50% of the reinforcing inorganic material sheet and 50 to 65% of the inorganic binder composition (B). Such a high content of the inorganic binder composition (B) imparts the plate material (I) with excellent heat resistance, arc resistance, thermal shock resistance and the like. Further, the reinforcing inorganic material sheet contained in the proportion of 35 to 50% allows the plate material (I) to exhibit excellent punching quality and mechanical strength and to be readily produced. Such plate material (I) offers such a merit as to absorb the energy of an arc generated in the arc extinguishing chamber of a switch upon an opening or closing operation of the electrodes thereof for cooling down and extinguish the arc, thereby protecting components of the switch from the heat of the arc.

Where the reinforcing inorganic material sheet used in the arc extinguishing plate material (I) is formed of a glass mat or glass fabric, e.g. those made of a glass fiber having an insulating property, or a ceramic paper made of a ceramic fiber, the plate material (I) exhibits higher mechanical strength and heat resistance.

Where the inorganic binder composition (A) used in the arc extinguishing plate material (I) is the inorganic binder composition (I) comprising 30 to 45% of an insulation imparting gas generating source compound, 0 to 28% of an arc resistant inorganic powder, 40 to 65% of an aqueous solution of primary metal salt of phosphoric acid and 2 to 10% of a curing agent for the primary metal salt of phosphoric acid, integration of the binder composition (I) with the reinforcing inorganic material sheet affords the arc extinguishing plate material (I) with excellent mechanical strength, arc resistance, heat resistance and the like, and demonstrates the effect of satisfactorily preventing the decrease in electrical resistance by insulating metal vapor and molten metal droplets which are generated from the electrodes, contacts and other metal components located adjacent thereto by an arc generated upon an opening or closing operation of the contacts.

Where the insulation imparting gas generating source compound in the arc extinguishing plate material (I) is aluminum hydroxide, the compound will generate atomic oxygen and molecular oxygen (O and $O_2$) as the insulation imparting gas, resulting in a more potent effect in preventing the decrease in electrical resistance.

Where the primary metal salt of phosphoric acid contained in the inorganic binder composition (A) in the arc extinguishing plate material (I) is aluminum primary phosphate or magnesium primary phosphate, the binder composition (A) exhibits favorable properties required for a binder since aluminum primary phosphate and magnesium primary phosphate each exhibit an excellent solubility in water and afford an aqueous solution of satisfactory viscosity and binding property, thus giving the inorganic binder composition (A) advantageously.

Where the concentration of the primary metal salt of phosphoric acid in the aqueous solution contained in the inorganic binder composition (A) in the arc extinguishing plate material (I) ranges from 25 to 55%, the concentration can easily be adjusted to 65 to 85%. In addition, it is possible to adjust the contents of the insulation imparting gas generating source compound and arc resistant inorganic powder to predetermined values and, hence, the inorganic binder composition (A) is possible to be favorably made to adhere to the reinforcing inorganic material sheet. This results in an easy preparation of the sheet.

Where the curing agent for the primary metal salt of phosphoric acid in the arc extinguishing plate material (I) is wollastonite crystal or aluminum hydroxide, it is possible to impart the primary metal salt of phosphoric acid with water resistance by heating to about 150° C., thereby affording the plate material (I) with an excellent water resistance.

Where the inorganic binder composition (A) in the arc extinguishing plate material (I) is the inorganic binder composition (II) comprising 30 to 50% of an insulation imparting gas generating source compound, 0 to 20% of an arc resistant inorganic powder and 50 to 70% of an aqueous solution of condensed alkali metal phosphate, the plate material (I) containing the inorganic binder composition (II) is capable of more effectively preventing the decrease in electrical resistance than that containing the aforementioned composition (I).

Where the insulation imparting gas generating source compound in the arc extinguishing plate material (I) is magnesium hydroxide, magnesium carbonate or calcium carbonate, the plate material (I) is capable of more effectively preventing the decrease in electrical resistance than that containing aluminum hydroxide.

Where the condensed alkali metal phosphate contained in the inorganic binder composition (A) in the arc extinguishing plate material (I) is sodium metaphosphate or potassium metaphosphate, the binder composition (A) exhibits favorable properties required for a binder since aluminum metaphosphate and magnesium metaphosphate each exhibit an excellent solubility in water and afford an aqueous solution of satisfactory viscosity and binding property, thus giving the inorganic binder composition (A) advantageously.

Where the aqueous solution of condensed alkali metal phosphate contained in the inorganic binder composition (A) in the arc extinguishing plate material (I) has a condensed alkali metal phosphate concentration of 10 to 40%, it is possible to easily adjust the concentration of the condensed alkali metal phosphate to 65 to 85% by drying. In addition, the contents of the insulation imparting gas generating source compound and arc resistant inorganic powder can readily be adjusted to predetermined values and, hence, it is possible to advantageously make the inorganic binder composition (A) adhere to the reinforcing inorganic material sheet, thereby facilitating the preparation of the sheet.

Where the insulation imparting gas generating source compound in the arc extinguishing plate material (I) acts also as a curing agent for the condensed alkali metal phosphate, the compound reacts with the condensed alkali metal phosphate, thereby advantageously imparting the condensed alkali metal phosphate with water resistance.

Where the arc resistant inorganic powder in the arc extinguishing plate material (I) is aluminum oxide powder, it exhibits excellent arc resistance and electrical insulating property and serves also as a curing agent, while on the other hand when the arc resistant inorganic powder is zircon powder or cordierite powder, it exhibits excellent arc resistance and low expansibility. Accordingly, the plate material (I) obtained with use of such arc resistant inorganic powder exhibits improved thermal shock resistance and can be prepared with less raw material cost.

The arc extinguishing plate material (I) of the present invention is prepared by the steps of: drying a sheet comprising a reinforcing inorganic material sheet and an inorganic binder composition (A) at 80° to 120° C. and then subjecting the same to pressure molding; and aging the pressure-molded sheet at 120° to 200° C. to remove moisture therefrom and cure the sheet, followed by cooling the thus molded and cured sheet down to 80° C. or below. Such preparation method affords the aforementioned excellent arc extinguishing plate material (I) with ease.

In the above preparation method, the sheet prior to undergoing the pressure molding is prepared by the steps of: mixing 30 to 45% of an insulation imparting gas generating source compound, 0 to 28% of an arc resistant inorganic powder, 2 to 10% of a curing agent for a primary metal salt of phosphoric acid; adding to the resulting mixture 40 to 65% of the aqueous solution of primary metal salt of phosphoric acid, followed by kneading to prepare the inorganic binder composition (I); immersing the reinforcing inorganic material sheet into the inorganic binder composition (I) to form the sheet with the inorganic binder composition (I) adhering thereto; and drying the sheet at 80° to 120° C. to adjust the concentration of the primary metal salt of phosphoric acid in the aqueous solution to 65 to 85%. With this method, the inorganic binder composition (I) is well integrated with the reinforcing inorganic material sheet without being forced out thereof when pressure-molded, thereby giving the arc extinguishing plate material (I) of dense quality which offers excellent mechanical strength and the like.

In the method of the present invention, in case that the insulation imparting gas generating source compound is aluminum hydroxide; the arc resistant inorganic powder is selected from the group consisting of aluminum oxide powder, zircon powder and cordierite powder; the curing agent for the primary metal salt of phosphoric acid is wollastonite crystal or aluminum hydroxide; and the aqueous solution of primary metal salt of phosphoric acid is a 25 to 55% aqueous solution of aluminum primary phosphate or magnesium primary phosphate, the arc extinguishing plate material (I) obtained by the method exhibits excellent arc resistance, heat resistance and thermal shock resistance and offers a favorable effect in preventing the decrease in electrical resistance.

In the method of the present invention, in case that the sheet prior to undergoing the pressure molding is prepared by the steps of: mixing 30 to 50% of an insulation imparting gas generating source compound and 0 to 20% of an arc resistant inorganic powder; adding to the resulting mixture 50 to 70% of an aqueous solution of condensed alkali metal phosphate, followed by kneading to prepare the inorganic binder composition (II); immersing the reinforcing inorganic material sheet into the inorganic binder composition (II) to prepare the sheet with the inorganic binder composition (II) adhering thereto; and drying the sheet at 80° to 120° C. to adjust the concentration of the condensed alkali metal phosphate in the aqueous solution to 65 to 85%, the arc extinguishing plate material obtained by this method offers a more potent effect in preventing the decrease in electrical resistance than that employing the inorganic binder composition (I).

In the method of the present invention, in case that the insulation imparting gas generating source compound is selected from the group consisting of magnesium hydroxide, magnesium carbonate and calcium carbonate; the arc resistant inorganic powder is selected from the group consisting of aluminum oxide powder, zircon powder and cordierite powder; and the aqueous solution of the condensed alkali metal phosphate is a 10 to 40% aqueous solution of sodium metaphosphate or potassium metaphosphate, the resulting arc extinguishing plate material offers a particularly potent effect in preventing the decrease in electrical resistance.

In the method of the present invention, in case that the proportion of the inorganic binder composition (I) or (II) adhering to the sheet is 200 to 350 parts relative to 100 parts of the reinforcing inorganic material sheet, the resulting arc extinguishing plate material exhibits excellent heat resistance, arc resistance and thermal shock resistance.

In the method of the present invention, in case that two or more of stacked sheets dried at 80° to 120° C. are pressure-molded, the size (thickness) thereof can be easily controlled, and the resulting arc extinguishing plate material enjoys improved mechanical strength as compared to that comprising a single sheet.

Where the method of the present invention further comprises the step of applying an insulation imparting gas generating source compound onto either or both faces of a reinforcing inorganic material sheet containing the inorganic binder composition (A), the resulting arc extinguishing plate material offers a further potent effect in preventing the decrease in electrical resistance.

In the method of the present invention, in case that the insulation imparting gas generating source compound is selected from the group consisting of magnesium hydroxide, magnesium carbonate and calcium carbonate, the resulting arc extinguishing plate material offers a greater effect in preventing the decrease in electrical resistance than that employing aluminum hydroxide.

Where the method of the present invention comprises the steps of: preparing one of the sheets to be stacked on each other with use of an inorganic binder composition (I) as recited in embodiment 3-3 and the other with use of an inorganic binder composition (II) as recited in embodiment 3-8; drying at 80° to 120° C. the one sheet to adjust the concentration of the primary metal salt of phosphoric acid in the aqueous solution contained therein to 65 to 85% and the other sheet to adjust the concentration of the condensed alkali metal phosphate in the aqueous solution contained therein to 65 to 85%; stacking the other sheet on either or both faces of the one sheet; further laying the resulting stacked sheet on the other stacked sheet prepared in the same manner to obtain a laminated sheet of a required thickness; subjecting the laminated sheet to pressure molding; aging the thus molded laminated sheet to facilitate removal of moisture therefrom and curing of the molded laminated sheet; and cooling the molded laminated sheet down to 80° C. or below, the resulting arc extinguishing plate material enjoys a more potent effect in preventing the decrease in electrical resistance than that using the inorganic binder composition (I) singly.

Where the method of the present invention further comprises the step of coating or impregnating the arc extinguishing plate material (I) with a coating material for preventing the plate material (I) from dusting when subjected to a punching process, the resulting plate material enjoys the effect of reducing the amount of fiber particles to be generated when the plate material is punched or cut in the punching process.

In the method of the present invention, in case that the coating material is an organic metal compound (a metal alkoxide) or an organic resin, the binding property of the coating material with the underlying plate material (I) is satisfactory, thus resulting in a potent effect in preventing dusting.

The arc extinguishing plate material (II) of the present invention is obtained by pressure molding and aging the inorganic binder composition (C) comprising 40 to 55% of an insulation imparting gas generating source compound, 25 to 40% of an arc resistant inorganic powder, 8 to 18% of a primary metal salt of phosphoric acid, 5 to 10% of a curing agent for the primary metal salt of phosphoric acid, 2.6 to 12% of water, and 2 to 10% of a reinforcing inorganic fiber. The plate material (II) of such constitution enjoys excellent heat resistance and arc resistance.

Where the insulation imparting gas generating source compound used in the arc extinguishing plate material (II) is selected from the group consisting of magnesium hydroxide, aluminum hydroxide, magnesium carbonate and calcium carbonate, the plate material (II) offers a potent effect in preventing the decrease in electrical resistance, like the foregoing plate material (I) employing the inorganic binder composition (II).

Where the arc resistant inorganic powder used in the arc extinguishing plate material (II) is selected from the group consisting of zircon powder, cordierite powder and mullite powder, the plate material (II) exhibits excellent thermal shock resistance as well as excellent arc resistance.

Where the primary metal salt of phosphoric acid used in the arc extinguishing plate material (II) is selected from the group consisting of aluminum primary phosphate, magnesium primary phosphate and sodium primary phosphate, the insulation imparting gas generating source compound acts also as a curing agent, thus allowing for a favorable inorganic binder composition.

In the arc extinguishing plate material (II), in case that the water is added in such an amount as to afford a 60 to 75% aqueous solution of the primary metal salt of phosphoric acid, the inorganic binder composition (II) becomes plastic when subjected to the pressure molding and hence is turned into a dense molded product.

Where the curing agent for the primary metal salt of phosphoric acid in the arc extinguishing plate material (II) is selected from the group consisting of wollastonite crystal, magnesium hydroxide, aluminum hydroxide, magnesium carbonate and calcium carbontate, there appears an effect such that heating up to 200° C. affords a molded product with water resistance.

Where the reinforcing inorganic fiber in the arc extinguishing plate material (II) is an inorganic short fiber, the fiber is homogeneously dispersed in the plate material (II) and imparts the plate material (II) with an excellent heat resistance.

Where the inorganic short fiber in the arc extinguishing plate material (II) is selected from the group consisting of a natural mineral fiber, a ceramic fiber and a ceramic whisker, the plate material (II) enjoys further enhanced mechanical strength and arc resistance.

Where the natural mineral fiber in the arc extinguishing plate material (II) is wollastonite crystal which acts also as a curing agent for the primary metal salt of phosphoric acid, the unreacted fiber component thereof acts to improve the mechanical strength (binding strength) of the plate material (II) while the reacted fiber component thereof acts to impart the plate material (II) with water resistance.

The arc extinguishing plate material (II) of the present invention is prepared by the steps of: pressure molding, with a mold, the inorganic binder composition (C) comprising 40 to 55% of an insulation imparting gas generating source compound, 25 to 40% of an arc resistant inorganic powder, 8 to 18% of a primary metal salt of phosphoric acid, 5 to 10% of a curing agent for the primary metal salt of phosphoric acid, 2.6 to 12% of water and 2 to 10% of a reinforcing inorganic fiber; and aging the thus molded product at 120° to 200° C. The arc extinguishing plate material thus prepared does, in most cases, not require finishing and hence can be a final product such as an arc extinguishing plate.

In the above method of the present invention, in case that the insulation imparting gas generating source compound is selected from the group consisting of magnesium hydroxide, aluminum hydroxide, magnesium carbonate and calcium carbonate, the resulting plate material (II) exhibits a potent effect in preventing the decrease in electrical resistance.

In the method of the present invention, in case that the arc resistant inorganic powder is selected from the group consisting of zircon powder, cordierite powder and mullite powder, the resulting arc extinguishing plate material (II) enjoys excellent arc resistance and thermal shock resistance.

In the method of the present invention, in case that the primary metal salt of phosphoric acid is selected from the group consisting of aluminum primary phosphate, magnesium primary phosphate and sodium primary phosphate, the inorganic binder composition (C) exhibits a strong binding power.

In the method of the present invention, in case that the curing agent for the primary metal salt of phosphoric acid is selected from the group consisting of wollastonite crystal, magnesium hydroxide, aluminum hydroxide, magnesium carbonate and calcium carbonate, the water resistance of the plate material (II) is developed by heating up to 200° C. and, in addition, the mechanical strength (binding strength) thereof is improved.

The switch of the present invention comprises electrodes, contacts provided to the electrodes, and an arc extinguishing chamber located adjacent to the electrodes and contacts and having an arc extinguishing side plate formed of an arc extinguishing plate material (I) or (II) as recited in any one of embodiments 3-1 to 3-13 and 3-26 to 3-34. The switch of such arrangement enjoys superior interrupting property, durability and insulation resistance enhancing performance.

The first group inventions of the present invention will be more fully described by specific examples thereof. In those examples were conducted the following interrupting test, short circuit test and durability test.

Interrupting test

A circuit breaker including an arc extinguishing device of the aforementioned arrangement in closed state is applied with a current six times as high as a rated current (for example, a circuit breaker rated at 100 A being applied with a current of 600 A) and a moving contact 4 is separated away from a fixed contact 5 by a contact gap distance L (distance between moving contact 4 and fixed contact 5) of 15 to 25 mm to generate an arc current. If the circuit breaker successfully interrupts the arc current predetermined times, the circuit breaker is regarded as passed the test.

Short circuit test

A circuit breaker as above in closed state is applied with an overcurrent of 10 to 100 kA and a moving contact element is separated away from a fixed contact to generate an arc current. If the circuit breaker successfully interrupts the arc current with no damage, the circuit breaker is regarded as passed the test.

Durability test

A circuit breaker as above in closed state is applied with a normal current (for example, a circuit breaker rated at 100 A being applied with a current of 100 A) and a moving contact element is mechanically separated away from a fixed contact to generate an arc current. If the circuit breaker successfully interrupts the arc current predetermined times and the arc extinguishing insulative material used therein exhibits a consumption-by-arc resistance, specifically to such a degree that a hole is not formed in the insulative material by the arc, the breaker is regarded as passed the test.

EXAMPLES 1-1 TO 1-10

Arc extinguishing devices as shown in FIGS. 1-1 to 1-3 were fabricated by using the arc extinguishing insulative material compositions shown in Table 1-1 for insulator (1) and insulator (2). The insulator (1) was disposed as surrounding the contact area of each contact of a circuit breaker, and the insulator (2) was disposed on both sides with respect to a plane including the locus of the moving contact or as enclosing the contact section of the breaker. The thus fabricated arc extinguishing devices were subjected to the aforementioned interrupting test, short circuit test and durability test, where the respective thicknesses T1 and T2 of the insulators (1) and (2) were 1 mm each, the width W of the insulator (2) was 10 mm, and the contact area of the moving and fixed contacts was 3 mm×3 mm.

The insulative material compositions used for the insulators (1) and (2) contained 40% and 30%, respectively, of filler.

The interrupting test, short circuit test and durability test were conducted at three-phase 720 V/600 A, three-phase 460 V/50 kA, and three-phase 550 V/100 A, respectively.

Particulars of the matrix resins and fillers shown in Table 1-1 were as follows:

PA6T: nylon 6T, ARLEN (trade mark) produced by MITSUI PETROCHEMICAL INDUSTRIES, LTD.;

PA66: nylon 66, NOVAMID (trade mark) produced by MITSUBISHI KASEI CORPORATION;

PA46: nylon 46, UNITIKA NYLON 46 (trade mark) produced by UNITIKA Ltd.;

PBT: polybutylene terephthalate, NOVADUR (trade mark) produced by MITSUBISHI KASEI CORPORATION;

Melamine: melamine resin, U-CON (trade mark) produced by FUJI KASEI CORPORATION;

GF-A: glass fiber formed of E glass containing 0.6% of group 1A metal compounds such as sodium oxide and potassium oxide in total and having a diameter of 10 μm and an average length of 3 mm, MICROGLASS (trade mark) produced by Nippon Sheet Glass Company, Limited;

$CaCO_3$: average particle diameter of 1.8 μm, produced by NIPPON TALC CORPORATION;

$3MgO.4SiO_2H_2O$: talc containing a composition represented by the foregoing composition formula as a main component and having an average particle diameter of 5 μm, produced by NIPPON TALC CORPORATION;

$3MgO.2SiO_2.2H_2O$: chrysotile containing a composition represented by the foregoing composition formula as a main component and having an average particle diameter of 3.5 μm, produced by NIPPON TALC CORPORATION;

$5MgO.3SiO_2.3H_2O$: ASTON containing a composition represented by the foregoing composition formula as a main component and having an average diameter of 1 μm and an average length of 10 μm, produced by NIPPON TALC CORPORATION;

Wollastonite: $CaO.SiO_2$, purity=97.4%, aspect ratio=20, average diameter=5 μm, produced by KINSEI MATEC KABUSHIKI KAISHA;

Aluminum silicate: aluminum silicate fiber having an average diameter of 5 μm and an average length of 50 μm;

Aluminum borate: aluminum borate whisker having an average diameter of 1 μm and an average length of 20 μm;

Alumina: alumina whisker having an average diameter of 1 μm and an average length of 10 μm; and Inorganic material: aluminum phosphate 20%, alumina 25%, zirconia 30%, aluminum hydroxide 10% and wollastonite 15%.

Each of the above fillers contained not more than 1% of group 1A metal compounds in total.

against pressure, while in contrast Examples 1-1 to 1-10 succeeded in interrupting an arc 30 times in the interrupting test, in interrupting an arc with no problem of damage in the short circuit test, and in interrupting an arc 6000 times with no problem in the durability test. Thus, the arc extinguishing devices of Examples 1-1 to 1-10 were regarded as passed.

EXAMPLES 1-11 TO 1-16

Arc extinguishing devices were fabricated by using arc extinguishing insulative material compositions shown in Table 1-2 in the same manner as in Examples 1-1 to 1-10 except that the width W of insulator (2) was 12 mm instead of 10 mm and that the insulative material compositions used for insulators (1) and (2) contained 50% and 40%, respectively, of filler.

The thus fabricated arc extinguishing devices were subjected to the tests under the same conditions as in Examples 1-1 to 1-10.

Particulars of the matrix resins and fillers in Table 1-2 were as follows:

PP: polypropylene, MITSUBISHI POLYPRO (trade mark) produced by MITSUBISHI PETROCHEMICAL COMPANY, LTD.;

TABLE 1-1

| | Arc extinguishing insulative material | | Test result | | |
|---|---|---|---|---|---|
| | Insulator (1) (filler 40%) | Insulator (2) (filler 30%) | Interrupting test (Number of times of success) | Short circuit test (Interruption/damage) | Durability test (Formation of hole) |
| Ex. No. | | | | | |
| 1-1 | PA6T/GF-A | PA66/GF-A | 30 | yes/no | not formed after 6000 interruptions |
| 1-2 | PA6T/GF-A | PA46/GF-A | 30 | yes/no | not formed after 6000 interruptions |
| 1-3 | PA6T/$CaCO_3$ | PA46/GF-A | 30 | yes/no | not formed after 6000 interruptions |
| 1-4 | PA6T/$3MgO.4SiO_2.H_2O$ | PA46/GF-A | 30 | yes/no | not formed after 6000 interruptions |
| 1-5 | PA6T/$3MgO.2SiO_2.2H_2O$ | PA46/GF-A | 30 | yes/no | not formed after 6000 interruptions |
| 1-6 | PA6T/$5MgO.3SiO_2.3H_2O$ | PA46/GF-A | 30 | yes/no | not formed after 6000 interruptions |
| 1-7 | PA6T/wollastonite | PA46/GF-A | 30 | yes/no | not formed after 6000 interruptions |
| 1-8 | PA6T/aluminum silicate | PA46/GF-A | 30 | yes/no | not formed after 6000 interruptions |
| 1-9 | PA6T/aluminum borate | PA46/GF-A | 30 | yes/no | not formed after 6000 interruptions |
| 1-10 | PA6T/alumina | PA46/GF-A | 30 | yes/no | not formed after 6000 interruptions |
| Comp. Ex. No. | | | | | |
| 1-1 | Inorganic material | Inorganic material | 0 | no/nO | not formed after 6000 interruptions |
| 1-2 | PBT/GF-A | PBT/GF-A | 3 | no/no | not formed after 6000 interruptions |
| 1-3 | Melamine/GF-A | Melamine/GF-A | 30 | yes/yes | not formed after 6000 interruptions |

As is apparent from Table 1-1, Comparative Example 1-1 (not employing an organic matrix resin but only an inorganic material for both insulators (1) and (2)) and Comparative Example 1-2 exhibited unsatisfactory arc extinguishing property and Comparative Example 1-3 was poor in strength EVOH: ethylene-vinyl alcohol copolymer (30:70), Soarlite (trade mark) produced by The Nippon Synthetic Chemical Industry Co., Ltd.; and Polymethylpentene: TPX (trade mark) produced by MITSUI PETROCHEMICAL INDUSTRIES, LTD.

TABLE 1-2

| | Arc extinguishing insulative material | | Test result | | |
|---|---|---|---|---|---|
| Ex. No. | Insulator (1) (filler 50%) | Insulator (2) (filler 40%) | Interrupting test (Number of times of success) | Short circuit test (Interruption/damage) | Durability test (Formation of hole) |
| 1-11 | PA6T/GF-A | PP/GF-A | 30 | yes/no | not formed after 6000 interruptions |
| 1-12 | PA6T/GF-A | EVOH/GF-A | 30 | yes/no | not formed after 6000 interruptions |

TABLE 1-2-continued

| | Arc extinguishing insulative material | | Test result | | |
|---|---|---|---|---|---|
| | | | Interrupting test | Short circuit | |
| Ex. No. | Insulator (1) (filler 50%) | Insulator (2) (filler 40%) | (Number of times of success) | test (Interruption/damage) | Durability test (Formation of hole) |
| 1-13 | PA6T/GF-A | Polymethylpentene/ GF-A | 30 | yes/no | not formed after 6000 interruptions |
| 1-14 | PA6T/GF-A | Polymethylpentene/ $5MgO.3SiO_2.3H_2O$ | 30 | yes/no | not formed after 6000 interruptions |
| 1-15 | PA6T/GF-A | Polymethylpentene/ wollastonite | 30 | yes/no | not formed after 6000 interruptions |
| 1-16 | PA6T/GF-A | Polymethylpentene/ aluminum borate | 30 | yesYno | not formed after 6000 interruptions |

As can be understood from Table 1-2, Examples 1-11 to 1-16 succeeded in interrupting an arc 30 times in the interrupting test, in interrupting an arc with no problem of damage in the short circuit test, and in interrupting an arc 6000 times with no problem in the durability test. Thus, the arc extinguishing devices of Examples 1-11 to 1-16 were regarded as passed. The same results as above were obtained when the inorganic mineral of the insulator (2) shown in Table 1-2 comprised magnesium silicate hydrate represented by $3MgO.4SiO_2.H_2O$ or $3MgO.2SiO_2.2H_2O$ not shown in Table 1-2, or the ceramic fiber of the insulator (2) comprised aluminum silicate fiber or alumina whisker not shown in Table 1-2. Further, the same results as above were obtained when the insulator (2) contained the glass fiber, inorganic mineral or ceramic fiber in an amount of 30%.

EXAMPLES 1-17 TO 1-24

Arc extinguishing devices similar to those of Examples 1-1 to 1-10 were fabricated by using arc extinguishing insulative material compositions shown in Table 1-3.

The insulative material compositions used for the insulators (1) and (2) contained 50% and 30%, respectively, of filler.

The thus fabricated arc extinguishing devices were subjected to the tests under the same conditions as in Examples 1-1 to 1-10.

TABLE 1-3

| | Arc extinguishing insulative material | | Test result | | |
|---|---|---|---|---|---|
| | | | Interrupting test | Short circuit | |
| Ex. No. | Insulator (1) (filler 50%) | Insulator (2) (filler 30%) | (Number of times of success) | test (Interruptions/damage) | Durability test (Formation of hole) |
| 1-17 | PA6T/GF-A | PA46/GF-A | 30 | yes/no | not formed after 6000 interruptions |
| 1-18 | PA6T/GF-A | PA46/$5MgO.3SiO_2.3H_2O$ | 30 | yes/no | not formed after 6000 interruptions |
| 1-19 | PA6T/GF-A | PA46/wollastonite | 30 | yes/no | not formed after 6000 interruptions |
| 1-20 | PA6T/GF-A | PA46/aluminum borate | 30 | yes/no | not formed after 6000 interruptions |
| 1-21 | PA6T/GF-A | PA66/GF-A | 30 | yes/no | not formed after 6000 interruptions |
| 1-22 | PA6T/GF-A | PA66/$5MgO.3SiO_2.3H_2O$ | 30 | yes/no | not formed after 6000 interruptions |
| 1-23 | PA6T/GF-A | PA66/wollastonite | 30 | yes/no | not formed after 6000 interruptions |
| 1-24 | PA6T/GF-A | PA46/aluminum borate | 30 | yes/no | not formed after 6000 interruptions |

As can be understood from Table 1-3, Examples 1-17 to 1-24 succeeded in interrupting an arc 30 times in the interrupting test, in interrupting an arc with no problem of damage in the short circuit test, and in interrupting an arc 6000 times with no problem in the durability test. Thus, the arc extinguishing devices of Examples 1-17 to 1-24 were regarded as passed. The same results as above were obtained when the inorganic mineral of the insulator (2) comprised magnesium silicate hydrate represented by $3MgO.4SiO_2.H_2O$ or $3MgO.2SiO_2.2H_2O$ not shown in Table 1-3, or the ceramic fiber of the insulator (2) comprised aluminum silicate fiber or alumina whisker not shown in Table 1-3. Further, the same results as above were obtained when the content of the glass fiber, inorganic mineral or ceramic fiber in each of the insulators (1) and (2) used in these Examples was in the range of 10% to 55%, specifically 55%, 50%, 45%, 40% or 30% for the insulator (1) and 55%, 40%, 35%, 30%, 20% or 10% for the insulator (2).

EXAMPLES 1-25 TO 1-35

Arc extinguishing devices similar to those of Examples 1-1 to 1-10 were fabricated by using arc extinguishing insulative material compositions shown in Table 1-4.

The insulative material compositions used for the insulators (1) and (2) contained 50% and 30%, respectively, of filler.

The thus fabricated arc extinguishing devices were subjected to the tests under the same conditions as in Examples 1-1 to 1-10.

Particulars of the matrix resins and fillers in Table 1-4 were as follows:

PA66/PP: blend of 90 parts of nylon 66 and 10 parts of PP; nylon 66 and PP were the same as used in the foregoing Examples (hereinafter the same);

PA66/TPE: blend of 90 parts of nylon 66 and 10 parts of thermoplastic elastomer (olefin elastomer, GDMER produced by MITSUI PETROCHEMICAL INDUSTRIES, LTD); and PA66/EPR: blend of 90 parts of nylon 66 and 10 parts of ethylene-propylene rubber.

Note that Examples 1-29 to 1-35 in Table 1-4 employed two kinds of fillers, the mixing ratio of which was 1:1 in weight.

TABLE 1-4

| | Arc extinguishing insulative material | | Test result | | |
|---|---|---|---|---|---|
| Ex. No. | Insulator (1) (filler 50%) | Insulator (2) (filler 30%) | Interrupting test (Number of times of success) | Short circuit test (Interruption/damage) | Durability test (Formation of hole) |
| 1-25 | PA6T/GF—A | PA66/PP/GF-A | 30 | yes/no | not formed after 6000 interruptions |
| 1-26 | PA6T/GF-A | PA66/TPE/GF—A | 30 | yes/no | not formed after 6000 interruptions |
| 1-27 | PA6T/GF-A | PA66/EPR/GF—A | 30 | yes/no | not formed after 6000 interruptions |
| 1-28 | PA6T/GF-A | PA66/Melamine/GF-A | 30 | yes/no | not formed after 6000 interruptions |
| 1-29 | PA6T/GF-A | PA46/GF-A/5MgO.3$SiO_2$.3$H_2O$ | 30 | yes/no | not formed after 6000 interruptions |
| 1-30 | PA6T/GF-A | PA46/GF-A/wollastonite | 30 | yes/no | not formed after 6000 interruptions |
| 1-31 | PA6T/GF-A | PA46/GF-A/aluminum borate | 30 | yes/no | not formed after 6000 interruptions |
| 1-32 | PA6T/GF-A | PA46/wollastonite/5MgO. 3$SiO_2$.3$H_2O$ | 30 | yes/no | not formed after 6000 interruptions |
| 1-33 | PA6T/GF-A | PA46/aluminum borate/ 5MgO.3$SiO_2$3$H_2O$ | 30 | yes/no | not formed after 6000 interruptions |
| 1-34 | PA6T/GF-A | PA46/wollastonite/ aluminum borate | 30 | yes/no | not formed after 6000 interruptions |
| 1-35 | PA6T/GF-A | PA46/GF-A/CaO.$SiO_2$/ aluminum borate | 30 | yes/no | not formed after 6000 interruptions |

As can be understood from Table 1-4, Examples 1-25 to 1-35 succeeded in interrupting an arc 30 times in the interrupting test, in interrupting an arc with no problem of damage in the short circuit test, and in interrupting an arc 6000 times with no problem in the durability test. Thus, the arc extinguishing devices of Examples 1-25 to 1-35 were regarded as passed. The same results as above were obtained when the insulator (1) and/or insulator (2) of Examples 1-25 to 1-28 contained, instead of the glass fiber, an inorganic mineral (magnesium silicate hydrate represented by 3MgO.4$SiO_2$.$H_2O$, 3MgO.2$SiO_2$.2$H_2O$ or 5MgO.3$SiO_2$.3$H_2O$, or wollastonite represented by CaO.$SiO_2$) or a ceramic fiber (aluminum silicate fiber, aluminum borate whisker or alumina whisker) which are not included in Table 1-4. Further, the same results as above were obtained when the content of the glass fiber, inorganic mineral or ceramic fiber in each of the insulators (1) and (2) used in Examples 1-25 to 1-28 and their analogous examples were in the range of 10% to 55%, specifically 55%, 50%, 45%, 40% or 30% for the insulator (1) and 40%, 35%, 30%, 20% or 10% for the insulator (2). Still further, the same results as above were obtained when nylon 66, a polymer blend of nylon 46 and nylon 66, or polymethylpentene was used instead of nylon 46 in Examples 1-29 to 1-35, when the inorganic mineral of the insulator (2) in Examples 1-29 to 1-35 comprised magnesium silicate hydrate represented by 3MgO.4$SiO_2$.$H_2O$ or 3MgO.2$SiO_2$.2$H_2O$, when the ceramic fiber of the insulator (2) in Examples 1-29 to 1-35 comprised aluminum silicate fiber or alumina whisker, or when the content of the glass fiber, inorganic mineral or ceramic fiber in each of the insulators (1) and (2) used in Examples 1-29 to 1-35 and their analogous examples was in the range of 10% to 55%, specifically 55%, 50%, 45% or 40% for the insulator (1) and 40%, 35%, 30% or 10% for the insulator (2).

EXAMPLES 1-36 TO 1-38

Arc extinguishing devices were fabricated by using arc extinguishing insulative material compositions shown in Table 1-5. The thus fabricated devices were similar to those of Examples 1-1 to 1-10 except that the width W of the insulator (2) was 15 mm.

In these Examples the insulators (1) and (2) contained 50% and 40%, respectively, of filler.

The arc extinguishing devices were subjected to the tests under the same conditions as in Examples 1-1 to 1-10.

Particulars of the matrix resins and fillers in Table 1-5 were as follows:

POM/PA6: blend of 30 parts of polyacetal (DURACON (trade mark) produced by POLYPLASTICS KABUSHIKI KAISHA) and 70 parts of nylon 6.

TABLE 1-5

| | Arc extinguishing insulative material | | Test result | | |
|---|---|---|---|---|---|
| Ex. No. | Insulator (1) (filler 50%) | Insulator (2) (filler 40%) | Interrupting test (Number of times of success) | Short circuit test (Interruption/damage) | Durability test (Formation of hole) |
| 1-36 | PA6T/GF-A | POM/PA6 | 30 | yes/no | not formed after 3000 interruptions |
| 1-37 | PA6T/GF-A | POM/PA6/wollastonite | 30 | yes/no | not formed after 6000 interruptions |
| 1-38 | PA6T/GF-A | POM/PA6/aluminum borate | 30 | yes/no | not formed after 6000 interruptions |

As can be understood from Table 1-5, Examples 1-36 to 1-38 succeeded in interrupting an arc 30 times in the interrupting test. Examples 1-37 and 1-38 further succeeded in interrupting an arc with no problem of damage in the short circuit test and in interrupting an arc 6000 times with no problem in the durability test and, therefore, regarded as passed.

EXAMPLES 1-39 TO 1-43

Arc extinguishing devices as shown in FIGS. 1-12 and 1-13 were fabricated each comprising only insulator (2) with use of the arc extinguishing insulative material compositions shown in Table 1-6 for the arc receiving layer and base layer of the insulator (2). The thus fabricated devices were subjected to the aforementioned interrupting test, short circuit test and durability test. The insulator (2) was of double layer structure having a thickness T2 of 2 mm including the arc receiving layer of 1 mm thickness and a width W of 12 mm. The contact area of each of the moving contact and fixed contact was 4 mm×4 mm. The arc extinguishing devices of these Examples precluded the insulator (1).

The content of a filler in each insulator material is shown in Table 1-6.

The interrupting test, short circuit test and durability test were conducted at three-phase 720 V/1500 A, three-phase 460 V/50 kA and three-phase 550 V/225 A, respectively.

TABLE 1-6

| | Arc extinguishing insulative material | | Test result | | |
|---|---|---|---|---|---|
| | Insulator (2) | | Interrupting test | Short circuit | |
| Ex. No. | Arc receiving layer | Base layer | (Number of times of success) | test (Interruption/damage) | Durability test (Formation of hole) |
| 1-39 | PA66 | PA66/aluminum borate(30%) | 20 | yes/no | not formed after 4000 interruptions |
| 1-40 | PA66 | PA66/aluminum silicate(30%) | 20 | yes/no | not formed after 4000 interruptions |
| 1-41 | PA66/aluminum borate(20%) | PA66/aluminum borate(30%) | 20 | yes/no | not formed after 4000 interruptions |
| 1-42 | PA66/aluminum silicate(20%) | PA66/aluminum silicate(30%) | 20 | yes/no | not formed after 4000 interruptions |
| 1-43 | PA66 | PA46/aluminum borate(40%) | 20 | yes/no | not formed after 4000 interruptions |

As can be understood from Table 1-6, Examples 1-39 to 1-43 succeeded in interrupting an arc 20 times in the interrupting test, in interrupting an arc with no problem of damage in the short circuit test, and in interrupting an arc 4000 times with no problem in the durability test. Therefore, the arc extinguishing devices of these Examples were regarded as passed. The same results were obtained when nylon 46 precluded from Table 1-6 was used in the arc receiving layer and base layer instead of nylon 66.

EXAMPLES 1-44 TO 1-47

Arc extinguishing devices similar to those of Examples 1-39 to 1-43 were fabricated by using arc extinguishing insulative material compositions shown in Table 1-7. The content of a filler in each insulative material is shown in Table 1-7. The thus fabricated arc extinguishing devices were subjected to the tests under the same conditions as in Examples 1-39 to 1-43.

Particulars of the matrix resins and fillers in Table 1-7 were as follows:

PA.MXD6: nylon MXD6, Reny (trade mark) produced by Mitsubishi Gas Chemical Company, Inc.;

PET: polyethylene terephthalate, NOVAPET (trade mark) produced by MITSUBISHI KASEI CORPORATION;

T-GF-A: glass fiber formed of T glass containing 0% of group 1A metal compounds such as sodium oxide and potassium oxide in total and having a diameter of 10 $\mu$m and a length of 3 mm, produced by Nitto Boseki Co., Ltd.

TABLE 1-7

| | Arc extinguishing insulative material | | Test result | | |
|---|---|---|---|---|---|
| | Insulator (2) | | Interrupting test | Short circuit | |
| Ex. No. | Arc receiving layer | Base layer | (Number of times of success) | test (Interruption/damage) | Durability test (Formation of hole) |
| 1-44 | PA66/aluminum borate(20%) | PA6T/T—GF—A(30%) | 20 | yes/no | not formed after 4000 interruptions |
| 1-45 | PA66 aluminum borate(20%) | PA.MXD6/T—GF—A(30%) | 20 | yes/no | not formed after 4000 interruptions |
| I-46 | PA66/aluminum borate(20%) | PET/T—GF—A(30%) | 20 | yes/no | not formed after 4000 interruptions |
| 1-47 | PA66/aluminum borate(20%) | PET/T—GF—A(30%) | 20 | yes/no | not formed after 4000 interruptions |

As can be understood from Table 1-7, Examples 1-44 to 1-47 succeeded in interrupting an arc 20 times in the interrupting test, in interrupting an arc with no problem of damage in the short circuit test, and in interrupting an arc 4000 times with no problem in the durability test. Therefore, the arc extinguishing devices of these Examples were regarded as passed. The same results were obtained when nylon 46 was used in the arc receiving layer of each Example instead of nylon 66.

EXAMPLES 1-48 TO 1-52

Arc extinguishing devices were fabricated by using arc extinguishing insulative material compositions shown in Table 1-8. The thus fabricated devices were similar to those of Examples 1-1 to 1-10.

In these Examples the insulator (1) contained 50% of a filler and the insulator (2) contained a filler in the amount shown in Table 1-8.

The arc extinguishing devices were subjected to a short circuit test at three-phase 460 V/50 kA twice and then an phase-to-phase insulation resistance on the loaded side of the circuit breaker provided with each of the arc extinguishing devices was measured.

Particulars of the fillers in Table 1-8 were as follows:

$Mg(OH)_2$: KISUMA 5 (trade mark) having a particle diameter of 0.7 $\mu$m produced by KYOWA KAGAKU CORPORATION;

$Al(OH)_3$: produced by Sumitomo Chemical Company, Limited;

$Sb_2O_5$: produced by Nissan Chemical Industries, Ltd; and

GF-C: powdery C glass having a diameter of 10 $\mu$m, MICROGLASS (trade mark) produced by Nippon Sheet Glass Company, limited.

TABLE 1-8

| | Arc extinguishing insulative material | | Test result Phase-to-phase insulation resistance (MΩ) | | |
|---|---|---|---|---|---|
| | Insulator (1) (filler 50%) | Insulator (2) | left-center | center-right | left-right |
| Ex. No. | | | | | |
| 1-48 | PA6T/GF—A | PA46/GF—A(30%)/$Mg(OH)_2$(10%) | 5 | 1.5 | 7 |
| 1-49 | PA6T/GF—A | PA46/GF—A(30%)/$Mg(OH)_2$(20%) | 9 | 2 | 10 |
| 1-50 | PA6T/GF—A | PA46/GF—A(30%)/$Sb_2O_6$(20%) | 7 | 1.8 | 8 |
| 1-51 | PA6T/GF—A | PA46/$Mg(OH)_2$(40%)/GF—A(5%) | 12 | 5 | 15 |
| 1-52 | PA6T/GF—A | POM/PA6/GF—A(30%)/Al(OH)3(20%) | 4 | 1.5 | 5 |
| Com. Ex. No. 1-4 | PA6T/GF—C | PA46 | 0.3 | 0.1 | 0.4 |

In this short circuit test Examples 1-48 to 1-52 succeeded in interrupting an arc with no problem of damage. When these Examples were further subjected to the interrupting test and durability test, they succeeded in interrupting an arc 30 times in the interrupting test and in interrupting an arc 6000 times with no problem in the durability test.

EXAMPLES 1-53 TO 1-57 AND COMPARATIVE EXAMPLES 1-5 AND 1-6

Arc extinguishing devices as shown in FIG. 1-11 were fabricated having only the insulator (1) with use of arc extinguishing compositions shown in Table 1-9.

The contact portion of each of the moving contact and fixed contact had dimensions of 3×3 mm (×2 mm in thickness). The dimensions of each of the moving contact element and fixed contact element were 3 mm width×5 mm thickness×25 mm length, and those of the insulator (1) were: 1 mm in T1, 5 mm×5 mm in the area of the face containing the contact portion, and 6 mm in the length perpendicular to the face.

The content of a filler in each insulative material is entered in Table 1-9. The interrupting test was conducted under the conditions; current/voltage: three-phase 600 A/720 V, and contact gap distance: 25 mm, while the short circuit test was conducted under the conditions; current/voltage: three phase 50 kA/460 V, and contact gap distance: 25 mm.

TABLE 1-9

| | Arc extinguishing insulative material Insulator (1) | Test result Interrupting test (Number of times of success) | Short circuit test (Interruption/damage) |
|---|---|---|---|
| Ex. No. | | | |
| 1-53 | PA6T/GF(30%) | 30 | yes/no |
| 1-54 | PA6T/GF(50%) | 30 | yes/no |
| 1-55 | PA46/GF(30%) | 30 | yes/no |
| 1-56 | PA46/GF(50%) | 30 | yes/no |

TABLE 1-9-continued

| | Arc extinguishing insulative material Insulator (1) | Test result: Interrupting test (Number of times of success) | Short circuit test (Interruption/damage) |
|---|---|---|---|
| 1-57 | PA46/aluminum borate(40%) | 30 | yes/no |
| Com. Ex. No. | | | |
| 1-5 | Liquid crystal polyester/GF(30%) | 10 | yes/no |
| 1-6 | Melamine/GF(30%) | 30 | yes/yes |

As can be understood from Table 1-9, Examples 1-53 to 1-57 succeeded in interrupting an arc 30 times in the interrupting test and in interrupting an arc with no problem of damage in the short circuit test.

EXAMPLES 1-58 TO 1-66 AND COMPARATIVE EXAMPLE 1-7

Arc extinguishing devices as shown in FIGS. 1-12 and 1-13 were fabricated having only the insulator (2) with use of arc extinguishing compositions shown in Table 1-10.

The contact portion of each of the moving contact and fixed contact had dimensions of 3 mm×3 mm (×1 mm in thickness). The dimensions of each of the moving contact element and fixed contact element were 3 mm×5 mm×25 mm, T2=1 mm, and W=12 mm.

The content of a filler in each insulator material is shown in Table 1-10. Test conditions were: three-phase 720 V/600 A and a contact gap distance of 25 mm for the interrupting test; three phase 460 V/50 kA and a contact gap distance of 25 mm for the short circuit test; and three-phase 550 V/100 A and a contact gap distance of 25 mm for the durability test.

After the short circuit test, the insulation resistances between terminals on load side were measured using a DC insulation resistance tester.

In the following examples were conducted the interrupting test, short circuit test and durability test under the conditions to be described below.

Interrupting test

A switch including an arc extinguishing device in closed state is applied with a current (one-phase 420 V/600 A or one-phase 420 V/1500 A) six times as high as a rated current, and a moving contact 4 is separated away from a fixed contact 5 by a contact gap distance L (distance between a moving contact 4 and a fixed contact 5) of 15 mm or 25 mm to generate an arc current. If the switch successfully interrupts the arc current predetermined times, the switch is regarged as passed the test.

Short circuit test

A switch as above in closed state is applied with an overcurrent of one-phase 265 V/25 kA, and a moving contact is separated away from a fixed contact to generate an arc current. If the switch successfully interrupts the arc current with no damage, the switch is regarded as passed the test.

TABLE 1-10

| | Arc extinguishing insulative material Insulator (2) | Test result: Phase-to-Phase insulation (Resistance/MΩ) left-center | center-right | left-right | Interrupting test (Number of times of success) | Short circuit test (Damage) | Durability test (Formation of hole) |
|---|---|---|---|---|---|---|---|
| Ex. No. | | | | | | | |
| 1-58 | PA46/GF(30%)/ $Mg(OH)_2$(10%) | 5 | 1.5 | 7 | 30 | no | not formed after 6000 interruptions |
| 1-59 | PA46/GF(30%)/ $Mg(OH)_2$(20%) | 9 | 2 | 10 | 30 | no | not formed after 6000 interruptions |
| 1-60 | PA46/GF(30%)/ $Sb_2O_5$(20%) | 7 | 1.8 | 8 | 30 | no | not formed after 6000 interruptions |
| 1-61 | PA46/$Mg(OH)_2$(40%) | 12 | 5 | 15 | 30 | no | not formed after 6000 interruptions |
| 1-62 | (POM/PA6)/(GF(30%) + $Al(OH)_3$(20%)) | 4 | 1.5 | 5 | 30 | no | not formed after 6000 interruptions |
| 1-63 | PA46/aluminum borate(40%) | — | — | — | 30 | no | not formed after 6000 interruptions |
| 1-64 | PA66/aluminum borate(40%) | — | — | — | 30 | no | not formed after 6000 interruptions |
| 1-65 | PA46/$Mg(OH)_2$(20%) | 3 | 1.2 | 4 | 30 | no | not formed after 4500 interruptions |
| 1-66 | PA66/$Mg(OH)_2$(5%) | 0.9 | 0.6 | 1.2 | 30 | no | not formed after 3000 interruptions |
| Com. Ex. No. 1-7 | PA46 | 0.3 | 0.1 | 0.4 | 30 | no | not formed after 3000 interruptions |

Durability test

A switch as above in closed state is applied with a current of three-phase 550 V/100 A or three-phase 550 V/225 A, and a moving contact is mechanically separated away from a fixed contact by a contact gap distance L of 25 mm to generate an arc current. If the switch successfully interrupts the arc current predetermined times and the arc extinguishing insulative material used therein exhibits a consumption resistance, specifically to such a degree that a hole is not formed in the insulative material by the arc, the switch is regarded as passed the test.

TABLE 1-11

| | Arc extinguishing insulative material | | Test result: Short circuit test | | Test result: Interrupting test | Test result: Durability test |
|---|---|---|---|---|---|---|
| | Insulator (1) | Insulator (2) | Damage to insulator (1) | Damage to insulator (2) | (Number of times of success) | (Formation of hole) |
| Ex. No. | | | | | | |
| 1-67 | PA6T/GF(30%) | PA46/GF(30%) | no | no | 30 | not formed after 6000 interruptions |
| 1-68 | PA6T/GF(30%) | PA66/GF(30%) | no | no | 30 | not formed after 6000 interruptions |
| 1-69 | PA6T/$CaCo_3$(30%) | PA46/GF(30%) | no | no | 30 | not formed after 6000 interruptions |
| 1-70 | PA6T/talc(30%) | PA46/GF(30%) | no | no | 30 | not formed after 6000 interruptions |
| 1-71 | PA6T/ASTON(30%) | PA46/GF(30%) | no | no | 30 | not formed after 6000 interruptions |
| 1-72 | PA6T/sepiolite(30%) | PA46/GF(30%) | no | no | 30 | not formed after 6000 interruptions |
| 1-73 | PA6T/wollastonite (30%) | PA46/GF(30%) | no | no | 30 | not formed after 6000 interruptions |
| 1-74 | PA6T/aluminum silicate(30%) | PA46/GF(30%) | no | no | 30 | not formed after 6000 interruptions |
| 1-75 | PA6T/aluminum borate(30%) | PA46/GF(30%) | no | no | 30 | not formed after 6000 interruptions |
| 1-76 | PA6T/alumina(30%) | PA46/GF(30%) | no | no | 30 | not formed after 6060 interruptions |
| 1-77 | PA46/GF(50%) | PA46/GF(30%) | no | no | 30 | not formed after 6000 interruptions |
| 1-78 | PA46/GF(50%) | PA66/GF(30%) | no | no | 30 | not formed after 6000 interruptions |
| Com. Ex. No. | | | | | | |
| 1-8 | Modified melamine resin/GF(30%) | PBT/GF(30%) | yes | no | 15 | not formed after 6000 interruptions |
| 1-9 | Liquid crystal polyester/GF(30%) | PBT/GF(30%) | no | no | 11 | not formed after 6000 interruptions |
| 1-10 | Liquid crystal polyester/GF(30%) | Modified melamine resin/GF(30%) | no | yes | 30 | not formed after 6000 interruptions |
| 1-11 | Liquid crystal polyester/GF(30%) | Liquid crystal polyester/GF(30%) | no | impossible to break arc | 3 | not formed after 6000 interruptions |

EXAMPLES 1-67 TO 1-78 AND COMPARATIVE EXAMPLES 1-8 TO 1-11

Arc extinguishing devices each having the insulators (1) and (2) were fabricated by using insulative materials shown in Table 1-11. The insulator (1) had a thickness T1 of 1 mm, and the insulator (2) had a thickness T2 of 1 mm and a width W of 10 mm. In these Examples the insulator (2) comprised nylon 46 or 66 and, filled therein, 30% of a glass fiber (GF) formed of E glass, while the insulator (1) comprised nylon 6T and, filled therein, 30% of GF, inorganic mineral for reinforcing plastics ($CaCO_3$, talc, ASTON, sepiolite or wollastonite) or ceramic fiber of aluminum silicate, aluminum borate or alumina.

In Comparative Examples 1-8 to 1-11 the insulator (1) or (2) comprised a modified melamine resin, PBT or liquid crystal polyester, and 30% of GF filled therein.

Test conditions

Interrupting test: one-phase 420 V/600 A, contact gap distance L=15 mm; durability test: three-phase 550 V/100 A, contact gap distance L=15 mm; short circuit test: one-phase 265 V/25 kA, contact gap distance L=25 mm.

As apparent from Table 1-11, Comparative Examples 1-8 to 1-11 using the modified melamine resin or liquid crystal polyester in combination with GF suffered a decrease in the number of successes in interrupting an arc with some insulators thereof damaged, whereas Examples 1-67 to 1-78 using nylon 6T in combination with the aforementioned filler, or nylon 46 or nylon 66 in combination with GF were not damaged at any insulator thereof and succeeded in interrupting an arc 30 times in the interrupting test and in interrupting an arc 6000 times in the durability test. Therefore, the devices of Examples 1-67 to 1-78 are regarded as passed.

Filling the aforementioned filler into nylon 6T, nylon 46 or nylon 66 having a high melting point allows the heat distortion temperature of nylon to be raised and improves the mechanical strength thereof. When nylon 6T having a melting point of more than 300° C. was filled with 10% or more of any one of the fillers, i.e., GF, an inorganic mineral for reinforcing plastics ($CaCO_3$, talc, ASTON, sepiolite or wollastonite) and a ceramic fiber of aluminum silicate, aluminum borate or alumina, the heat distortion temperature of the composition was higher than nylon 6T free of filler. The use of the composition comprising nylon 6T and 10% or more of the filler for the insulator (1) affords good results since the gas produced therefrom by thermal decomposition effectively functions as an arc extinguishing gas and the insulator (1) is hard to deform by virtue of the raised heat distortion temperature. Of course, it is possible to use the composition for the insulator (2) which is used under less severe thermal conditions.

Further, since nylon 6T, nylon 46 and nylon 66 are poor in or free of aromatic ring, they tend to be less carbonized and allow free carbon to scatter, thus resulting in less likelihood of insulation failure.

When the proportion of the filler in the composition exceeds 55%, the arc extinguishing property of the composition tends to degrade and, hence, the composition becomes unsuitable for use.

EXAMPLES 1-79 TO 1-94

Arc extinguishing devices each having insulators (1) and (2) were fabricated by using insulative materials shown in Table 1-12. The insulator (1) had a thickness T1 of 1 mm and comprised nylon 6T and 30% of GF filled therein. The insulator (2) had a thickness T2 of 1 mm and a width W of 12 mm and comprised nylon 46, nylon 66 or a blend of nylon 66 and polypropylene (nylon 66: polypropylene=90:10), and 10 to 50% of GF, a plastic reinforcing inorganic mineral (ASTON), a ceramic fiber of aluminum borate, a mixture of GF and aluminum borate or a mixture of ASTON and aluminum borate.

The arc extinguishing devices thus fabricated were subjected to the interrupting test and durability test under the following conditions:

Interrupting test: one-phase 420 V/600 A, contact gap distance L=15 mm

Durability test: three-phase 550 V/100 A, contact gap distance L=15 mm.

The results of the tests were as shown in Table 1-12.

TABLE 1-12

| Ex. | Arc extinguishing insulative material | | Test result | |
|---|---|---|---|---|
| No. | Insulator (1) | Insulator (2) | Interrupting test (Number of times of success) | Durability test (Formation of hole) |
| 1-79 | PA6T/GF(30%) | PA46/GF(10%) | 30 | not formed after 6000 interruptions |
| 1-80 | PA6T/GF(30%) | PA46/GF(30%) | 30 | not formed after 6000 interruptions |
| 1-81 | PA6T/GF(30%) | PA46/GF(50%) | 30 | not formed after 6000 interruptions |
| 1-82 | PA6T/GF(30%) | PA66/GF(10%) | 30 | not formed after 6000 interruptions |
| 1-83 | PA6T/GF(30%) | PA66/GF(50%) | 30 | not formed after 6000 interruptions |
| 1-84 | PA6T/GF(30%) | PA66/ASTON(10%) | 30 | not formed after 6000 interruptions |
| 1-85 | PA6T/GF(30%) | PA66/ASTON(50%) | 30 | not formed after 6000 interruptions |
| 1-86 | PA6T/GF(30%) | PA66/aluminum borate(10%) | 30 | not formed after 6000 interruptions |
| 1-87 | PA6T/GF(30%) | PA66/aluminum borate(50%) | 30 | not formed after 6000 interruptions |
| 1-88 | PA6T/GF(30%) | PA66/(GF 5% + ASTON 5%) | 30 | not formed after 6000 interruptions |
| 1-89 | PA6T/GF(30%) | PA66/(GF 40% + ASTON 10%) | 30 | not formed after 6000 interruptions |
| 1-90 | PA6T/GF(30%) | PA66/(GF 5% + aluminum borate 5%) | 30 | not formed after 6000 interruptions |
| 1-91 | PA6T/GF(30%) | PA66/(GF 40% + aluminum borate 10%) | 30 | not formed after 6000 interruptions |
| 1-92 | PA6T/GF(30%) | PA66/(ASTON 5% + aluminum borate 5%) | 30 | not formed after 6000 interruptions |
| 1-93 | PA6T/GF(30%) | PA66/(ASTON 10% + aluminum borate 40%) | 30 | not formed after 6000 interruptions |
| 1-94 | PA6T/GF(30%) | (PA66 + polypropylene/GF 50%) | 30 | not formed after 6000 interruptions |

As apparent from Table 1-12, the arc extinguishing devices of these Examples using the compositions containing 10 to 50% of the filler comprising GF, plastic reinforcing inorganic mineral (ASTON), ceramic fiber of aluminum borate or a mixture thereof succeeded in interrupting an arc 30 times in the interrupting test and 6000 times in the durability test. Therefore, the devices were regarded as passed.

Like ASTON, wollastonite and sepiolite are fibrous inorganic fillers having an excellent effect in mechanical reinforcement. Also, aluminum silicate and aluminum whisker, like aluminum borate whisker, are ceramic fibers exhibiting an excellent effect in mechanical reinforcement. The same results as above were obtained when wollastonite or sepiolite was used instead of ASTON or when aluminum silicate or aluminum whisker was used instead of aluminum borate whisker. In this case the sepiolite used had an average diameter of 0.1 $\mu$m and an average length of 2 $\mu$m and was a product of NIPPON TALC CORPORATION.

The composition of nylon 46 or nylon 66 and, filled therein, each or mixture of the aforementioned fillers has a raised heat distortion temperature and enjoys improved mechanical strength. Nylon 46 and nylon 66 have melting points as high as 290° C. and 260° C., respectively. When each of nylon 46 and nylon 66 is filled with 10% or more of the filler, the respective heat distortion temperatures thereof are raised to 285° C. (220° C. in non-reinforced state) and to 245° C. (100° C. in non-reinforced state) according to measurement method ASTM-D648. The proportion of the filler is preferably 30% or more since such an effect is particularly enhanced. The upper limit of the proportion of the filler is 55%. When the proportion thereof exceeds 55%, the composition becomes poor in processability and hence unsuitable for use.

EXAMPLES 1-95 AND 1-96

Arc extinguishing devices each having insulators (1) and (2) were fabricated by using insulative materials shown in Table 1-13. The insulator (1) had a thickness T of 1 mm and comprised nylon 6T and 50% of GF filled therein. The insulator (2) had a thickness T of 1 mm and a width W of 12 mm and comprised a polymer blend of nylon 6 and polyacetal (nylon 6:polyacetal=70:30) and 40% of GF.

The arc extinguishing devices thus fabricated were subjected to the interrupting test and durability test under the following conditions:

Interrupting test: one-phase 420 V/600 A, open contact distance L=15 mm

Durability test: three-phase 550 V/100 A, open contact distance L=15 mm.

The results of the tests were as shown in Table 1-13.

TABLE 1-13

| Ex. | Arc extinguishing insulative material | | Test result | |
|---|---|---|---|---|
| | | | Interrupting test (Number of times | Durability test |
| No. | Insulator (1) | Insulator (2) | (of success) | (Formation of hole) |
| 1-95 | PA6T/GF(50%) | POM/PA6 | 30 | not formed after 3000 interruptions |
| 1-96 | PA6T/GF(50%) | (POM/PA6)/GF(40%) | 30 | not formed after 6000 interruptions |

As apparent from Table 1-13, the arc extinguishing devices of these Examples succeeded in interrupting an arc 30 times in the interrupting test and succeeded in interrupting an arc 3000 times and 6000 times, respectively, in the durability test. Therefore, the devices were regarded as passed.

Since nylon 6 is incompatible with polyacetal, polymer blending these materials allows the arc receiving surface of the insulator (2) to be formed of polyacetal thereby causing polyacetal to produce an arc extinguishing gas when the arc receiving surface is exposed to an elevated temperature due to arc. The arc extinguishing gas produced from polyacetal has a potent arc extinguishing action, which leads to improved current limiting or interrupting performance. Further, the polymer blend of nylon 6 enjoys a higher heat distortion temperature and, hence, even a small-size arc extinguishing device using this polymer blend exhibits a mechanical strength sufficient to withstand an elevated pressure due to arc.

EXAMPLES 1-97 TO 1-101

Arc extinguishing devices each having insulators (1) and (2) were fabricated by using insulative materials shown in Table 1-14. The insulator (1) had a thickness T of 1 mm and comprised nylon 6T and 50% of GF filled therein. The insulator (2) had a thickness T2 of 1 mm and a width W of 12 mm and comprised a composition containing nylon 46, 30% of GF and an additive comprising magnesium hydroxide, antimony pentoxide or aluminum hydroxide, or containing a polymer blend of nylon 6 and polyacetal and the additive, or containing nylon 46 and 40% of magnesium hydroxide.

The arc extinguishing devices thus fabricated were subjected to tests under the same conditions as in Examples 1-58 to 1-62.

The heat of arc decomposes aluminum hydroxide into alumina and $H_2O$, magnesium hydroxide into magnesium oxide and $H_2O$, antimony tetroxide into antimony trioxide and $O_2$ or O, and antimony pentoxide into antimony tetroxide and $O_2$ or O and further into antimony trioxide and $O_2$ or O. $H_2O$, $O_2$ or O produced by the decomposition reacts with a metal vapor generated from the periphery of the contacts or a free carbon generated from the insulator upon interruption of electric current to give a metal oxide, carbon monoxide or carbon dioxide, which acts to inhibit the occurrence of insulation failure. Hence, even if the arc extinguishing device using such an additive is of small size, an insulation failure is effectively inhibited.

In these Examples nylon 66 or nylon 6T may be used instead of nylon 46. The composition containing nylon 66 or nylon 6T in combination with the additive can also lead to phase-to-phase insulation resistances higher by one order or greater than those of the case excluding the additive.

EXAMPLES 1-102 TO 1-108

Arc extinguishing devices each having only insulator (2) were fabricated by using the insulative materials shown in Table 1-15. The insulator (2) had a thickness T2 of 1.5 mm and a width W of 10 mm and was of a double-layered structure comprising an arc receiving layer (1 mm thick) and an outer base layer (0.5 mm thick) covering the arc receiving layer. The arc receiving layer comprised nylon 46 or 66 reinforced with 20% of a filler or non-reinforced nylon 46 or 66, while the outer base layer comprised nylon 46, nylon MXD6, PET or nylon 6T which was reinforced with GF.

The arc extinguishing devices thus fabricated were subjected to the tests under the following conditions:

Interrupting test: one-phase 420 V/1500 A, open contact distance L=25 mm

Durability test: three-phase 550 V/225 A, open contact distance L=25 mm

TABLE 1-14

| Ex. | Arc extinguishing insulative material | | Test result Phase-to-phase insulation resistance (MΩ) at loaded side | | |
|---|---|---|---|---|---|
| No. | Insulator (1) | Insulator (2) | left-center | center-right | left-right |
| 1-97 | PA6T/GF(50%) | PA46/GF(30%)/$Mg(OH)_2$(10%) | 5 | 1.5 | 6 |
| 1-98 | PA6T/GF(50%) | PA46/GF(30%)/$Mg(OH)_2$(20%) | 8 | 2 | 10 |
| 1-99 | PA6T/GF(50%) | PA46/GF(30%)/$Sb_2O_5$(20%) | 7 | 1.8 | 8 |
| 1-100 | PA6T/GF(50%) | PA46/$Mg(OH)_2$(40%) | 12 | 5 | 13 |
| 1-101 | PA6T/GF(50%) | (POM/PA6)/(GF(30%) + $Al(OH)_3$(20%)) | 4 | 1.5 | 5 |

As can be understood from Table 1-14, the devices of Examples 1-97 to 1-101 exhibited phase-to-phase insulation resistances on the loaded side higher by one order or greater than those of the case excluding the additive.

Short circuit test: one-phase 265 V/25 kA, open contact distance L=25 mm.

The results of the tests were as shown in Table 1-15.

TABLE 1-15

| | Arc extinguishing insulative material | | | Test result | | |
|---|---|---|---|---|---|---|
| | | Insulator (2) | | Short circuit test | Interrupting test (Number of | |
| Ex. No. | Insulator (1) | Arc receiving layer | Base layer | (Damage to insulator) | times of success) | Surability test (Formation of hole) |
| 1-102 | not present | PA66/GF(10%) | PA46/GF(50%) | no | 20 | not formed after 4000 interruptions |
| 1-103 | not present | PA66 | PA46/GF(50%) | no | 20 | not formed after 4000 interruptions |
| 1-104 | not present | PA66/$Mg(OH)_2$(10%) | PA46/GF(50%) | no | 20 | not formed after 4000 interruptions |
| 1-105 | not present | PA66 | PA6T/GF(50%) | no | 20 | not formed after 4000 interruptions |
| 1-106 | not present | PA66 | PAMXD6/GF(50%) | no | 20 | not formed after 4000 interruptions |
| 1-107 | not present | PA66 | PET/GF(45%) | no | 20 | not formed after 4000 interruptions |
| 1-108 | not present | PA46/GF(20%) | PA46/GF(40%) | no | 20 | not formed after 4000 interruptions |

As apparent from Table 1-15, the arc extinguishing devices of these Examples were not damaged at insulator (2) in the short circuit test, succeeded in interrupting an arc 20 times in the interrupting test, and did not suffer the formation of hole in the durability test. Therefore, the devices were regarded as passed.

Like those nylon 46, nylon MXD6, PET and nylon 6T, satisfactory test results were obtained when the base layer was formed of any one of modified polyphenylene oxide, polycarbonate, polyphenylene sulfide, polysulfone, polyether sulfone and polyether ketone which were each reinforced with GF.

The fillers used in those Examples did not allow the respective insulation resistances thereof to lower even when exposed to the heat of arc. Accordingly, there were obtained arc extinguishing materials of high insulation resistance.

It should be noted that although the insulative materials in Examples 1-102 to 1-108 exhibited an excellent effect when used in the insulator (2), they exhibited a satisfactory effect when used in the insulator (1).

Next, the method for insulating scattered metal particles, the gas generating source material for use therein and the switch employing the method according to the second group inventions of the present invention will be more fully described by way of specific examples thereof. The present invention will not be limited to such examples.

EXAMPLE 2-1

Barium peroxide powder (first grade chemical, average particle diameter of 6 $\mu$m) for use as a gas generating source compound was press-molded into a molded article having a diameter of 30 mm and a thickness of 6 mm.

The following experiment was conducted on the molded product using an experimental device shown in FIG. 2-5 for measuring the electric resistance of a scattered deposit produced by arc and for identifying the scattered deposit.

The experimental device shown comprised a cylindrical sealed container 109 and a pair of opposing electrodes 111, 111. Molded article 110 of the gas generating source material was placed just below the opposing electrodes 111, 111 and then exposed to an arc generated between the electrodes 111, 111 to give a scattered deposit, which adhered to a deposition plate 112 provided on the inside surface of a circular panel of the sealed container 109. The opposing electrodes 111, 111 each comprised 60% of Ag and 40% of WC and were spaced from each other by 18 mm.

The electric resistance (MΩ) of the scattered deposit was immediately measured in accordance with the measuring method for molded case circuit breakers (for practical use) described in JIS C 8370 using an insulation resistance tester (500 V portable megger described in JIS C 1301). Further, the scattered deposit was identified by measuring a peak intensity X-ray diffraction pattern of the scattered deposit in powdered condition with use of X-ray diffractometer XD-3A of SHIMADZU CORPORATION. The results were as shown in Table 2-1.

If the electric resistance thus measured was 100 MΩ or higher, the insulation imparting gas generated from the gas generating source compound is considered to have exhibited the effect of inhibiting the electric resistance from lowering.

Further, in the column of Table 2-1 for the results of identification of the scattered deposit there are shown principal ones of the substances in which diffraction peaks are found, with the peak intensities of the principal substances being compared using a sign of inequality.

EXAMPLE 2-2

In the same manner as in Example 2-1 except that aluminum oxide powder (average particle diameter of 0.3 $\mu$m) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-3

In the same manner as in Example 2-1 except that magnesium oxide powder (average particle diameter of 20 $\mu$m) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-4

In the same manner as in Example 2-1 except that zircon powder (average particle diameter of 16 $\mu$m) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-5

In the same manner as in Example 2-1 except that cordierite powder (average particle diameter of 7.5 $\mu$m) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-6

In the same manner as in Example 2-1 except that mullite powder (average particle diameter of 4 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-7

In the same manner as in Example 2-1 except that wollastonite needle-like crystal (FPW-350, a product of Kinsei Matec Kabushiki Kaisha, average particle diameter of 20 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-8

In the same manner as in Example 2-1 except that aluminum hydroxide powder (average particle diameter of 0.8 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-9

In the same manner as in Example 2-1 except that magnesium hydroxide powder (average particle diameter of 0.6 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-10

In the same manner as in Example 2-1 except that muscovite powder (325-mesh through) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-11

In the same manner as in Example 2-1 except that talc powder (product of Nippon Talc Kabushiki Kaisha, average particle diameter of 0.6 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-12

In the same manner as in Example 2-1 except that calcium carbonate powder (average particle diameter of 0.3 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-13

In the same manner as in Example 2-1 except that magnesium carbonate powder (average particle diameter of 0.4 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-14

In the same manner as in Example 2-1 except that dolomite powder (average particle diameter of 2.4 μm) was used as the gas generating source compound, a molded article was prepared and then exposed to an arc, followed by measuring the electric resistance of the resulting scattered deposit and identifying the scattered deposit.

The results were as shown in Table 2-1.

EXAMPLE 2-15

In the same manner as in Example 2-1 except that magnesium sulfate powder (average particle diameter of 8 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-16

In the same manner as in Example 2-1 except that aluminum sulfate powder (average particle diameter of 6 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-17

In the same manner as in Example 2-1 except that calcium sulfate powder (pulverized calcium sulfate dihydrate, average particle diameter of 8 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-18

In the same manner as in Example 2-1 except that barium sulfide powder (first grade chemical, average particle diameter of 1 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-19

In the same manner as in Example 2-1 except that zinc fluoride powder (zinc fluoride tetrahydrate, first grade chemical, average particle diameter of 2 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-20

In the same manner as in Example 2-1 except that magnesium fluoride powder (first grade chemical, average particle diameter of 2 μm) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-21

In the same manner as in Example 2-1 except that fluorophlogopite powder treated with fluorine (synthetic phlogopite PDM-KG325 of Topy Kogyo Kabushiki Kaisha, 325-mesh through) was used as the gas generating source compound, a molded article was prepared and then exposed to an arc, followed by measuring the electric resistance of the resulting scattered deposit and identifying the scattered deposit. The results were as shown in Table 2-1.

EXAMPLE 2-22

Magnesium hydroxide powder of the same type as used in Example 2-9 for use as the gas generating source compound was contained in the proportion of 70% in a silicone grease to form a paste, which was in turn filled into pores of a 3 mm-thick sintered metal body (copper-cadmium oxide alloy) of a size of 30 mm×30 mm with a filling rate of 60 mg/3 cm×3 cm, to prepare a supported material.

In the same manner as in Example 2-1 except that the thus prepared carrier product was used instead of the molded article, the carrier product was exposed to an arc, followed by measuring the electric resistance of the resulting scattered deposit and identifying the scattered deposit. The results were as shown in Table 2-1.

EXAMPLE 2-23

Magnesium hydroxide of the same type as used in Example 2-9 for use as the gas generating source compound was contained in the proportion of 50% in ethyl alcohol to form a slurry, which was in turn applied with brush onto a one-side surface of a 5 mm-thick aluminum oxide plate of a size of 30 mm×30 mm in such an amount as to afford a 50 μm-thick coating when dried, to prepare a supported material.

In the same manner as in Example 2-1 except that the thus prepared carrier product was used instead of the molded article, the carrier product was exposed to an arc, followed by measuring the electric resistance of the resulting scattered deposit and identifying the scattered deposit. The results were as shown in Table 2-1.

EXAMPLE 2-24

A carrier product was prepared in the same manner as in Example 2-23 except that silicon ethoxide hydrolysate ($Si(OC_2H_5)_2(OH)_2$, with ethanol contained) was used as the gas generating source compound and that a slurry containing the silicon ethoxide was applied onto an aluminum oxide plate of the same type as above by roll coating in such an amount as to afford a 20 μm-thick coating when dried.

In the same manner as in Example 2-1 except that the thus prepared carrier product was used instead of the molded article, the supported material was exposed to an arc, followed by measuring the electric resistance of the resulting scattered deposit and identifying the scattered deposit. The results were as shown in Table 2-1.

EXAMPLE 2-25

Magnesium hydroxide of the same type as used in Example 2-9 for use as the gas generating source compound was filled into pores of a 5 mm-thick porous ceramic body mainly containing zircon-cordierite porcelain of a size of 3 mm×3 mm with a filling rate of 120 mg/3 cm×3 cm, to prepare a supported material.

In the same manner as in Example 2-1 except that the thus prepared supported material was used instead of the molded article, the carrier product was exposed to an arc, followed by measuring the electric resistance of the resulting scattered deposit and identifying the scattered deposit. The results were as shown in Table 2-1.

EXAMPLE 2-26

A polyester material was prepared as containing, as the gas generating source compound, 30% of magnesium hydroxide powder of the same type as used in Example 2-9, and a glass fabric-polyester laminated body was molded as containing the polyester material with a filling rate of 30 g/30 cm×30 cm and was processed as having a size of 30 mm×30 mm and a thickness of 1 mm, to prepare a supported material.

In the same manner as in Example 2-1 except that the thus prepared supported material was used instead of the molded article, the supported material was exposed to an arc, followed by measuring the electric resistance of the resulting scattered deposit and identifying the scattered deposit. The results were as shown in Table 2-1.

EXAMPLE 2-27

A supported material was prepared in the same manner as in Example 2-26 except for the use of a glass fabric-polyester laminated body (GLASSMER of Nikko Kasei Kabushiki Kaisha) filled with a polyester material containing 30% of alumina hydrate powder instead of the magnesium hydroxide powder.

In the same manner as in Example 2-1 except that the thus prepared supported material was used instead of the molded article, the supported material was exposed to an arc, followed by measuring the electric resistance of the resulting scattered deposit and identifying the scattered deposit. The results were as shown in Table 2-1.

COMPARATIVE EXAMPLE 2-1

In the same manner as in Example 2-1 except that instead of the barium peroxide powder was used a composition comprising, as an organic material that was free of any aromatic ring having many carbon atoms but was rich in hydrogen atom, a blend of an acrylic ester copolymer and an aliphatic hydrocarbon resin (polyethylene) (acrylic ester copolymer:polyethylene=70:30 in weight ratio), and 30% of a glass fiber material filled therein, a molded article was prepared and then exposed to an arc, followed by measuring the electric resistance of the resulting scattered deposit and identifying the scattered deposit. The results were as shown in Table 2-1.

COMPARATIVE EXAMPLE 2-2

In the same manner as in Example 2-9 except that the molded product was disposed within the experimental device shown in FIG. 2-5 at a location adjacent the deposition plate 12 spaced by 150 mm from the opposing electrodes 111, not at a location adjacent (just below) the opposing electrodes 111, the molded article was exposed to an arc, followed by measuring the electric resistance of the resulting scattered deposit and identifying the scattered deposit. The results were as shown in Table 2-1.

TABLE 2-1

| Gas generating source material | | Electric registance (MΩ) | Result of identification of scattered deposit |
|---|---|---|---|
| Example | | | |
| 2-1 | Barium peroxide | >500 | BaO > Ag, W |
| 2-2 | Aluminum oxide | >1000 | $Al_2O_3$ > Ag, W |
| 2-3 | Magnesium oxide | >2000 | MgO > Ag, W |
| 2-4 | Zircon | >500 | $ZrO_2$ .$SiO_2$, Ag |
| 2-5 | Cordierite | >500 | MgO.$Al_2O_2$, Ag |
| 2-6 | Mullite | >1000 | $3Al_2O_3$ .$2SiO_2$, Ag |
| 2-7 | Wollastonite | >2000 | α-CaO.$SiO_2$, Ag, W |
| 2-8 | Aluminum hydroxide | >5000 | γ-$Al_2O_3$ > Ag, W |
| 2-9 | Magnesium hydroxide | ∞ | MgO, $Ag_2O$ > Ag, W |
| 2-10 | Muscovite | >500 | KAl $Si_2O_6$, Ag, W |
| 2-11 | Talc | >2000 | MgO.$SiO_4$, Ag, W |
| 2-12 | Calcium carbonate | ∞ | Ca(OH)2 > Ag, W |
| 2-13 | Magnesium carbonate | ∞ | Mg(OH)2 > Ag, W |
| 2-14 | Dolomite | >5000 | MgO, CaO > Ag, W |
| 2-15 | Magnesium sulfate | >200 | MgO < Ag |
| 2-16 | Aluminum sulfate | >200 | γ-$Al_2O_3$ < Ag |
| 2-17 | Calcium sulfate | >100 | CaO < Ag |
| 2-18 | Barium sulfide | >1000 | BaS, AgS, Ag, W |
| 2-19 | Zinc fluoride | >2000 | ZnO, AgF, Ag, W |
| 2-20 | Magnesium fluoride | >2000 | MgO, AgF, Ag, W |
| 2-21 | Phlogopite treated with fluorine | >1000 | Fluorophlogopite, AgF, Ag, W |
| 2-22 | Magnesium hydroxide (+ silicone grease) | ∞ | MgO, $Ag_2O$ > Ag, W |
| 2-23 | Magnesium hydroxide (+ ethyl alcohol) | ∞ | MgO, $Ag_2O$ > Ag, W |
| 2-24 | Silicon ethoxide hydrolysate (+ ethyl alcohol) | >300 | $SiO_2$ > Ag, W |
| 2-25 | Magnesium hydroxide (+ porous ceramic) | >2000 | MgO, $Ag_2O$ > Ag |
| 2-26 | Magnesium hydroxide (+ glass fabric-polyester lamination) | >1000 | MgO, $Ag_2O$ > Ag, W |
| 2-27 | Alumina hydrate (+ glass fabric-polyester lamination) | >100 | γ-$Al_2O_3$ < Ag, W |
| Comparative Example | | | |
| 2-1 | — | <50 | Ag, W |
| 2-2 | Magnesium hydroxide | <20 | MgO << Ag, WC |

As can be understood from the results shown in Table 2-1, in any of Examples 2-1 to 2-27 the electric resistance measured was higher than 100 MΩ and was satisfactorily inhibited from lowering. Since the electric resistance was as high as infinity in Examples 2-9, 2-12 and 2-13 in particular, the materials used in these Examples, i.e., magnesium hydroxide, calcium carbonate and magnesium carbonate were found to generate an insulation imparting gas exhibiting a particularly great insulation imparting effect.

Further, since each of the gas generating source compounds used in Examples 2-1 to 2-7 deposited together with the conductor metal, Ag or W, of the electrodes onto the deposition plate with little chemical change of itself and the peak intensity of X-ray diffraction pattern of Ag or W was lower than those of the identified oxides, these oxides (insulators) are considered to have intervened between scattered metal particles to insulate these metal particles.

The gas generating source compounds used in Examples 2-8 to 2-11 and 2-24 were dehydrated into oxides. In the case of magnesium hydroxide in particular, $Ag_2O$ was confirmed to be produced. Since the peak intensity of X-ray diffraction pattern of each of the oxides was higher than that of Ag or W, these oxides are considered to have intervened between scattered metal particles to insulate these metal particles as in Examples 2-1 to 2-7.

In Examples 2-22, 2-23, 2-25 and 2-26 also, $Ag_2O$ was confirmed to be produced with the aid of magnesium hydroxide, an insulator of high electric resistance was found to be formed.

The gas generating source compounds used in Examples 2-12 to 2-14 were changed into oxides by decarboxylation or into hydroxides by reaction with moisture in the ambient air. Since the peak intensity of X-ray diffraction pattern of each of the oxides or hydroxides was higher than that of Ag or W, these oxides or hydroxides are considered to have intervened between scattered metal particles to insulate these metal particles.

The gas generating source compounds used in Examples 2-15 to 2-17 were changed into oxides by desulfurization. Although a metal sulfide was supposed to be produced, definite identification of such a metal sulfide could not be achieved by X-ray diffraction. Since the peak intensity of X-ray diffraction pattern of Ag or W was higher than that of each of the oxides, the electric resistance of the resulting scattered deposit was relatively low, compared to other Examples.

The gas generating source compound used in Example 2-18 is assumed to have decomposed at a highly elevated temperature, and AgS resulting from the reaction of the compound with Ag was identified though in a trace amount. In this Example too, the sulfide is considered to have intervened between scattered metal particles to insulate these metal particles.

The gas generating source compounds used in Examples 2-19 to 2-21 are considered to have decomposed into oxides and have fluorinated Ag or W to turn it into an insulator.

In Example 2-27 crystal water was dissociated from the gas generating source compound and adhered to the deposition plate together with Ag or W. Since the peak intensity of X-ray diffraction pattern of Ag or W was higher than that of the oxide, the electric resistance of the resulting scattered deposit was relatively low, compared to other Examples.

On the other hand, Comparative Example 2-1 carried out a conventional method not using the gas generating source material, and the resulting scattered deposit contained Ag or W kept uninsulated and hence had a low electric resistance.

In Comparative Example 2-2 magnesium hydroxide exhibiting an excellent insulation imparting effect was disposed adjacent the deposition plate significantly spaced apart from the electrodes. Unlike Example 2-9, since $Ag_2O$ was not produced with a small amount of MgO produced, it is not considered that the decrease in the electric resistance of the resulting scattered deposit was effectively inhibited.

As can be understood from these results, as in Examples 2-1 to 2-27 the gas generating source compound for generating a highly effective insulation imparting gas is required to be disposed in such a position in the vicinity of the electrodes, contacts and other metal components located adjacent thereto as to enable the compound to generate the gas at a highly elevated temperature when exposed to an arc developed and to enable the scattered metal deposit to be insulated successfully.

Next, reference is made to examples of gas generating source material comprising an organic binder and a gas generating source compound, insulating method and switch using the same according to the second group inventions of the present invention, and also to comparative examples thereof.

FIG. 2-6 illustrates in side elevation an arc extinguishing device provided in one example of a switch in closed state. There are included gas generating source material 113, moving contact element 114, moving contact 115, fixed contact 116, fixed contact element 117, and pivoting center 118 of the moving contact element.

FIG. 2-7 illustrates in side elevation the arc extinguishing device of the switch shown in FIG. 2-6 in opened state and wherein same reference numerals denote same parts as above.

FIG. 2-8 illustrates a switch (circuit breaker) of three-phase configuration to which the arc extinguishing device shown in FIG. 2-6 is applied. The switch includes the same parts 113 and 114 as above, power side terminals 119 including left terminal 119*a,* central terminal 119*b* and right terminal 119*c,* load side terminals 120 including left terminal 120*a,* central terminal 120*b* and right terminal 120*c,* power side terminal holes 121 including left terminal hole 121*a,* central terminal hole 121*b* and right terminal hole 121*c,* load side terminal holes 122 including left terminal hole 122*a,* central terminal hole 122*b* and right terminal hole 122*c,* handle (lever portion) 123, handle (slide portion) 124, and connecting bar 125.

FIG. 2-9 is a sectional view of the switch including the arc extinguishing device in closed state taken along lines A—A of FIG. 2-8, and FIG. 2-10 is also a sectional view of the switch including the arc extinguishing device in opened state taken along lines A—A of FIG. 2-8. In FIGS. 2-9 and 2-10 numerals 13 to 18, 23 and 24 denote the same parts as above.

EXAMPLE 2-28

Forty parts by weight of a high density polyethylene and 60 parts by weight of magnesium hydroxide were homogeneously mixed using a kneading extruder, and the mixture was formed into a molded article having dimensions of 2 cm (length)×2 cm (width)×0.2 cm (thickness) using an injection molding machine to afford the gas generating source material of the present invention, followed by subjecting the material to the following test.

The test was carried out in the following manner according to the measurement method for circuit breaker provided in JIS C8370.

An overcurrent of three-phase 460 V/25 kA was applied to the switch in closed state shown in FIG. 2-8 and the moving contact element was opened to generate an arc current, followed by measuring the insulation resistances between load side terminals with use of an insulation resistance tester provided in JIS C1302.

The results of the test were as shown in Table 2-2 where the abbreviations represent as follows:

HDPE: high density polyethylene
PP: polypropylene
PS: polystyrene
PVC: polyvinyl chloride
EVOH: ethylene-vinyl alcohol copolymer
EVA: ethylene-vinyl acetate copolymer
PA12: nylon 12
PA6: nylon 6
TPE: thermoplastic olefin elastomer
EPR: ethylene-propylene rubber
GF: glass fiber
EP: bisphenol A-type epoxy resin

EXAMPLES 2-29 TO 2-41

In the same manner as in Example 2-28 except that each gas generating source material comprised the ingredients shown in Table 2-2 at the compounding ratio also shown in Table 2-2, gas generating source materials according to the present invention were obtained, followed by conducting the same test as in Example 2-28. The results were as shown in Table 2-2.

TABLE 2-2

| | Gas generating source material | | Test Insulation resistance between load side terminals (MΩ) | | |
|---|---|---|---|---|---|
| Example No. | Ingredients | Compounding ratio (wt. %) | left-central terminals | central-right terminals | left-right terminals |
| 2-28 | HDPE/$Mg(OH)_2$ | 40/60 | 6.0 | 5.0 | 6.5 |
| 2-29 | PP/$Mg(OH)_2$ | 40/60 | 6.8 | 6.0 | 7.0 |
| 2-30 | Polymethylpentene/$Mg(OH)_2$ | 50/50 | 5.0 | 4.5 | 5.0 |
| 2-31 | PS/$Mg(OH)_2$ | 50/50 | 4.5 | 4.0 | 5.0 |
| 2-32 | PVC/$Mg(OH)_2$ | 70/30 | 1.3 | 1.0 | 1.3 |
| 2-33 | EVOH/$Mg(OH)_2$ | 50/50 | 6.0 | 5.0 | 6.2 |
| 2-34 | EVA/$Mg(OH)_2$ | 50/50 | 6.0 | 4.9 | 6.5 |
| 2-35 | PA12/$Mg(OH)_2$ | 40/60 | 7.0 | 6.0 | 7.5 |
| 2-36 | PA6/$Mg(OH)_2$ | 50/50 | 5.0 | 4.5 | 5.2 |
| 2-37 | PA6/PP/$Mg(OH)_2$ | 45/5/50 | 5.0 | 4.8 | 5.5 |
| 2-38 | PA6/TPE/$Mg(OH)_2$ | 45/5/50 | 5.1 | 4.8 | 5.5 |
| 2-39 | PA6/EPR/$Mg(OH)_2$ | 45/5/50 | 5.1 | 4.9 | 5.5 |
| 2-40 | PA6/melamine/$Mg(OH)_2$ | 45/5/50 | 4.9 | 4.6 | 5.2 |
| 2-41 | Paraffin wax/$Mg(OH)_2$ | 30/70 | 8.0 | 7.0 | 8.5 |

EXAMPLES 2-42 TO 2-52

In the same manner as in Example 2-28 except that each gas generating source material comprised the ingredients shown in Table 2-3, gas generating source materials according to the present invention were obtained, followed by conducting the same test as in Example 2-28. The results were as shown in Table 2-3.

COMPARATIVE EXAMPLE 2-3

In the same manner as in Example 2-28 except that the gas generating source material was not used, the test was conducted. The results were as shown in Table 2-3.

COMPARATIVE EXAMPLE 2-4

In the same manner as in Example 2-28 except that the gas generating source material comprised polypropylene only, the test was conducted. The results were as shown in Table 2-3.

TABLE 2-3

| | Gas generating source material | | Test Insulation resistance between load side terminals (MΩ) | | |
|---|---|---|---|---|---|
| | Ingredients | Compounding ratio (wt. %) | left-central terminals | central-right terminals | left-right terminals |
| Example No. | | | | | |
| 2-42 | Bisphenol F-type epoxy/$Mg(OH)_2$ | 40/60 | 6.7 | 6.1 | 6.8 |
| 2-43 | Biphenyl epoxy/$Mg(OH)_2$ | 40/60 | 6.5 | 6.0 | 6.5 |
| 2-44 | Biphenyl epoxy/GF/$Mg(OH)_2$ | 35/10/55 | 6.0 | 5.5 | 6.5 |
| 2-45 | PP/$Al(OH)_3$ | 40/60 | 4.4 | 4.0 | 4.5 |
| 2-46 | PP/$CaCO_3$ | 40/60 | 3.7 | 3.0 | 4.0 |
| 2-47 | PP/Zinc borate | 60/40 | 2.5 | 2.0 | 2.5 |
| 2-48 | PP/Talc | 40/60 | 2.3 | 2.0 | 2.5 |
| 2-49 | PP/ASTON | 40/60 | 3.5 | 3.0 | 3.6 |
| 2-50 | PP/Ammonium octamolybdate | 60/40 | 3.0 | 2.5 | 3.5 |
| 2-51 | PP/Antimony pentoxide | 60/40 | 2.9 | 2.2 | 3.0 |
| 2-52 | EP/Ammonium borate | 60/40 | 2.0 | 1.8 | 2.2 |
| Com. Ex. | | | | | |
| 2-3 | — | — | 0.7 | 0.5 | 0.8 |
| 2-4 | PP | 100 | 0.4 | 0.2 | 0.4 |

As can be readily understood from Tables 2-2 and 2-3, the use of the gas generating source material of the present invention ensured a high insulation resistance and hence inhibited the decrease in electric resistance. In particular, the gas generating source material containing 50% or greater of $Mg(OH)_2$ as in Examples 2-28 to 2-31 and 2-33 to 2-44 ensured a particularly large insulation resistance. As can be understood from these results, a high filling rate of $Mg(OH)_2$ resulted in a high insulation imparting effect. (From the infrared absorption spectra of FIGS. 2-11 and 2-12, it was confirmed that silver oxide was produced, namely silver used as the electrode material was oxidized.) In Example 2-32, though the proportion of $Mg(OH)_2$ was 30% which was less than those in Examples 2-28 to 2-31 and 2-33 to 2-44, the gas generating source material provided an insulation resistance larger than those in Comparative Examples 2-3 and 2-4 and, hence, an insulation imparting effect was developed. Also, in Examples 2-45 to 2-52 the gas generating source material provided an insulation resistance larger than those in Comparative Examples 2-3 and 2-4 and, was thus confirmed to exhibit an insulation imparting effect. It should be noted that silver oxide was not produced in Comparative Example 2-3.

FIG. 2-11 is a graphic representation of the infrared absorption spectrum of a deposit adhering to a wall surface of the arc extinguishing device after the test in Example 2-29.

FIG. 2-12 is a graphic representation of the infrared absorption spectrum of a deposit adhering to a wall surface of the arc extinguishing device after the test in Example 2-42.

FIG. 2-13 is a graphic representation of the infrared absorption spectrum of a deposit adhering to a wall surface of the arc extinguishing device after the test in Comparative Example 2-3.

Silver oxide was confirmed to be produced in in Examples 2-29 and 2-42 from these figures and, hence, it can be understood that oxidation reaction of the electrode material, or silver occurred thereby inhibiting the decrease in insulation resistance. In contrast, such an oxide was not found to be produced in Comparative Example 2-3 and, hence, a large decrease in insulation resistance resulted.

Arc extinguishing plate materials (I) and (II), preparation methods for the respective materials, and switch employing the material (I) or (II) according to the third group inventions of the present invention will be more fully described by way of specific examples thereof. The present invention will not be limited to such examples.

EXAMPLES 3-1 TO 3-10

An inorganic binder composition (I) was prepared by mixing solid materials of the ingredients thereof shown in Table 3-1, namely insulation imparting gas generating source compound, arc resistant inorganic powder and curing agent, for 30 minutes using an Ishikawa-type agitating mortar, and then adding an aqueous solution of primary metal salt of phosphoric acid to the mixture, followed by further kneading for 15 minutes.

A reinforcing inorganic material sheet of 30 cm square and 0.2 mm (in the case of glass fabric) or 0.5 mm (in the case of glass mat or ceramic paper) thickness was immersed in the inorganic binder composition (I) to prepare a sheet impregnated with the inorganic binder composition (I) in an amount shown in Table 3-1. The impregnated sheet was placed in a vat and introduced into an oven where the sheet was heated to 80° C. to remove the moisture thereof until the concentration of the aqueous solution of primary metal salt of phosphoric acid reached 65% and to allow the curing of the sheet to proceed, thereby preparing a sheet before undergoing pressurization.

The thus prepared sheet was pressure-molded under 150 $kg/cm^2$-G at room temperature for one minute to afford a molded product. The molded product thus obtained was allowed to stand for one day and then heated from room temperature up to 200° C. at a rate of 5° C./min in an oven, followed by aging therein at 200° C. for one hour. The molded product was then allowed to be naturally cooled down to afford an arc extinguishing plate material (I). The composition and thickness of the thus obtained arc extinguishing plate material were as shown in Table 3-2. It was confirmed that only the moisture of the inorganic binder composition (I) adhering to the arc extinguishing plate material (I) was removed. Further, when the arc extinguishing plate material (I) was heated to 200° C. to examine whether there was a loss of weight, there was found no loss of weight.

Thereafter, both faces of the arc extinguishing plate material were coated with a dusting preventive coating material shown in Table 3-1 by means of brush and then dried. In any of Examples 3-1 to 3-10, the total amount of the coating material used per plate material was 9 g, 4.5 g for each face. Such an amount was determined by measuring the change in weight after the aging.

The arc extinguishing plate material (I) thus obtained was punched and then finished into a predetermined form to afford an arc extinguishing side plate. Two such arc extinguishing side plates were combined to form an arc extinguishing chamber of 30 mm (length)×20 mm (width)×50 mm (height) as shown in FIG. 3-1.

Using the arc extinguishing chamber thus constructed, a switch as shown in FIG. 3-2 was manufactured wherein the distance between the contacts and the chamber was 2 cm at the largest.

Particulars of abbreviations, compounds and reinforcing inorganic material sheets including glass mat, glass fabric and ceramic paper are as follows and the same is true for Tables hereinafter.

A: aluminum hydroxide, average particle size of 0.8 μm;

Alumina powder: aluminum oxide powder, average particle size of 0.3 μm (350-mesh pass);

Zircon powder: zirconium silicate powder, average particle size of 16 μm (350-mesh pass);

Cordierite powder: average diameter of 7.5 μm, SS-200 (trade mark) of MARUSU YUYAKU KABUSHIKI KAISHA;

Aluminum primary phosphate: produced by NACALAI TESQUE KABUSHIKI KAISHA, powdery reagent;

Magnesium primary phosphate: produced by NACALAI TESQUE KABUSHIKI KAISHA, powdery reagent B: wollastonite crystal, 350-mesh pass, FPW-350 (trade mark) of KINSEI MATEC KABUSHIKI KAISHA;

Glass mat: formed of E glass, weight per square meter: 455 g/m$^2$, CM455FA (trade mark) of ASAHI FIBER KABUSHIKI KAISHA;

Glass fabric: formed of silica glass, 7628 STYLE (trade mark) of ASAHI SCHWEBEL KABUSHIKI KAISHA, 0.2 mm thick, 44×33 filaments/in.;

Ceramic paper: formed of aluminosilicate, FIBER FLUX NO. 300 (trade mark) of TOSHIBA MONOFRAX KABUSHIKI KAISHA, 0.5 mm thick;

Dusting preventive coating material (a): ethyl silicate containing 20% of Si, TSB4200 (trade mark) of YUGEN KAISHA TSB;

Dusting preventive coating material (b): acrylic resin, MASACO (trade mark) of MITSUBISHI KASEI KABUSHIKI KAISHA Note that amounts of aluminum hydroxide represented by the character A are separately shown in Table 3-1, one acting as a curing agent and the other acting as an insulation imparting gas generating source compound (hereinafter the same).

The switch thus manufactured was subjected to the following interrupting test, durability test and insulation resistance test (megohm measurement). The results are as shown in Table 3-2.

Overload interrupting test

In accordance with the measuring method for molded case circuit breakers provided in JIS C8370, the switch in closed condition is applied with a current six times as high as a rated current (for example, if the rated current is 100 A, the current to be applied is three-phase 550 V/600 A) and the movable contact is separated away from the fixed contact to generate an arc current. If the switch successfully interrupts the arc current predetermined times (50 times), the switch is regarded as passed the test.

Durability test

The switch in closed condition is applied with a current of three-phase 550 V/100 A and the movable contact is mechanically separated away from the fixed contact to generate an arc current. If the switch successfully interrupts the arc current predetermined times (6000 times) and the arc extinguishing side plate used therein exhibits a consumption-by-arc resistance, specifically to such a degree that a hole is not formed in the side plate by arc, the switch is regarded as passed the test.

Insulation resistance test

The switch in closed condition is applied with an overcurrent of three-phase 460 V/25 kA and the movable contact is separated away from the fixed contact to generate an arc current. If the switch successfully interrupts the arc current, the switch is regarded as passed a short circuit test. Thereafter, the insulation resistances between terminals are measured using the insulation resistance tester provided in JIS C1302. The results shown in Table 3-2 are the lowest values of phase-to-phase insulation resistances (MΩ) on the load side.

TABLE 3-1

| | Inorganic binder composition (I) (part) | | | | | | | | | | | |
|---|---|---|---|---|---|---|---|---|---|---|---|---|
| | Insulation imparting gas generating | Arc resistant inorganic powder | | | Aqueous solution of primary metal salt of phosphoric acid | | Curing agent | | Amount of applied inorganic binder composition (I) (part) | | | Dusting preventive |
| Ex. No. | source compound A | Alumina powder | Zircon powder | Cordierite powder | Aluminum primary phosphate | Magnesium primary phosphate | A | B | Glass mat | Glass fabric | Ceramic paper | coating material |
| 3-1 | 35 | 5 | — | — | 57(30) | — | — | 3 | 300 | — | — | b |
| 3-2 | 35 | 5 | — | — | 57(30) | — | — | 3 | — | 200 | — | b |
| 3-3 | 35 | 5 | — | — | 57(30) | — | — | 3 | — | — | 200 | b |
| 3-4 | 35 | — | 1.5 | — | 50(30) | — | — | 5 | 280 | — | — | b |
| 3-5 | 35 | — | — | 15 | 50(30) | — | — | 5 | 280 | — | — | b |
| 3-6 | 35 | — | 5 | 5 | 50(40) | — | — | 5 | 260 | — | — | a |
| 3-7 | 30 | — | 15 | — | — | 50(40) | — | 5 | 260 | — | — | b |
| 3-8 | 30 | — | — | 15 | — | 50(40) | — | 5 | 260 | — | — | b |
| 3-9 | 30 | — | 5 | 5 | — | 50(40) | — | 5 | 260 | — | — | a |
| 3-10 | 37 | — | — | — | 55(30) | — | 8 | — | 300 | — | — | b |

TABLE 3-2

| Ex. No. | Evaluation test on switch: Interrupting test Number of times of success | Durability test Formation of hole | Insulation resistance test (lowest value of phase-to-phase insulation resistance) | Composition of arc extinguishing plate material (I) (part): Reinforcing inorganic material sheet | Inorganic binder composition (I) | Thickness of arc extinguishing plate material (I) (mm) |
|---|---|---|---|---|---|---|
| 3-1 | 50 | not formed after 6000 interruptions | 0.6 | 36 | 64 | 1.0 |
| 3-2 | 50 | not formed after 6000 interruptions | 0.6 | 45 | 55 | 0.5 |
| 3-3 | 50 | not formed after 6000 interruptions | 0.6 | 45 | 55 | 1.2 |
| 3-4 | 50 | not formed after 6000 interruptions | 0.6 | 35 | 65 | 1.0 |
| 3-5 | 50 | not formed after 6000 interruptions | 0.6 | 35 | 65 | 1.0 |
| 3-6 | 50 | not formed after 6000 interruptions | 0.6 | 35 | 65 | 1.0 |
| 3-7 | 50 | not formed after 6000 interruptions | 0.6 | 35 | 65 | 0.9 |
| 3-8 | 50 | not formed after 6000 interruptions | 0.6 | 35 | 65 | 0.9 |
| 3-9 | 50 | not formed after 6000 interruptions | 0.6 | 35 | 65 | 0.9 |
| 3-10 | 50 | not formed after 6000 interruptions | 0.6 | 35 | 65 | 1.1 |

As can be understood from Table 3-2, any of the switches according to these Examples succeeded in interrupting an arc 50 times in the interrupting test and 6000 times in the durability test and, therefore, was found to exhibit excellent interrupting performance. This means that the arc extinguishing plate materials (I) prepared in these Examples were excellent. Visual observation of the portion, contacted by arc, of the arc extinguishing side plate after the tests revealed that the portion had remained in a satisfactory condition with little damage.

Further, as can be understood from the results of the insulation resistance test, the arc extinguishing side plate formed from the arc extinguishing plate material (I) of the present invention exhibited a potent effect in enhancing the insulation resistance, the enhanced insulation resistance being higher than the required value, 0.5 MΩ.

EXAMPLES 3-11 TO 3-20

Arc extinguishing plate materials (I) were prepared in the same manner as in Examples 3-1 to 3-10 except that the impregnated sheet was dried at 120° C. and that two sheets before undergoing pressurization were laid on top of the other and pressure-molded under 200 kg/cm$^2$-G at room temperature for one minute and the resultant molded product was allowed to be aged at 180° C. over a whole day and night. Each of the arc extinguishing plate materials (I) thus obtained was coated with a dusting preventive coating material and then dried. The thus obtained arc extinguishing material (I) was formed into an arc extinguishing side plate, which was in turn used to construct arc extinguishing chamber and switch similar to those of Examples 3-1 to 3-10. In Table 3-3 are shown the inorganic binder compositions (I) used in Examples 3-11 to 3-20, amount of each inorganic binder composition (I) applied relative to 100 parts of the reinforcing inorganic material sheet and the kind of dusting preventive coating material used, and in Table 4 are shown the composition and thickness of each of the arc extinguishing plate materials (I) obtained.

The switches thus constructed were subjected to the same evaluation tests as in Examples 3-1 to 3-10. The results are as shown in Table 3-4.

TABLE 3-3

| Ex. No. | Inorganic binder composition (I) (part): Insulation imparting gas generating source compound A | Arc resistant inorganic powder: Alumina powder | Zircon powder | Cordierite powder | Aqueous solution of primary metal salt of phosphoric acid: Aluminum primary phosphate | Magnesium primary phosphate | Curing agent A | Curing agent B | Amount of applied inorganic binder composition (I) (part): Glass mat | Glass fabric | Ceramic paper | Dusting preventive coating material |
|---|---|---|---|---|---|---|---|---|---|---|---|---|
| 3-11 | 35 | 5 | — | — | 57(30) | — | — | 3 | 300 | — | — | b |
| 3-12 | 35 | 5 | — | — | 57(30) | — | — | 3 | — | 200 | — | b |
| 3-13 | 35 | 5 | — | — | 57(30) | — | — | 3 | — | — | 200 | b |

TABLE 3-3-continued

| Ex. No. | Insulation imparting gas generating source compound A | Inorganic binder composition (I) (part): Arc resistant inorganic powder: Alumina powder | Zircon powder | Cordierite powder | Aqueous solution of primary metal salt of phosphoric acid: Aluminum primary phosphate | Magnesium primary phosphate | Curing agent A | Curing agent B | Amount of applied inorganic binder composition (I) (part): Glass mat | Glass fabric | Ceramic paper | Dusting preventive coating material |
|---|---|---|---|---|---|---|---|---|---|---|---|---|
| 3-14 | 35 | — | 15 | — | 50(30) | — | — | 5 | 280 | — | — | b |
| 3-15 | 35 | — | — | 15 | 50(30) | — | — | 5 | 280 | — | — | b |
| 3-16 | 35 | — | 5 | 5 | 50(40) | — | — | 5 | 260 | — | — | a |
| 3-17 | 30 | — | 15 | — | — | 50(40) | — | 5 | 260 | — | — | b |
| 3-18 | 30 | — | — | 15 | — | 50(40) | — | 5 | 260 | — | — | b |
| 3-19 | 30 | — | 5 | 5 | — | 55(40) | — | 5 | 260 | — | — | a |
| 3-20 | 37 | — | — | — | 55(30) | — | 8 | — | 300 | — | — | b |

TABLE 3-4

| Ex. No. | Evaluation test on switch: Interrupting test Number of times of success | Durability test Formation of hole | Insulation resistance test (lowest value of phase-to-phase insulation resistance) | Composition of arc extinguishing plate material (I) (part): Reinforcing inorganic material sheet | Inorganic binder composition (I) | Thickness of arc extinguishing plate material (I) (mm) |
|---|---|---|---|---|---|---|
| 3-11 | 50 | not formed after 6000 interruptions | 0.6 | 36 | 64 | 1.5 |
| 3-12 | 50 | not formed after 6000 interruptions | 0.6 | 45 | 55 | 0.8 |
| 3-13 | 50 | not formed after 6000 interruptions | 0.6 | 45 | 55 | 1.8 |
| 3-14 | 50 | not formed after 6000 interruptions | 0.6 | 35 | 65 | 1.5 |
| 3-15 | 50 | not formed after 6000 interruptions | 0.6 | 35 | 65 | 1.5 |
| 3-16 | 50 | not formed after 6000 interruptions | 0.6 | 35 | 65 | 1.5 |
| 3-17 | 50 | not formed after 6000 interruptions | 0.6 | 35 | 65 | 1.4 |
| 3-18 | 50 | not formed after 6000 interruptions | 0.6 | 35 | 65 | 1.4 |
| 3-19 | 50 | not formed after 6000 interruptions | 0.6 | 35 | 65 | 1.4 |
| 3-20 | 50 | not formed after 6000 interruptions | 0.8 | 35 | 65 | 1.7 |

As can be understood from Table 3-4, the arc extinguishing plate materials (I) and switches obtained in Examples 3-11 to 3-20 exhibited excellent performance. Visual observation of the portion, contacted by arc, of the arc extinguishing side plate after the tests revealed that the portion had remained in a satisfactory condition with little damage.

EXAMPLES 3-21 TO 3-26

Arc extinguishing plate materials (I), arc extinguishing side plates, arc extinguishing chambers and switches were manufactured in the same manner as in Examples 3-4 and 3-7 except that the insulation imparting gas generating source compound of Table 3-5 was applied onto either or both of the faces of the sheet before undergoing pressurization. The application of the insulation imparting gas generating source compound was achieved by sieving the compound onto the entire face of the sheet to an even thickness with use of a 35-mesh sieve. The amount of the applied compound was calculated by subtracting the amount of the compound not adhering to the sheet from the total amount of the compound used.

Table 3-5 shows the kind of the sheet before undergoing pressurization (represented by the number of Example where the corresponding sheet was prepared), the kind and amount of the applied insulation imparting gas generating source compound, and the kind of dusting preventive coating material.

Particulars of the compounds shown in Table 3-5 are as follows:

Magnesium hydroxide: average particle size 0.6 μm, powdery reagent of NACALAI TESQUE KABUSHIKI KAISHA;

Magnesium carbonate: average particle size 0.4 μm, powdery reagent of NACALAI TESQUE KABUSHIKI KAISHA;

Calcium carbonate: average particle size 0.3 μm, special grade chemical made by NACALAI TESQUE KABUSHIKI KAISHA.

The thickness of each of the prepared arc extinguishing plate materials (I) and the results of the evaluation tests, same as in Examples 3-1 to 3-10, on each of the switches constructed in Examples 3-21 to 3-26 are shown in Table 3-6.

TABLE 3-5

| Ex. No. | Kind of sheet before undergoing pressurization (the number of Example where that sheet was prepared) | Kind of insulation imparting gas generating source compound and amount of the source compound applied (g/300 mm square) | | | Application | Dusting preventive coating material |
|---|---|---|---|---|---|---|
| | | Magnesium hydroxide | Magnesium carbonate | Calcium carbonate | | |
| 3-21 | 4 | 40 | — | — | one side | b |
| 3-22 | 4 | 40 | — | — | both sides | b |
| 3-23 | 4 | 20 | 20 | — | both sides | b |
| 3-24 | 7 | 40 | — | — | both sides | b |
| 3-25 | 7 | 20 | 20 | — | both sides | b |
| 3-26 | 7 | 20 | — | 20 | both sides | b |

TABLE 3-6

| Ex. No. | Evaluation test on switch | | | Thickness of arc extinguishing plate material (I) (mm) |
|---|---|---|---|---|
| | Interrupting test Number of times of success | Durability test Formation of hole | Insulation resistance test (lowest value of phase-to-phase insulation resistance) | |
| 3-21 | 50 | not formed after 6000 interruptions | 2.0 | 1.0 |
| 3-22 | 50 | not formed after 6000 interruptions | 2.0 | 1.1 |
| 3-23 | 50 | not formed after 6000 interruptions | 1.8 | 1.1 |
| 3-24 | 50 | not formed after 6000 interruptions | 2.0 | 1.1 |
| 3-25 | 50 | not formed after 6000 interruptions | 1.5 | 1.1 |
| 3-26 | 50 | not formed after 6000 interruptions | 1.8 | 1.1 |

As can be understood from Table 3-6, the arc extinguishing plate materials (I) and switches obtained in Examples 3-21 to 3-26 of the present invention exhibited excellent performance, like those obtained in Examples 3-1 to 3-10. Visual observation on the portion, contacted by arc, of each of the arc extinguishing side plates after the tests revealed that the portion had remained in satisfactory condition with little damage.

EXAMPLES 3-27 TO 3-32

Arc extinguishing plate materials (I), arc extinguishing side plates, arc extinguishing chambers and switches were manufactured in the same manner as in Examples 3-21 to 3-26 except that two sheets applied with the insulation imparting gas generating source compound used in each of Examples 3-21 to 3-26 were laid on top of the other (in Example 3-27 such two sheets were laid on top of the other with their compound-free faces opposed to each other).

Table 3-7 shows the kind of the sheet before undergoing pressurization (the number of Example where the corresponding sheet was prepared), the kind and amount of the applied insulation imparting gas generating source compound, and the kind of dusting preventive coating material.

The thickness of each of the prepared arc extinguishing plate materials (I) and the results of the evaluation tests, same as in Examples 3-1 to 3-10, on each of the switches constructed in Examples 3-27 to 3-32 are shown in Table 3-8.

TABLE 3-7

| Ex. No. | Kind of sheet before undergoing pressurization (the number of Example where that sheet was prepared) | Kind of insulation imparting gas generating source compound and amount of the source compound applied (g/300 mm square) | | | Application | Dusting preventive coating material |
|---|---|---|---|---|---|---|
| | | Magnesium hydroxide | Magnesium carbonate | Calcium carbonate | | |
| 3-27 | 4 | 40 | — | — | one side | b |
| 3-28 | 4 | 40 | — | — | both sides | b |

TABLE 3-7-continued

| Ex. No. | Kind of sheet before undergoing pressurization (the number of Example where that sheet was prepared) | Kind of insulation imparting gas generating source compound and amount of the source compound applied (g/300 mm square) Magnesium hydroxide | Magnesium carbonate | Calcium carbonate | Application | Dusting preventive coating material |
|---|---|---|---|---|---|---|
| 3-29 | 4 | 20 | 20 | — | both sides | b |
| 3-30 | 7 | 40 | — | — | both sides | b |
| 3-31 | 7 | 20 | 20 | — | both sides | b |
| 3-32 | 7 | 20 | — | 20 | both sides | b |

TABLE 3-8

| Ex. No. | Evaluation test on switch: Interrupting test Number of times of success | Durability test Formation of hole | Insulation resistance test (lowest value of phase-to-phase insulation resistance) | Thickness of arc extinguishing plate material (I) (mm) |
|---|---|---|---|---|
| 3-27 | 50 | not formed after 6000 interruptions | 2.0 | 1.5 |
| 3-28 | 50 | not formed after 6000 interruptions | 2.0 | 1.6 |
| 3-29 | 50 | not formed after 6000 interruptions | 1.8 | 1.6 |
| 3-30 | 50 | not formed after 6000 interruptions | 2.0 | 1.6 |
| 3-31 | 50 | not formed after 6000 interruptions | 1.5 | 1.6 |
| 3-32 | 50 | not formed after 6000 interruptions | 1.8 | 1.6 |

As can be understood from Table 3-8, the arc extinguishing plate materials (I) and switches obtained in Examples 3-27 to 3-32 of the present invention exhibited excellent performance, like those obtained in Examples 3-1 to 3-10. Visual observation on the portion, contacted by arc, of each of the arc extinguishing side plates after the tests revealed that the portion had remained in satisfactory condition with little damage.

EXAMPLES 3-33 TO 3-42

Arc extinguishing plate materials (I) were manufactured in the same manner as in Examples 3-1 to 3-10 except that solid materials, i.e., insulation imparting gas generating source compound and arc resistant inorganic powder, of inorganic binder composition (II) shown in Table 3-9 were mixed for 30 minutes by the use of an Ishikawa-type agitating mortar and further kneaded together with an additional aqueous solution of condensed alkali metal phosphate (referred to as "aqueous solution of condensed metal phosphate" in Table, and hereinafter the same) for 15 minutes to give inorganic binder composition (II), and then the mois ture of the aqueous solution of condensed alkali metal phosphate was removed until the concentration thereof reached 65% to afford a sheet before undergoing pressurization. Each of the arc extinguishing plate materials (I) thus manufactured was punched and finished into a predetermined form to obtain an arc extinguishing side plate. In this case the arc extinguishing side plate was not applied with a dusting preventive coating material. Using the thus obtained arc extinguishing side plate were obtained an arc extinguishing chamber and then a switch.

Particulars of the compounds and abbreviations in Table 3-9 are as follows:

Sodium metaphosphate: powdery reagent, produced by NACALAI TESQUE KABUSHIKI KAISHA;

Potassium metaphosphate: powdery reagent, produced by NACALAI TESQUE KABUSHIKI KAISHA;

C: magnesium hydroxide (same as used in Examples 3-21 to 3-26);

D: magnesium carbonate (same as used in Examples 3-21 to 3-26);

E: calcium carbonate (same as used in Examples 3-21 to 3-26).

The thus obtained switches were subjected to the same evaluation tests as in Examples 3-1 to 3-10. The results of the tests together with the composition and thickness of each arc extinguishing plate material (I) are shown in Table 3-10.

TABLE 3-9

| Ex. No. | Inorganic binder composition (II) (part): Insulation imparting gas generating source compound C | D | E | Total | Arc resistant inorganic powder: Alumina powder | Zircon powder | Cordierite powder | Aqueous solution of condensed metal phosphate (concentration (%)): Sodium metaphosphate | Potassium metaphosphate | Amount of applied inorganic binder composition (II) (part): Glass mat | Glass fabric | Ceramic paper |
|---|---|---|---|---|---|---|---|---|---|---|---|---|
| 3-33 | 38 | — | — | (38) | — | — | — | 62(35) | — | 300 | — | — |
| 3-34 | 38 | — | — | (38) | — | — | — | 62(35) | — | — | 200 | — |
| 3-35 | 38 | — | — | (38) | — | — | — | 62(35) | — | — | — | 200 |
| 3-36 | 38 | — | — | (38) | — | — | — | — | 62(30) | 300 | — | — |
| 3-37 | 38 | — | — | (38) | — | — | — | — | 62(30) | — | 200 | — |
| 3-38 | 38 | — | — | (38) | — | — | — | — | 62(30) | — | — | 200 |
| 3-39 | 20 | 5 | 10 | (35) | — | 10 | — | 55(30) | — | 300 | — | — |
| 3-40 | 20 | 10 | 5 | (35) | 10 | — | — | 55(30) | — | 300 | — | — |
| 3-41 | 20 | 10 | 5 | (35) | — | — | 10 | 55(30) | — | 300 | — | — |
| 3-42 | 30 | 5 | 5 | (40) | — | — | — | 55(20) | — | 330 | — | — |

TABLE 3-10

| Ex. No. | Evaluation test on switch: Interrupting test Number of times of success | Durability test Formation of hole | Insulation resistance test (lowest value of phase-to-phase insulation resistance) | Composition of arc extinguishing plate material (I) (part): Reinforcing inorganic material sheet | Inorganic binder composition (II) | Thickness of arc extinguishing plate material (I) (mm) |
|---|---|---|---|---|---|---|
| 3-33 | 50 | not formed after 6000 interruptions | 2.0 | 36 | 64 | 0.8 |
| 3-34 | 50 | not formed after 6000 interruptions | 2.0 | 46 | 54 | 0.3 |
| 3-35 | 50 | not formed after 6000 interruptions | 2.0 | 46 | 54 | 0.9 |
| 3-36 | 50 | not formed after 6000 interruptions | 2.0 | 37 | 63 | 0.8 |
| 3-37 | 50 | not formed after 6000 interruptions | 2.0 | 47 | 53 | 0.3 |
| 3-38 | 50 | not formed after 6000 interruptions | 2.0 | 47 | 53 | 0.9 |
| 3-39 | 50 | not formed after 6000 interruptions | 1.6 | 35 | 65 | 0.8 |
| 3-40 | 50 | not formed after 6000 interruptions | 1.6 | 35 | 65 | 0.8 |
| 3-41 | 50 | not formed after 6000 interruptions | 1.6 | 35 | 65 | 0.8 |
| 3-42 | 50 | not formed after 6000 interruptions | 1.8 | 35 | 65 | 0.9 |

As can be understood from Table 3-10, the arc extinguishing plate materials (I) and switches obtained in Examples 3-33 to 3-42 of the present invention exhibited excellent performance, like those obtained in Examples 3-1 to 3-10. Visual observation on the portion, contacted by arc, of each of the arc extinguishing side plates after the tests revealed that the portion had remained in satisfactory condition with little damage.

EXAMPLES 3-43 TO 3-52

Arc extinguishing plate materials (I) were manufactured in the same manner as in Examples 3-33 to 3-42 except that two sheets before undergoing pressurization as manufactured in Examples 3-33 to 3-42 were laid on top of the other and pressure-molded under 200 kg/cm$^2$-G at room temperature for one minute. Note that the abbreviations and compounds shown in Table 3-11 are the same as in Table 3-9. Using each of the thus manufactured arc extinguishing plate materials (I) were prepared an arc extinguishing side plate, arc extinguishing chamber and switch which were similar to those of Examples 3-1 to 3-10.

The thus obtained switches were subjected to the same evaluation tests as in Examples 3-1 to 3-10. The results of the tests together with the composition and thickness of each arc extinguishing plate material (I) are shown in Table 3-12.

TABLE 3-11

| Ex. No. | Inorganic binder composition (II) (part): Insulation imparting gas generating source compound C | D | E | Total | Arc resistant inorganic powder: Alumina powder | Zircon powder | Cordierite powder | Aqueous solution of condensed metal phosphate (concentration (%)): Sodium metaphosphate | Potassium metaphosphate | Amount of applied inorganic binder composition (II) (part): Glass mat | Glass fabric | Ceramic paper |
|---|---|---|---|---|---|---|---|---|---|---|---|---|
| 3-43 | 38 | — | — | (38) | — | — | — | 62(35) | — | 300 | — | — |
| 3-44 | 38 | — | — | (38) | — | — | — | 62(35) | — | — | 200 | — |
| 3-45 | 38 | — | — | (38) | — | — | — | 62(35) | — | — | — | 200 |
| 3-46 | 38 | — | — | (38) | — | — | — | — | 62(30) | 300 | — | — |
| 3-47 | 38 | — | — | (38) | — | — | — | — | 62(30) | — | 200 | — |
| 3-48 | 38 | — | — | (38) | — | — | — | — | 62(30) | — | — | 200 |
| 3-49 | 20 | 5 | 10 | (35) | — | 10 | — | 55(30) | — | 300 | — | — |
| 3-50 | 20 | 10 | 5 | (35) | 10 | — | — | 55(30) | — | 300 | — | — |
| 3-51 | 20 | 10 | 5 | (35) | — | — | 10 | 55(30) | — | 300 | — | — |
| 3-52 | 30 | 5 | 5 | (35) | — | — | — | 55(20) | — | 300 | — | — |

TABLE 3-12

| Ex. No. | Evaluation test on switch: Interrupting test Number of times of success | Durability test Formation of hole | Insulation resistance test (lowest value of phase-to-phase insulation resistance) | Composition of arc extinguishing plate material (I) (part): Reinforcing inorganic material sheet | Inorganic binder composition (II) | Thickness of arc extinguishing plate material (I) (mm) |
|---|---|---|---|---|---|---|
| 3-43 | 50 | not formed after 6000 interruptions | 2.9 | 36 | 64 | 1.2 |
| 3-44 | 50 | not formed after 6000 interruptions | 2.0 | 46 | 54 | 0.5 |
| 3-45 | 50 | not formed after 6000 interruptions | 2.0 | 46 | 54 | 1.5 |
| 3-46 | 50 | not formed after 6000 interruptions | 2.0 | 37 | 63 | 1.2 |
| 3-47 | 50 | not formed after 6000 interruptions | 2.0 | 47 | 53 | o.5 |
| 3-48 | 50 | not formed after 6000 interruptions | 2.0 | 47 | 53 | 1.6 |
| 3-49 | 50 | not formed after 6000 interruptions | 1.6 | 35 | 65 | 1.2 |
| 3-50 | 50 | not formed after 6000 interruptions | 1.6 | 35 | 65 | 1.6 |
| 3-51 | 50 | not formed after 6000 interruptions | 1.6 | 35 | 65 | 1.6 |
| 3-52 | 50 | not formed after 6000 interruptions | 1.8 | 35 | 65 | 1.8 |

As can be understood from Table 3-12, the arc extinguishing plate materials (I) and switches obtained in Examples 3-43 to 3-52 of the present invention exhibited excellent performance, like those obtained in Examples 3-1 to 3-10. Visual observation on the portion, contacted by arc, of each of the arc extinguishing side plates after the tests revealed that the portion had remained in satisfactory condition with little damage.

EXAMPLES 3-53 TO 3-60

Sheets (4), (7), (33) and (39) before undergoing pressurization were prepared in the same manner as in Examples 3-4, 3-7, 3-33 and 3-39, respectively, except that the moisture of the aqueous solution of primary metal salt of phosphoric acid or aqueous solution of condensed alkali metal phosphate was removed until the concentration thereof reached 85% Arc extinguishing plate materials (I) of Examples 3-53 to 3-56 were manufactured in the same manner as in Examples 3-1 to 3-10 except that a sheet (I) comprising the thus prepared sheet (4) or (7) and a sheet (II) comprising the thus prepared sheet (33) or (39), shown in Table 3-13, were laid on top of the other and then pressure-molded under 200 kg/cm$^2$-G at 200° C. for one minute. Further, arc extinguishing plate materials (I) of Examples 3-57 to 3-60 were manufactured in the same manner as in Examples 3-53 to 3-56 except that a sheet (I) shown in Table 3-13 was sandwiched between sheets (II) shown in Table 3-13. In this case three sheets were used in total. Using each of the thus manufactured arc extinguishing plate materials (I) were prepared an arc extinguishing side plate, arc extinguishing chamber and switch which were similar to those of Examples 3-1 to 3-10.

The thus obtained switches were subjected to the same evaluation tests as in Examples 3-1 to 3-10. The results of the tests together with the thickness of each arc extinguishing plate material (I) are shown in Table 3-13.

TABLE 3-13

| Ex. No. | Kind of sheet before undergoing pressurization I | II | Evaluation test on switch: Interrupting test Number of times of success | Durability test Formation of hole | Insulation resistance test (lowest value of phase-to-phase insulation resistance) | Thickness of arc extinguishing plate material (I) (mm) |
|---|---|---|---|---|---|---|
| 3-53 | (4) | (33) | 50 | not formed after 6000 interruptions | 2.0 | 1.6 |
| 3-54 | (4) | (39) | 50 | not formed after 6000 interruptions | 1.6 | 1.4 |
| 3-55 | (7) | (33) | 50 | not formed after 6000 interruptions | 2.0 | 1.6 |
| 3-56 | (7) | (39) | 50 | not formed after 6000 interruptions | 1.6 | 1.4 |
| 3-57 | (4) | (33) | 50 | not formed after 6000 interruptions | 2.0 | 1.6 |
| 3-58 | (4) | (39) | 50 | not formed after 6000 interruptions | 1.6 | 1.4 |
| 3-59 | (7) | (33) | 50 | not formed after 6000 interruptions | 2.0 | 1.6 |
| 3-60 | (7) | (39) | 50 | not formed after 6000 interruptions | 1.6 | 1.4 |

As can be understood from Table 3-13, the arc extinguishing plate materials (I) and switches obtained in Examples 3-53 to 3-60 of the present invention exhibited excellent performance, like those obtained in Examples 3-1 to 3-10. Visual observation on the portion, contacted by arc, of each of the arc extinguishing side plates after the tests revealed that the portion had remained in satisfactory condition with little damage.

EXAMPLES 3-61 TO 3-77

Solid contents, i.e., insulation imparting gas generating source compound, arc resistant inorganic powder, primary metal salt of phosphoric acid, curing agent and reinforcing inorganic fiber, of each of inorganic binder compositions (C) shown in Tables 3-14 and 3-15 were mixed for 30 minutes by the use of an Ishikawa-type agitating mortar, followed by further mixing the mixture for 15 minutes while adding thereto water dropwise using an injector, to give a material before undergoing pressurization.

The abbreviations used in Tables 3-14 and 3-15 represent the compounds as follows:

F: zircon powder (same as used in Examples 3-1 to 3-10);

G: cordierite powder (same as used in Examples 3-1 to 3-10);

H: mullite powder, average particle size of 4 μm (350-mesh pass);

I: aluminum primary phosphate (same as used in Examples 3-1 to 3-10);

J: magnesium primary phosphate (same as used in Examples 3-1 to 3-10);

K: sodium primary phosphate, powdery reagent, produced by NACALAI TESQUE KABUSHIKI KAISHA;

L: aluminum borate whisker, average fiber diameter: 0.6 μm, average fiber length: 25 μm, ALBOREX (trade mark) of SHIKOKU KASEI KABUSHIKI KAISHA;

M: SiC whisker, average fiber diameter: 0.08 μm, average fiber length: 7 μm, SCW (trade mark) of TATEHO KAGAKU KOGYO KABUSHIKI KAISHA;

N: calcium carbonate whisker, average fiber diameter: 0.6 μm, average fiber length: 25 μm, WHISCAL (trade mark) of SHIKOKU KASEI KABUSHIKI KAISHA;

O: silica alumina glass fiber, average fiber diameter: 10 μm, average fiber length: 60 μm, KAOWOOL (trade mark) MILLED FIBER of ISOLITE KOGYO KABUSHIKI KAISHA; and P: $Si_3N_4$ whisker, average fiber diameter: 0.5 μm, average fiber length: 130 μm, SNW (trade mark) of TATEHO KAGAKU KOGYO KABUSHIKI KAISHA.

In Tables 3-14 and 3-15, the amount of each of the compounds represented by abbreviations A and C (same as in the foregoing Table) is divided into an amount acting as a curing agent and an amount acting as an insulation imparting gas generating source compound, and the amount of the material (wollastonite crystal) represented by abbreviation B is also divided into an amount acting as a curing agent and an amount acting as a reinforcing inorganic fiber.

The thus prepared material before undergoing pressurization was filled into a mold of the shape of an arc extinguishing side plate having dimensions of 40 mm (length)×50 mm (width)×5 mm (depth) and pressure-molded under 700 kg/cm$^2$-G at room temperature for one minute to afford a molded product in the form of arc extinguishing side plate. This molded product was allowed to stand for one day, then heated from room temperature up to 200° C. at a rate of 5° C./min in an oven and allowed to be aged at the temperature maintained at 200° C. for three hours, followed by allowing it to cool naturally to afford an arc extinguishing side plate (arc extinguishing plate material (II)). Further, using the thus prepared arc extinguishing side plates were manufactured arc extinguishing chambers and switches which were similar to those obtained in Examples 3-1 to 3-10.

The thus manufactured switches were subjected to the same evaluation tests as in Examples 3-1 to 3-10. The results were as shown in Tables 3-16 and 3-17.

TABLE 3-14

| Ex. | Inorganic binder composition (C) (part) | | | | | | | | | | | | | | | | | |
|---|---|---|---|---|---|---|---|---|---|---|---|---|---|---|---|---|---|---|
| | Insulation imparting gas generating source compound | | | | Arc resistant inorganic powder | | | | Primary metal salt of phosphoric acid | | | Curing agent | | | | Reinforcing inorganic fiber | | |
| No. | A | C | D | Total | F | G | H | Total | I | J | K | A | B | C | Water | B | L | M | N |
| 3-61 | — | 40 | — | (40) | 25 | — | — | (25) | 16 | — | — | — | 5 | — | 6 | 4 | 4 | — | — |
| 3-62 | — | 40 | — | (40) | 25 | — | — | (25) | — | 10 | — | — | 5 | — | 6 | 4 | 4 | — | — |
| 3-63 | — | 40 | — | (40) | 25 | — | — | (25) | — | — | 10 | — | 5 | — | 6 | 4 | 4 | — | — |
| 3-64 | 20 | 20 | — | (40) | 25 | — | — | (25) | 10 | — | — | — | 5 | — | 6 | 4 | 4 | — | — |
| 3-65 | 20 | 20 | — | (40) | 25 | — | — | (25) | — | 10 | — | — | 5 | — | 6 | 4 | 4 | — | — |
| 3-66 | — | 24 | 20 | (44) | 20 | 15 | — | (35) | 8 | — | — | — | — | 5 | 5 | — | 3 | — | — |
| 3-67 | 8 | 27 | 10 | (45) | 10 | 10 | 5 | (25) | 10 | — | — | 2 | — | 3 | 6 | — | — | 9 | — |
| 3-68 | 8 | 27 | 10 | (45) | 10 | 10 | 5 | (25) | — | 10 | — | 2 | — | 3 | 6 | — | — | 9 | — |
| 3-69 | 10 | 30 | — | (40) | 15 | 5 | 5 | (25) | 12 | — | — | 3 | — | 5 | 8 | — | — | — | 7 |

TABLE 3-14

| Ex. | Inorganic binder composition (C) (part) | | | | | | | | | | | | | | | | | |
|---|---|---|---|---|---|---|---|---|---|---|---|---|---|---|---|---|---|---|
| | Insulation imparting gas generating source compound | | | | Arc resistant inorganic powder | | | | Primary metal salt of phosphoric acid | | | Curing agent | | | | Reinforcing inorganic fiber | | |
| No. | A | C | D | Total | F | G | H | Total | I | J | K | A | B | C | Water | B | O | P |
| 3-70 | — | 40 | — | (40) | 25 | — | — | (25) | 10 | — | — | — | 5 | — | 6 | 4 | 4 | — |
| 3-71 | — | 40 | — | (40) | 25 | — | — | (25) | — | 10 | — | — | 5 | — | 6 | 4 | 4 | — |
| 3-72 | — | 40 | — | (40) | 25 | — | — | (25) | — | — | 10 | — | 5 | — | 6 | 4 | 4 | — |
| 3-73 | 20 | 20 | — | (40) | 25 | — | — | (25) | 10 | — | — | — | 5 | — | 6 | 4 | 4 | — |
| 3-74 | 20 | 20 | — | (40) | 25 | — | — | (25) | — | 10 | — | — | 5 | — | 6 | 4 | 4 | — |
| 3-75 | — | 24 | 20 | (44) | 20 | 15 | — | (35) | 8 | — | — | — | — | 5 | 5 | — | 3 | — |
| 3-76 | 8 | 27 | 10 | (45) | 10 | 10 | 5 | (25) | 10 | — | — | 2 | — | 3 | 6 | — | — | 9 |
| 3-77 | 8 | 27 | 10 | (45) | 10 | 10 | 5 | (25) | — | 10 | — | 2 | — | 3 | 6 | — | — | 9 |

TABLE 3-16

| Ex. No. | Evaluation test on switch | | |
|---|---|---|---|
| | Interrupting test Number of times of success | Durability test Formation of hole | Insulation resistance test (lowest value of phase-to-phase insulation resistance) |
| 3-61 | 50 | not formed after 6000 interruptions | 2.0 |
| 3-62 | 50 | not formed after 6000 interruptions | 2.0 |
| 3-63 | 50 | not formed after 6000 interruptions | 2.0 |
| 3-64 | 50 | not formed after 6000 interruptions | 2.0 |
| 3-65 | 50 | not formed after 6000 interruptions | 2.0 |
| 3-66 | 50 | not formed after 6000 interruptions | 2.0 |
| 3-67 | 50 | not formed after 6000 interruptions | 2.0 |
| 3-68 | 50 | not formed after 6000 interruptions | 2.0 |
| 3-69 | 50 | not formed after 6000 interruptions | 2.0 |

TABLE 3-17

| | Evaluation test on switch | | |
|---|---|---|---|
| | Interrupting test Number of times of success | Durability test Formation of hole | Insulation resistance test (lowest value of phase-to-phase insulation resistance) |
| Ex. No. | | | |
| 3-70 | 50 | not formed after 6000 interruptions | 2.0 |
| 3-71 | 50 | not formed after 6000 interruptions | 2.0 |
| 3-72 | 50 | not formed after 6000 interruptions | 2.0 |
| 3-73 | 50 | not formed after 6000 interruptions | 2.0 |
| 3-74 | 50 | not formed after 6000 interruptions | 2.0 |
| 3-75 | 50 | not formed after 6000 interruptions | 2.0 |
| 3-76 | 50 | not formed after 6000 interruptions | 2.0 |
| 3-77 | 50 | not formed after 6000 interruptions | 2.0 |
| Com. Ex. No. | | | |
| 3-1 | 50 | formed after 4500 interruptions | 0.15 |
| 3-2 | 50 | not formed after 6000 interruptions | 0.15 |

As can be understood from Tables 3-16 and 3-17, the arc extinguishing plate materials (II) and switches obtained in Examples 3-61 to 3-77 of the present invention exhibited excellent performance, like those obtained in Examples 3-1 to 3-10. Visual observation on the portion, contacted by arc, of each arc extinguishing side plate after the tests revealed that the portion had remained in satisfactory condition with little damage.

COMPARATIVE EXAMPLE 3-1

In accordance with Japanese Unexamined Patent Publication No. 310534/1988, a 1 mm-thick lamination plate having dimensions of 300 mm×300 mm was prepared using an organic material which was free of any aromatic ring having many carbon atoms and abundant in hydrogen and which comprised an acrylic acid ester copolymer (polymethylmethacrylate) and 30% of a glass fiber filled therein. The lamination plate was then shaped into an arc extinguishing side plate having the same dimensions and thickness as those of Example 3-1.

Using the arc extinguishing side plate thus obtained were manufactured an arc extinguishing chamber and a switch in the same manner as in Examples 3-1 to 3-10. The switch was subjected to the same evaluation tests as in Examples 3-1 to 3-10. The results are as shown in Table 3-17.

COMPARATIVE EXAMPLE 3-2

A molded product (GLASSMER of NIKKO KASEI KABUSHIKI KAISHA) formed from a glass fabric-polyester resin composite plate in which the polyester resin contained 30% of alumina as a filler was shaped into an arc extinguishing side plate having the same dimensions and thickness as those of Example 3-1.

Using the arc extinguishing side plate thus obtained were manufactured an arc extinguishing chamber and a switch in the same manner as in Examples 3-1 to 3-10. The switch thus manufactured was subjected to the same tests as in Examples 3-1 to 3-10. The results are as shown in Table 3-17.

As can be understood from Table 3-17, Comparative Examples 3-1 and 3-2 contributed to an insulation resistance much lower than the required value, i.e., 0.5Ω in the insulation resistance test.

As has been described, the present invention provides an arc extinguishing material and a switch using the same which are applicable to a switch generating an arc upon interruption of electric current flowing therethrough such as a circuit breaker, current-limiting device or electromagnetic contactor and which is capable of immediately extinguishing the arc and inhibiting the decrease in insulation resistance within and around an arc extinguishing chamber and at inner wall surfaces of the switch case.

What we claim is:

1. An arc extinguishing material for use in a switch comprising a gas generating source compound capable of generating an insulation imparting gas combinable with particles of metals which are scattered from contact elements, contacts and other metal components located adjacent thereto of the switch by an arc generated when the contacts of the contact elements are operated to be opened or closed, said insulation imparting gas being reactive with said metals or being electrically insulative, wherein said gas generating source compound is selected from the group consisting of antimony pentoxide, ammonium octamolybdate, zircon, cordierite, mullite, muscovite and $5MgO.3SiO_2.3H_2O$.

2. The arc extinguishing material of claim 1, which is in the form of a powder, a molded article or a supported material in which said gas generating source compound is supported on a carrier selected from the group consisting of a metal material having a high melting point, a porous material having a high melting point and a laminated material.

3. An arc extinguishing material for use in a switch comprising a thermoplastic or thermosetting resin, and a gas generating source compound capable of generating an insulation imparting gas combinable with particles of metals which are scattered from contact elements, contacts and other metal components located adjacent thereto of the switch by an arc generated when the contacts of the contact elements are operated to be opened or closed, said insulation imparting gas being reactive with said metals or being electrically insulative, wherein said gas generating source compound is selected from the group consisting of antimony pentoxide, ammonium octamolybdate, zircon, cordierite, mullite, muscovite and $5MgO.3SiO_2.3H_2O$.

4. The arc extinguishing material of claim 3, wherein said thermoplastic or thermosetting resin is selected from the group consisting of a polyolefin, an olefin copolymer, a polystyrene, a polyvinyl chloride, a polyamide, a bisphenol A-type epoxy resin, a bisphenol F-type epoxy resin, a biphenyl epoxy resin, an unsaturated polyester, a melamine resin and a urea resin.

5. The arc extinguishing material of claim 3, wherein said thermoplastic resin is a polyamide or a polyamide polymer blend.

6. The arc extinguishing material of claim 3, which is in the form of a powder, a molded article or a supported material in which said gas generating source compound is supported on a carrier selected from the group consisting of a metal material having a high melting point, a porous material having a high melting point and a laminated material.

7. The arc extinguishing material of claim 3, which contains a reinforcing filler.

8. A switch comprising a fixed contact element having a fixed contact joined to the upper surface thereof, a moving contact element having a moving contact joined to the under surface thereof so as to provide electrical contact with the fixed contact, and an arc extinguishing device including a gas generating source material capable of generating an insulation imparting gas combinable with particles of metals which are scattered from the contact elements, contacts and other metal components located adjacent thereto by an arc generated when the contacts of the contact elements are operated to be opened or closed, said insulation imparting gas being reactive with said metals or being electrically insulative, the gas generating source material being provided in the vicinity of the contact elements, contacts and other metal components located adjacent thereto and containing a gas generating source compound selected from the group consisting of antimony pentoxide, ammonium octamolybdate, zircon, cordierite, mullite, muscovite and $5MgO.3SiO_2.3H_2O$.

9. The switch of claim 8, wherein said gas generating source material contains a binder selected from the group consisting of a thermoplastic resin, a thermoplastic elastomer, a thermosetting resin, a rubber and an organic wax.

* * * * *